US009108399B2

(12) United States Patent
Kamoda

(10) Patent No.: US 9,108,399 B2
(45) **Date of Patent: *Aug. 18, 2015**

(54) METHOD AND APPARATUS FOR DRIVING PRINTING PRESS

(75) Inventor: Hiroyoshi Kamoda, Noda (JP)

(73) Assignee: KOMORI CORPORATION, Tokyo (JP)

( * ) Notice: Subject to any disclaimer, the term of this patent is extended or adjusted under 35 U.S.C. 154(b) by 885 days.

This patent is subject to a terminal disclaimer.

(21) Appl. No.: 12/538,670

(22) Filed: Aug. 10, 2009

(65) Prior Publication Data

US 2010/0037790 A1 Feb. 18, 2010

(30) Foreign Application Priority Data

Aug. 13, 2008 (JP) ..... 2008-208362

(51) Int. Cl.

| | |
|---|---|
| ***B41F 5/06*** | (2006.01) |
| ***B41F 13/016*** | (2006.01) |
| ***B41F 13/004*** | (2006.01) |
| ***B41F 31/00*** | (2006.01) |
| *B41F 33/00* | (2006.01) |

(52) U.S. Cl.

CPC ..... *B41F 13/016* (2013.01); *B41F 13/0045* (2013.01); *B41F 31/004* (2013.01); *B41F 33/0009* (2013.01); *B41P 2213/72* (2013.01); *B41P 2213/73* (2013.01); *B41P 2213/734* (2013.01)

(58) Field of Classification Search

CPC .. B41F 13/016; B41F 13/0045; B41F 31/004; B41F 33/0009; B41P 2213/72; B41P 2213/73; B41P 2213/734

USPC ..... 101/216–218, 247; 318/86–88

See application file for complete search history.

(56) References Cited

U.S. PATENT DOCUMENTS 3,557,692 A * 1/1971 Lee ..... 101/177
5,355,742 A * 10/1994 Herrmann ..... 74/409

(Continued)

FOREIGN PATENT DOCUMENTS

DE 10 2004 048 151 A 4/2006
EP 1256445 A1 11/2002

(Continued)

OTHER PUBLICATIONS

European Search Report issued in European Patent Application No. 09167740.1 on Jun. 19, 2012.
Japanese Office Action issued in Japanese Patent Application No. 2008-208362 on Dec. 4, 2012.

*Primary Examiner* — Jill Culler
*Assistant Examiner* — Marissa Ferguson Samreth
(74) *Attorney, Agent, or Firm* — Birch, Stewart, Kolasch & Birch, LLP

(57) ABSTRACT

In a printing press including; a blanket cylinder gear driven by a drive motor of the printing press; a blanket cylinder including a notch, the blanket cylinder being rotationally driven by the blanket cylinder gear; a plate cylinder gear rotationally driven by the drive motor of the printing press through the blanket cylinder gear; and a plate cylinder including a notch at a position corresponding to the notch of the blanket cylinder, the plate cylinder being rotationally driven by the plate cylinder gear, a load motor is provided to the plate cylinder or the plate cylinder gear, and a braking force of the load motor is controlled according to load applied to the drive motor of the printing press.

12 Claims, 131 Drawing Sheets

(56) References Cited

U.S. PATENT DOCUMENTS

| | | | | |
|---|---|---|---|---|
| 5,524,538 | A * | 6/1996 | Voge et al. | 101/142 |
| 5,826,505 | A | 10/1998 | Volz et al. | |
| 6,796,239 | B2 | 9/2004 | Detmers et al. | |
| 6,810,809 | B2 * | 11/2004 | Detmers et al. | 101/483 |
| 6,823,792 | B2 * | 11/2004 | Grutzmacher et al. | 101/483 |
| 2002/0134261 | A1 | 9/2002 | Detmers et al. | |
| 2003/0019375 | A1 | 1/2003 | Grutzmacher et al. | |
| 2006/0260485 | A1 * | 11/2006 | Ohsawa | 101/230 |

FOREIGN PATENT DOCUMENTS

| | | | |
|---|---|---|---|
| EP | 1717031 | A2 | 11/2006 |
| JP | 61-266249 | A | 11/1986 |
| JP | 63-309447 | A | 12/1988 |
| JP | 63-315244 | A | 12/1988 |
| JP | 6-75746 | U | 10/1994 |

* cited by examiner

METHOD AND APPARATUS FOR DRIVING PRINTING PRESS

TECHNICAL FIELD

The present invention relates to a method and an apparatus for driving an offset printing press, an intaglio printing press or the like.

BACKGROUND ART

In a conventional offset rotary printing press, a drive motor is used to drive not only the main body of the printing press but also an inking device via a plate cylinder. This configuration also achieves a function of applying a load of the inking device to the plate cylinder. For this reason, the drive motor of the printing press is subjected to a large load. It is therefore necessary to use a motor having a large capacity. As a result, there is a problem that such a conventional offset rotary printing press has to use an expensive motor and also is incapable of supporting a higher speed operation.

Furthermore, in recent years, as disclosed in Patent Literatures 1 and 2, there has been introduced a printing press provided with a different drive motor for driving an inking device singly (hereinafter, single drive motor) in addition to the drive motor for driving the main body of the printing press. Such single drive motor for the inking device is provided so that operations related to the inking device such as ink cleaning can be performed in parallel, at different timings or speeds, with operations related to the main body of the printing press such as cleaning of a blanket cylinder or an impression cylinder.

CITATION LIST

[Patent Literature 1] Japanese Patent Application Publication Sho 63-309447

[Patent Literature 2] Japanese Patent Application Publication Sho 63-315244

SUMMARY OF THE INVENTION

Technical Problem

However, even in a case where the inking device and the main body of the printing press are driven respectively by the single drive motor and the drive motor in synchronization with each other at the time of printing as disclosed in Patent Literature 1, there occurs fluctuation of load between a plate cylinder and the blanket cylinder (this fluctuation of load occurs because of the difference in load between the state where circumferential surfaces of the plate and blanket cylinders are in contact with each other and the plate and blanket cylinders are subjected to contact pressure, and the state where notches of the plate and blanket cylinders face each other and the plate and blanket cylinders are not subjected to contact pressure). Such fluctuation may cause non-uniform rotation because of the gap between the drive gears of the plate and blanket cylinders, hence causing printing faults such as mackle.

On the other hand, the aforementioned non-uniform rotation does not occur when a configuration as disclosed in Patent Literature 2 is employed. In this configuration, a clutch is provided between a drive system of the main body of the printing press and a drive system of the inking device. When the inking device is to be singly driven, the clutch is disengaged, so that the inking device is driven by the independent drive motor. On the other hand, at the time of printing, the clutch is engaged, so that the inking device is driven by the drive motor. In this configuration, since a large load of the inking device is applied to the plate cylinder at the time of printing, the non-uniform rotation described above does not occur. However, at the time of printing, this configuration still has the aforementioned problems that the printing press has to use an expensive large-capacity motor and cannot sufficiently support higher speed operation. In addition, when an inking device is independently driven in an intaglio printing press, non-uniform rotation occurs between an intaglio cylinder and an intaglio impression cylinder in the same manner.

In this respect, an object of the present invention is to provide a method and an apparatus for driving a printing press, which are capable of preventing occurrence of printing faults by effectively providing a braking means for eliminating non-uniform rotation of rotating bodies having notches.

Solution to Problem

To achieve the aforementioned problem, the present invention provides a method for driving a printing press, the printing press including:

first driven means driven by first driving means;

a first rotating body including a notch, the first rotating body being rotationally driven by the first driven means;

second driven means rotationally driven by the first driving means through the first driven means; and a second rotating body provided with a notch at a position corresponding to the notch of the first rotating body, the second rotating body being rotationally driven by the second driven means, the method characterized by including the steps of:

providing braking means to any one of the second rotating body, the second driven means, and third driven means rotationally driven by the second driven means; and controlling a braking force of the braking means according to load applied to the first driving means.

The method is also characterized in that the braking force of the braking means to be applied when the notch of the first rotating body and the notch of the second rotating body face each other is larger than that applied when a circumferential surface of the first rotating body and a circumferential surface of the second rotating body face each other.

The method is also characterized in that the braking means is a load motor.

The method is also characterized in that the first driving means is an electric motor, and electric power generated by the load motor is used to drive the electric motor.

The method is also characterized in that the first rotating body is a blanket cylinder of an offset printing press, the second rotating body is a plate cylinder of the offset printing press, the offset printing press includes:

an inking device supplying ink to a printing plate supported by the plate cylinder of the offset printing press; and second driving means for driving the inking device, and rotational speeds of the first driving means and the second driving means are synchronously controlled when printing is performed.

The method is also characterized in that the first rotating body is an intaglio impression cylinder of an intaglio printing press, the second rotating body is a transfer cylinder of the intaglio printing press, the intaglio printing press includes:

an inking device supplying ink to an intaglio printing plate supported by an intaglio cylinder of the intaglio printing press; and second driving means for driving the inking device, and rotational speeds of the first driving means and the second driving means are synchronously controlled when printing is performed.

To achieve the aforementioned problem, the present invention provides a driving apparatus for a printing press, the printing press including:

first driven means driven by first driving means;

a first rotating body including a notch, the first rotating body being rotationally driven by the first driven means;

second driven means rotationally driven by the first driving means through the first driven means; and a second rotating body provided with a notch at a position corresponding to the notch of the first rotating body, the second rotating body being rotationally driven by the second driven means, the driving apparatus characterized by including:

braking means provided to any one of the second rotating body, the second driven means, and third driven means rotationally driven by the second driven means; and control means for controlling a braking force of the braking means according to load applied to the first driving means.

The driving apparatus is also characterized in that the braking force of the braking means to be applied when the notch of the first rotating body and the notch of the second rotating body face each other is larger than that applied when a circumferential surface of the first rotating body and a circumferential surface of the second rotating body face each other.

The driving apparatus is also characterized in that the braking means is a load motor.

The driving apparatus is also characterized in that the first driving means is an electric motor, and electric power generated by the load motor is recovered to be used as electric power to drive the electric motor.

The driving apparatus is also characterized in that the first rotating body is a blanket cylinder of an offset printing press, the second rotating body is a plate cylinder of the offset printing press, the offset printing press includes;

an inking device supplying ink to a printing plate supported by the plate cylinder of the offset printing press; and second driving means for driving the inking device, and rotational speeds of the first driving means and the second driving means are synchronously controlled when printing is performed.

The driving apparatus is also characterized in that the first rotating body is an intaglio impression cylinder of an intaglio printing press, the second rotating body is a transfer cylinder of the intaglio printing press, the intaglio printing press includes:

an inking device supplying ink to an intaglio printing plate supported by an intaglio cylinder of the intaglio printing press; and second driving means for driving the inking device, and rotational speeds of the first driving means and the second driving means are synchronously controlled when printing is performed.

Advantageous Effects of Invention

According to the aforementioned configuration of the present invention, the braking means to eliminate the non-uniform rotation of the rotating bodies having the notches are effectively provided. This makes it possible to prevent occurrence of printing faults such as mackle. In addition, the braking means are composed of the load motors. This eliminates the need to replace the components unlike the case of brakes, and the braking means can be made maintenance-free. Moreover, the electric power generated by the load motors is recovered as electric power for driving the drive motor, thus achieving energy savings.

In addition, the first and second driving means separately provide driving forces. Accordingly, the driving means can be reduced in size and capacity, thereby achieving lower cost and higher speed operation.

BRIEF DESCRIPTION OF THE DRAWINGS

FIG. 44A is an operational flowchart of the drive controller of the printing press.

FIG. 44B is an operational flowchart of the drive controller of the printing press.

FIG. 44C is an operational flowchart of the drive controller of the printing press.

FIG. 45 is an operational flowchart of the drive controller of the printing press.

FIG. 46A is an operational flowchart of the drive controller of each of the first to fourth inking units.

FIG. 46B is an operational flowchart of the drive controller of each of the first to fourth inking units.

FIG. 47A is an operational flowchart of the drive controller of each of the first to fourth inking units.

FIG. 47B is an operational flowchart of the drive controller of each of the first to fourth inking units.

FIG. 48 is an operational flowchart of the drive controller of each of the first to fourth inking units.

FIG. 49 is a front view showing a drive system on the printing press main body side, in an offset printing press.

FIG. 50 is a side view showing the drive system on the inking device side and the printing press main body side, in the offset printing press.

FIG. 51 is an explanatory diagram showing a modification example of the drive system on a printing press main body side in an offset printing press.

Figure 52:
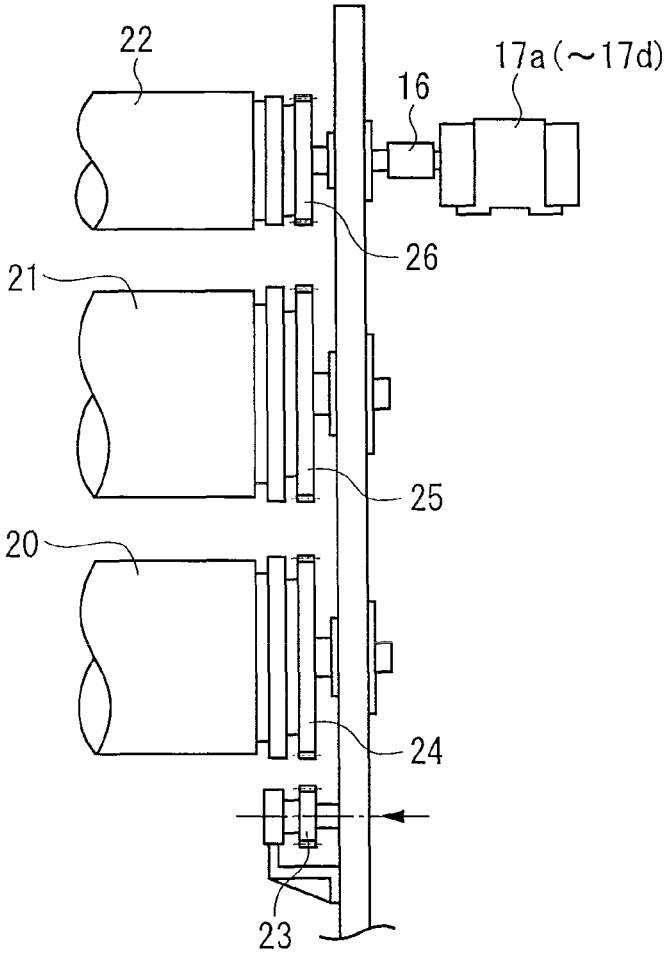

FIG. 52 is an explanatory diagram of the drive system on a printing press main body side in a case where the present invention is applied to an intaglio printing press.

DESCRIPTION OF EMBODIMENTS

Hereinafter, with reference to the drawings, a description is given in detail of embodiments of a method and an apparatus for driving a printing press according to the present invention.

Examples

Embodiment 1

Figure 1A:
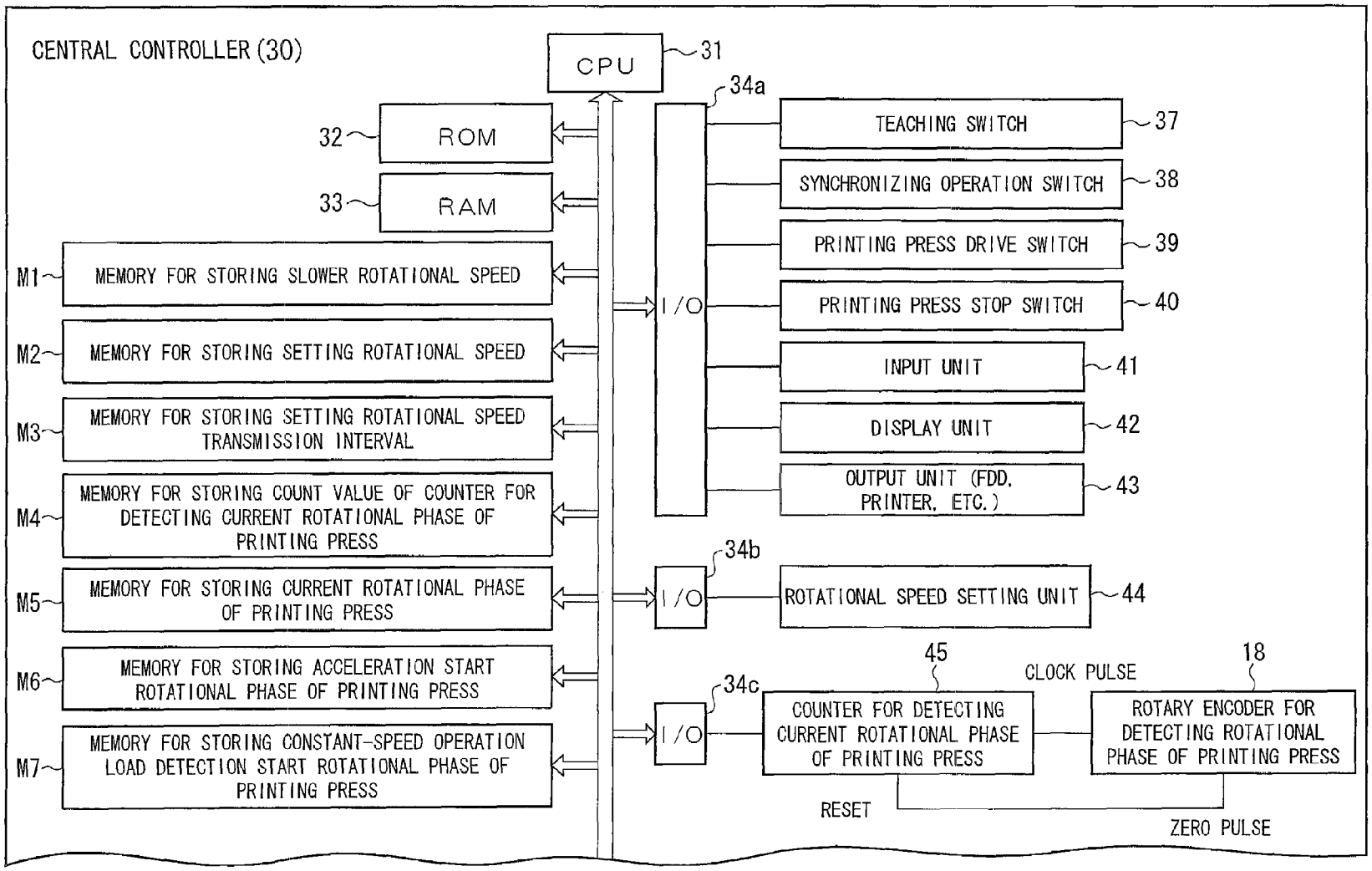
FIG. 1A is a hardware block diagram of a central controller according to Embodiment 1 of the present invention.
Figure 1B:
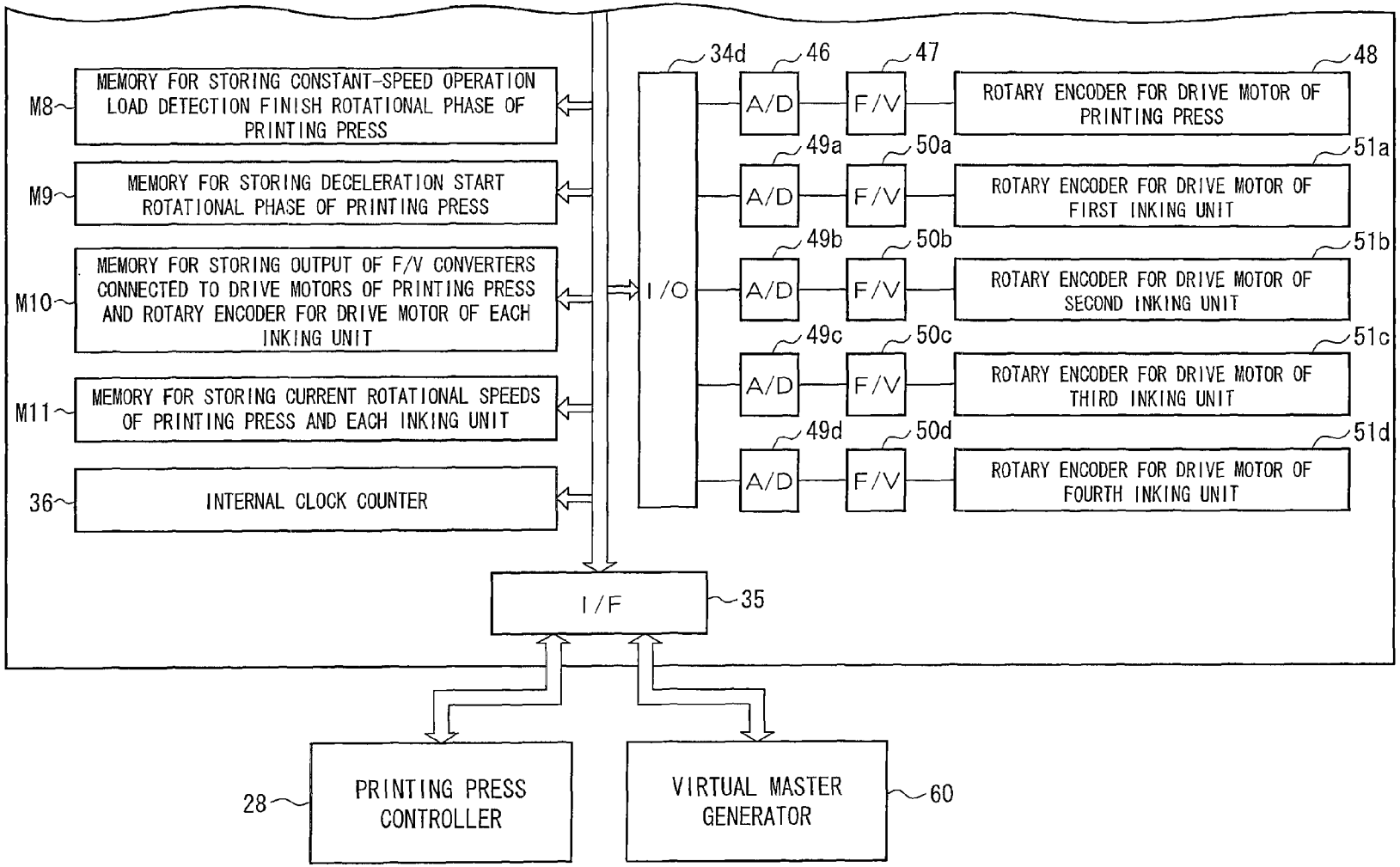
FIG. 1B is a hardware block diagram of the central controller according to Embodiment 1 of the present invention.
Figure 2:
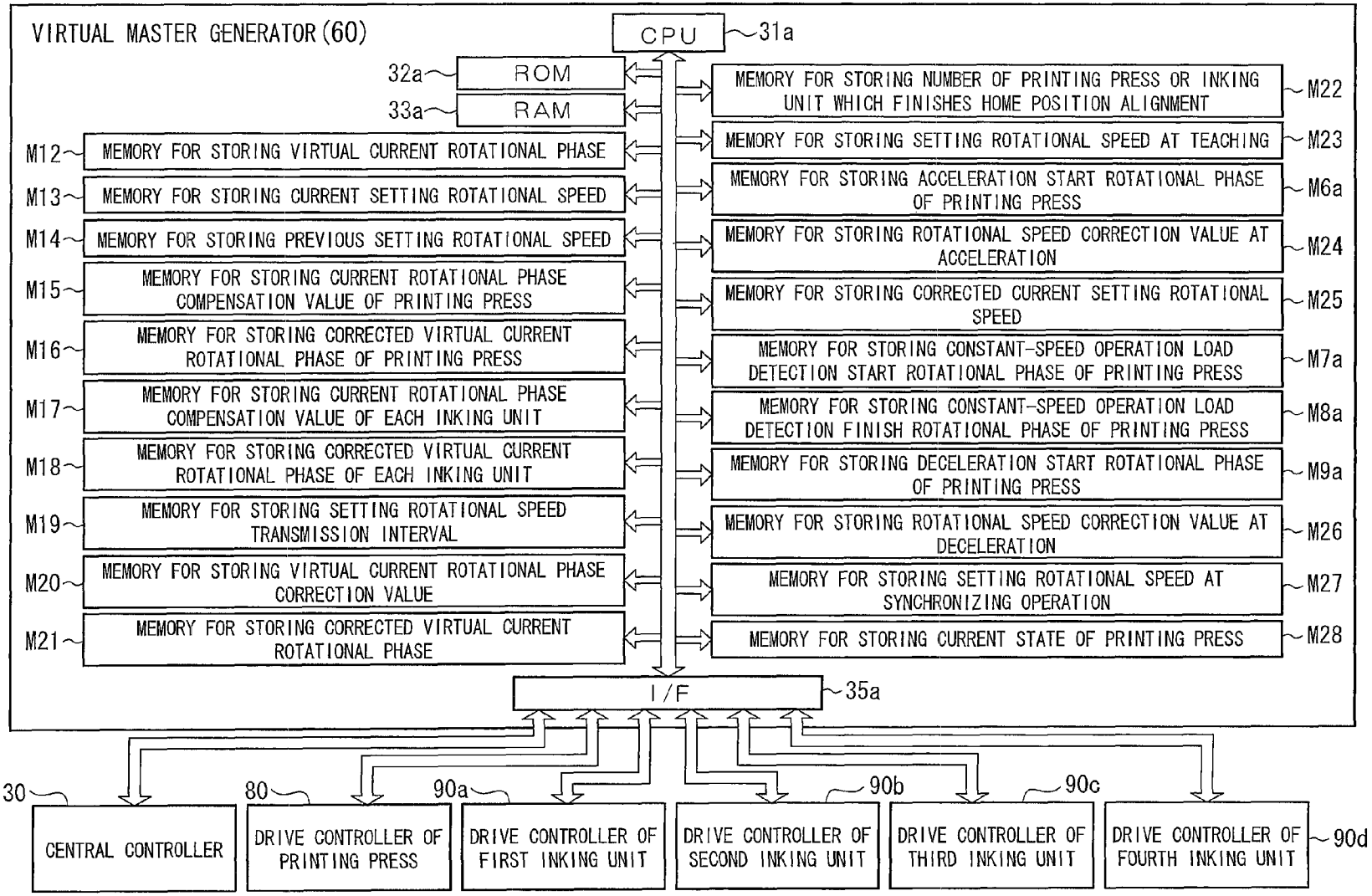
FIG. 2 is a hardware block diagram of a virtual master generator.
Figure 3A:
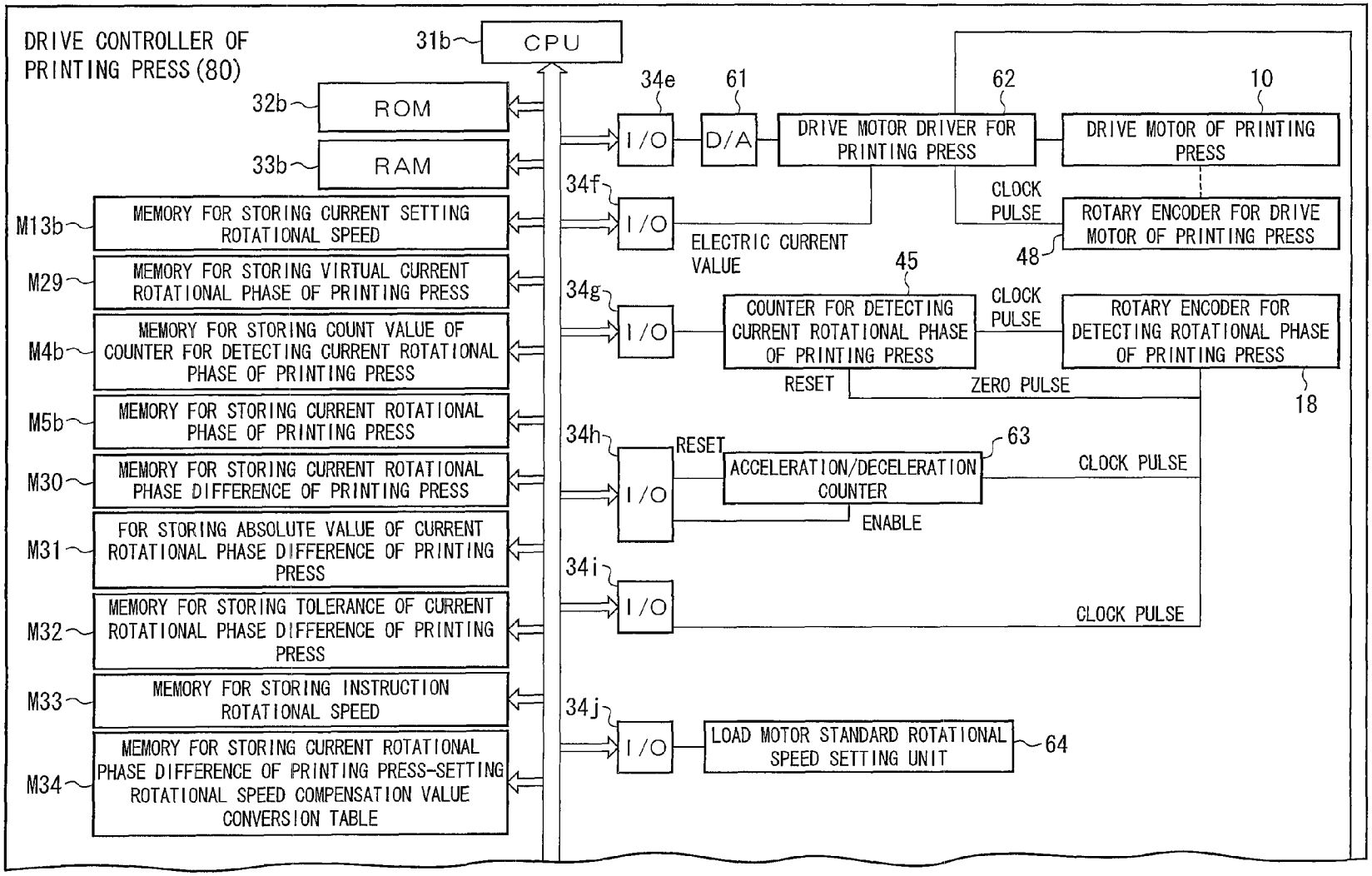
FIG. 3A is a hardware block diagram of a drive controller of a printing press.
Figure 3B:
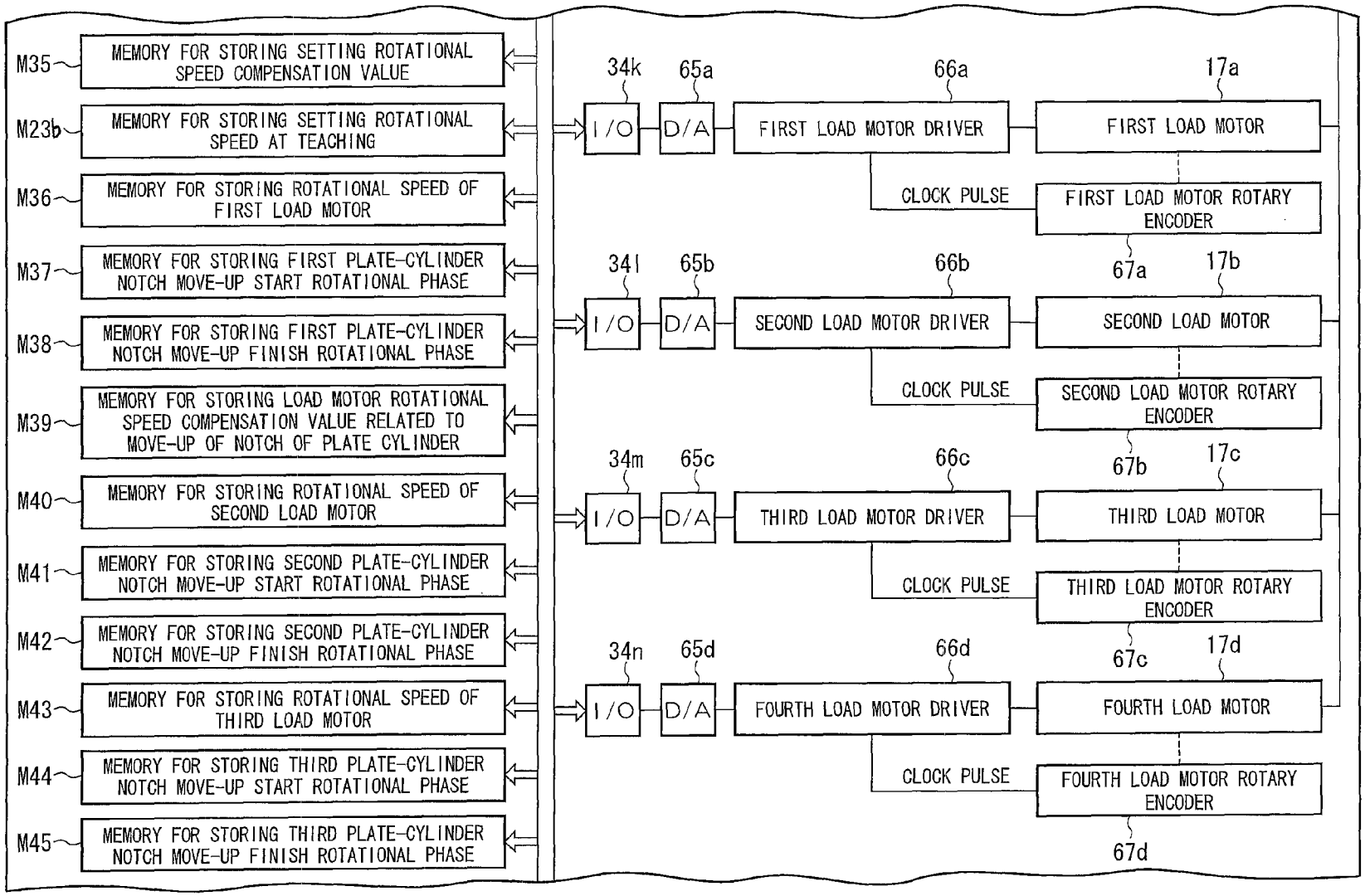
FIG. 3B is a hardware block diagram of the drive controller of the printing press.
Figure 3C:
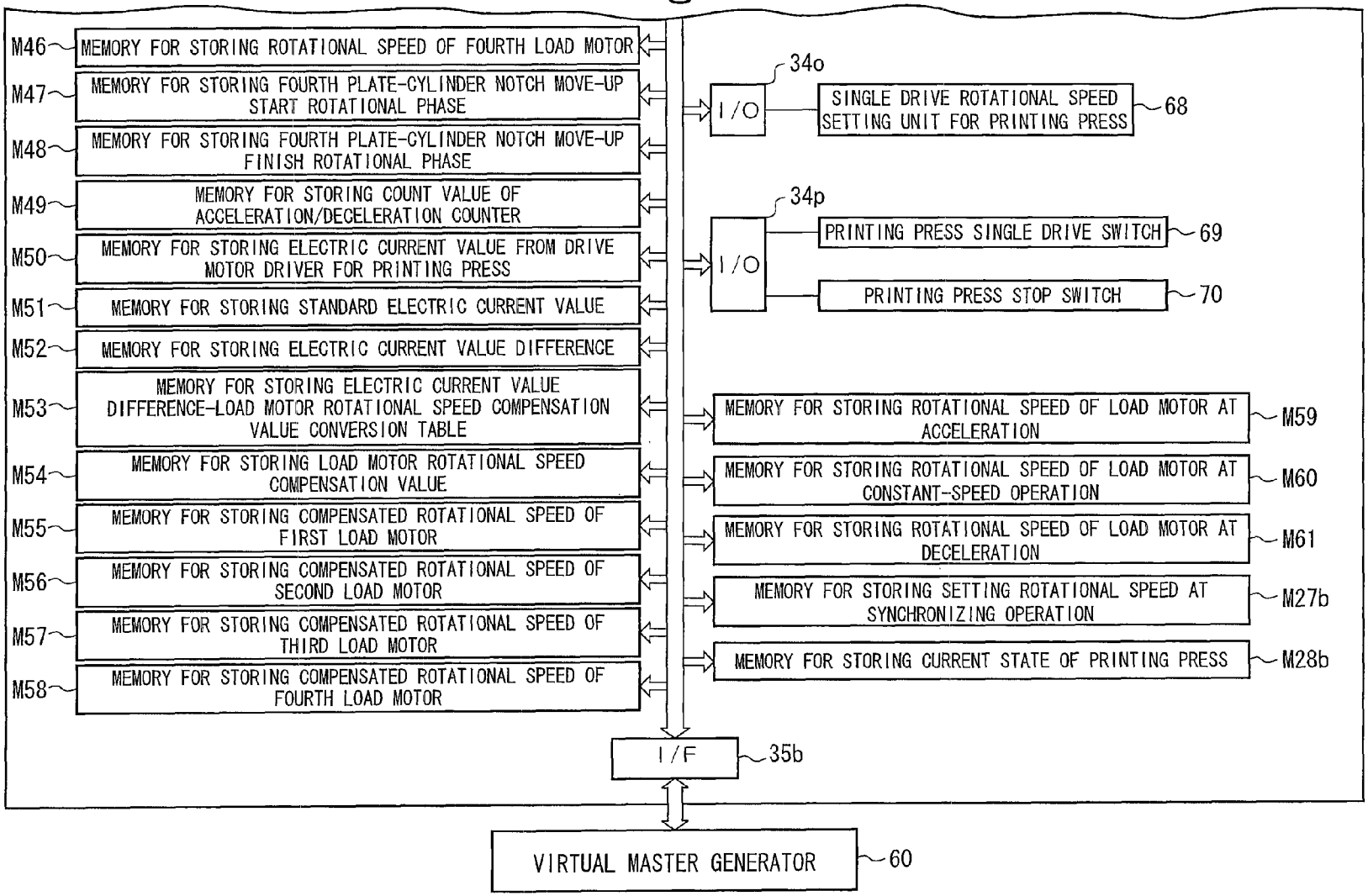
FIG. 3C is a hardware block diagram of the drive controller of the printing press.
Figure 4:
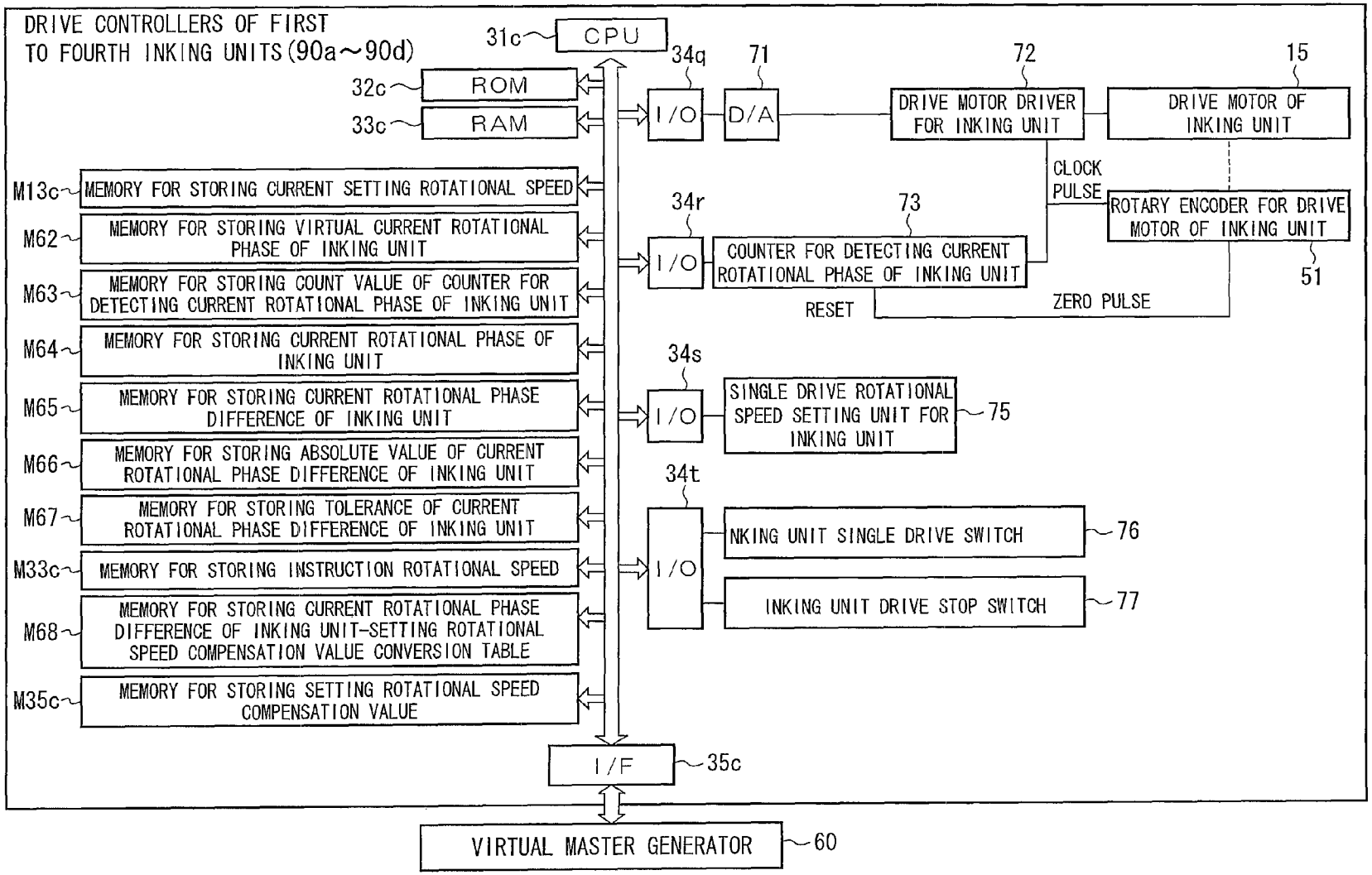
FIG. 4 is a hardware block diagram of a drive controller of each of first to fourth inking units.
Figure 5A:
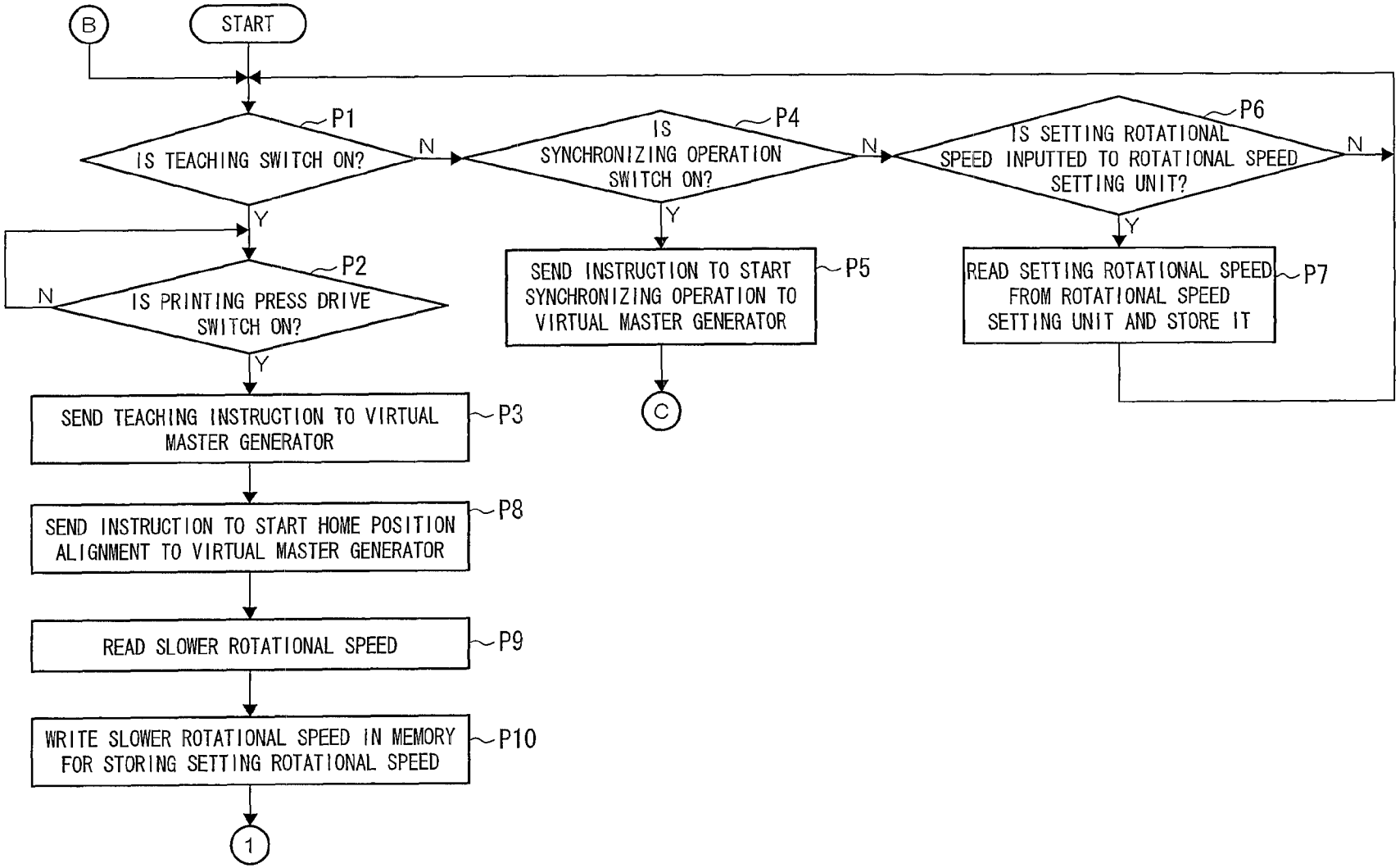
FIG. 5A is an operational flowchart of the central controller.
Figure 5B:
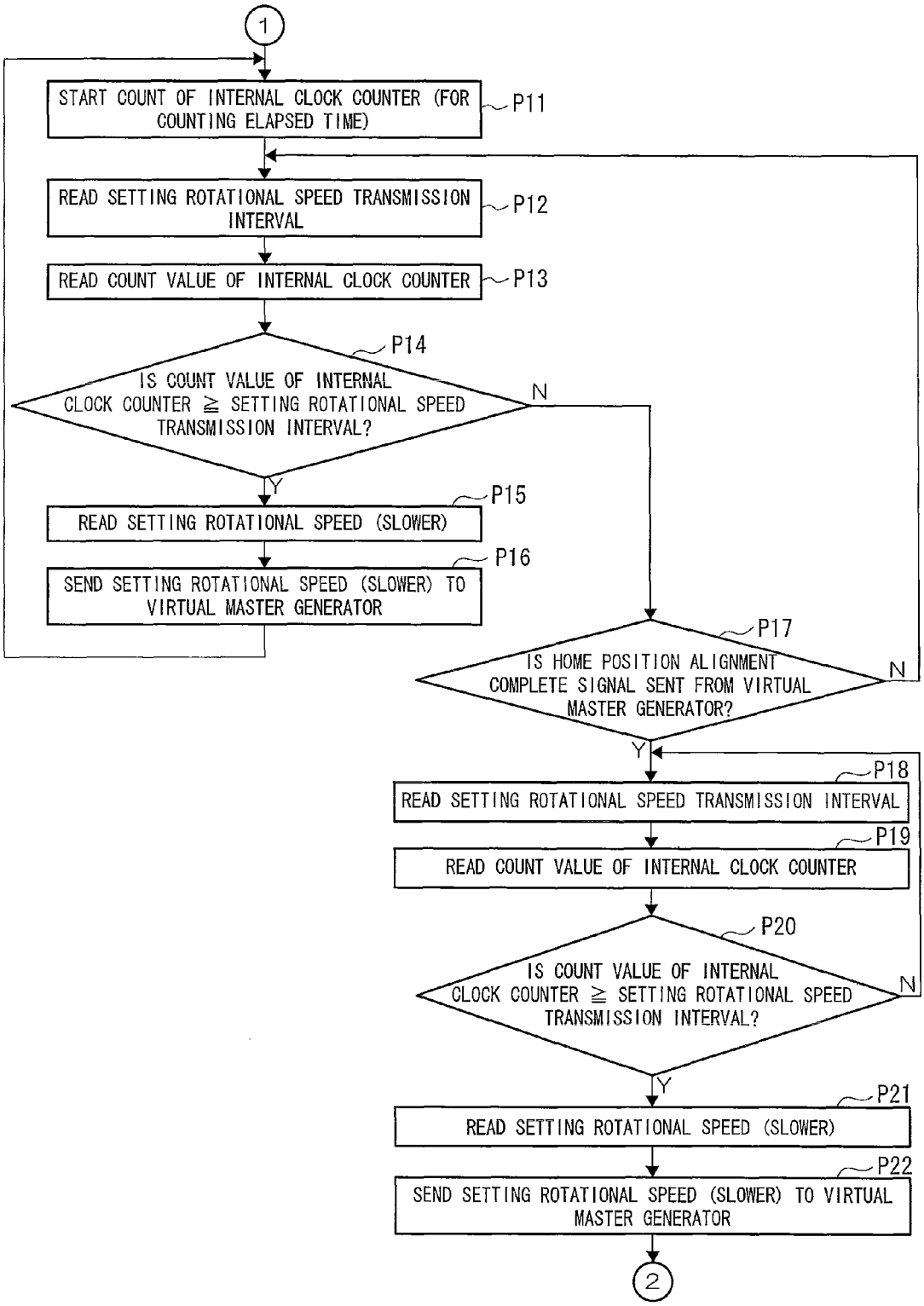
FIG. 5B is an operational flowchart of the central controller.
Figure 5C:
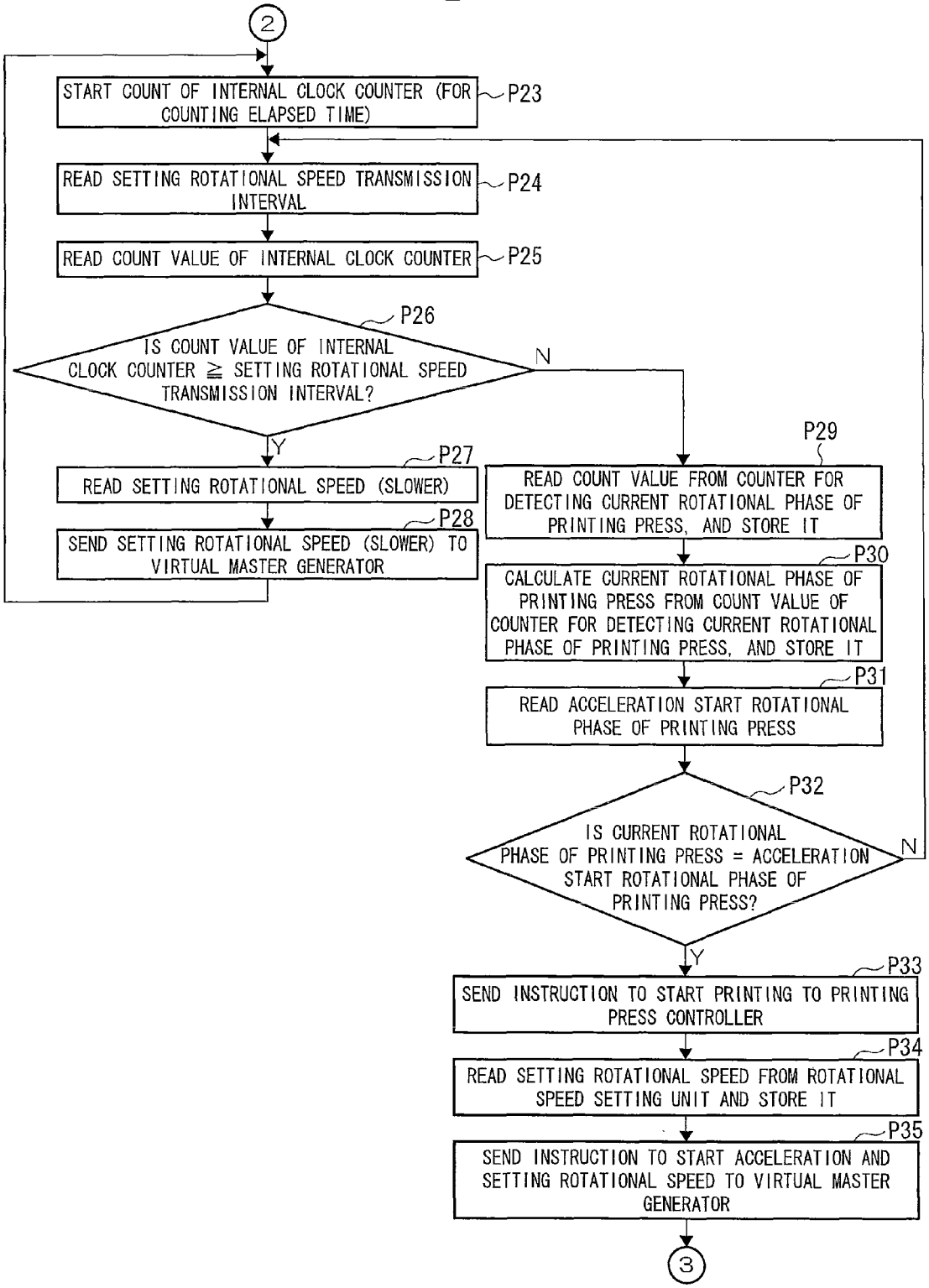
FIG. 5C is an operational flowchart of the central controller.
Figure 5D:
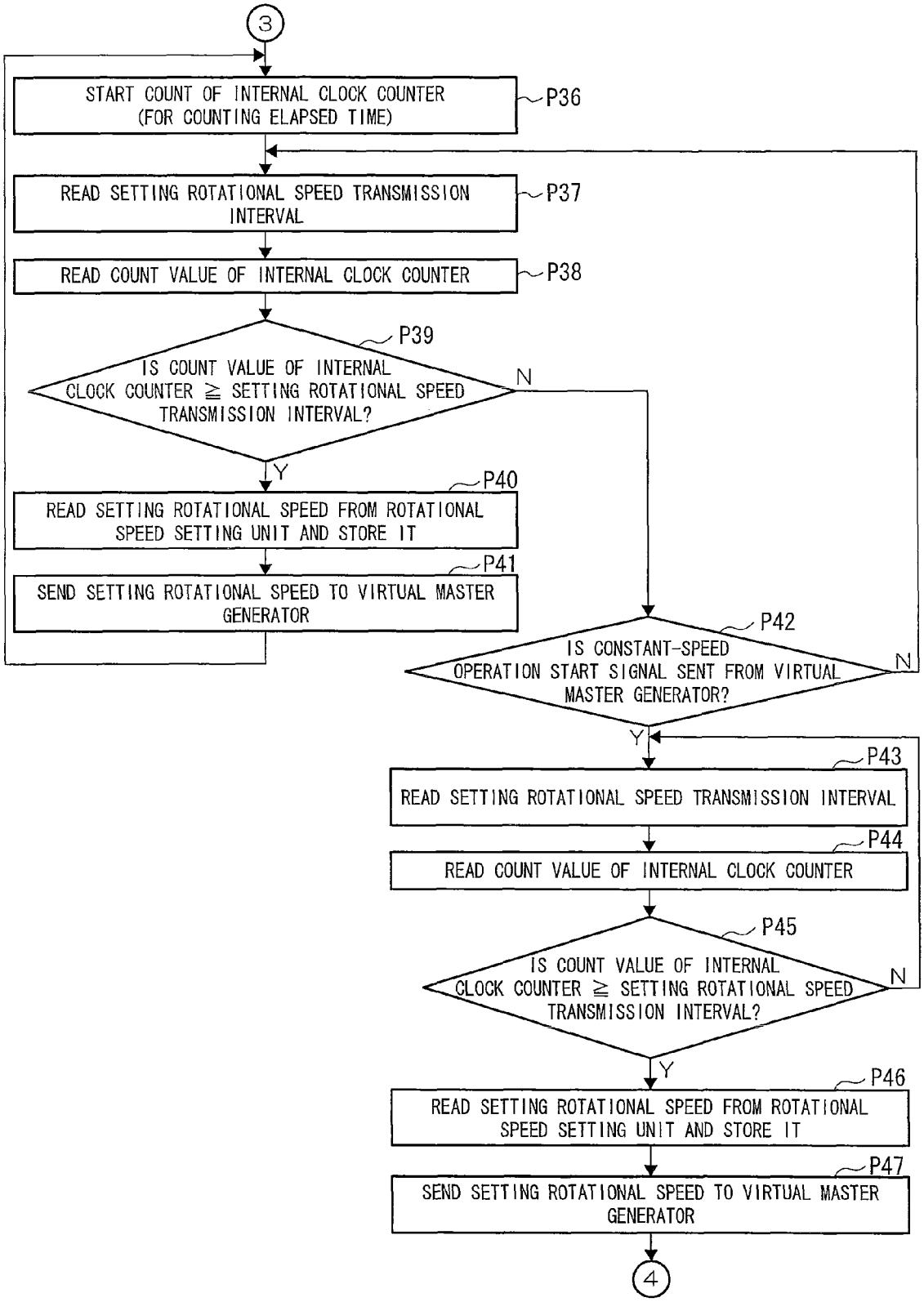
FIG. 5D is an operational flowchart of the central controller.
Figure 5E:
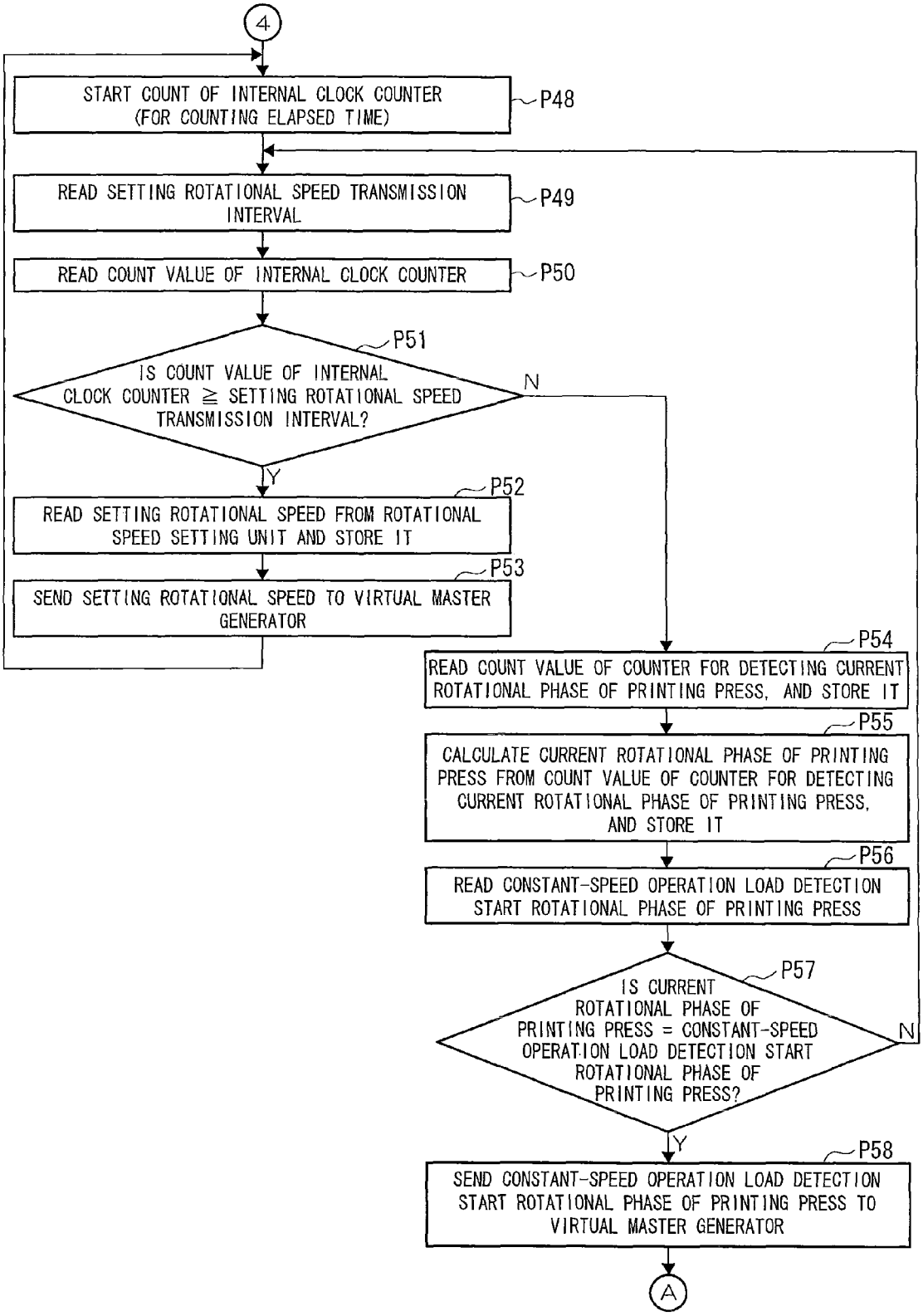
FIG. 5E is an operational flowchart of the central controller.

FIGS. 1A and 1B are hardware block diagrams of a central controller according to Embodiment 1 of the present invention. FIG. 2 is a hardware block diagram of a virtual master generator. FIGS. 3A to 3C are hardware block diagrams of a drive controller of a printing press. FIG. 4 is a hardware block diagram of a driver controller of each of first to fourth inking units.

Figure 6A:
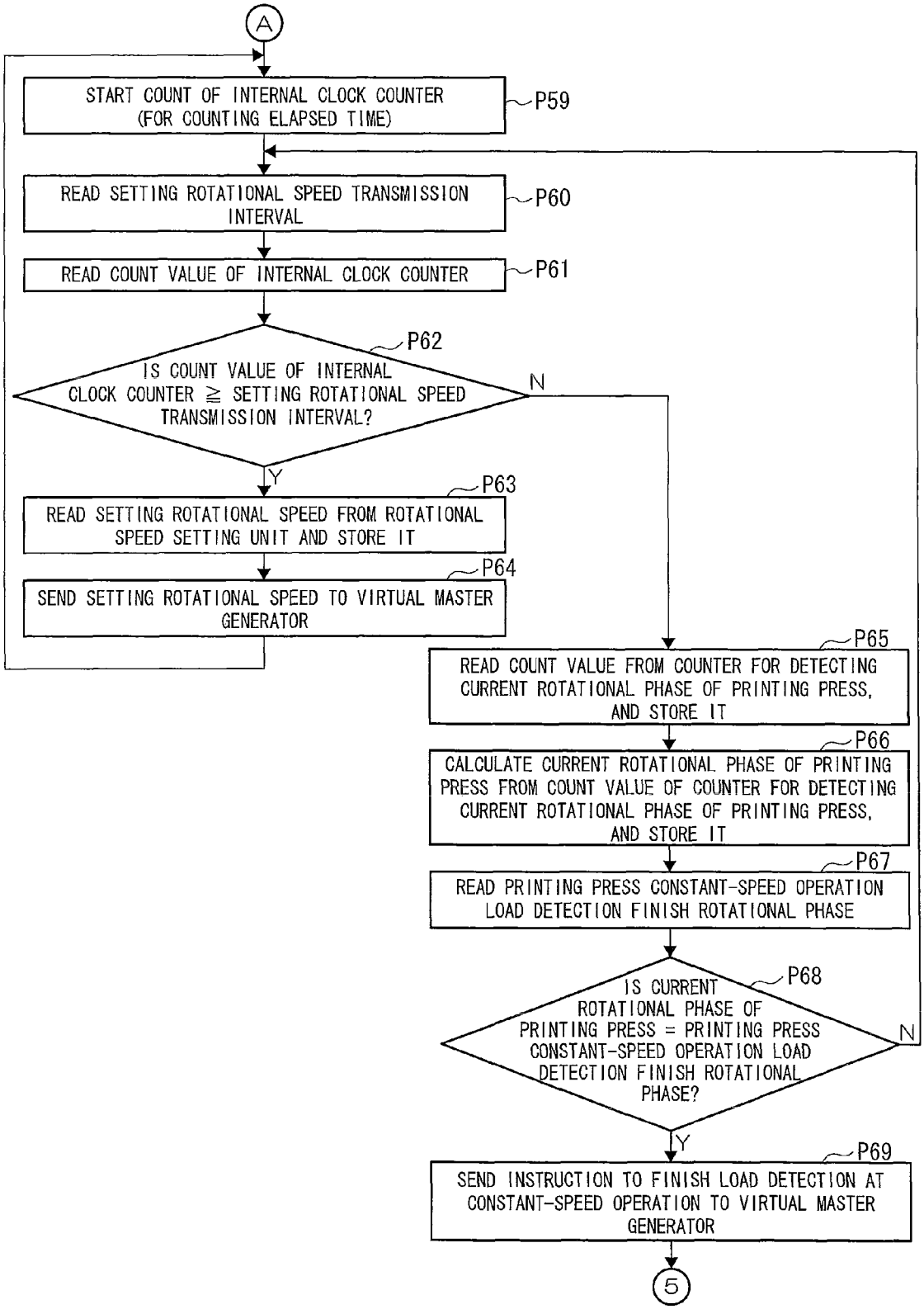
FIG. 6A is an operational flowchart of the central controller.
Figure 6B:
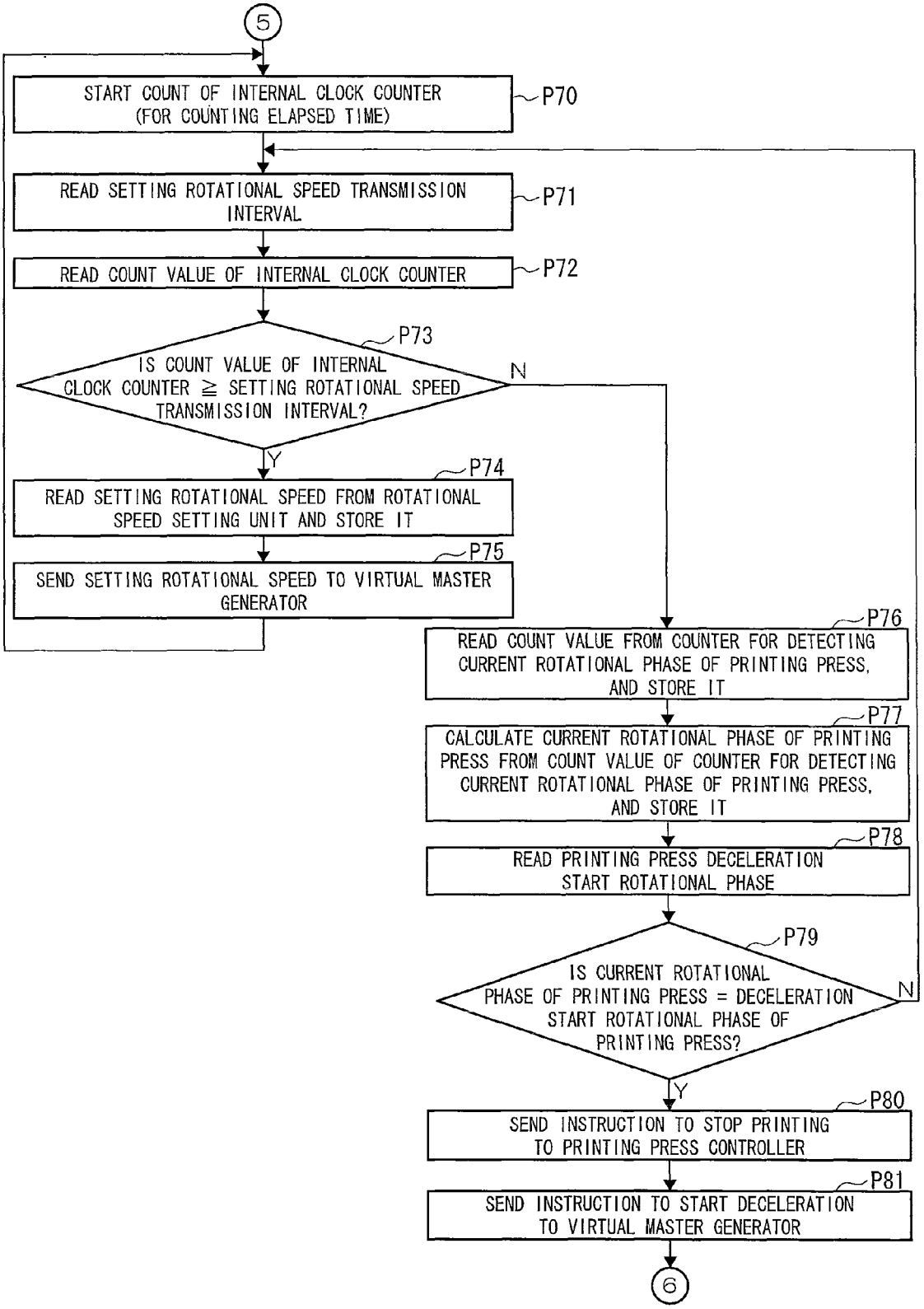
FIG. 6B is an operational flowchart of the central controller.
Figure 6C:
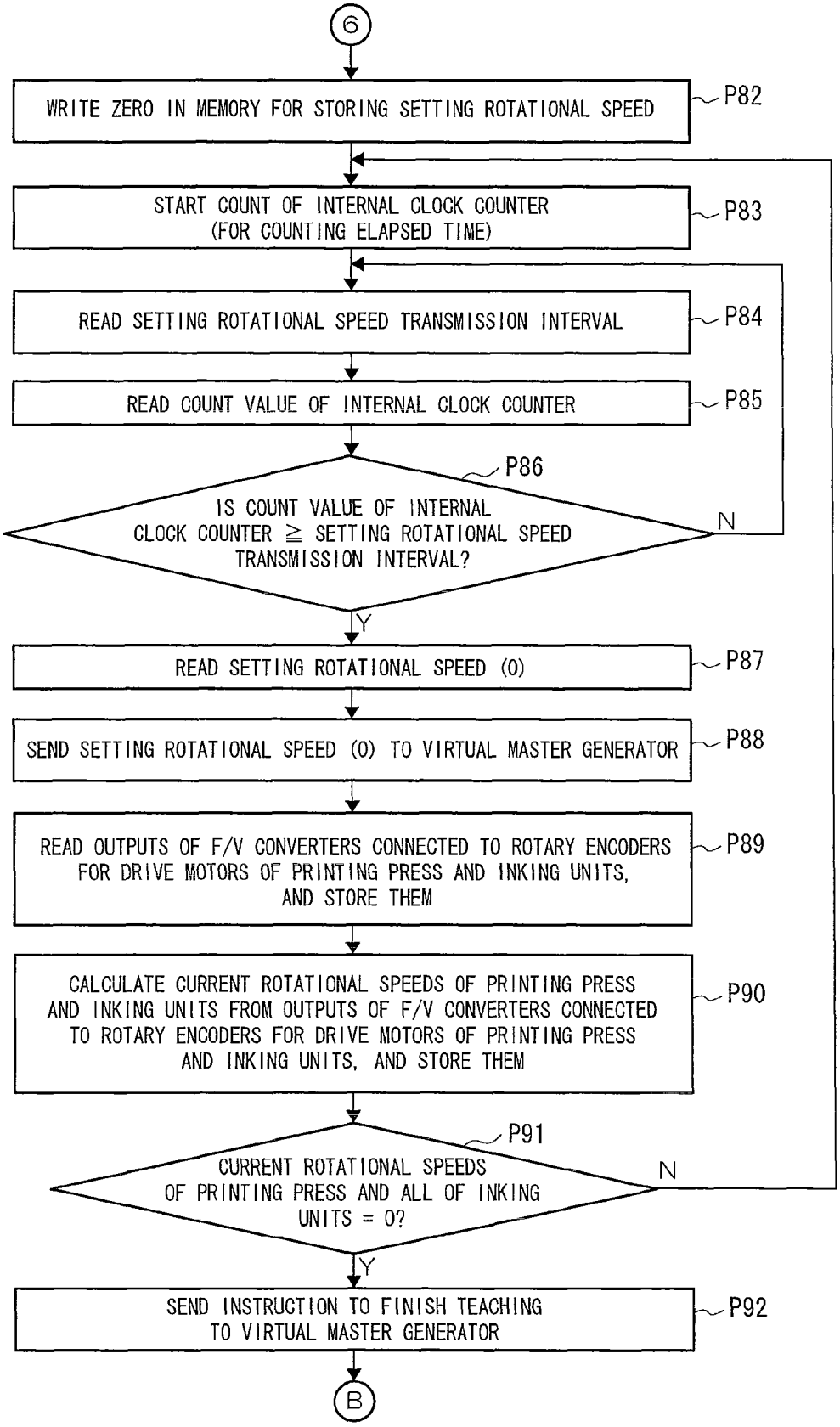
FIG. 6C is an operational flowchart of the central controller.
Figure 7A:
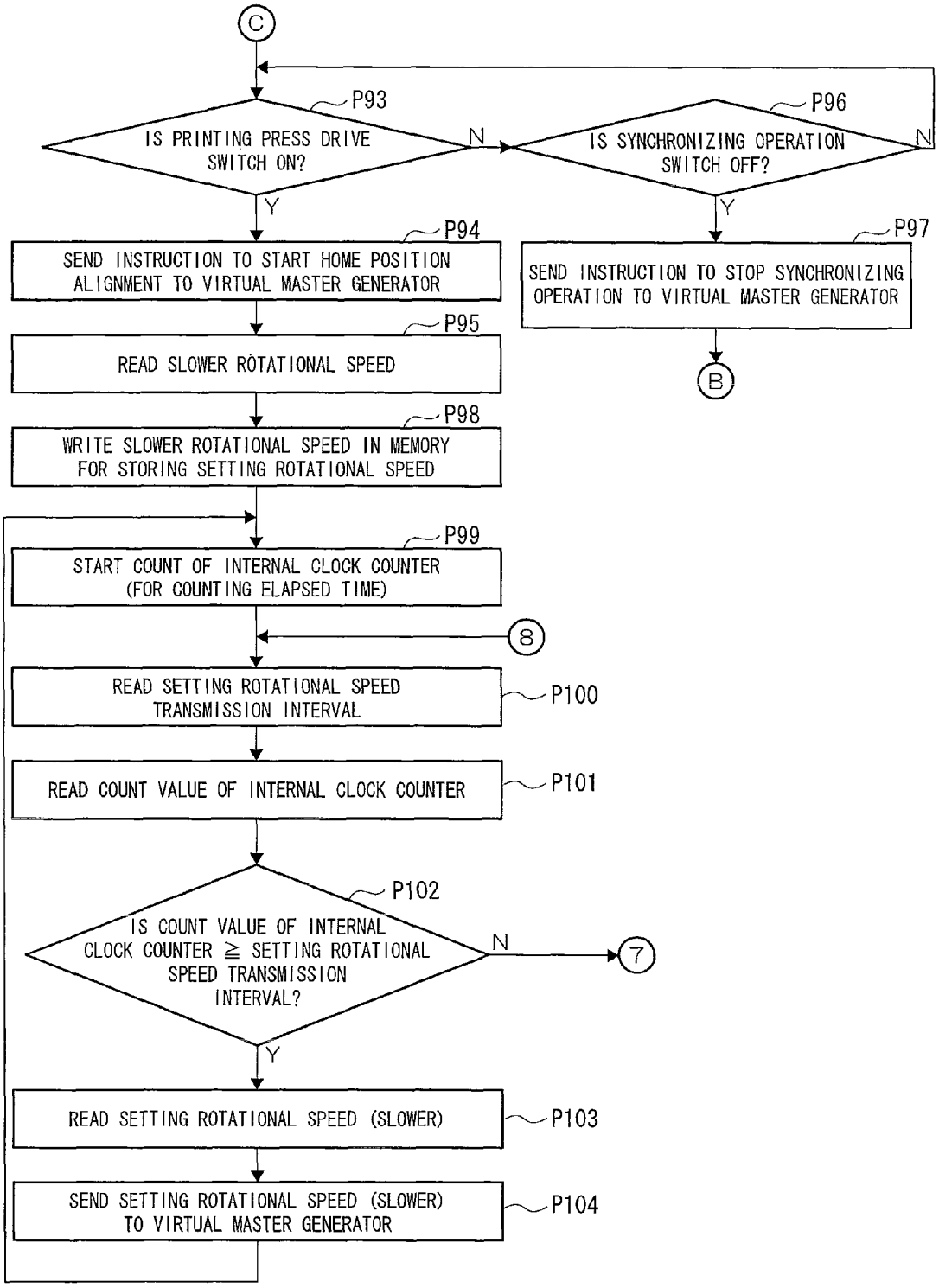
FIG. 7A is an operational flowchart of the central controller.
Figure 7B:
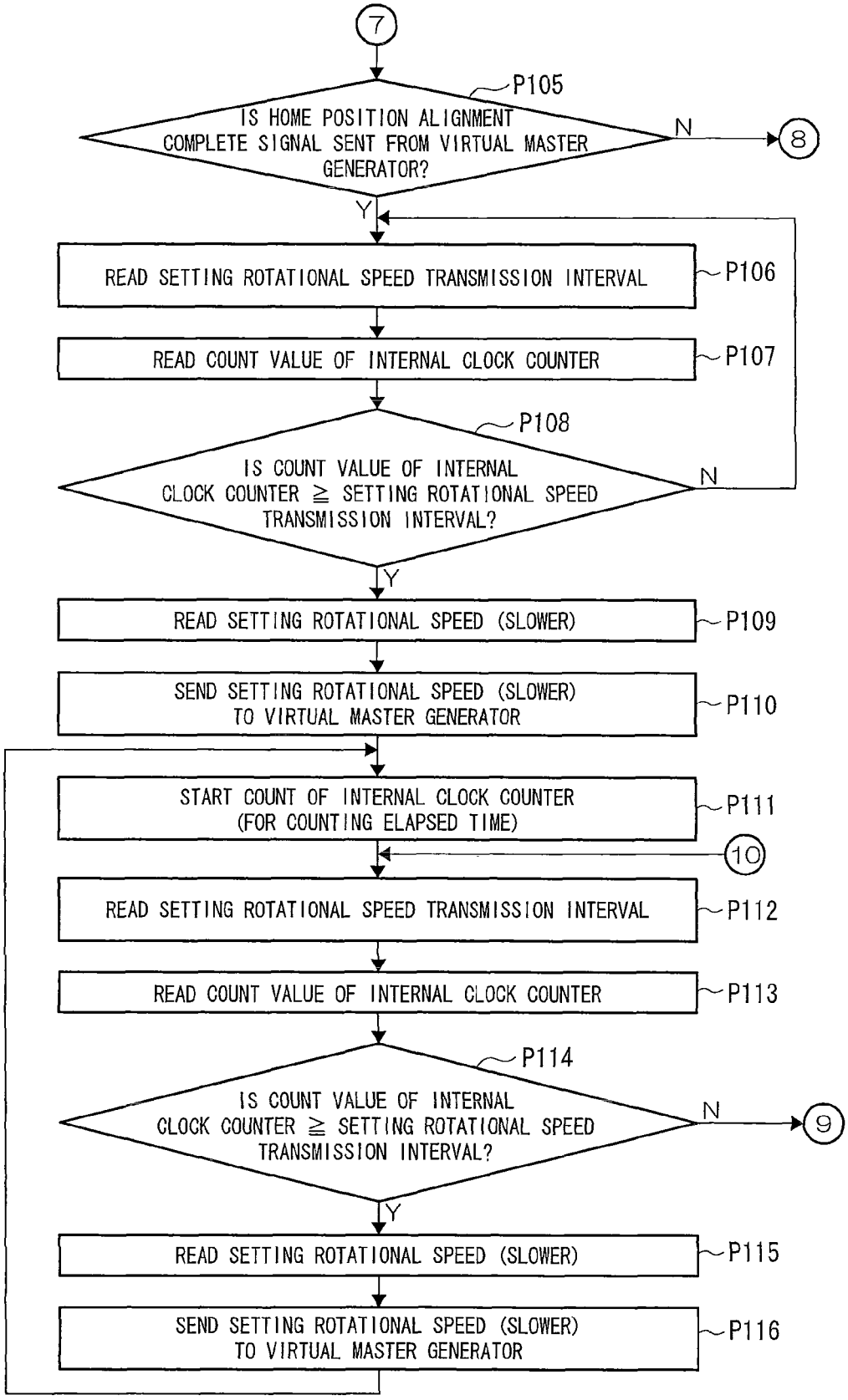
FIG. 7B is an operational flowchart of the central controller.
Figure 7C:
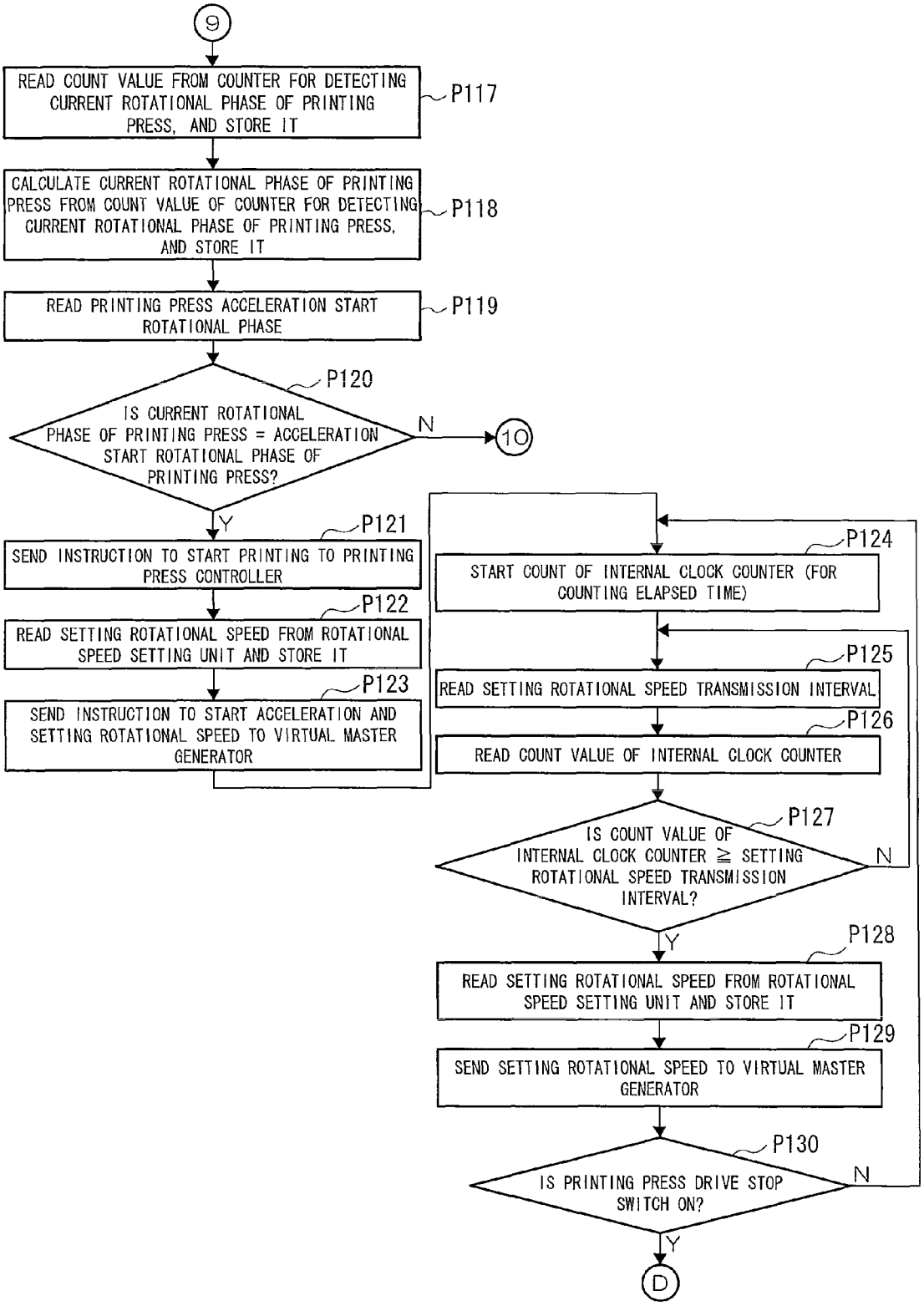
FIG. 7C is an operational flowchart of the central controller.
Figure 8A:
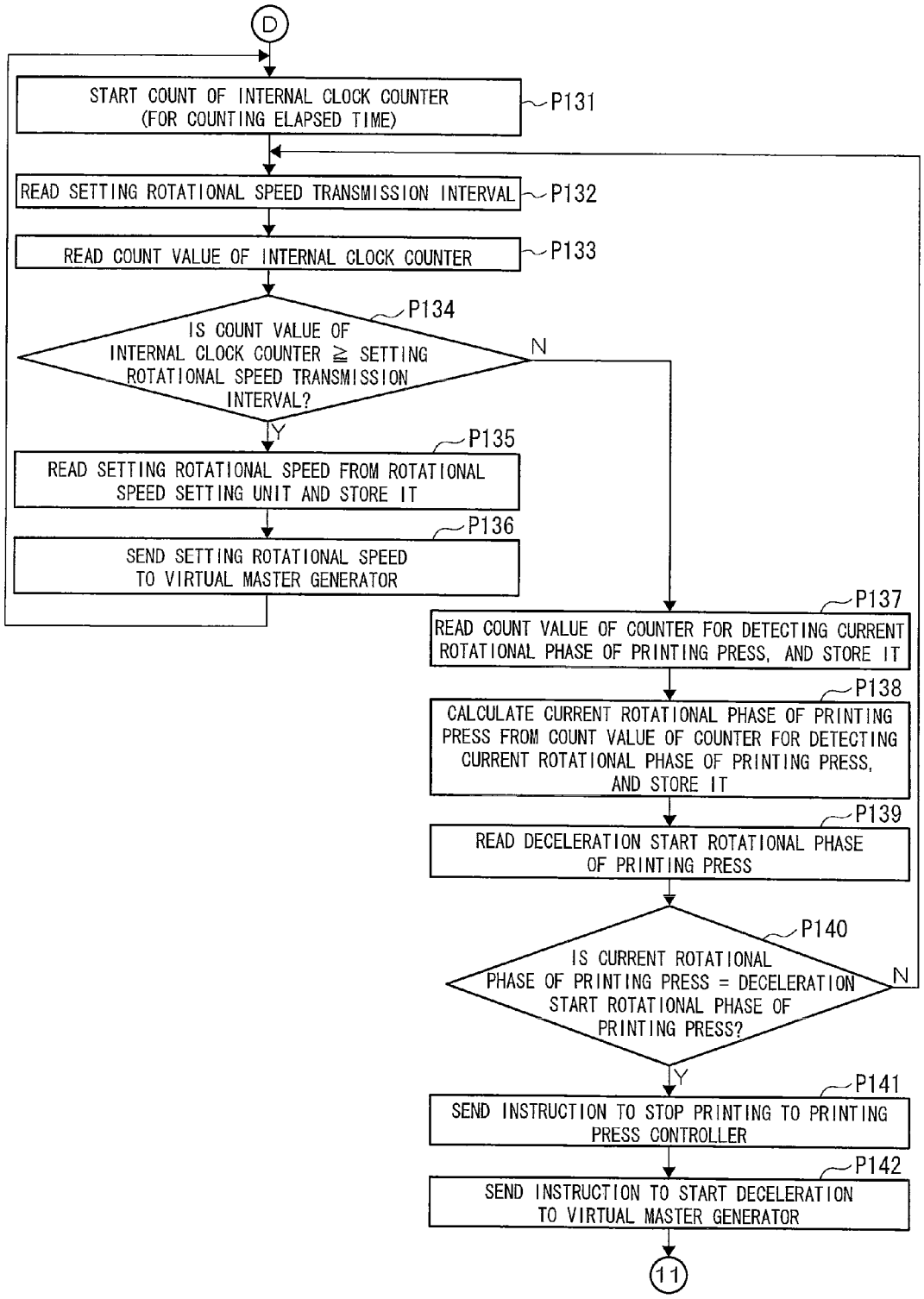
FIG. 8A is an operational flowchart of the central controller.
Figure 8B:
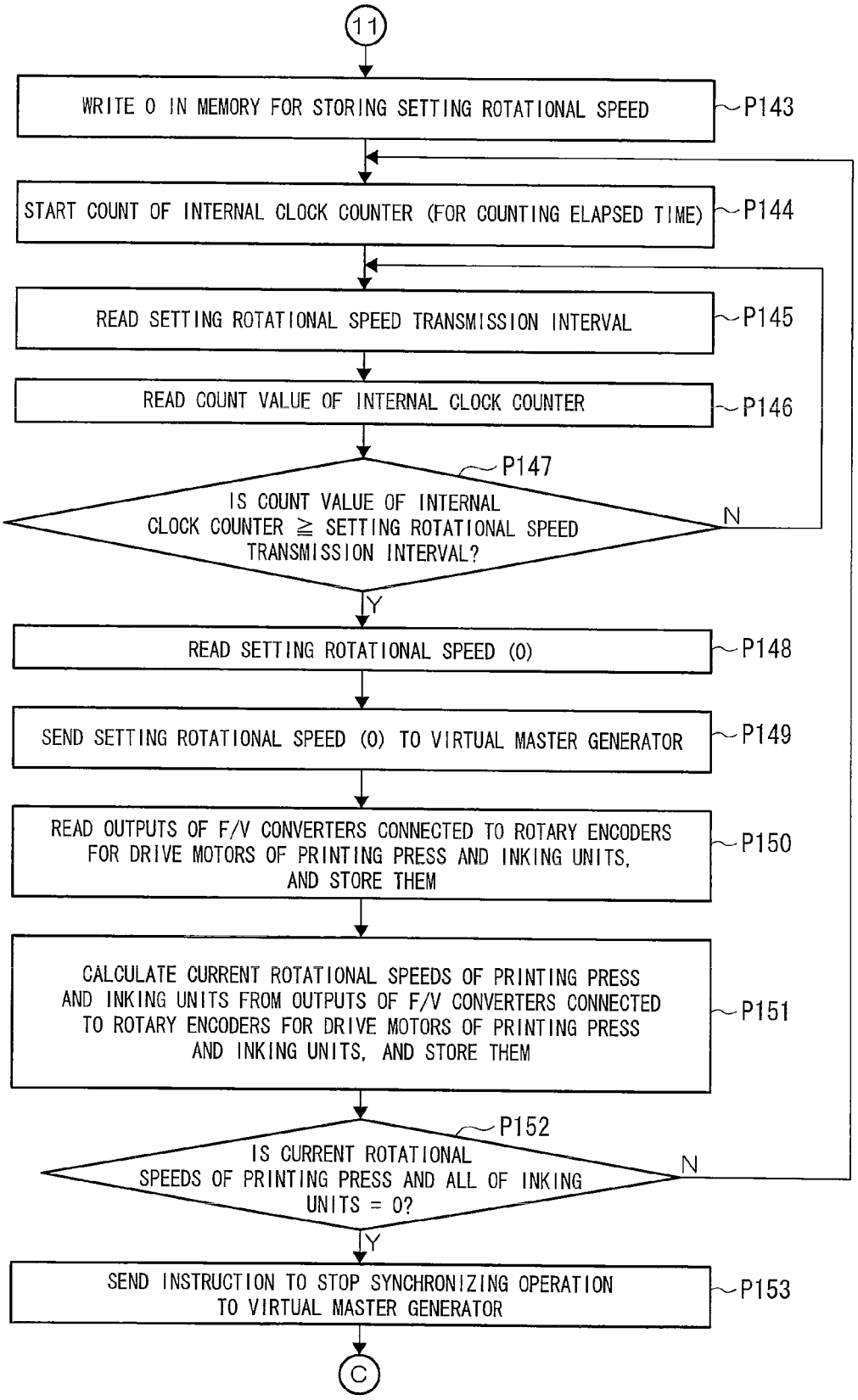
FIG. 8B is an operational flowchart of the central controller.

FIGS. 5A to 5E are operational flowcharts of the central controller. FIGS. 6A to 6C are operational flowcharts of the central controller. FIGS. 7A to 7C are operational flowcharts of the central controller. FIGS. 8A and 8B are operational flowcharts of the central controller.

Figure 9A:
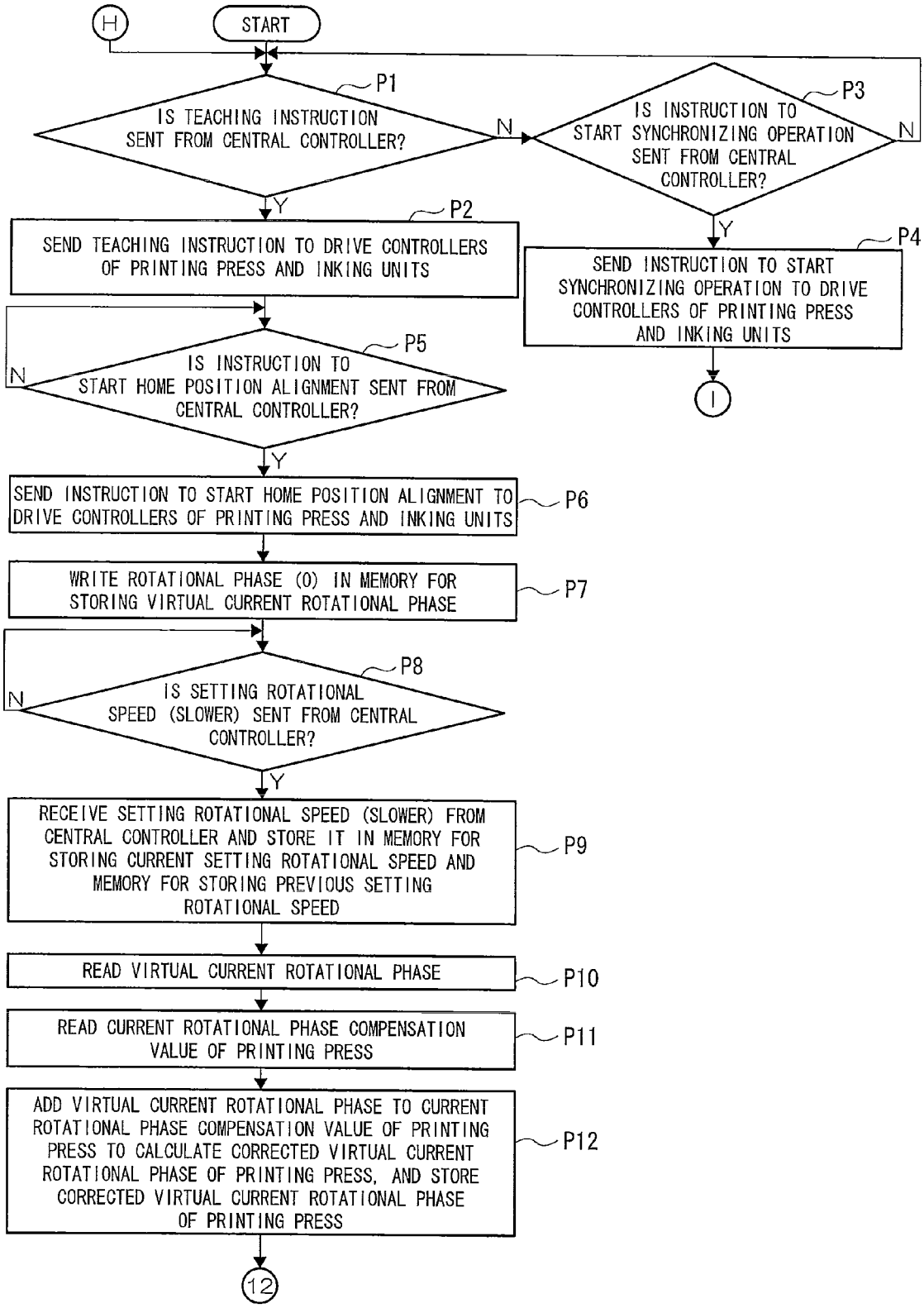
FIG. 9A is an operational flowchart of the virtual master generator.
Figure 9B:
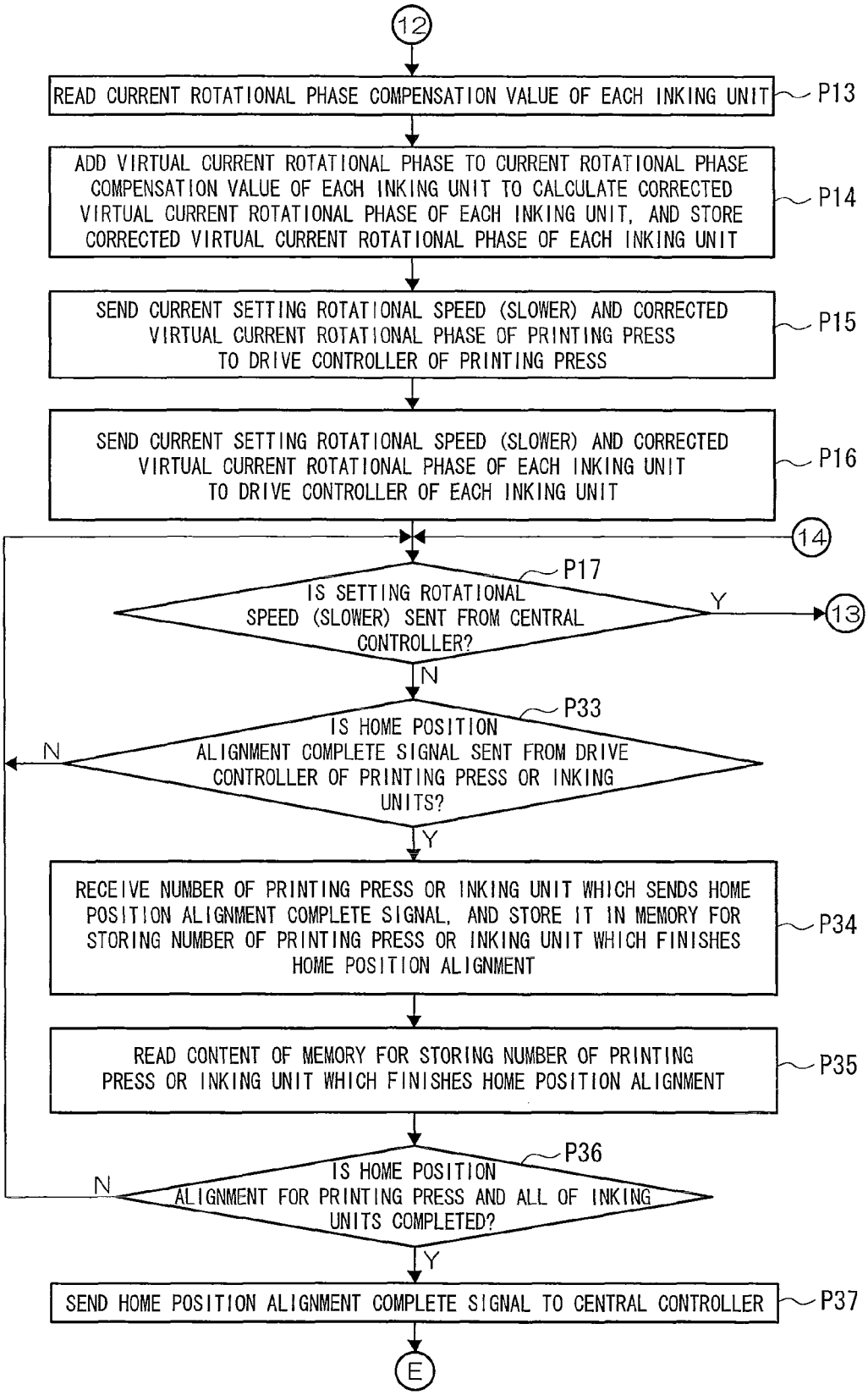
FIG. 9B is an operational flowchart of the virtual master generator.
Figure 9C:
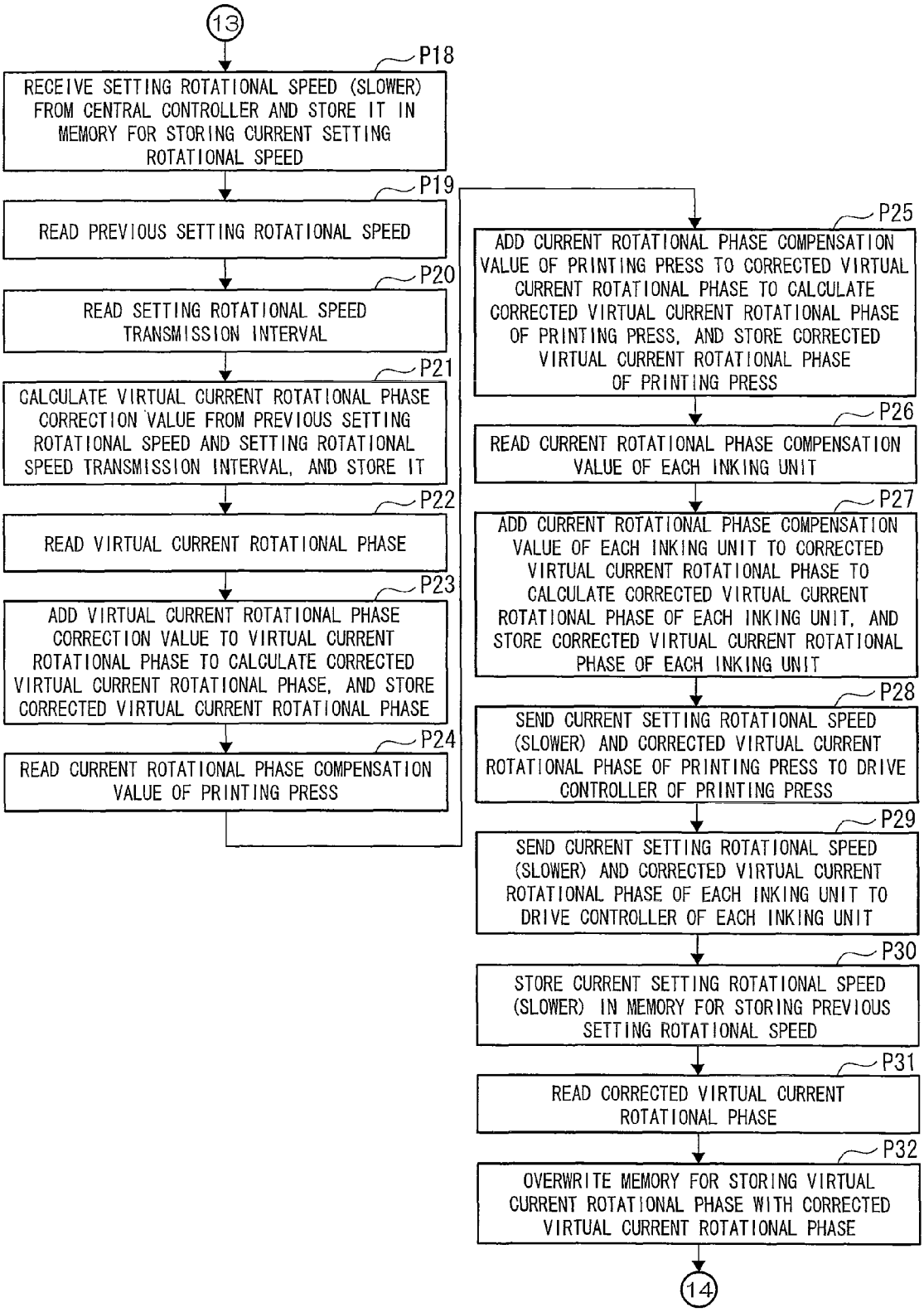
FIG. 9C is an operational flowchart of the virtual master generator.
Figure 10A:
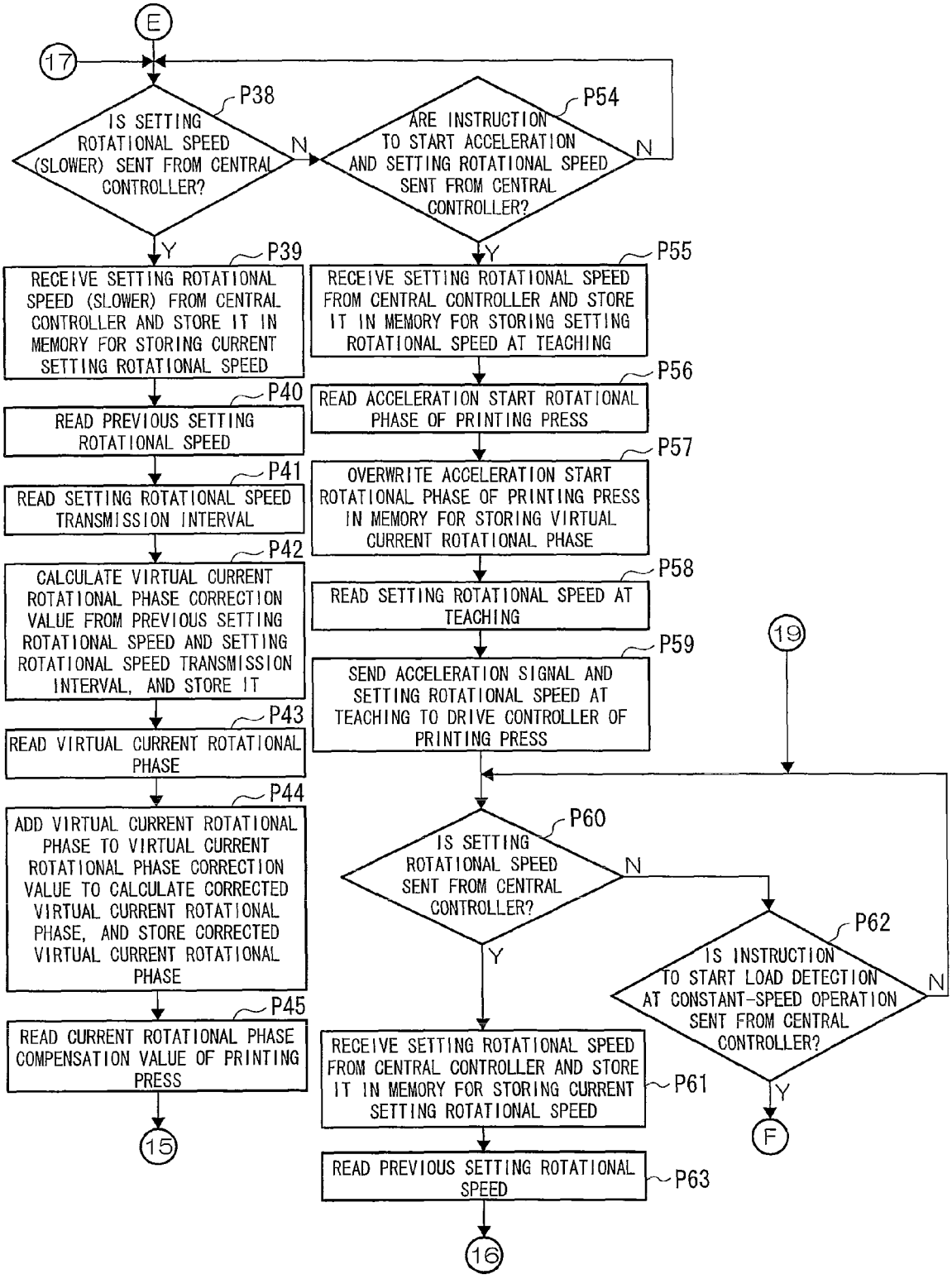
FIG. 10A is an operational flowchart of the virtual master generator.
Figure 10B:
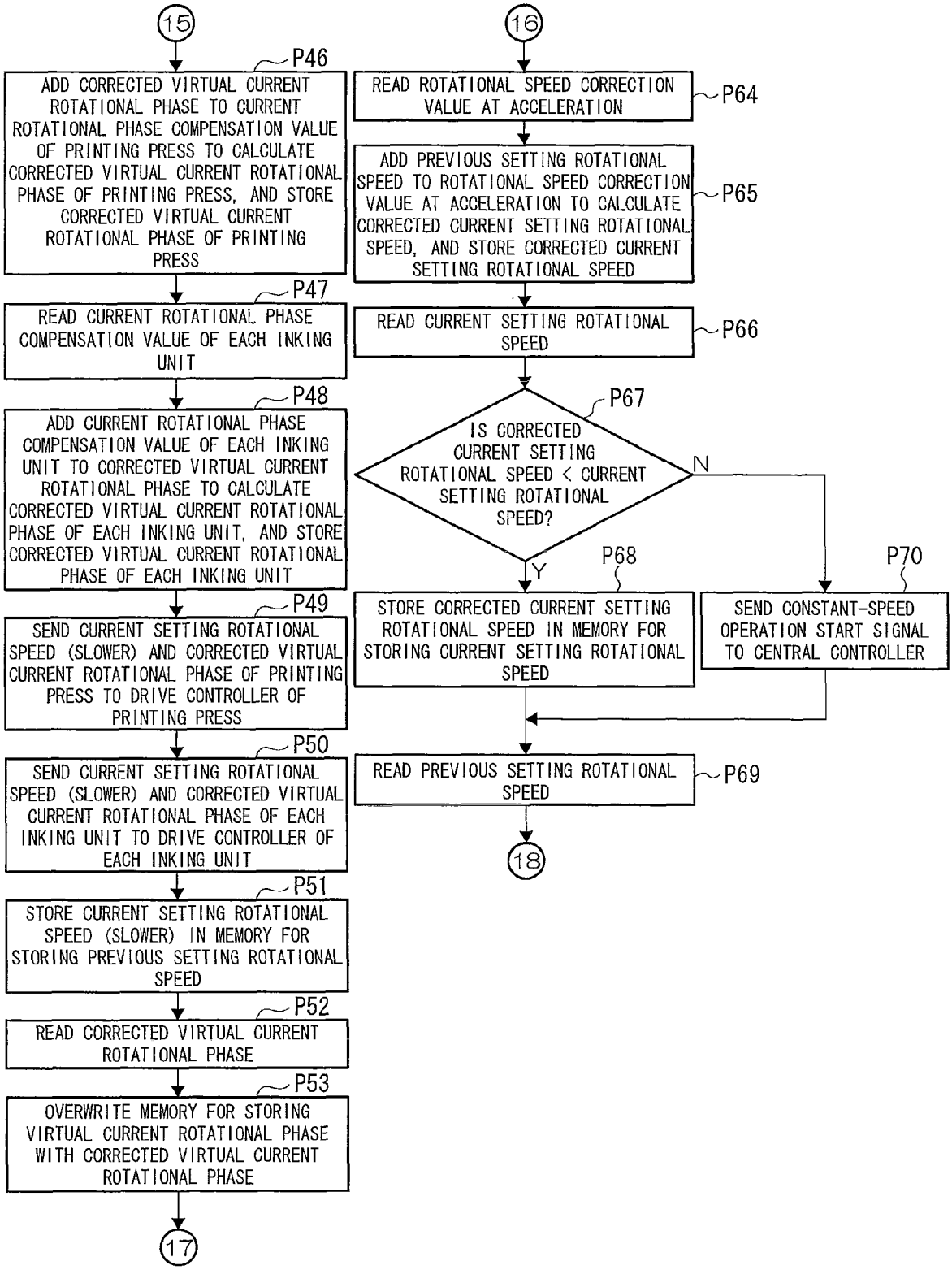
FIG. 10B is an operational flowchart of the virtual master generator.
Figure 10C:
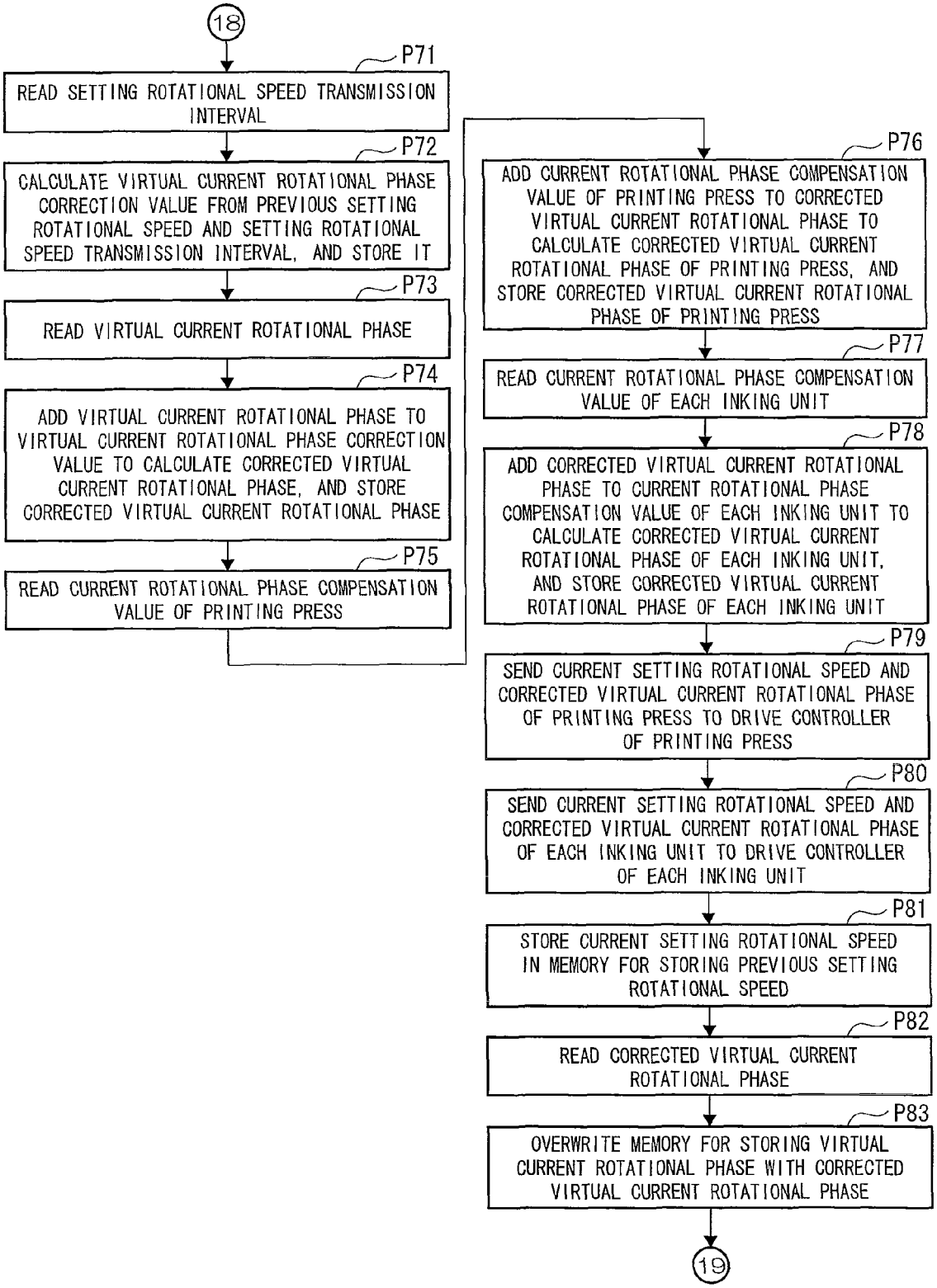
FIG. 10C is an operational flowchart of the virtual master generator.
Figure 11A:
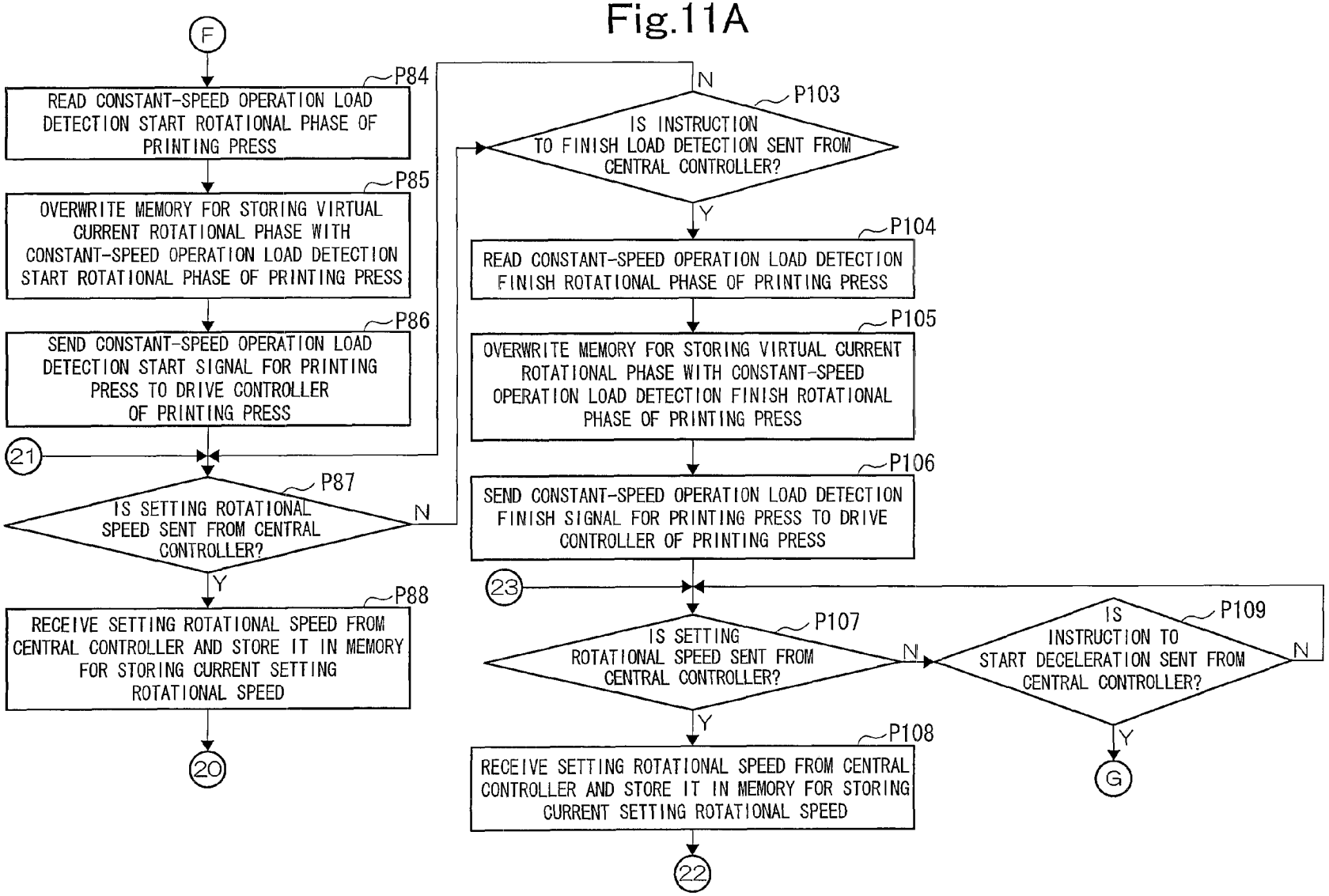
FIG. 11A is an operational flowchart of the virtual master generator.
Figure 11B:
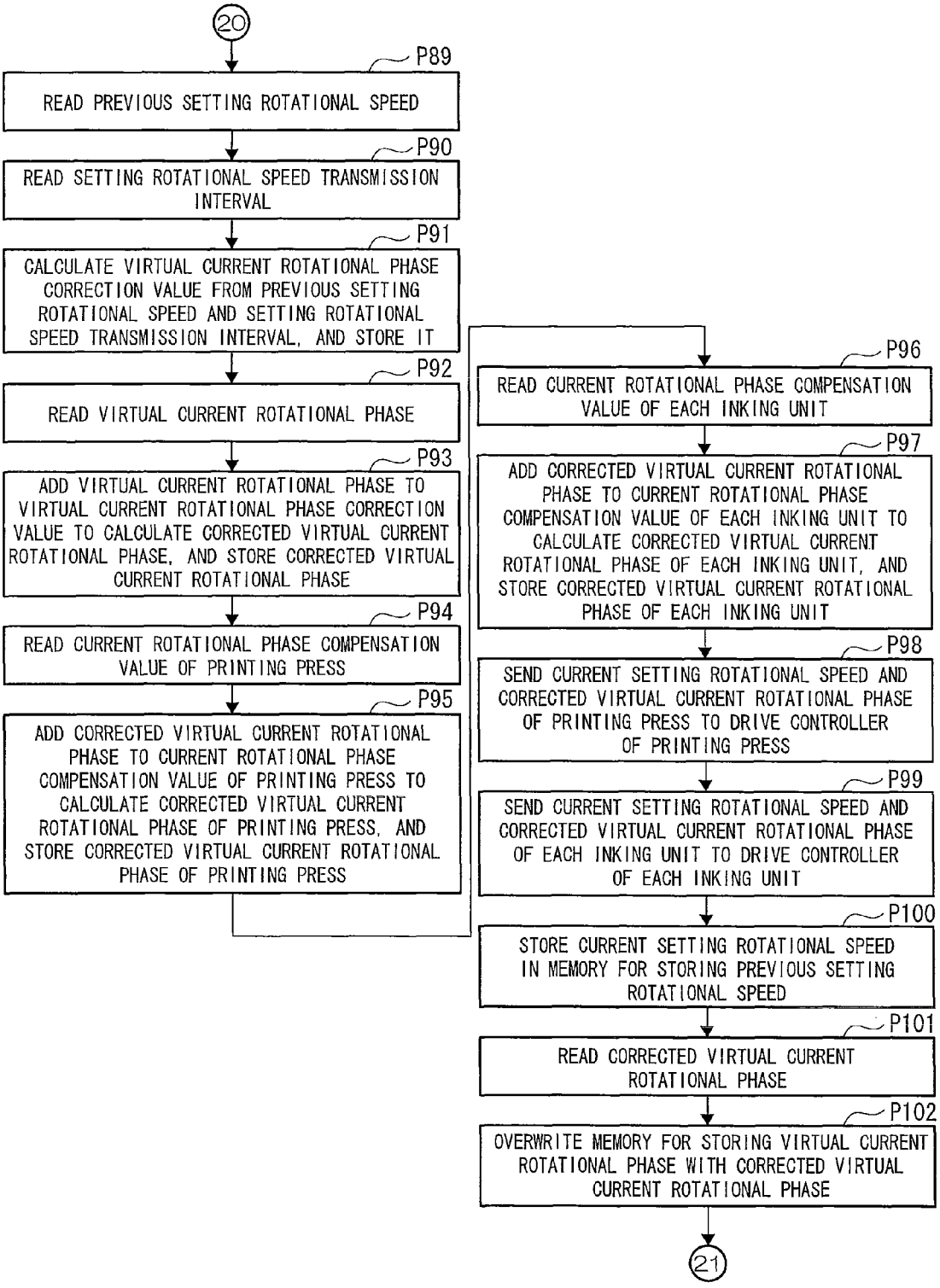
FIG. 11B is an operational flowchart of the virtual master generator.
Figure 11C:
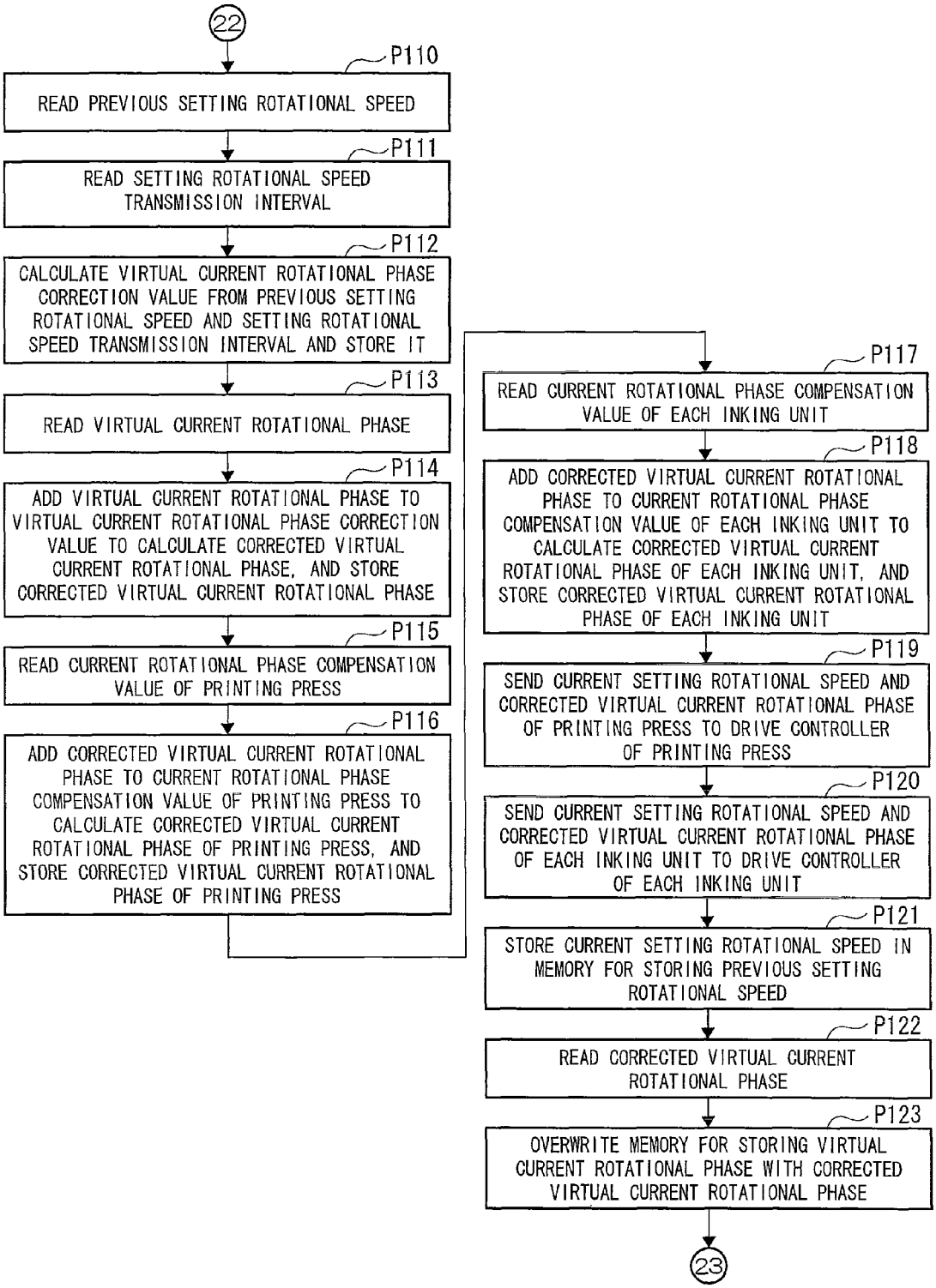
FIG. 11C is an operational flowchart of the virtual master generator.
Figure 12A:
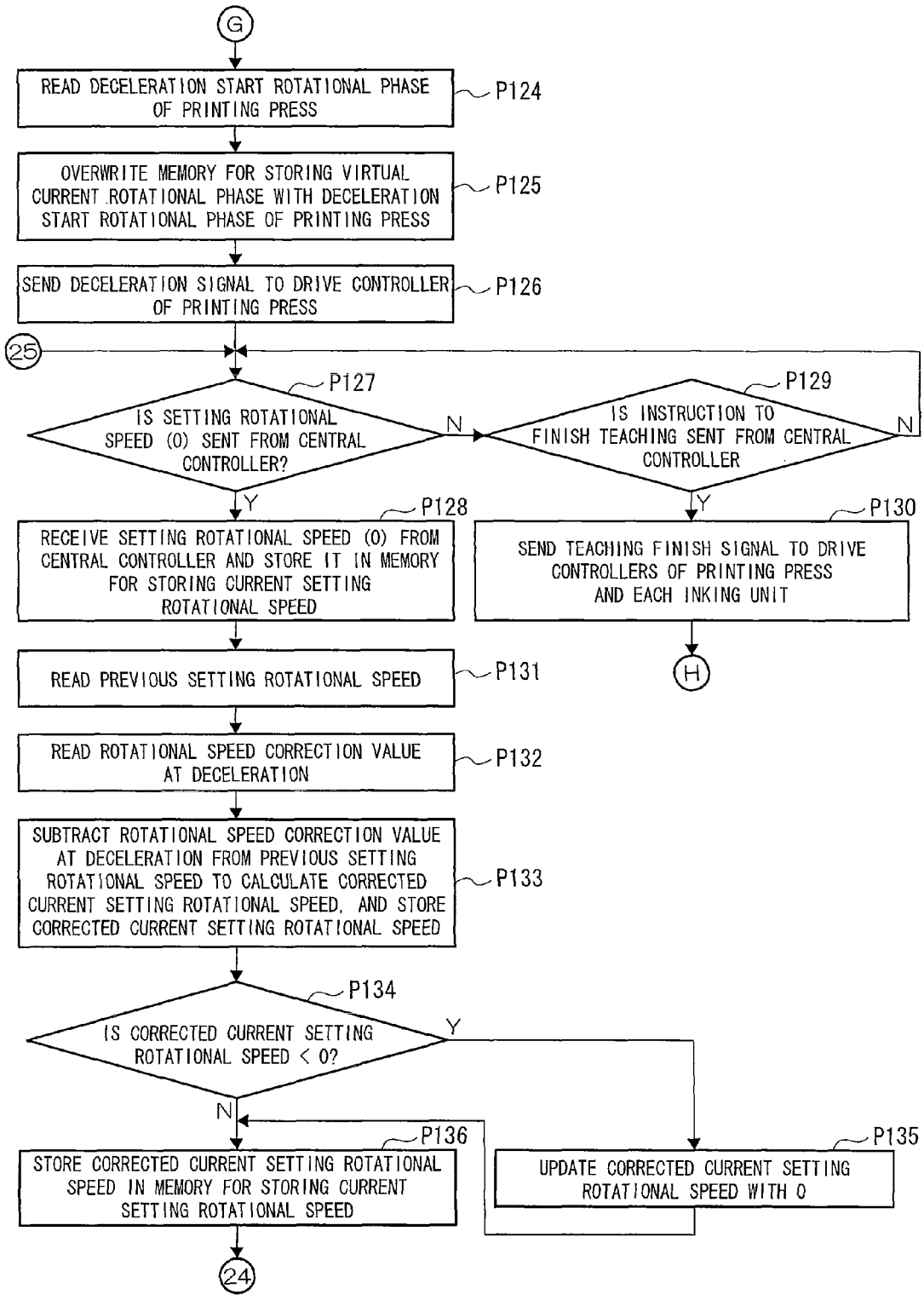
FIG. 12A is an operational flowchart of the virtual master generator.
Figure 12B:
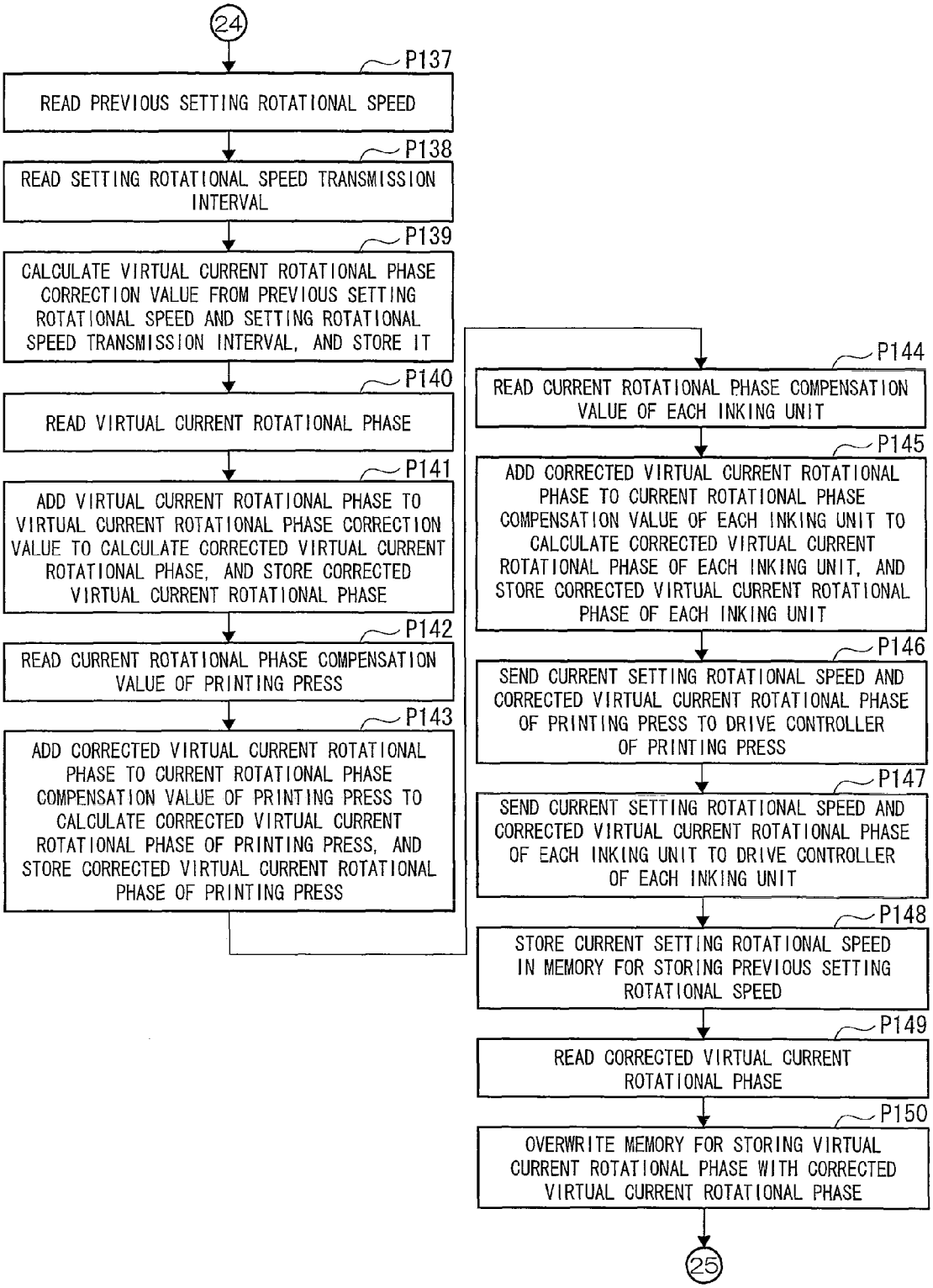
FIG. 12B is an operational flowchart of the virtual master generator.
Figure 13A:
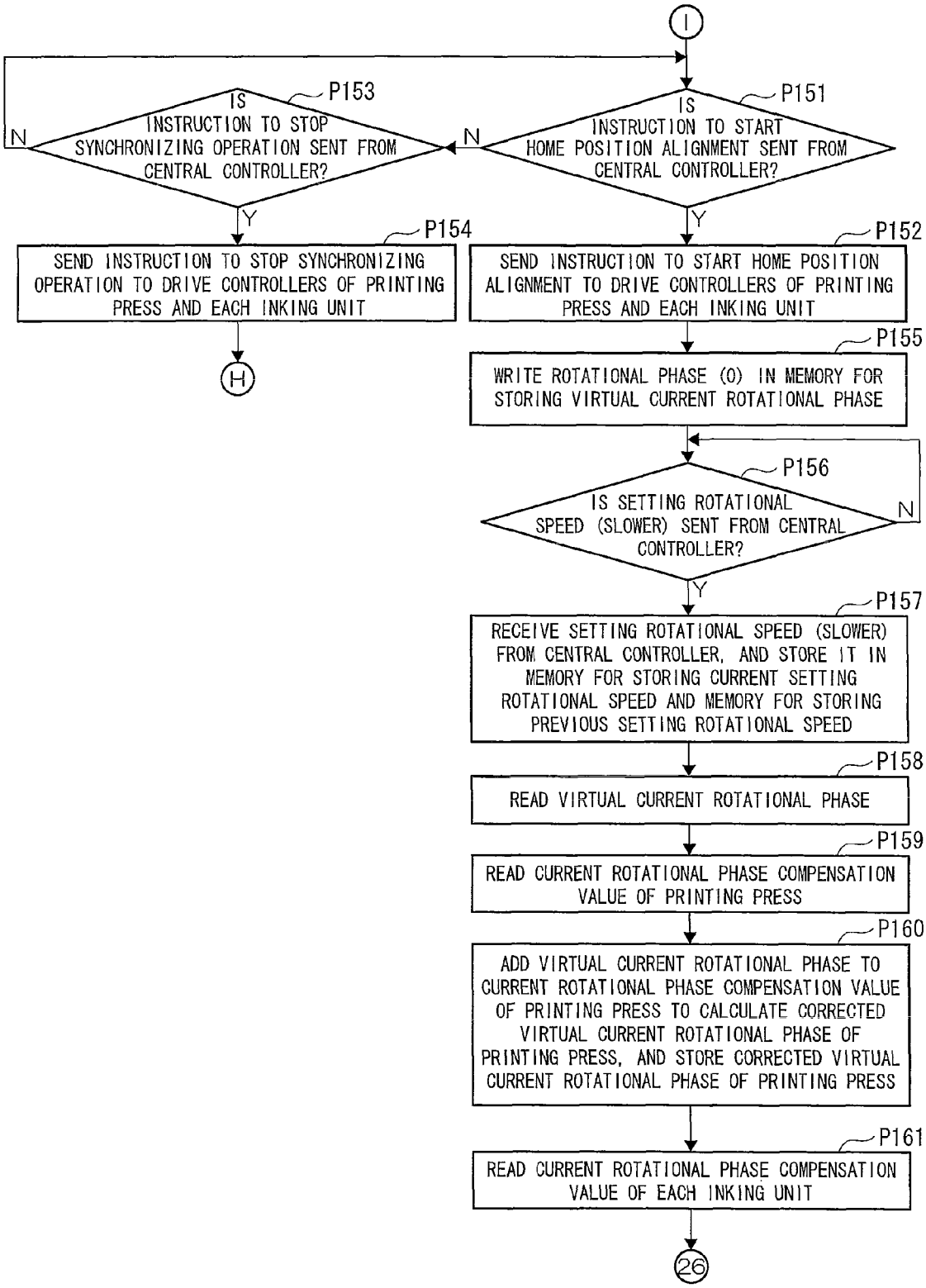
FIG. 13A is an operational flowchart of the virtual master generator.
Figure 13B:
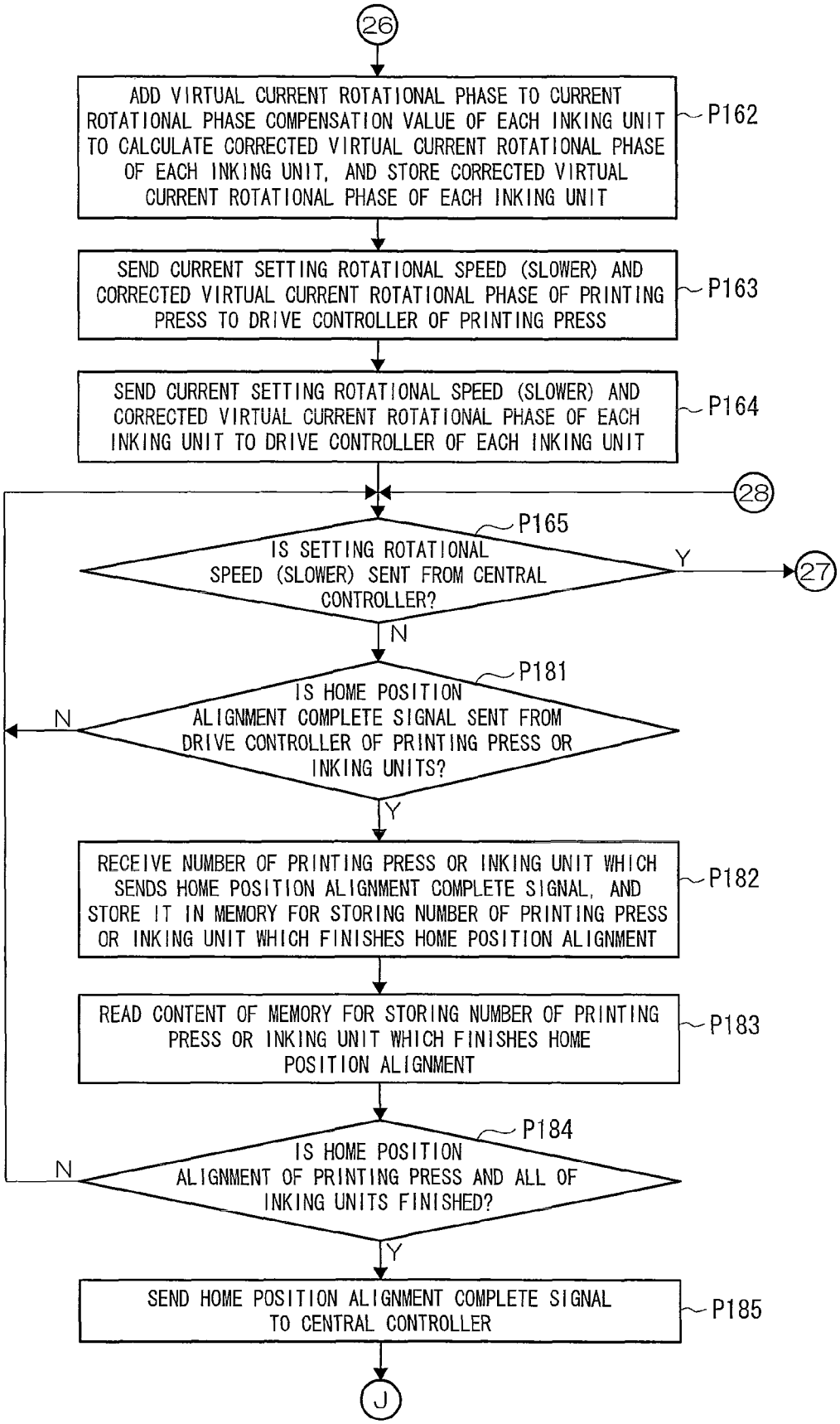
FIG. 13B is an operational flowchart of the virtual master generator.
Figure 13C:
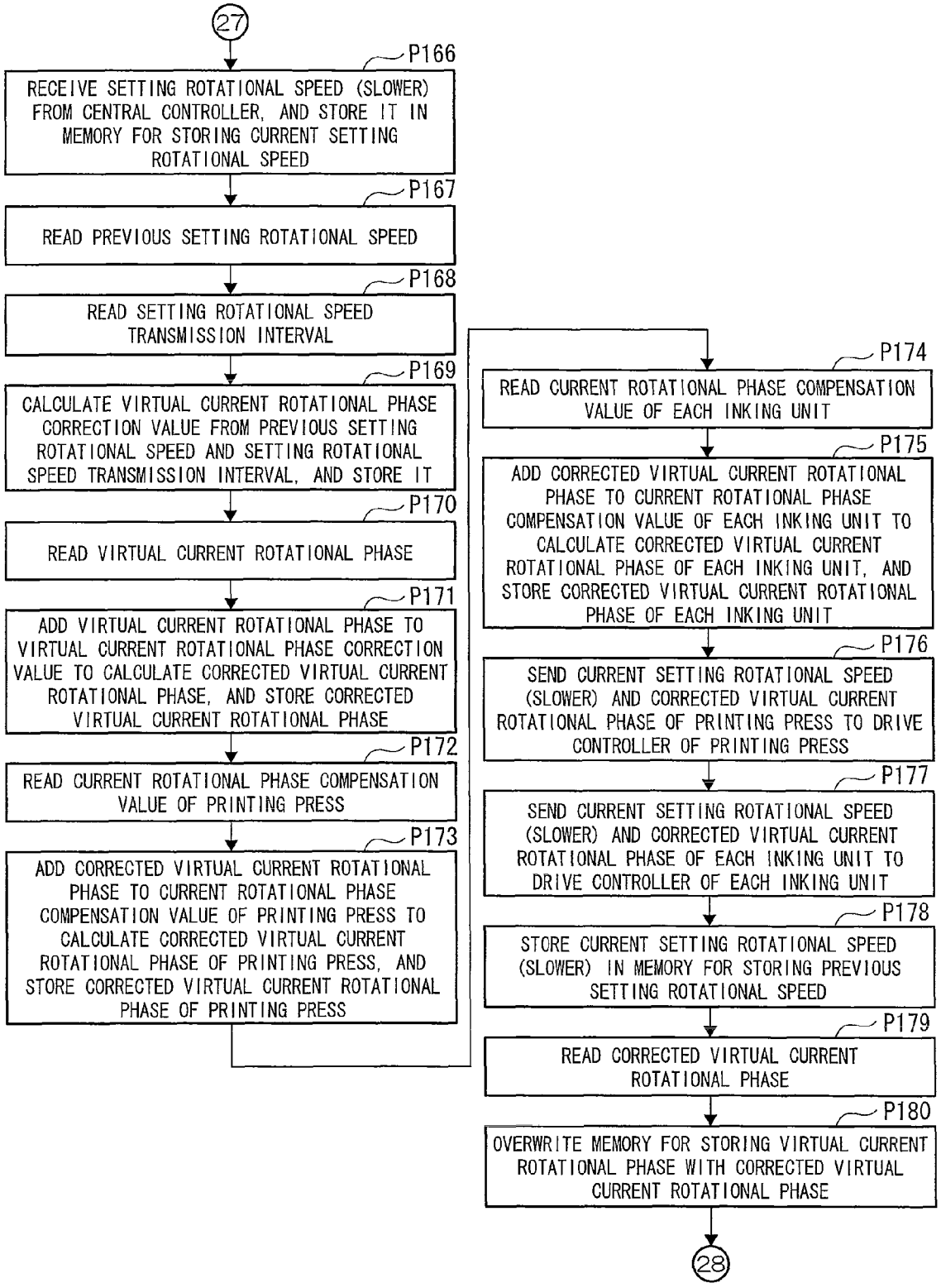
FIG. 13C is an operational flowchart of the virtual master generator.
Figure 14A:
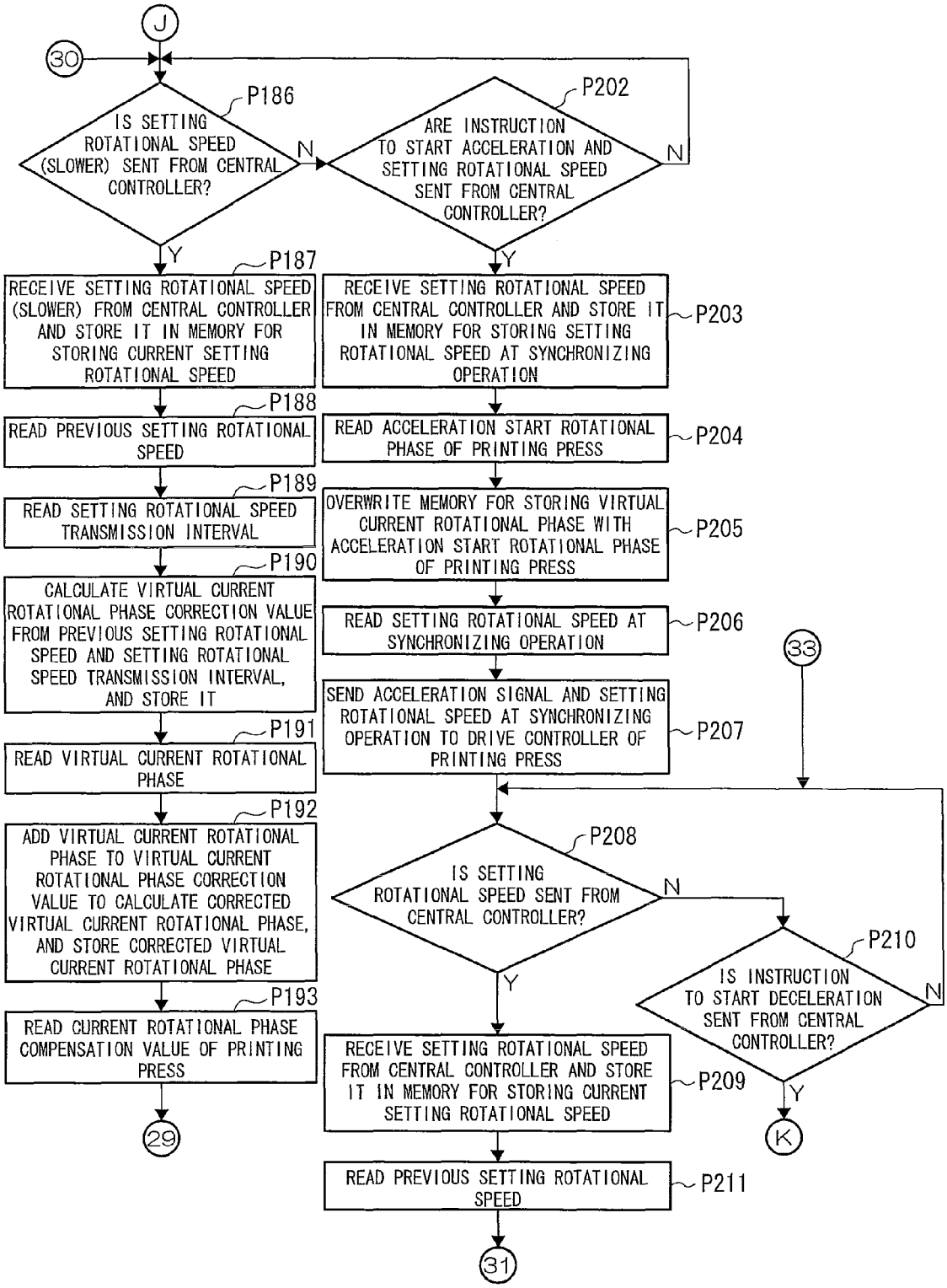
FIG. 14A is an operational flowchart of the virtual master generator.
Figure 14B:
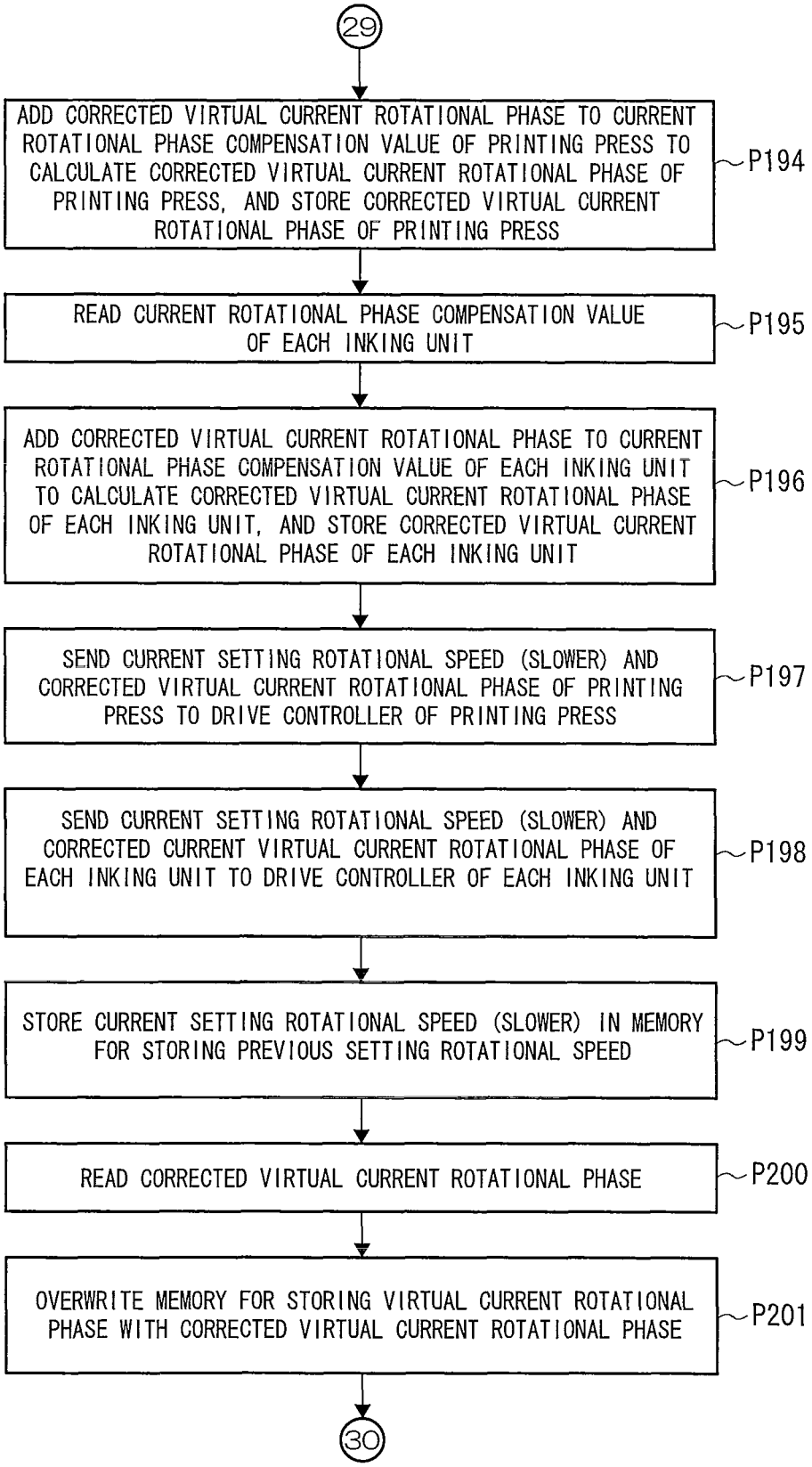
FIG. 14B is an operational flowchart of the virtual master generator.
Figure 14C:
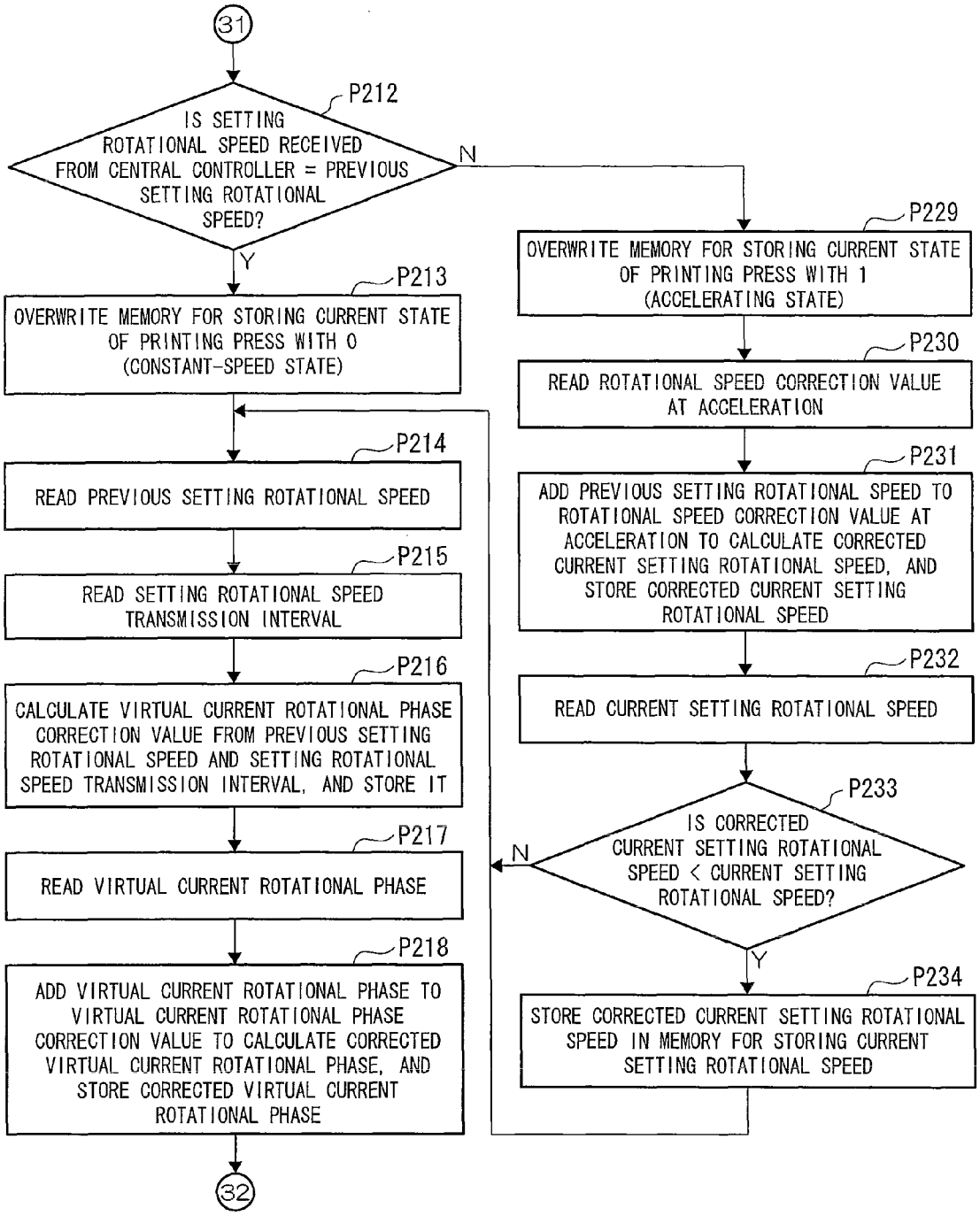
FIG. 14C is an operational flowchart of the virtual master generator.
Figure 14D:
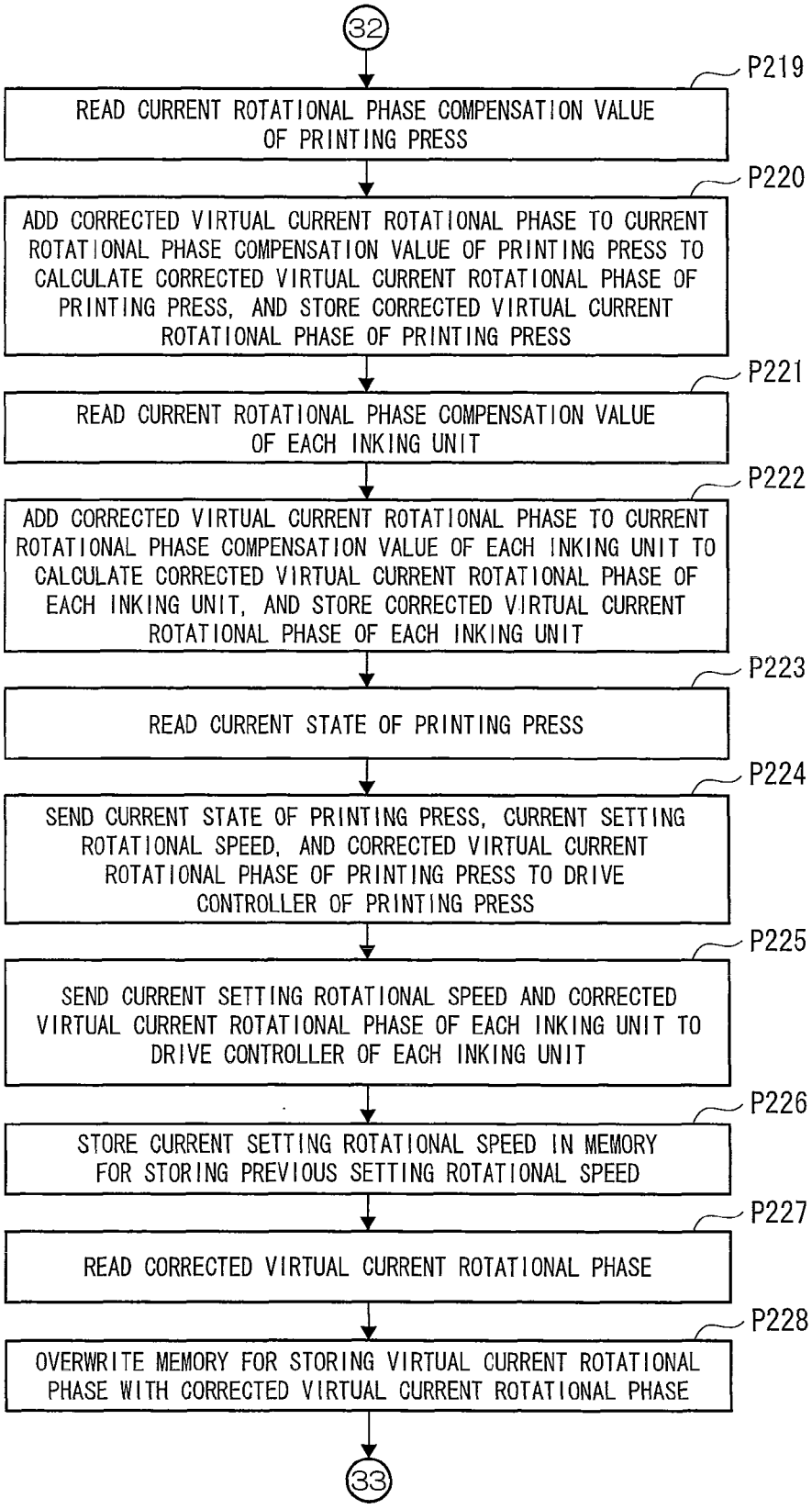
FIG. 14D is an operational flowchart of the virtual master generator.
Figure 15A:
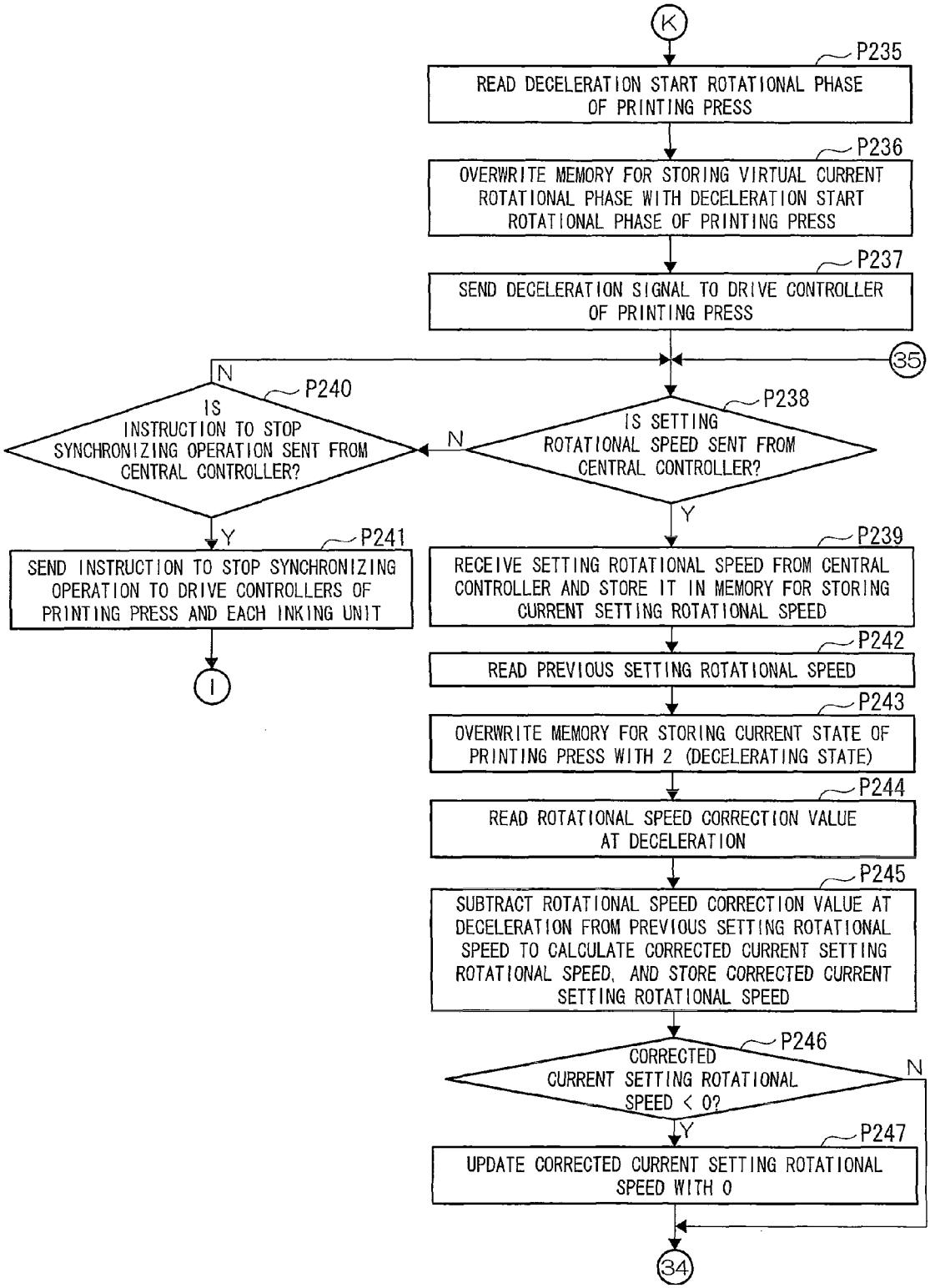
FIG. 15A is an operational flowchart of the virtual master generator.
Figure 15B:
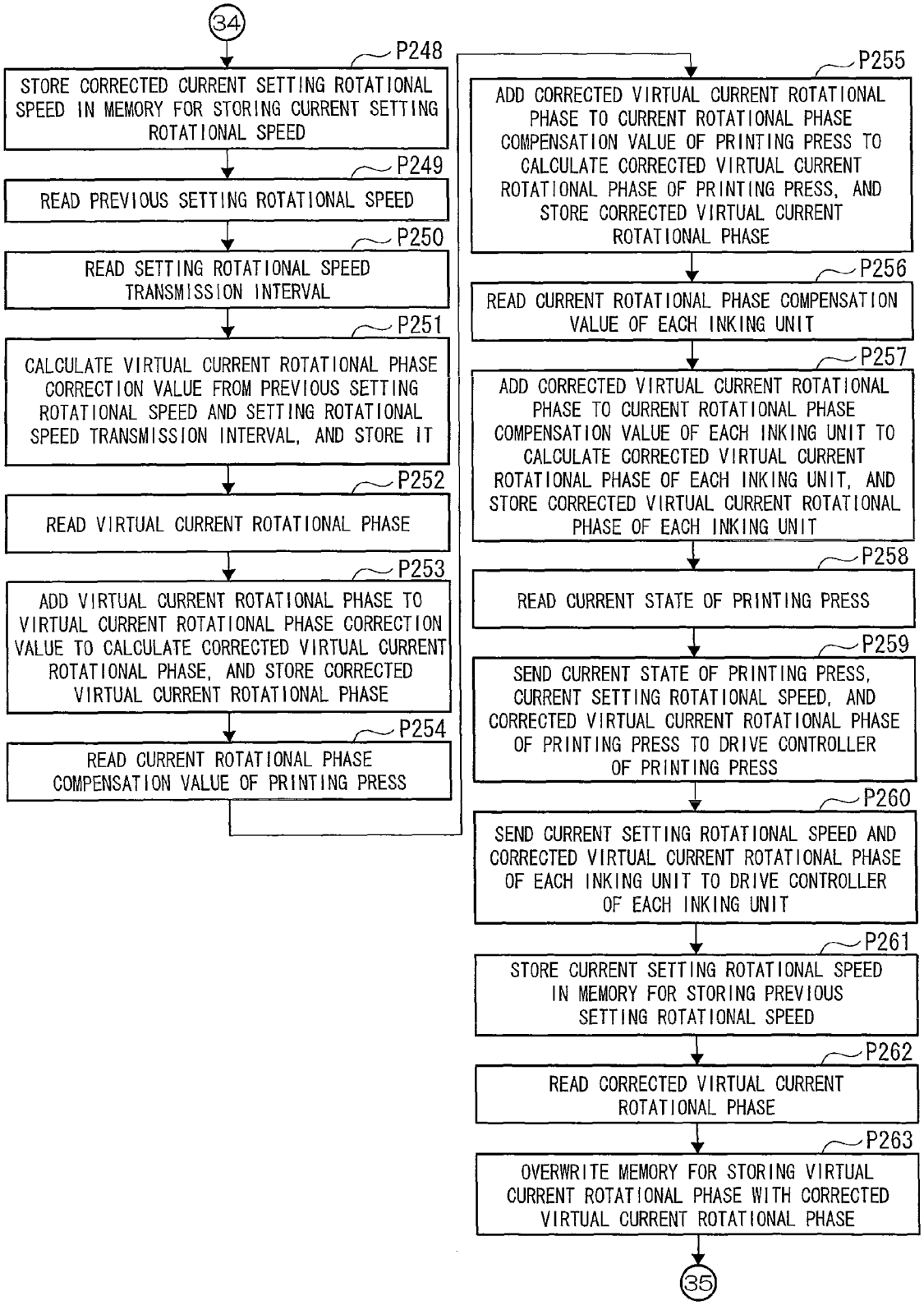
FIG. 15B is an operational flowchart of the virtual master generator.

FIGS. 9A to 9C are operational flowcharts of the virtual master generator. FIGS. 10A to 10C are operational flowcharts of the virtual master generator. FIGS. 11A to 11C are operational flowcharts of the virtual master generator. FIGS. 12A and 12B show operational flowcharts of the virtual master generator. FIGS. 13A to 13C are operational flowcharts of the virtual master generator. FIGS. 14A to 14D are operational flowcharts of the virtual master generator. FIGS. 15A and 15B are operational flowcharts of the virtual master generator.

Figure 16A:
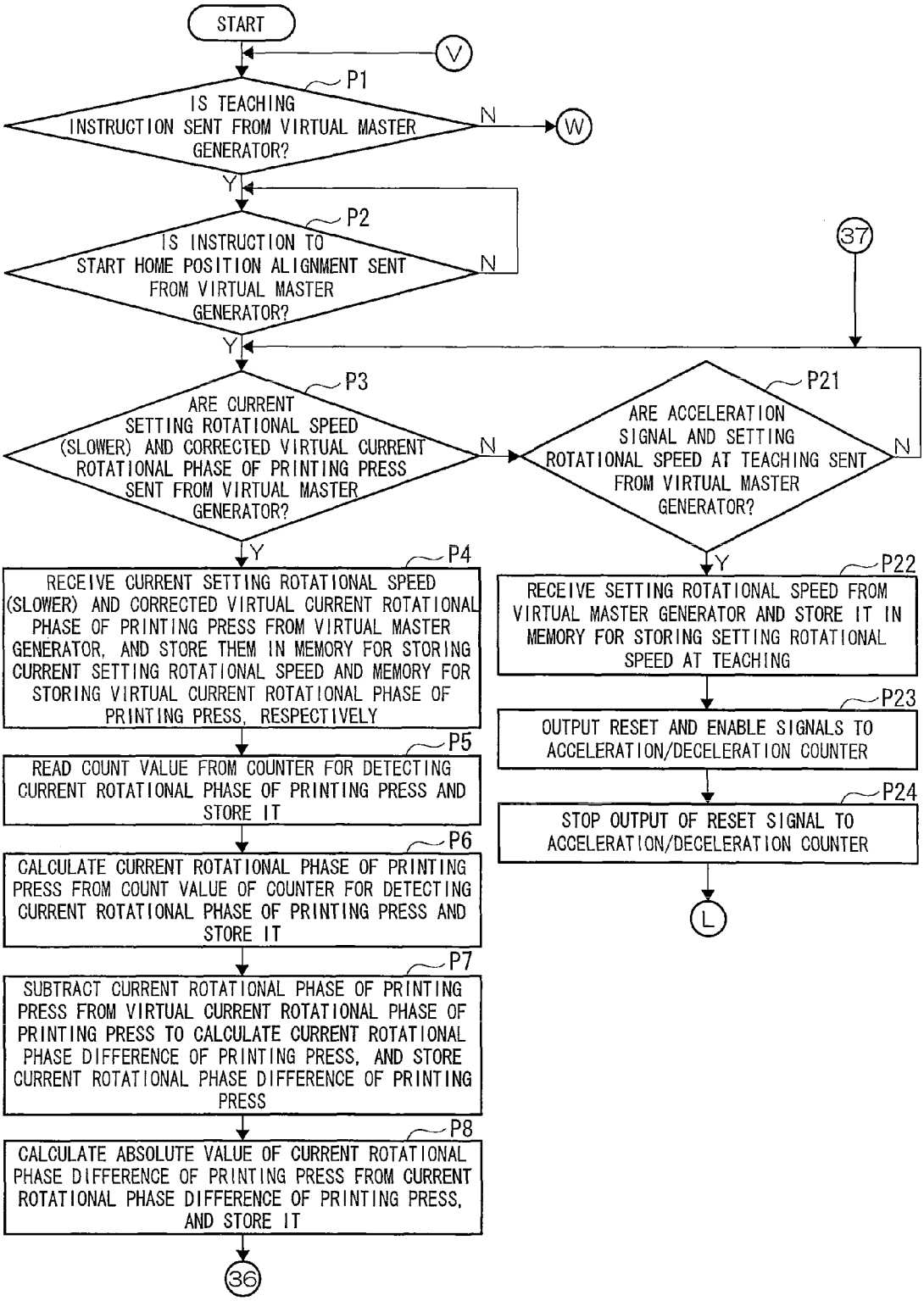
FIG. 16A is an operational flowchart of the drive controller of the printing press.
Figure 16B:
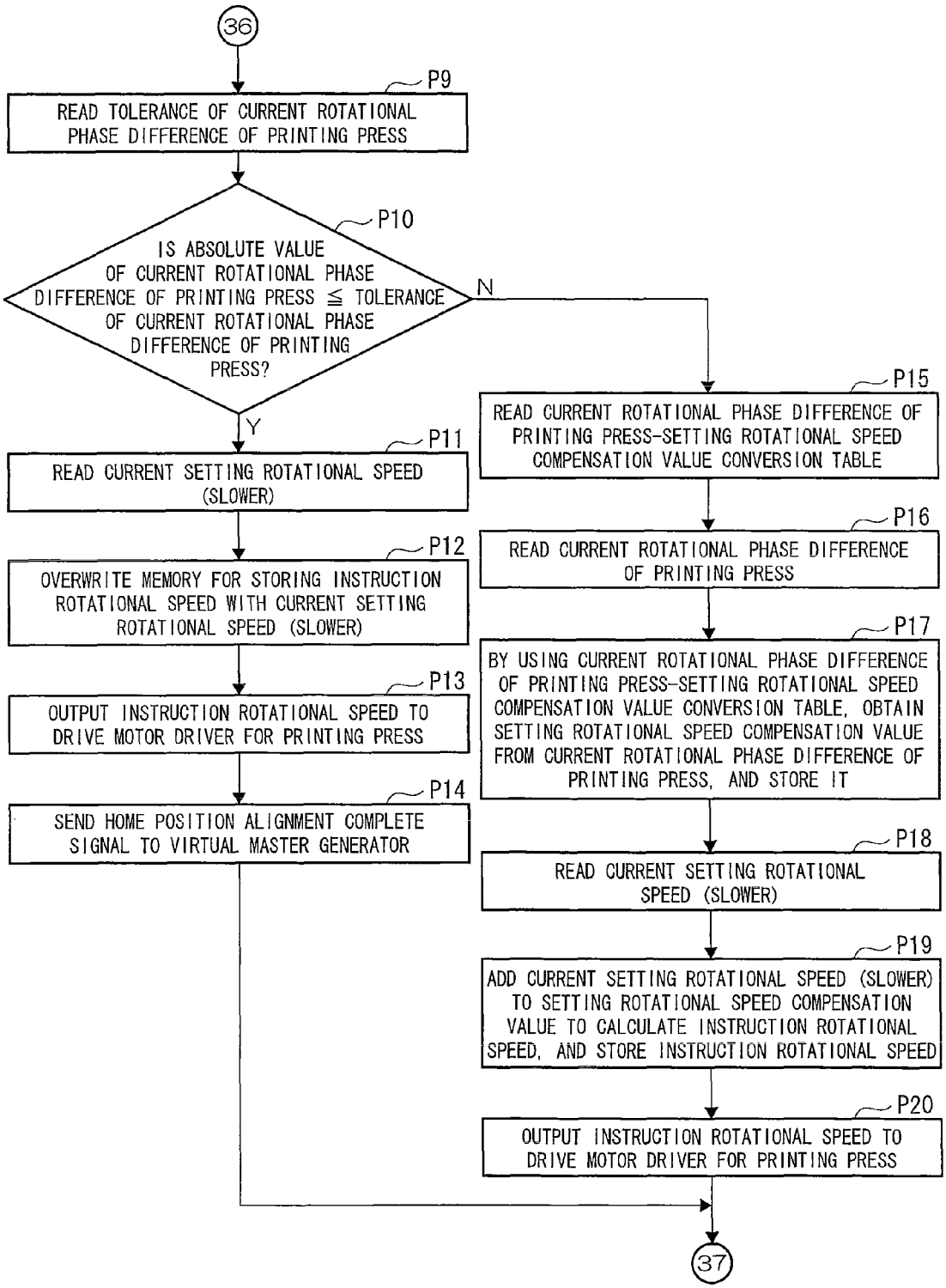
FIG. 16B is an operational flowchart of the drive controller of the printing press.
Figure 17A:
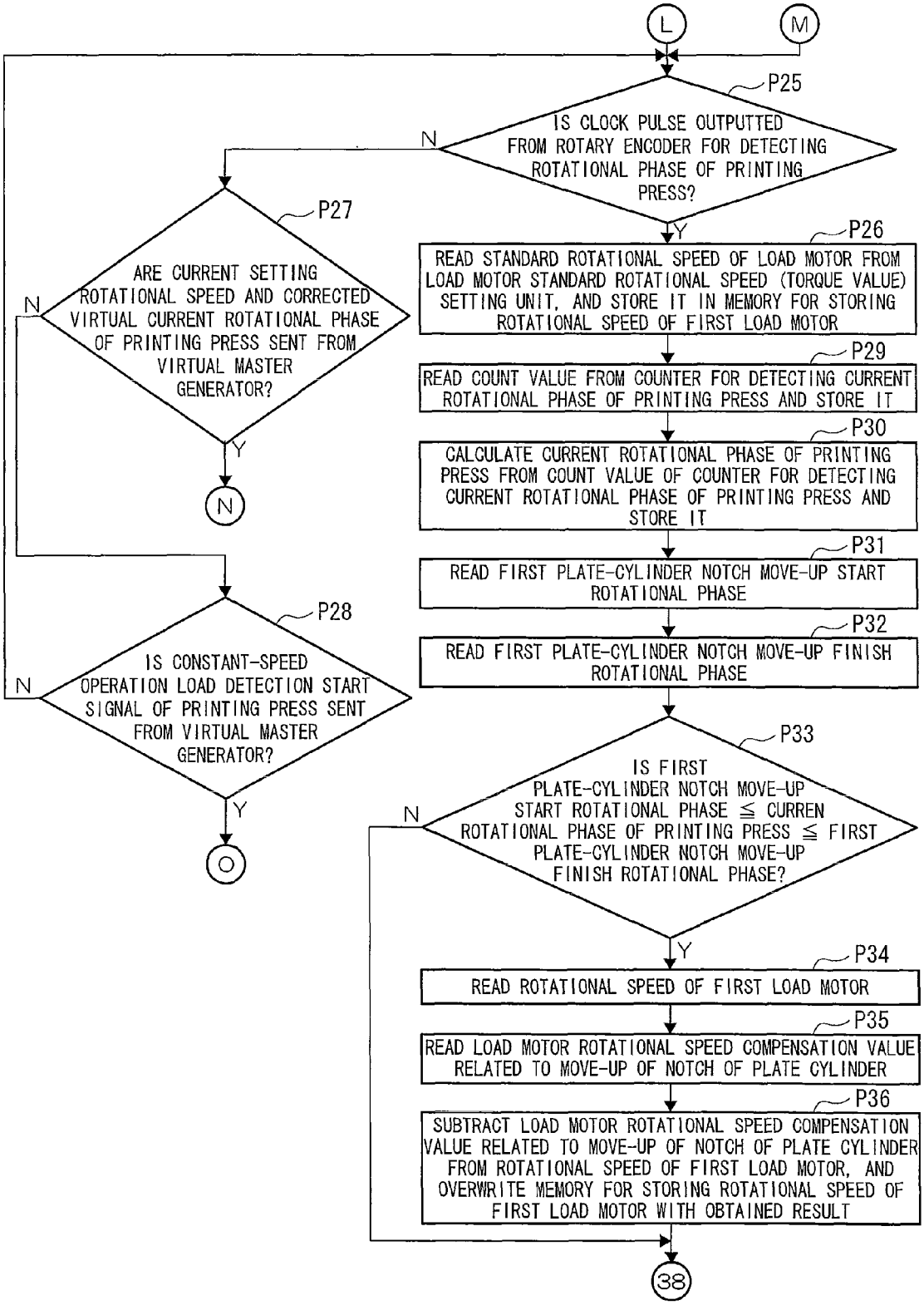
FIG. 17A is an operational flowchart of the drive controller of the printing press.
Figure 17B:
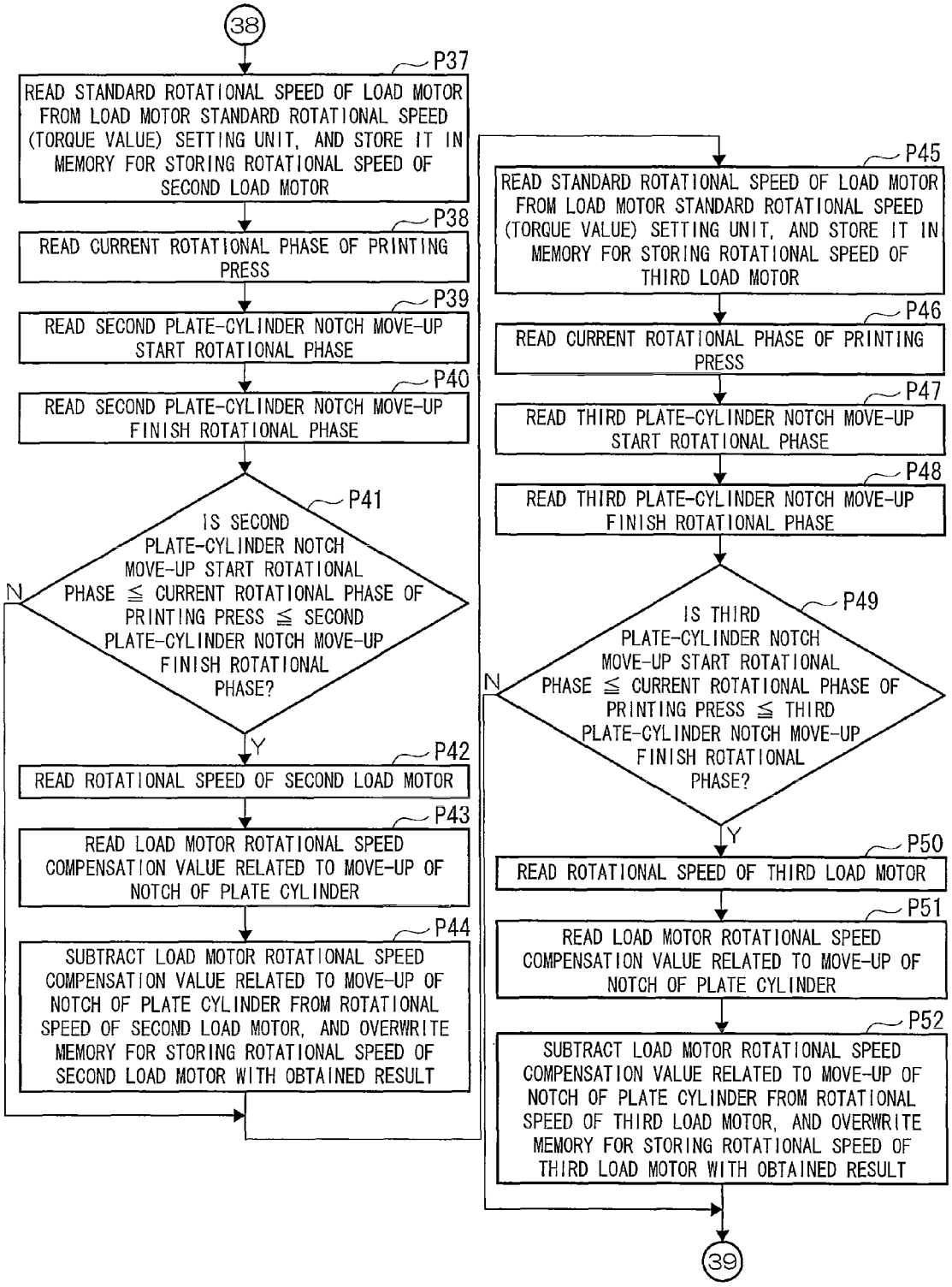
FIG. 17B is an operational flowchart of the drive controller of the printing press.
Figure 17C:
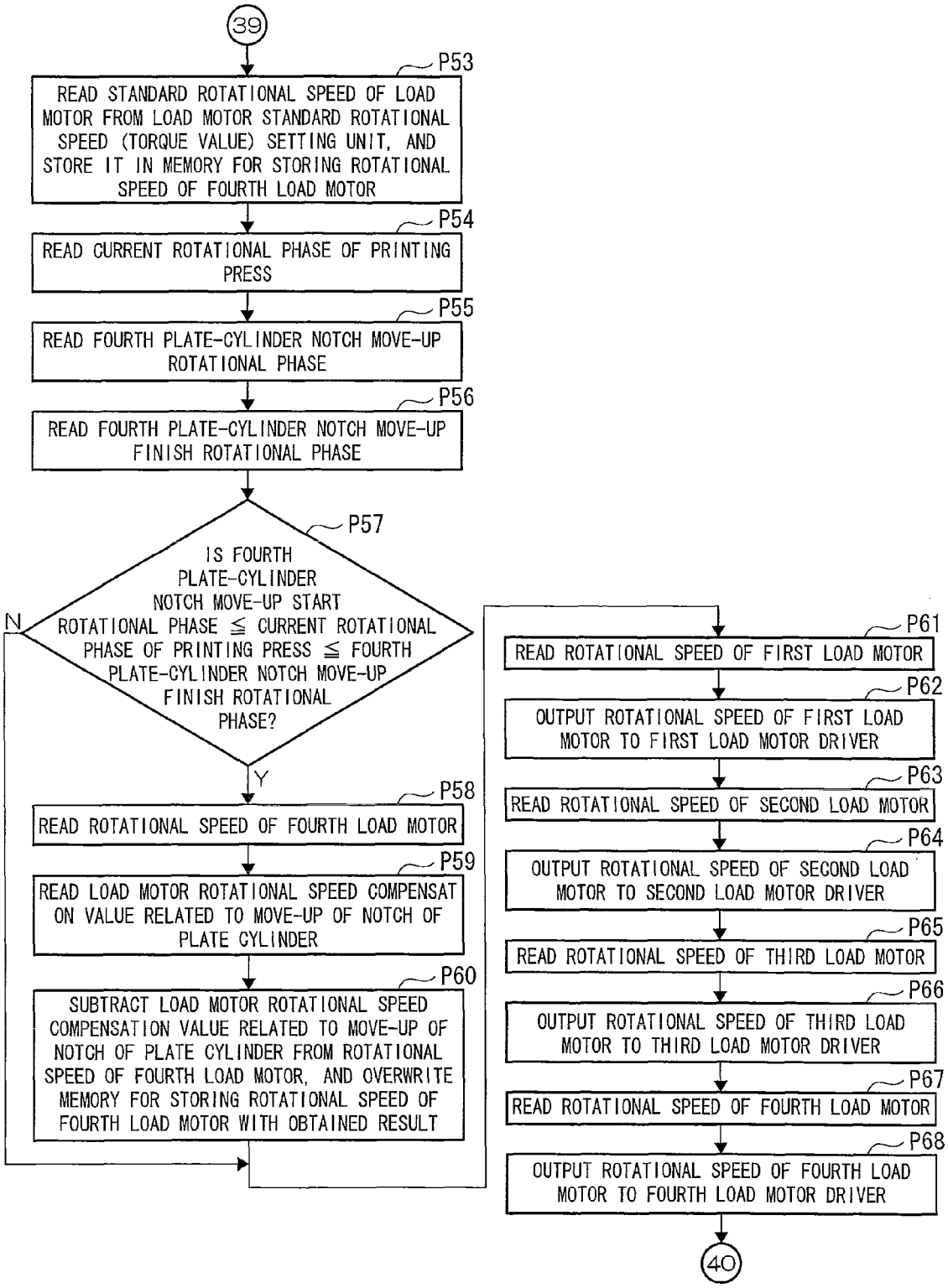
FIG. 17C is an operational flowchart of the drive controller of the printing press.
Figure 17D:
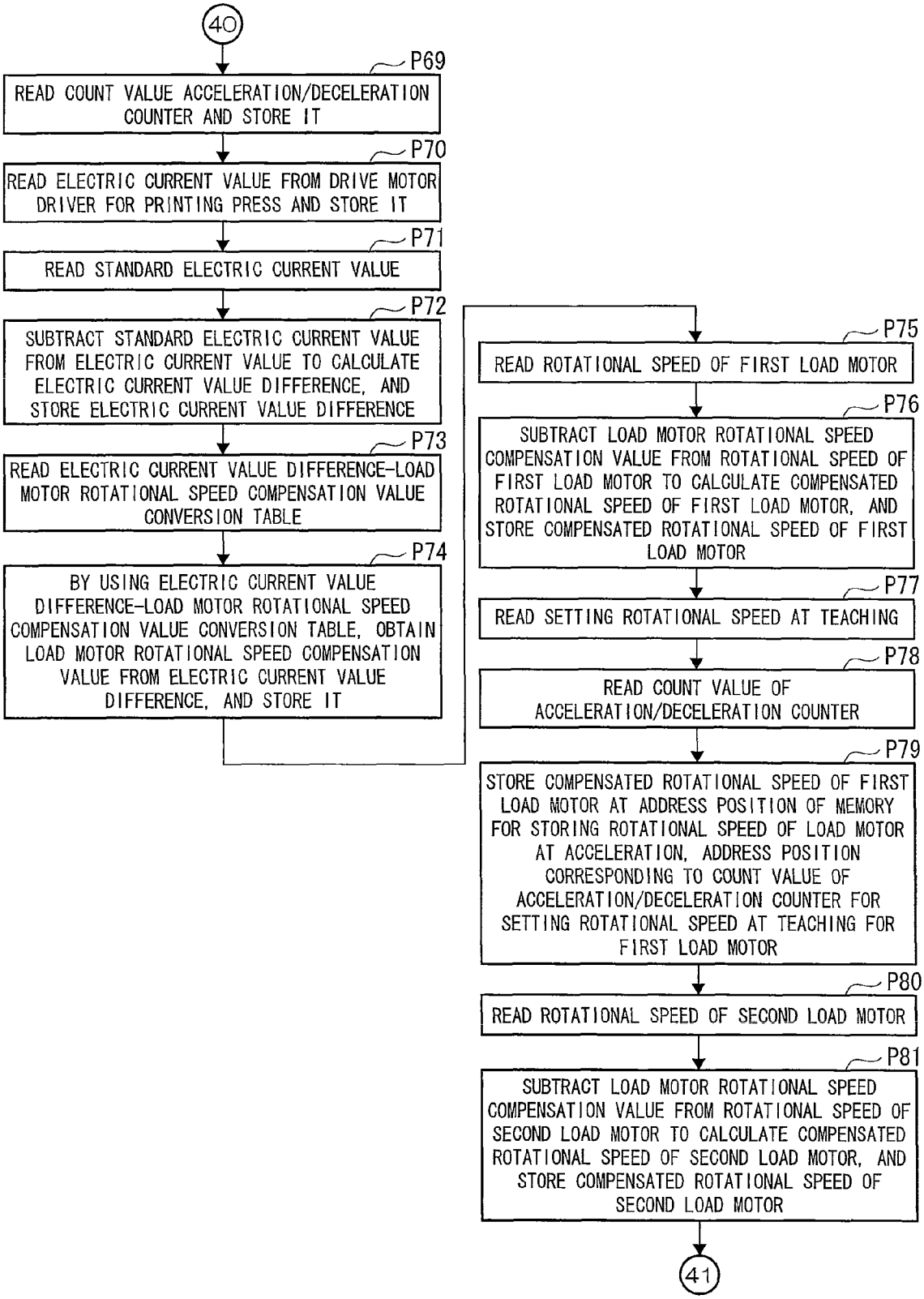
FIG. 17D is an operational flowchart of the drive controller of the printing press.
Figure 17E:
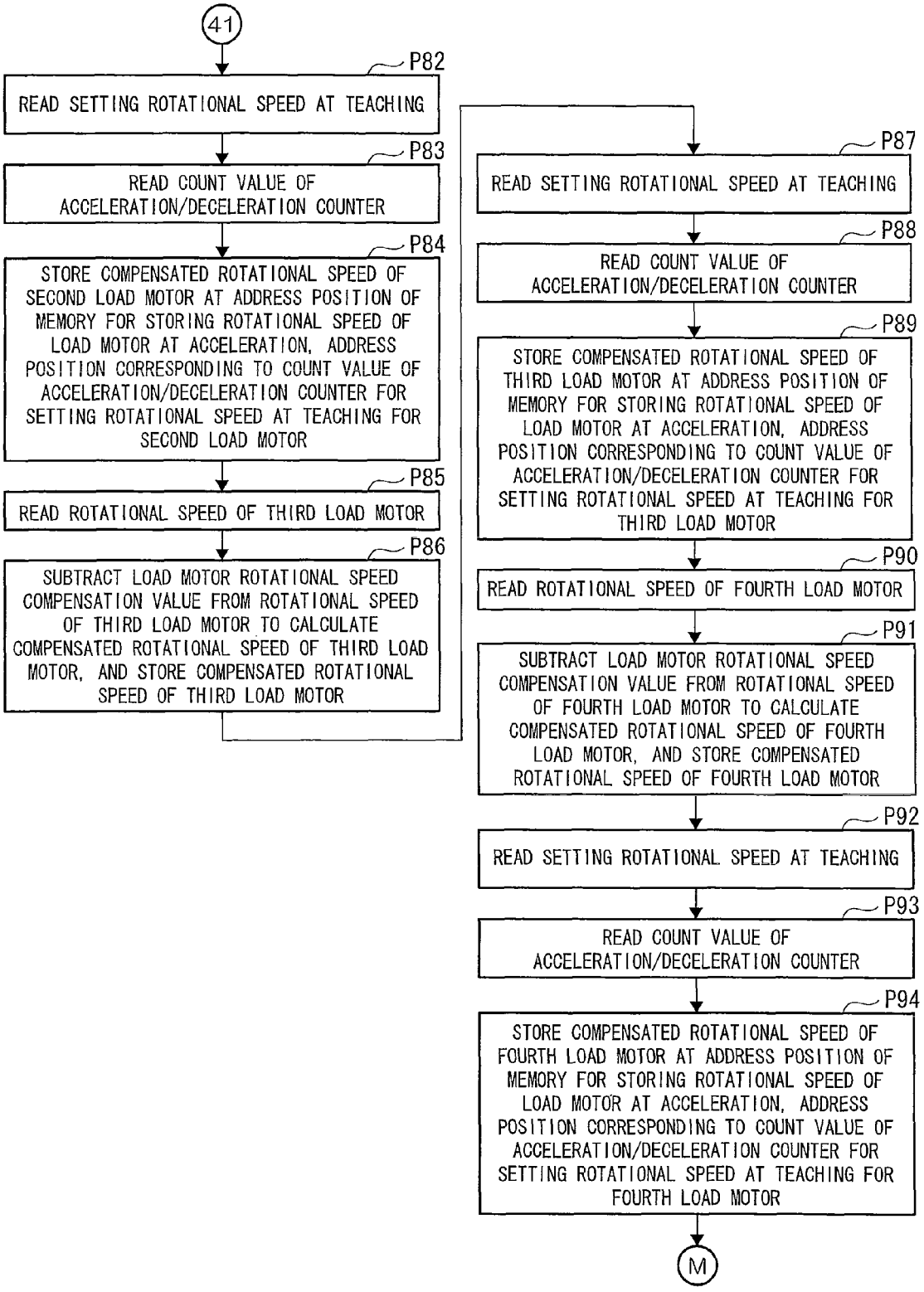
FIG. 17E is an operational flowchart of the drive controller of the printing press.
Figure 18:
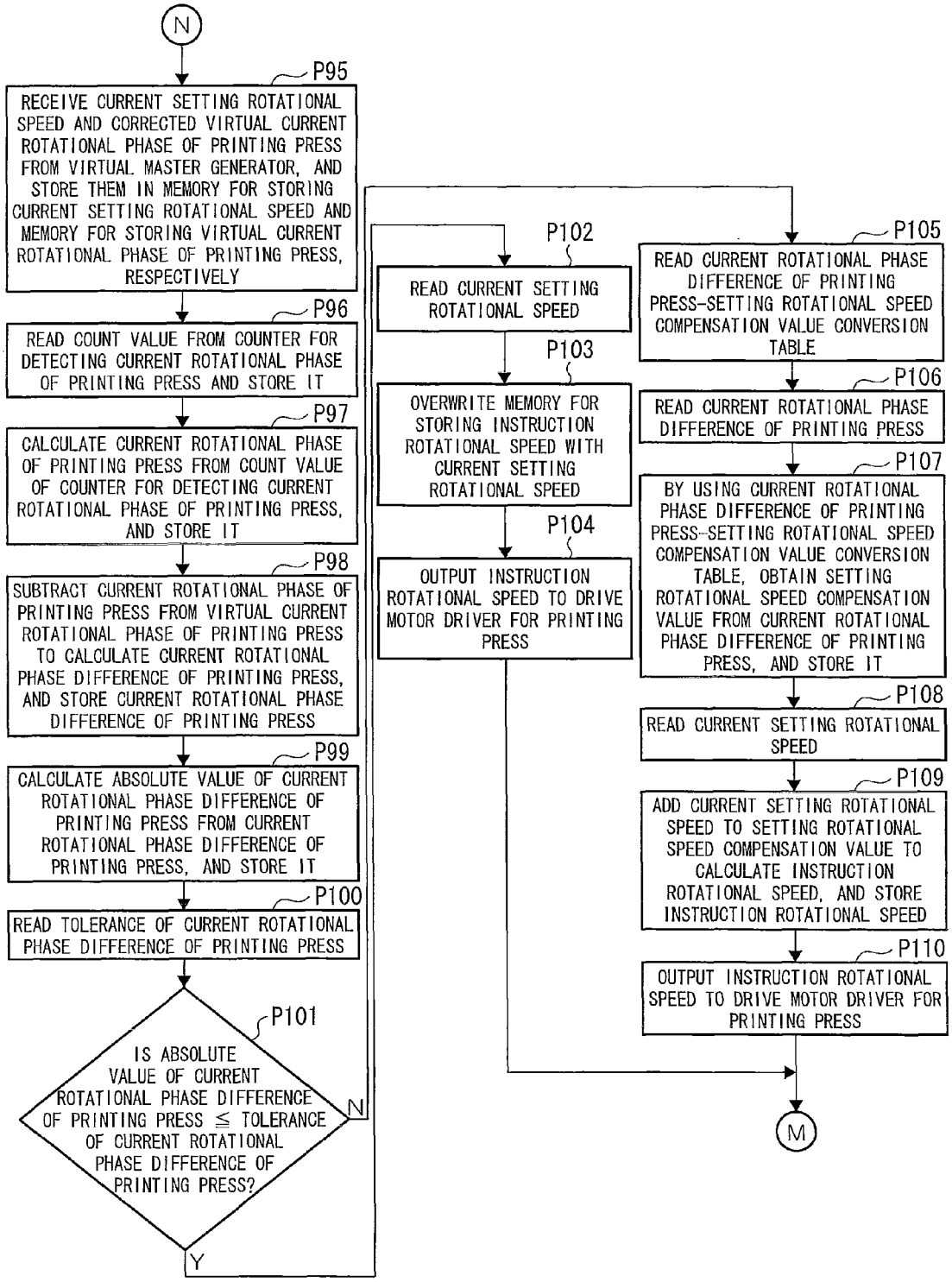
FIG. 18 is an operational flowchart of the drive controller of the printing press.
Figure 19A:
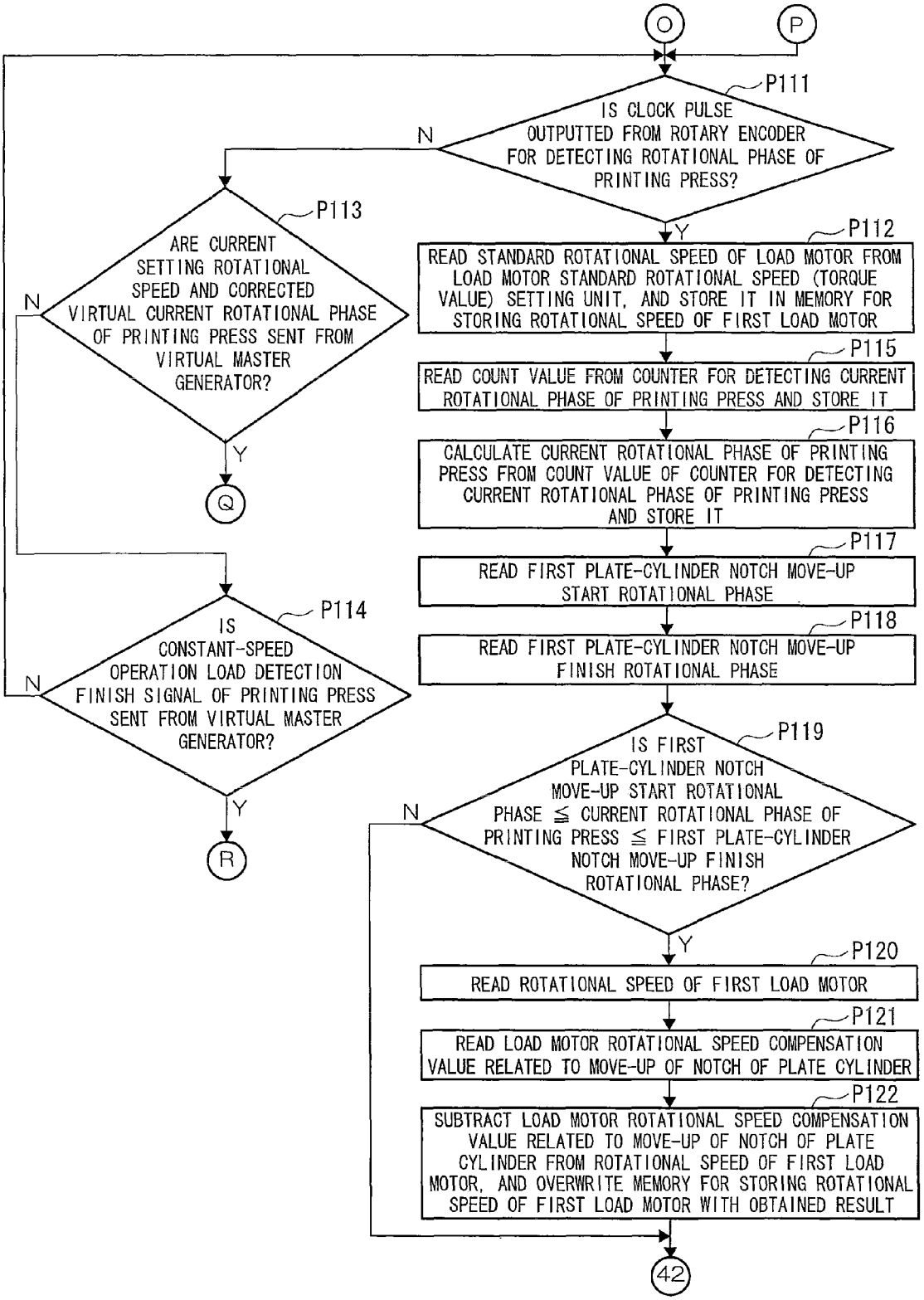
FIG. 19A is an operational flowchart of the drive controller of the printing press.
Figure 19B:
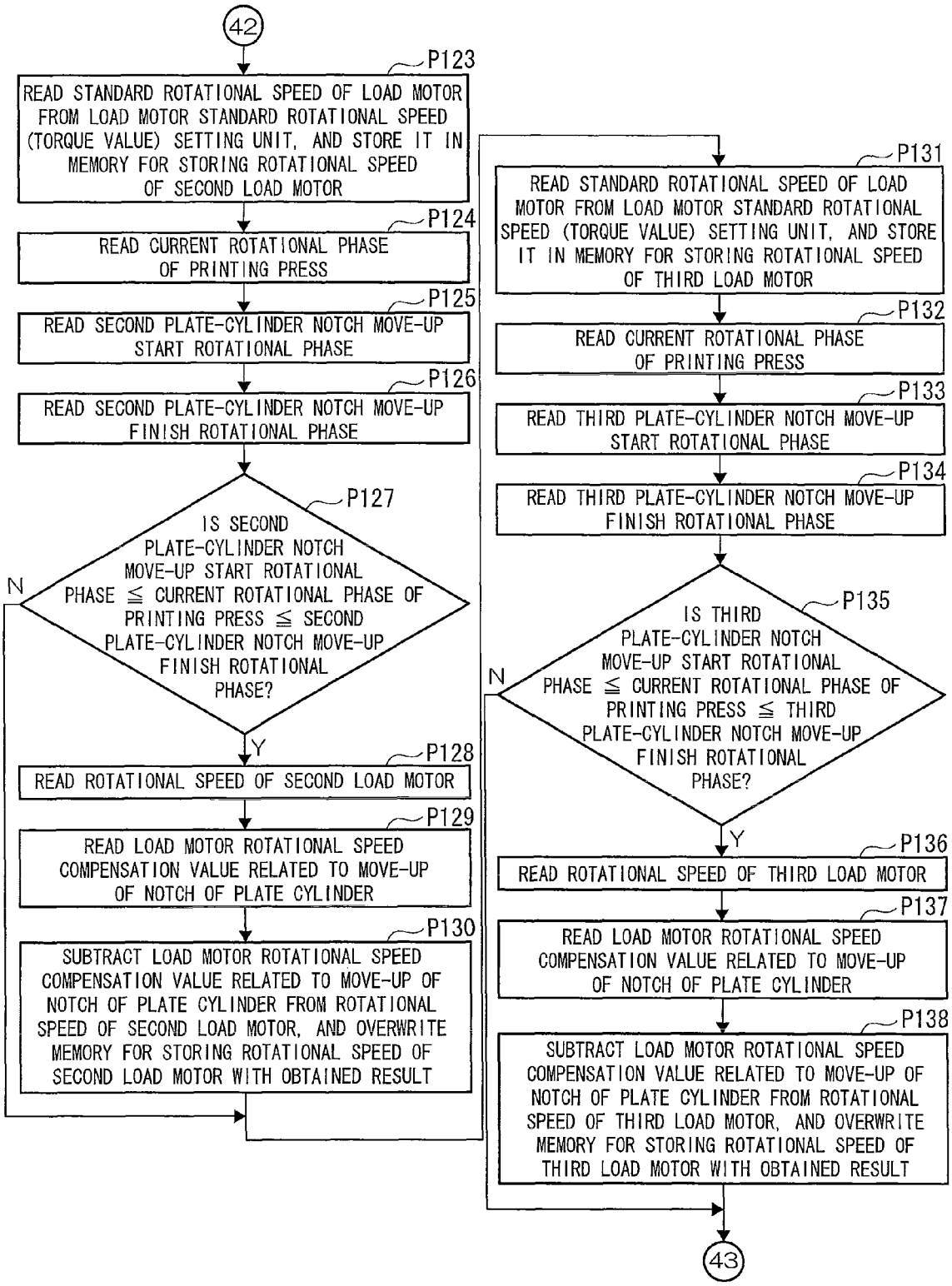
FIG. 19B is an operational flowchart of the drive controller of the printing press.
Figure 19C:
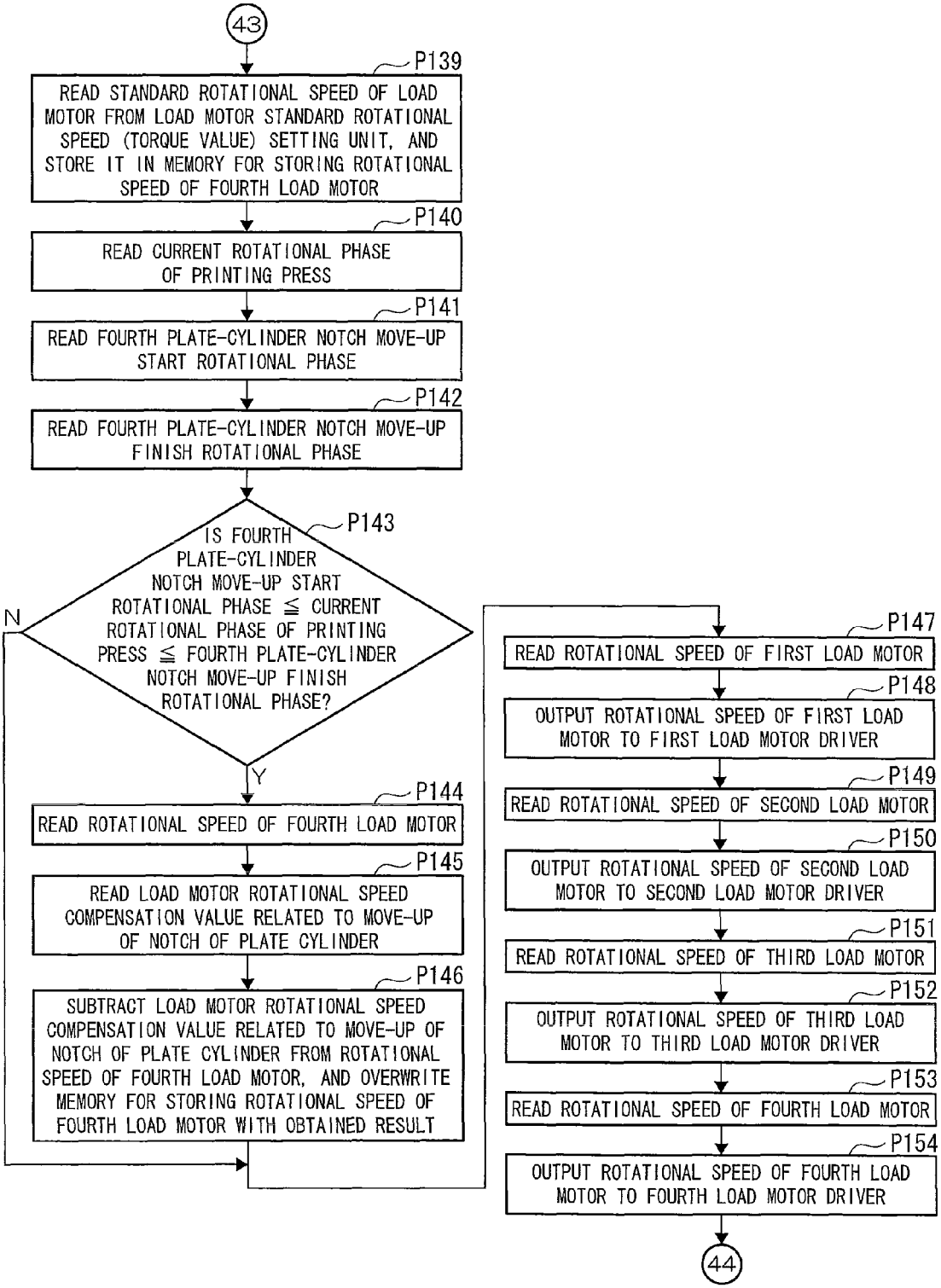
FIG. 19C is an operational flowchart of the drive controller of the printing press.
Figure 19D:
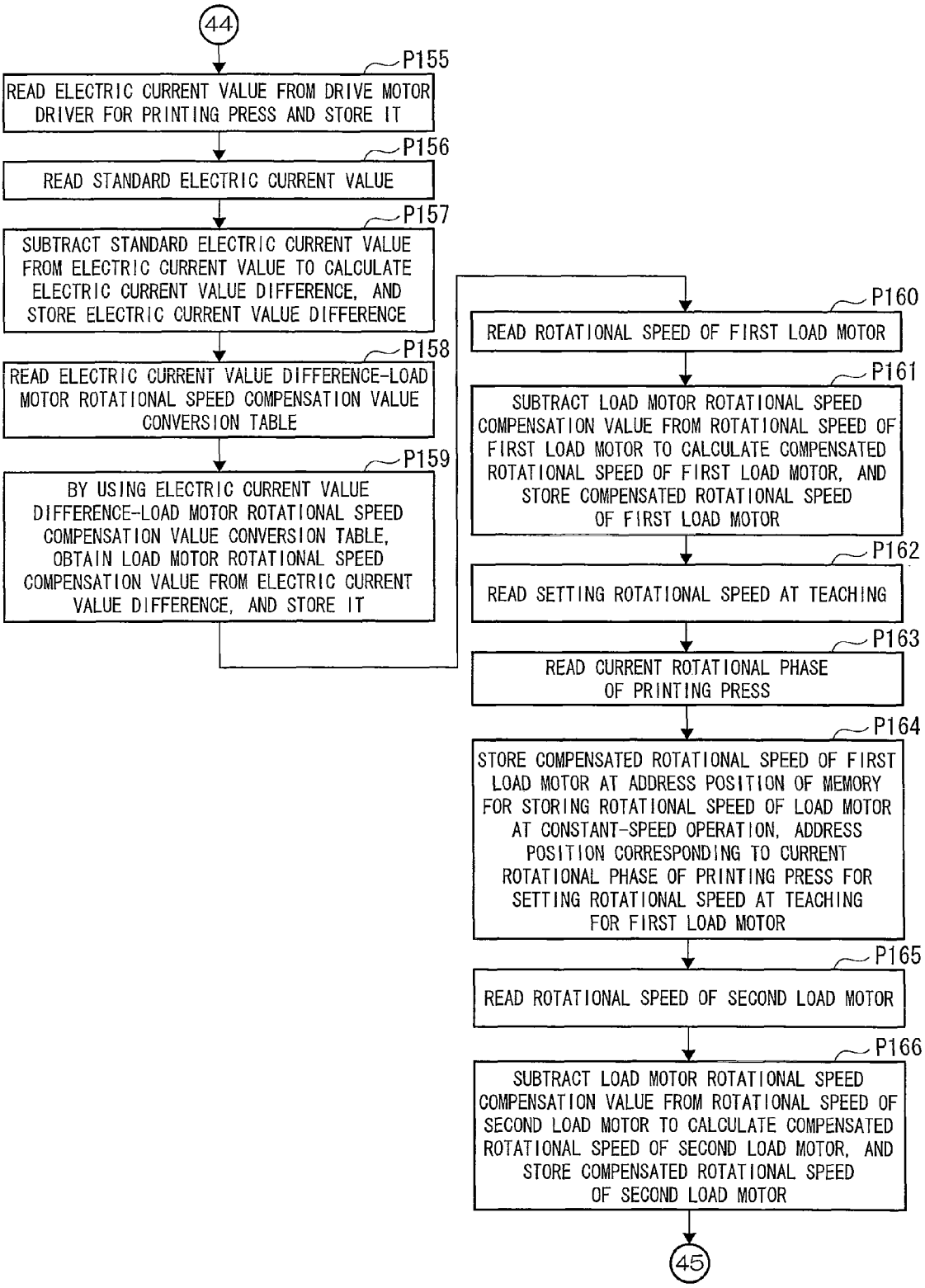
FIG. 19D is an operational flowchart of the drive controller of the printing press.
Figure 19E:
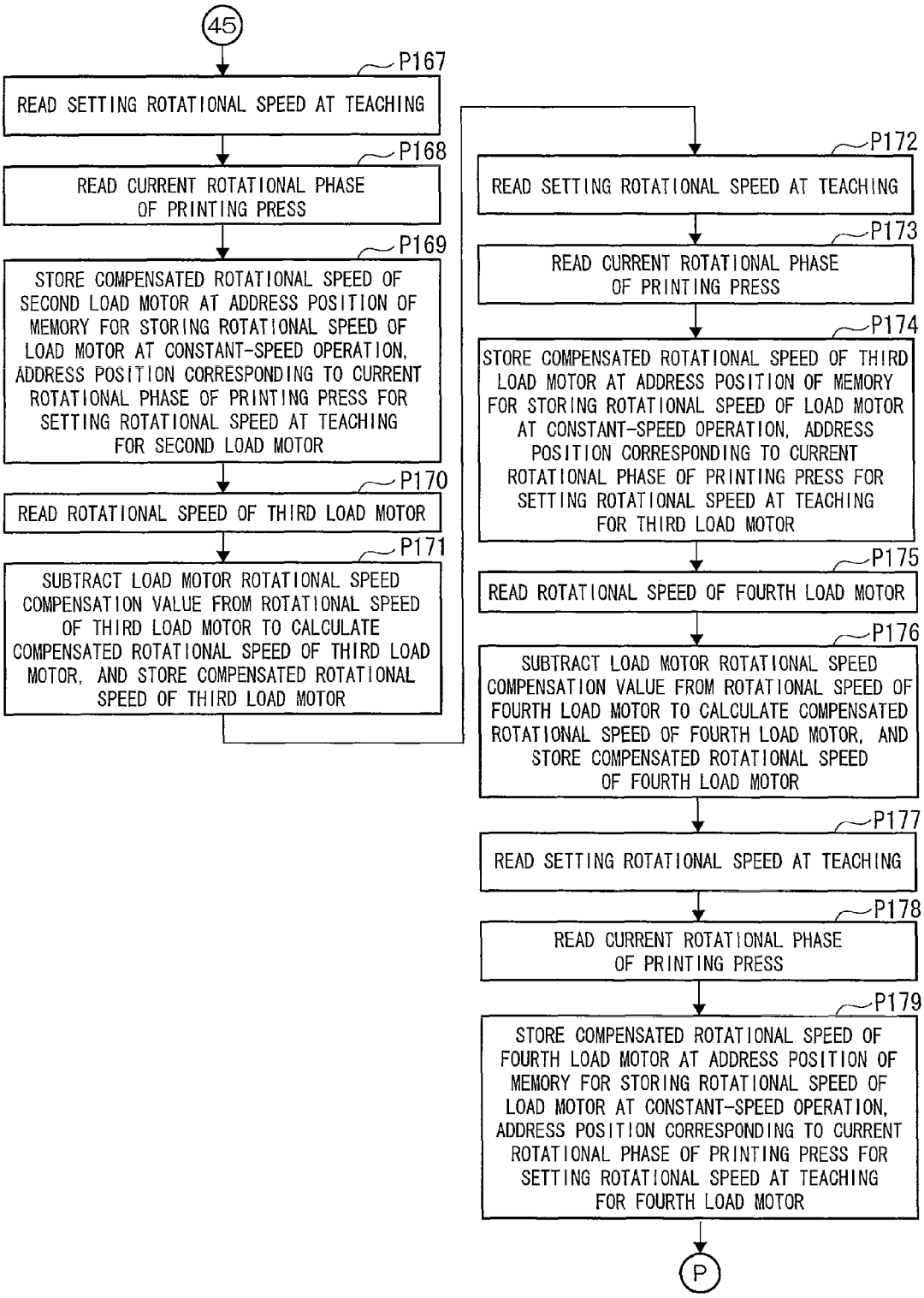
FIG. 19E is an operational flowchart of the drive controller of the printing press.
Figure 20:
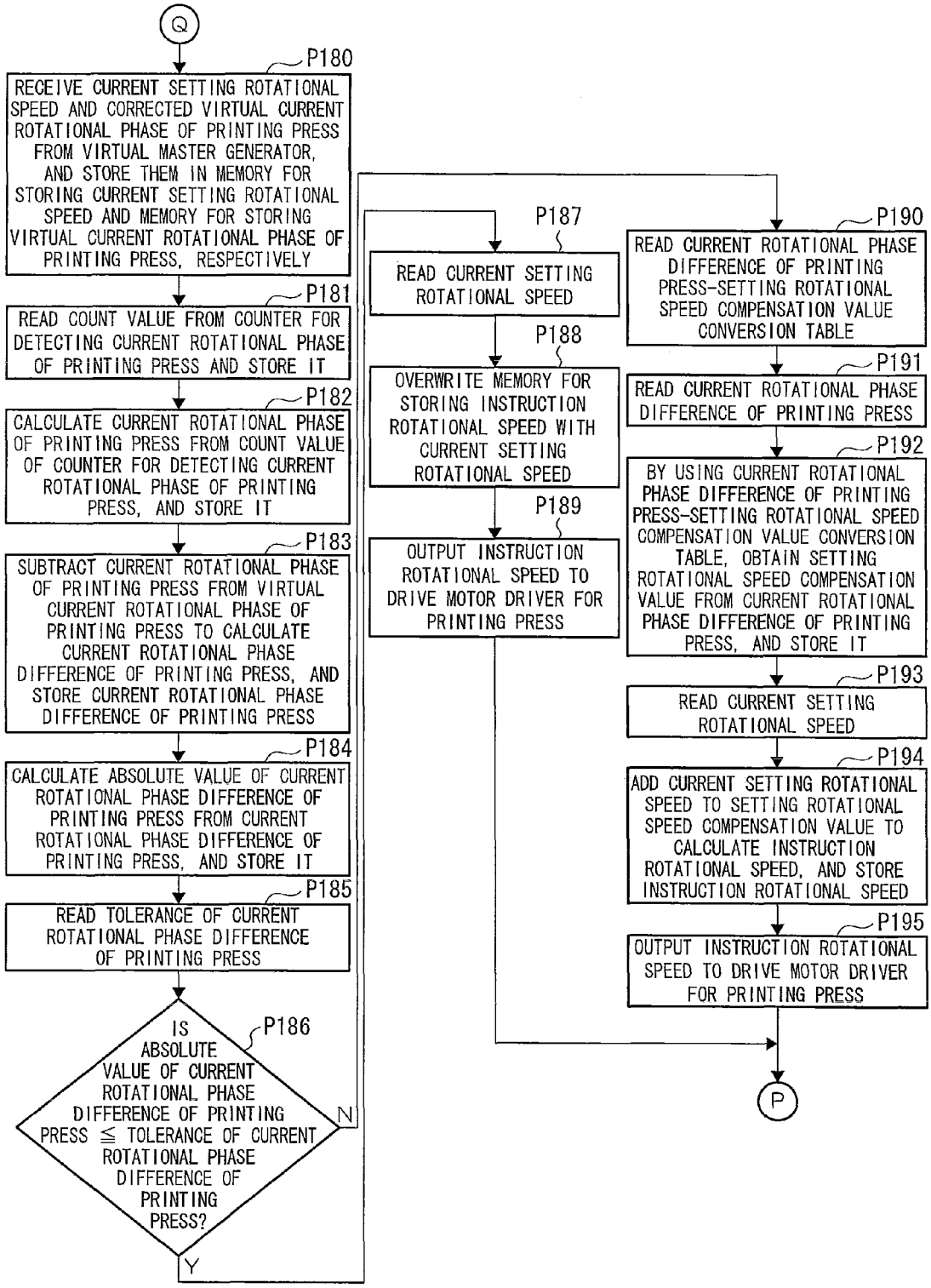
FIG. 20 is an operational flowchart of the drive controller of the printing press.
Figure 21A:
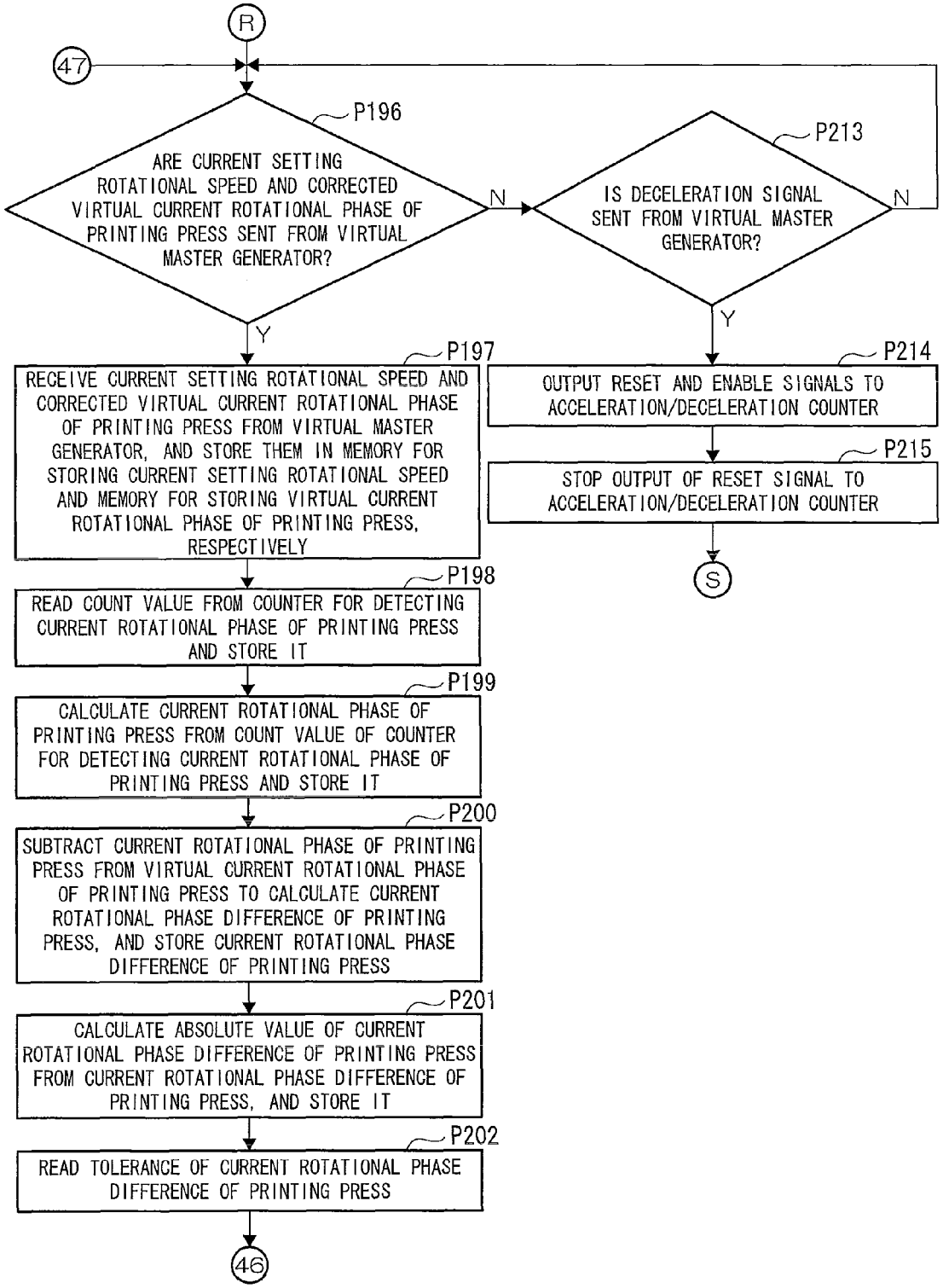
FIG. 21A is an operational flowchart of the drive controller of the printing press.
Figure 21B:
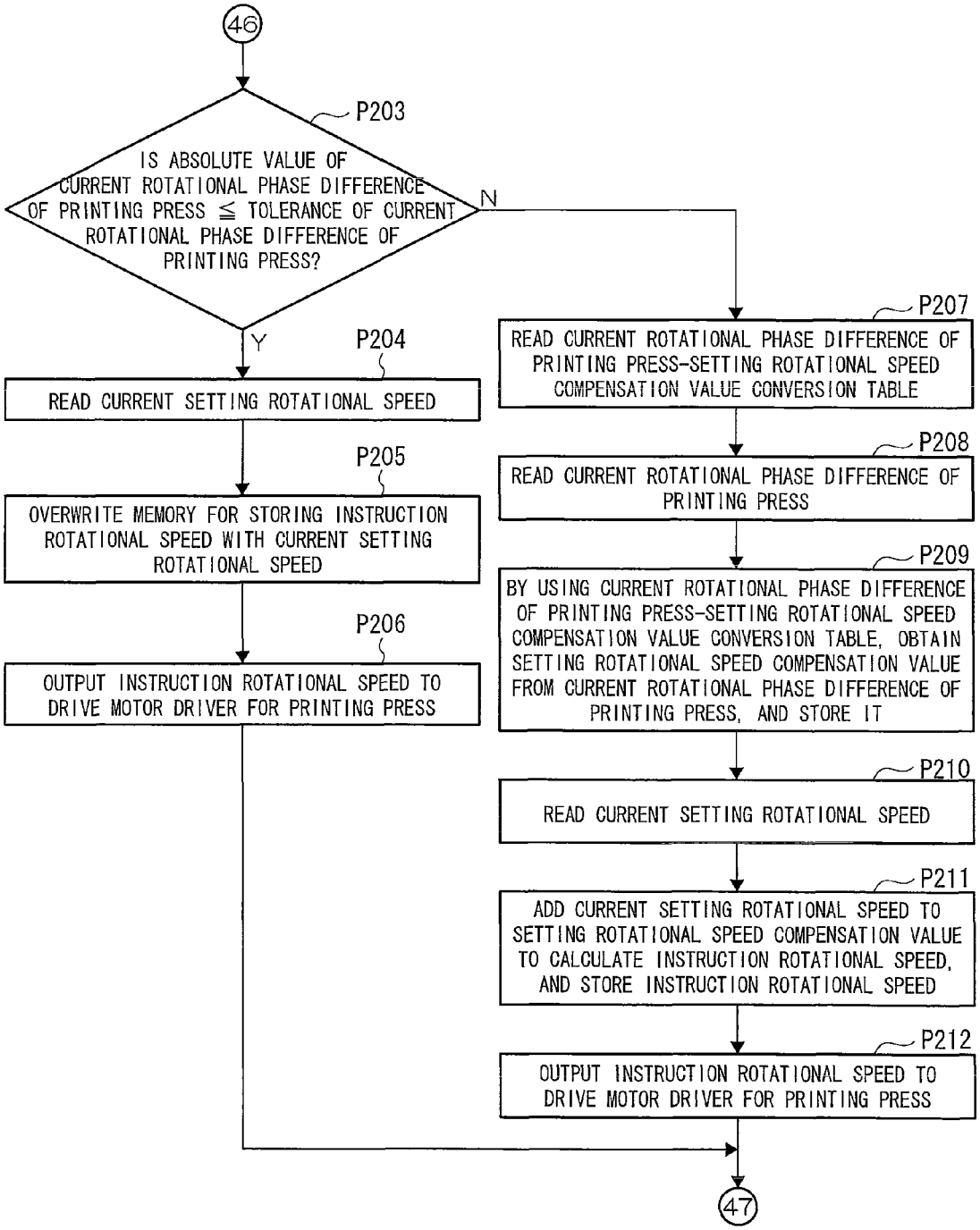
FIG. 21B is an operational flowchart of the drive controller of the printing press.
Figure 22A:
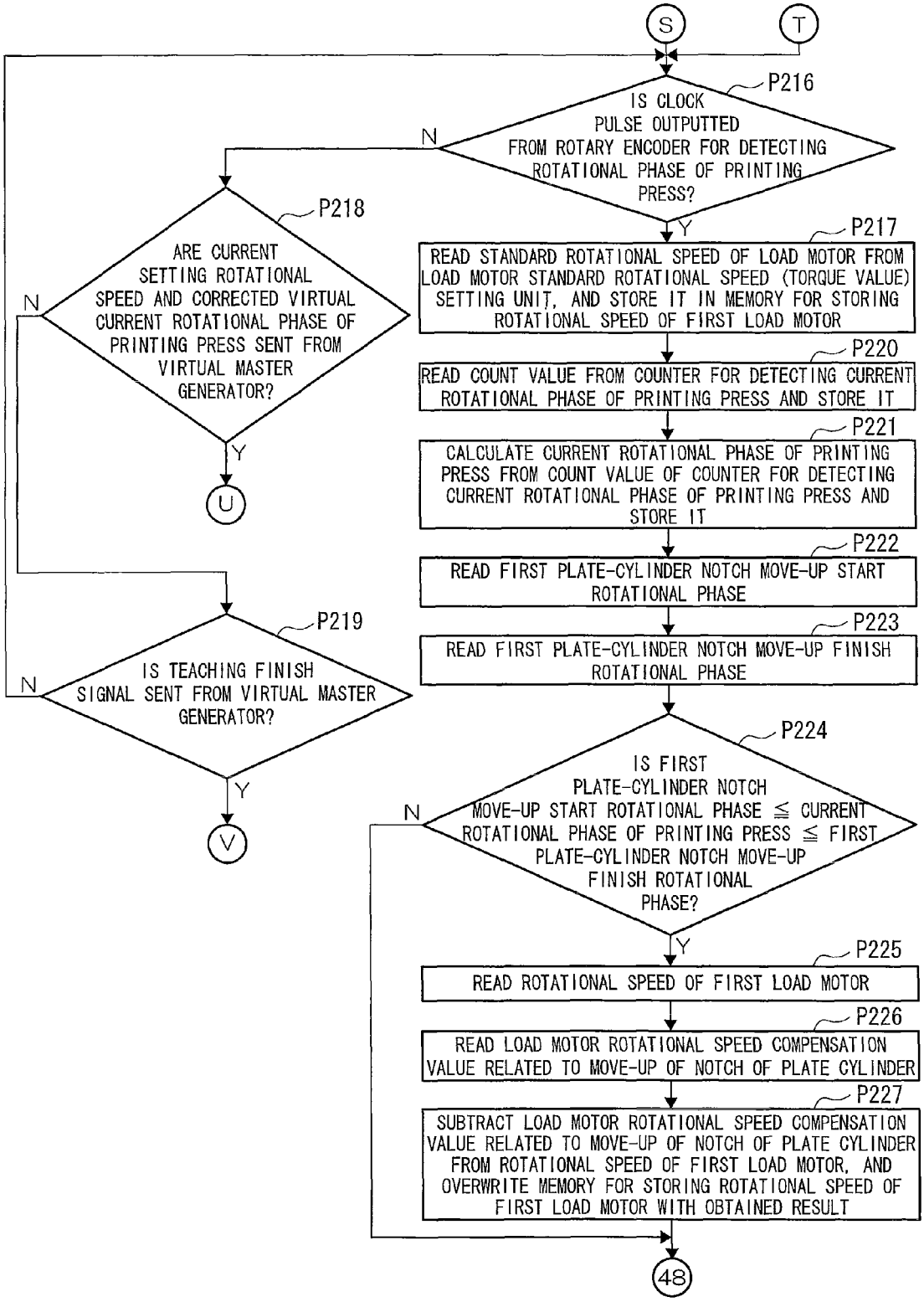
FIG. 22A is an operational flowchart of the drive controller of the printing press.
Figure 22B:
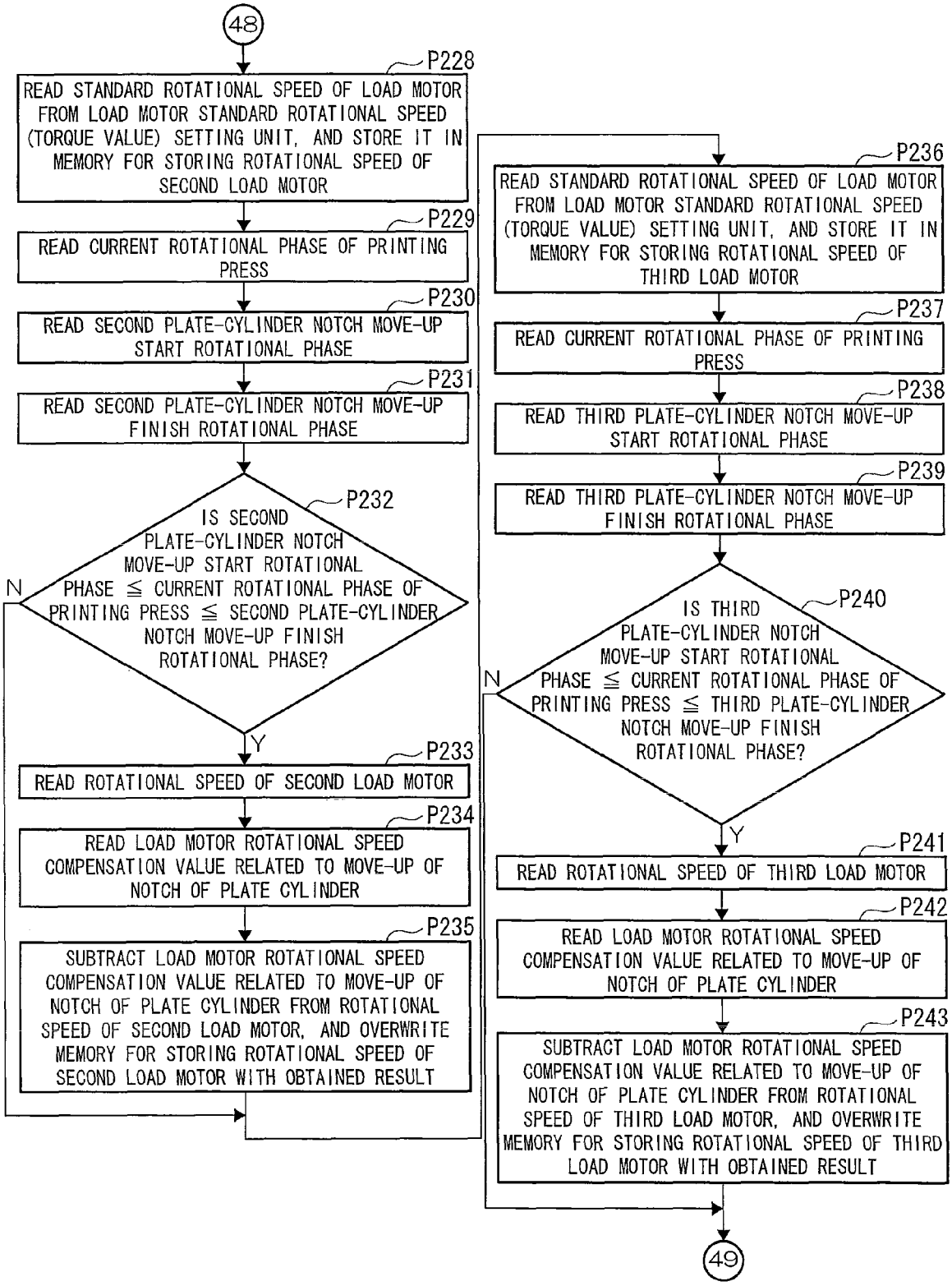
FIG. 22B is an operational flowchart of the drive controller of the printing press.
Figure 22C:
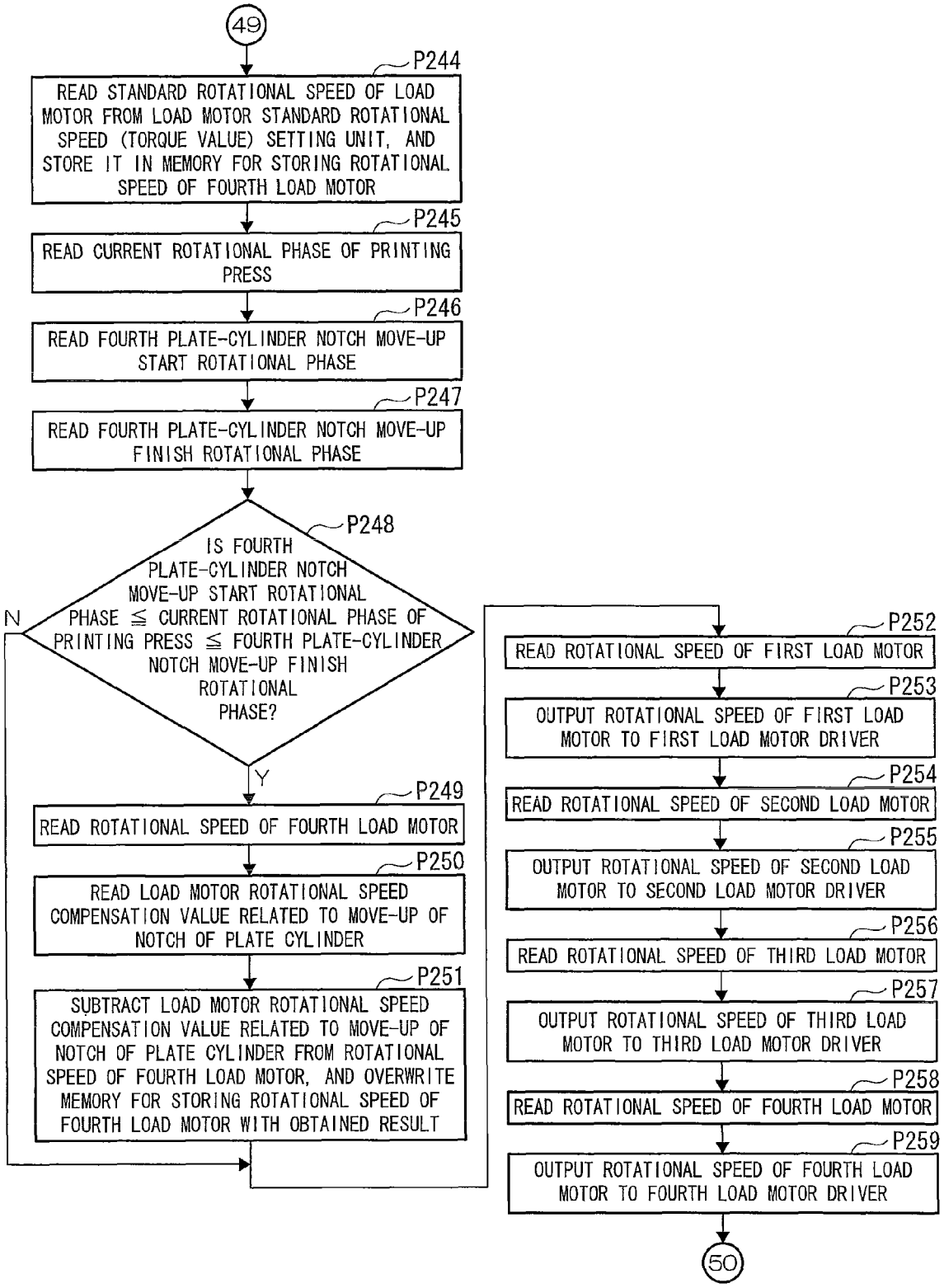
FIG. 22C is an operational flowchart of the drive controller of the printing press.
Figure 22D:
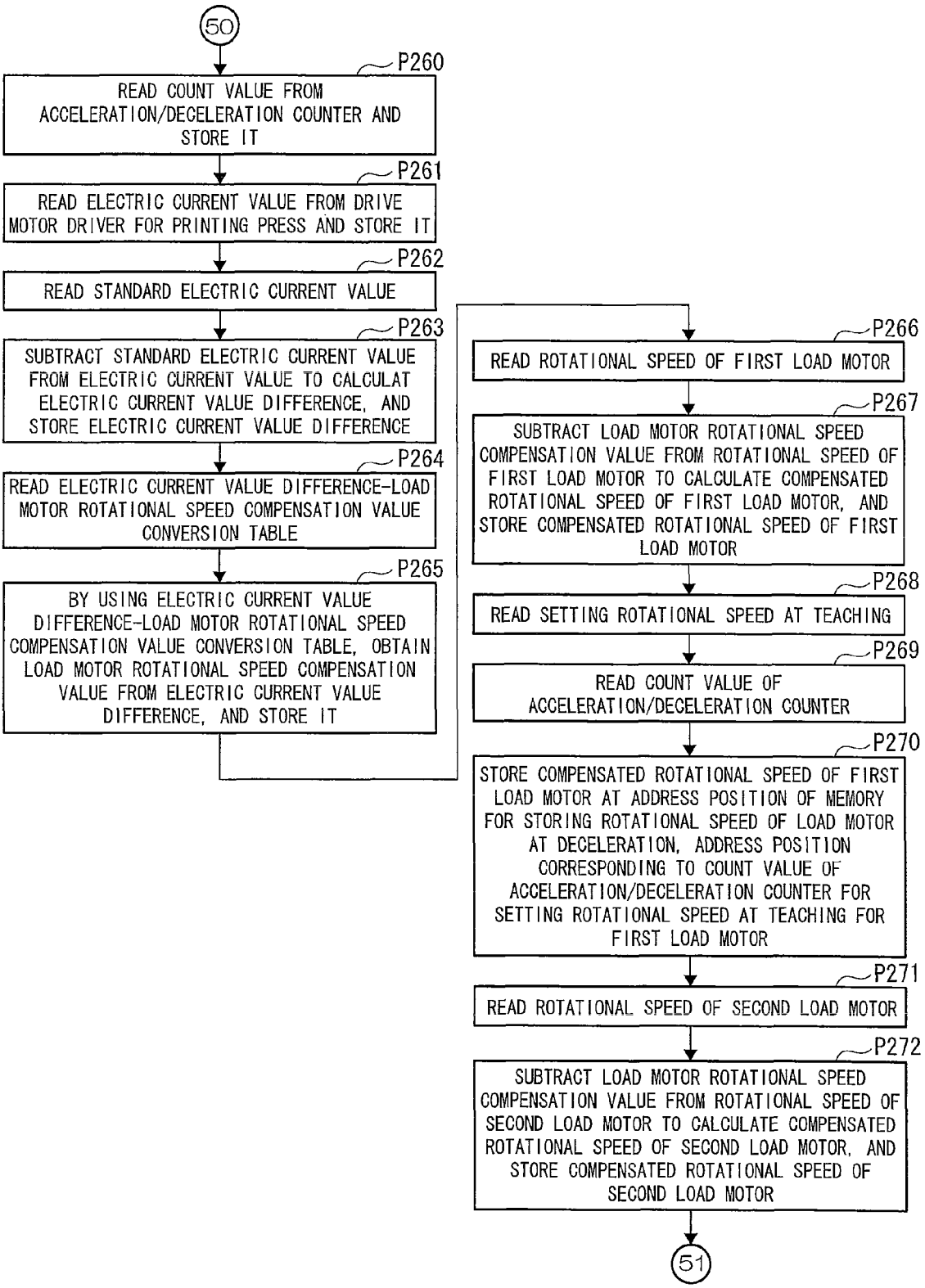
FIG. 22D is an operational flowchart of the drive controller of the printing press.
Figure 22E:
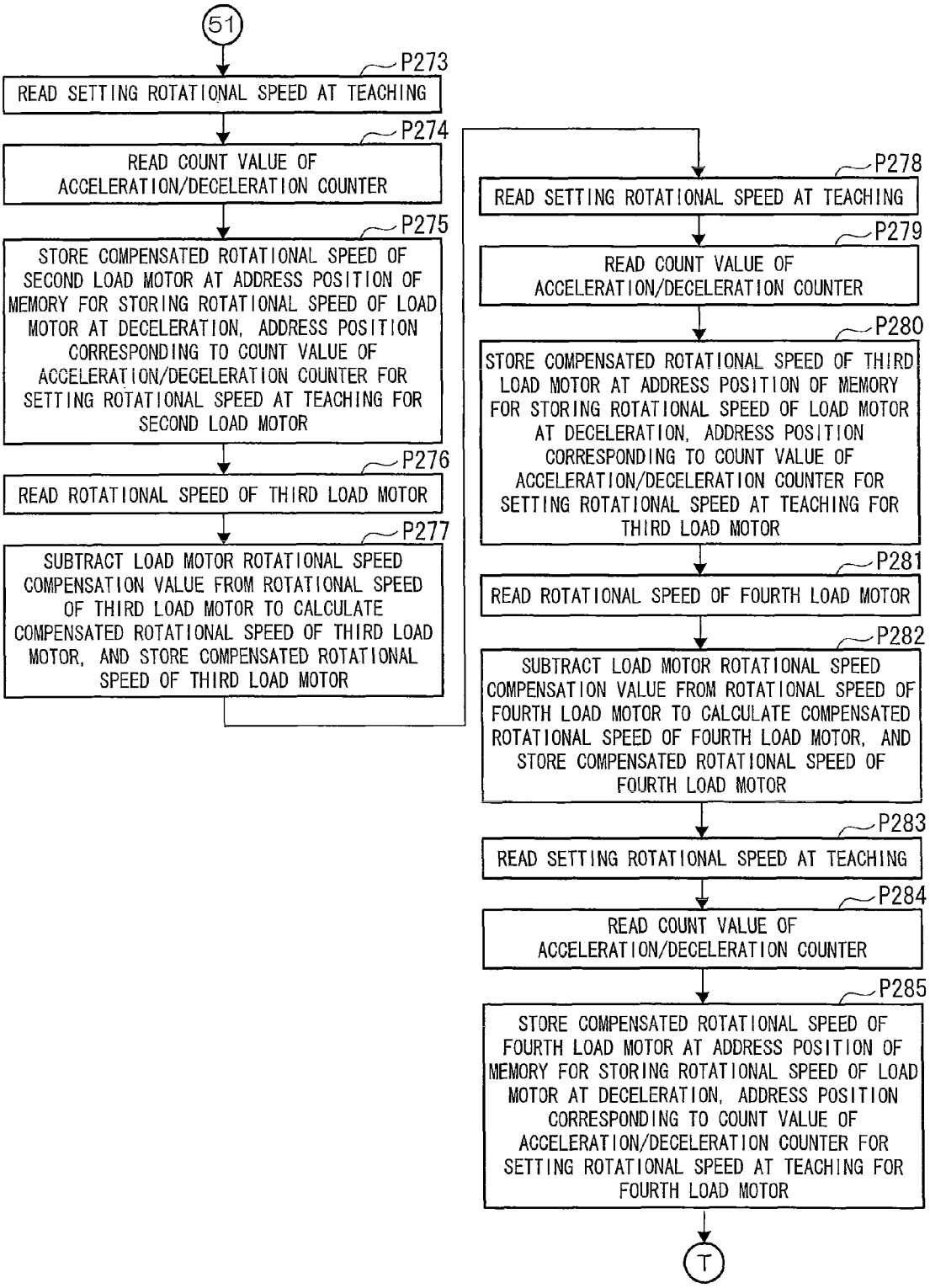
FIG. 22E is an operational flowchart of the drive controller of the printing press.
Figure 23:
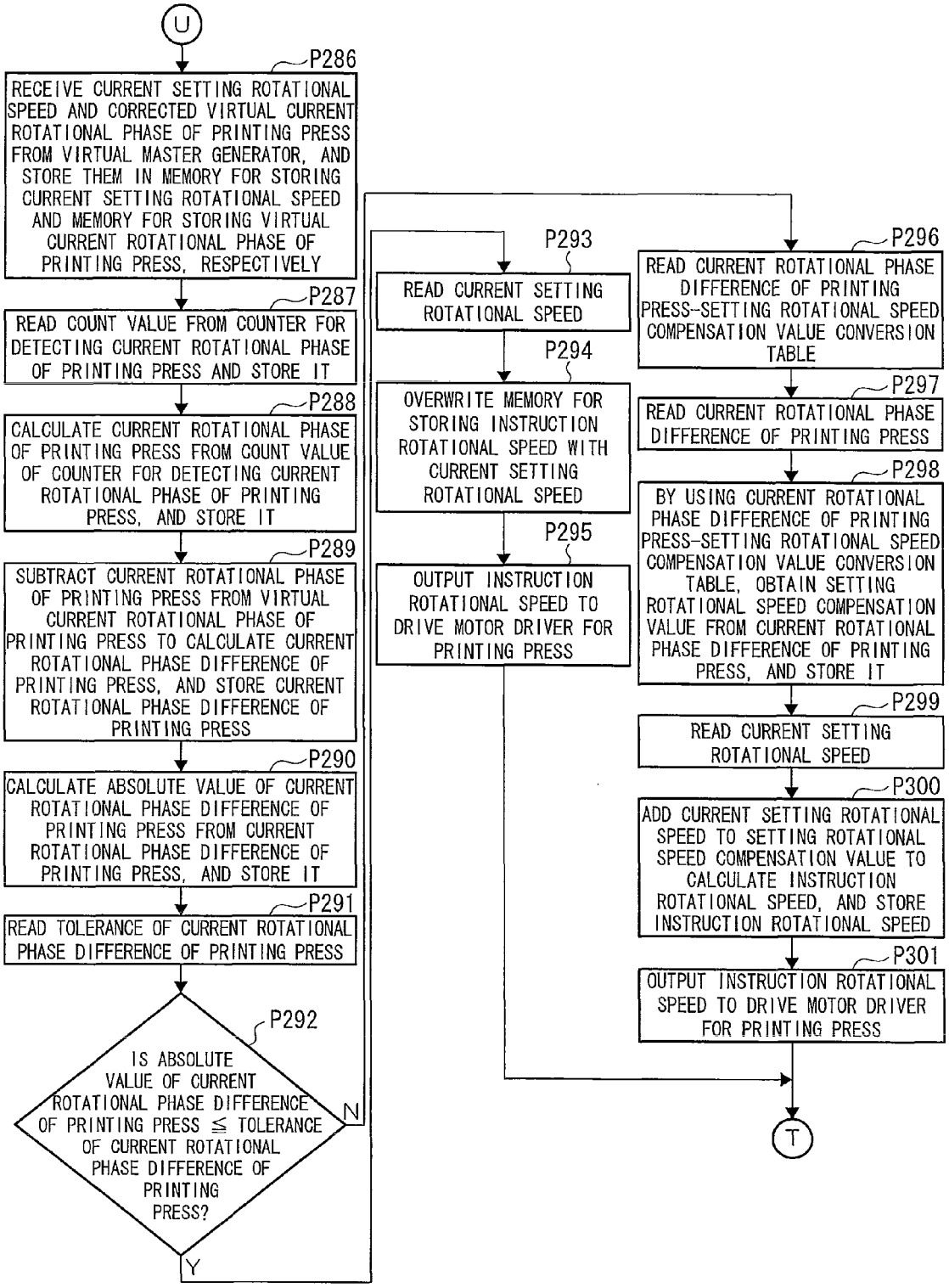
FIG. 23 is an operational flowchart of the drive controller of the printing press.
Figure 24A:
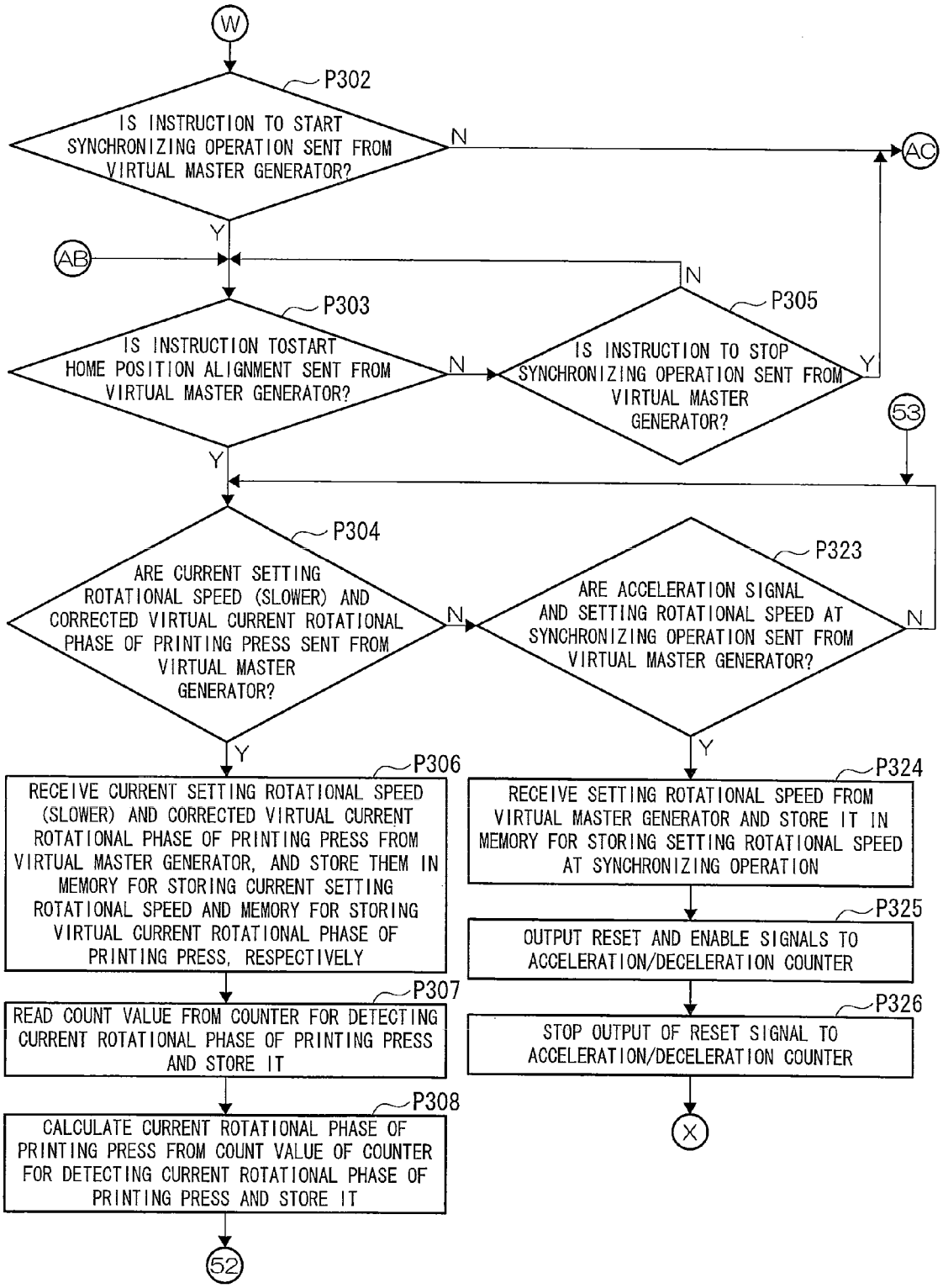
FIG. 24A is an operational flowchart of the drive controller of the printing press.
Figure 24B:
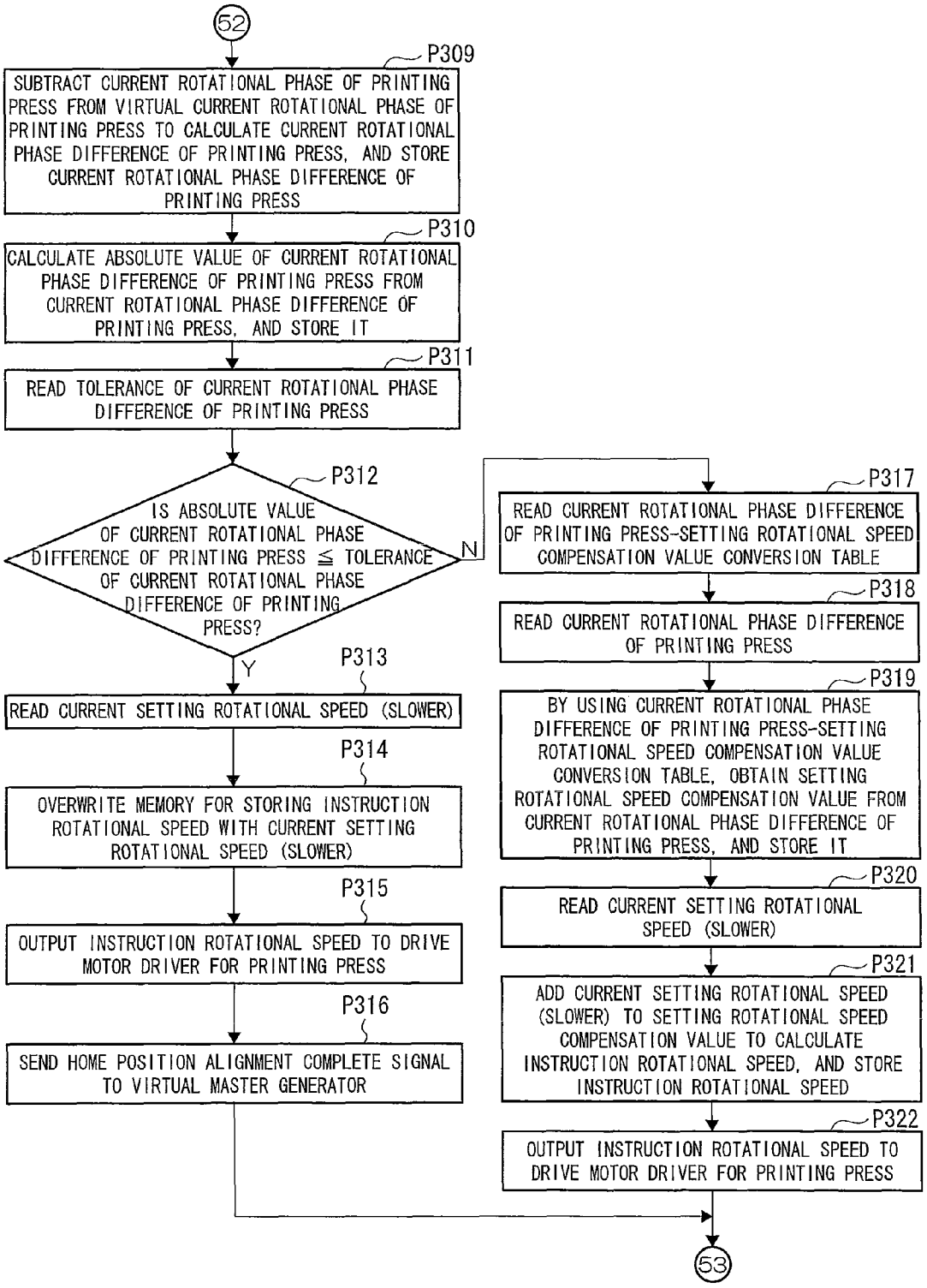
FIG. 24B is an operational flowchart of the drive controller of the printing press.
Figure 25A:
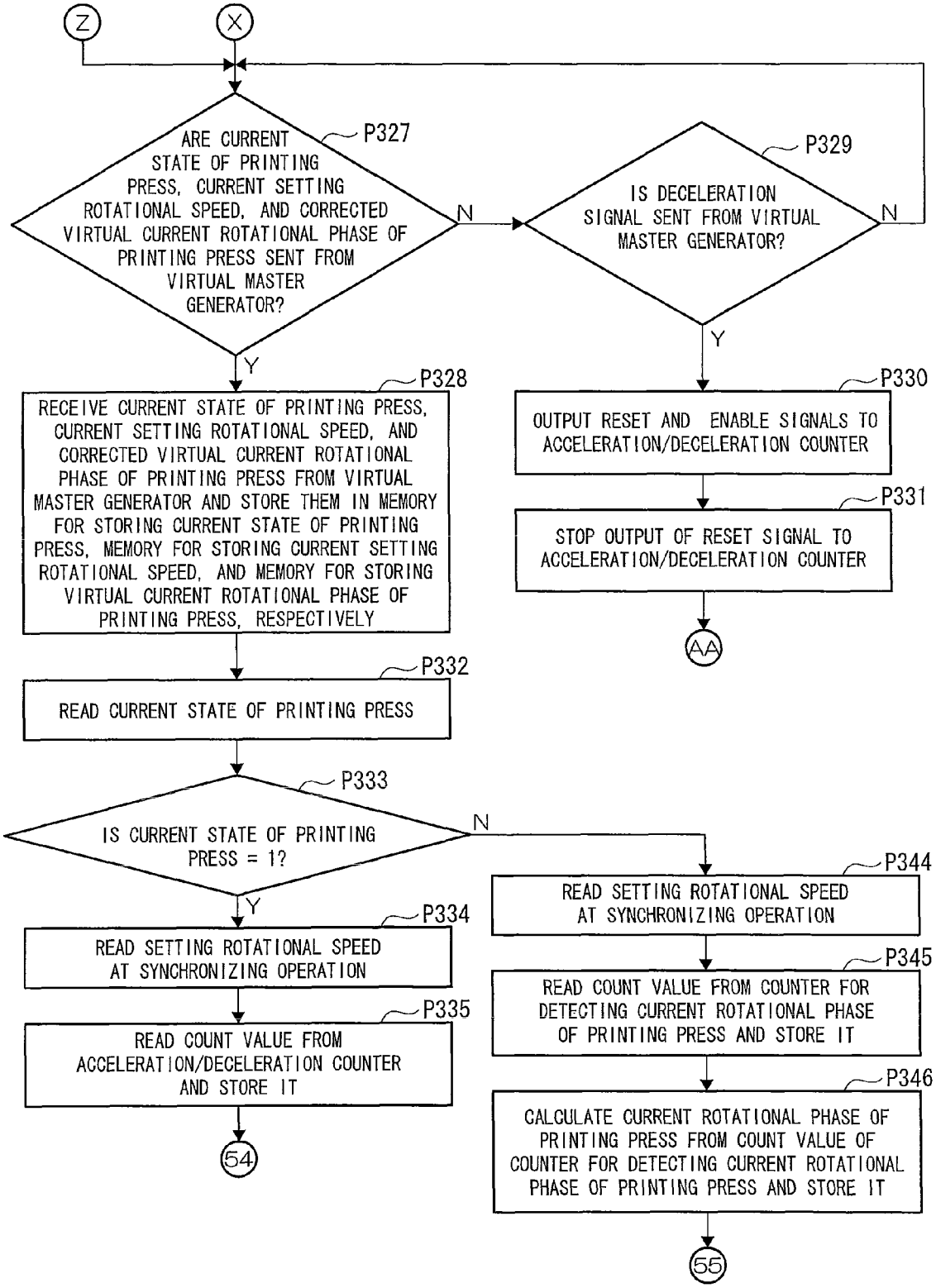
FIG. 25A is an operational flowchart of the drive controller of the printing press.
Figure 25B:
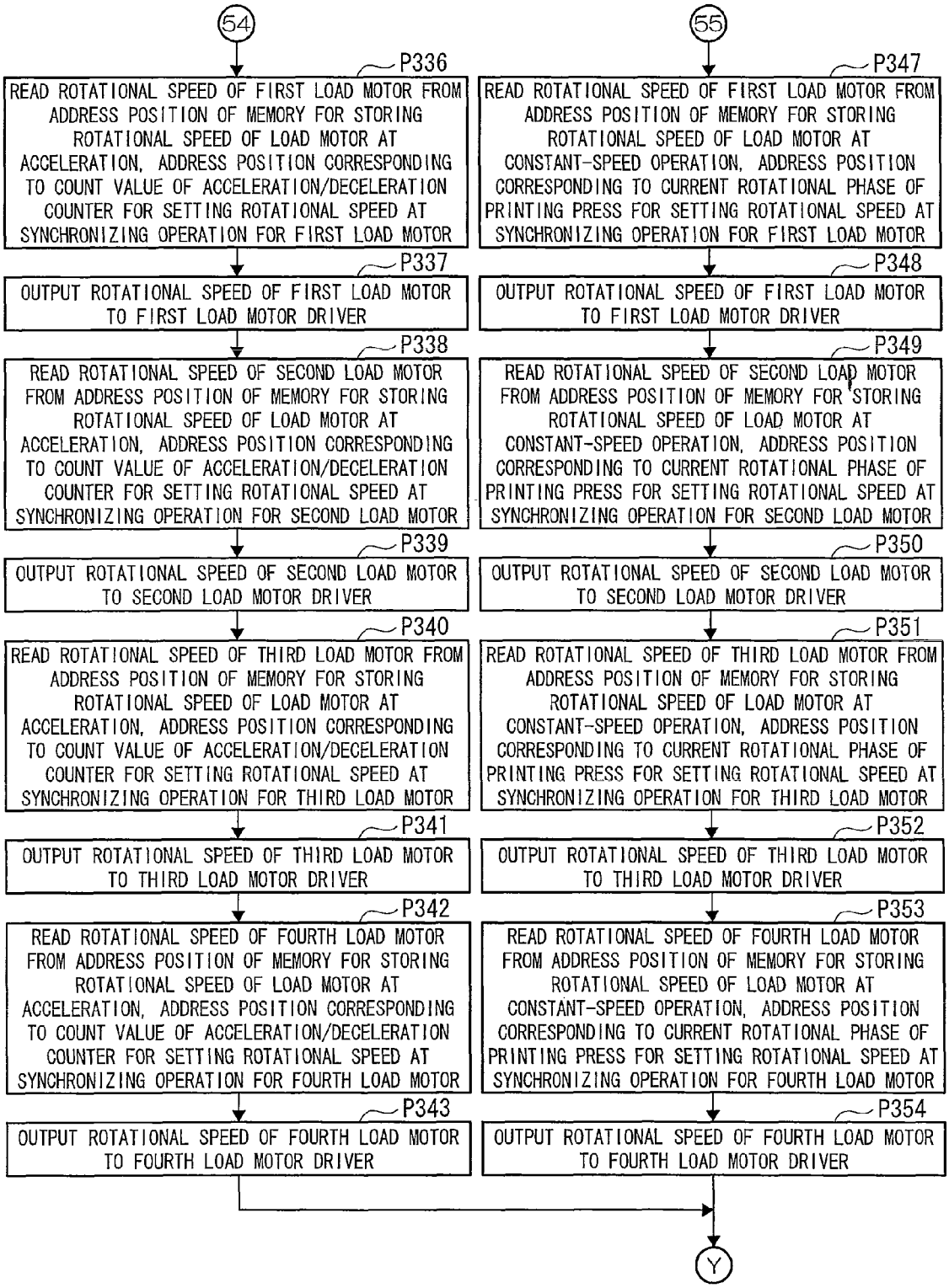
FIG. 25B is an operational flowchart of the drive controller of the printing press.
Figure 26:
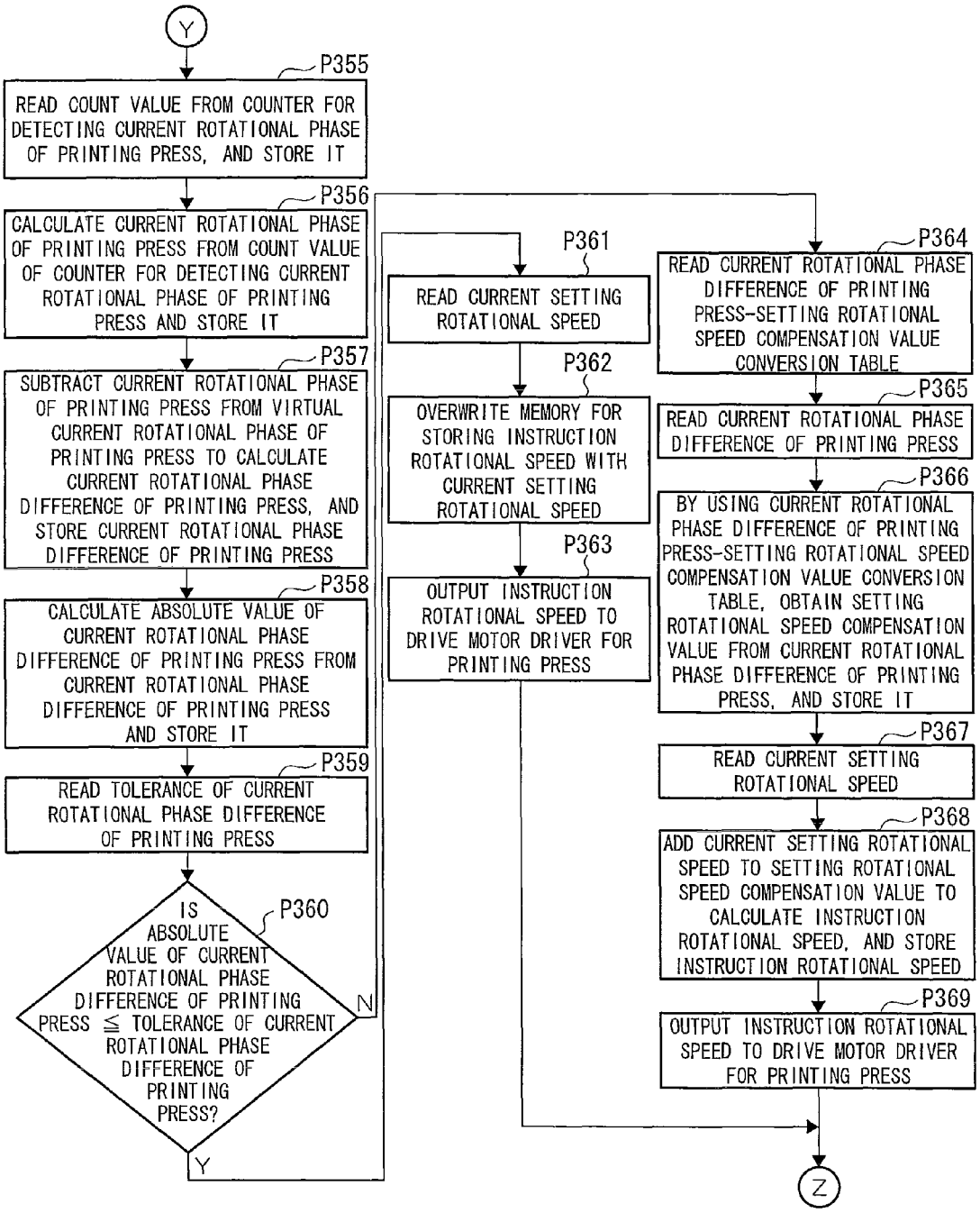
FIG. 26 is an operational flowchart of the drive controller of the printing press.
Figure 27A:
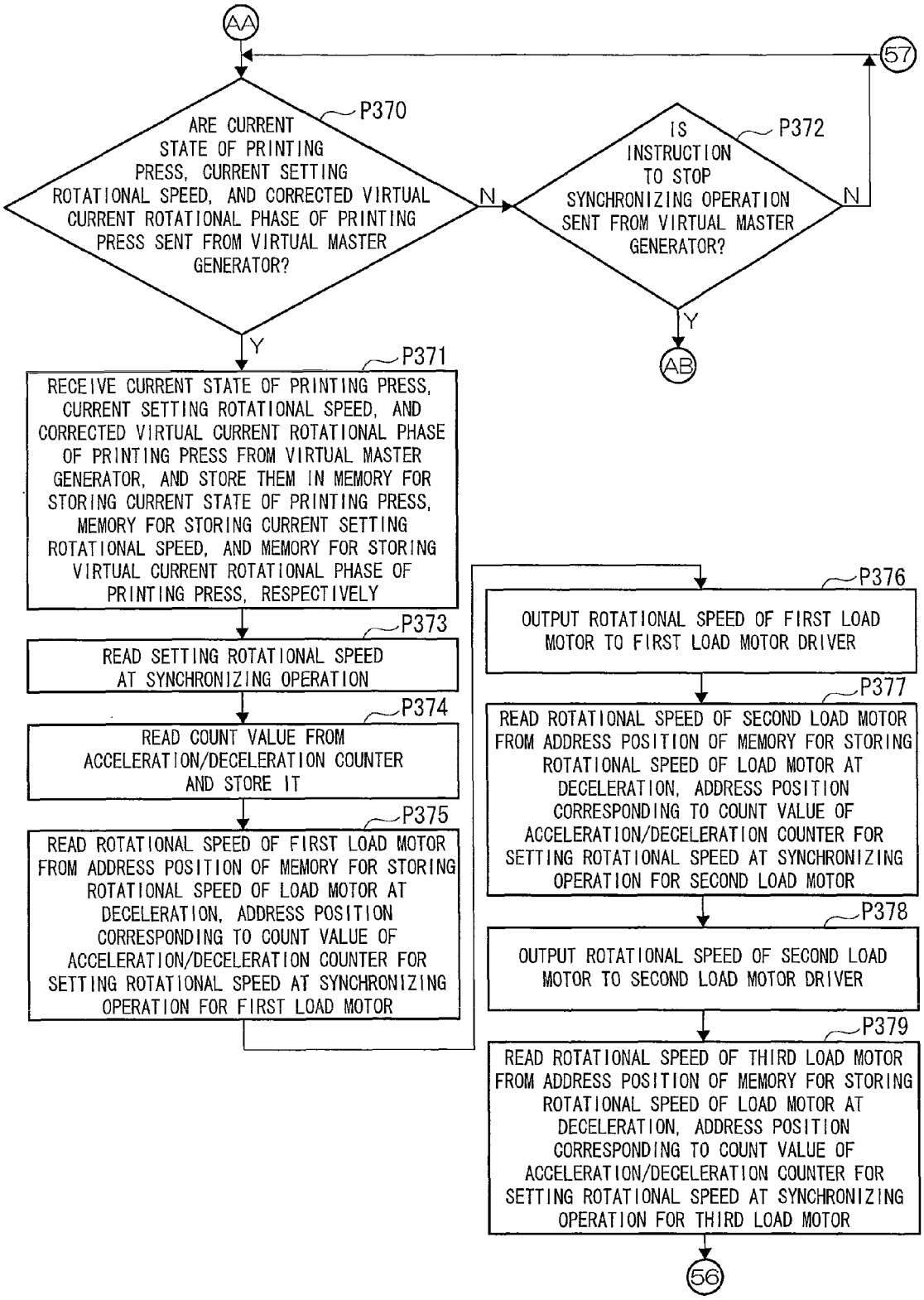
FIG. 27A is an operational flowchart of the drive controller of the printing press.
Figure 27B:
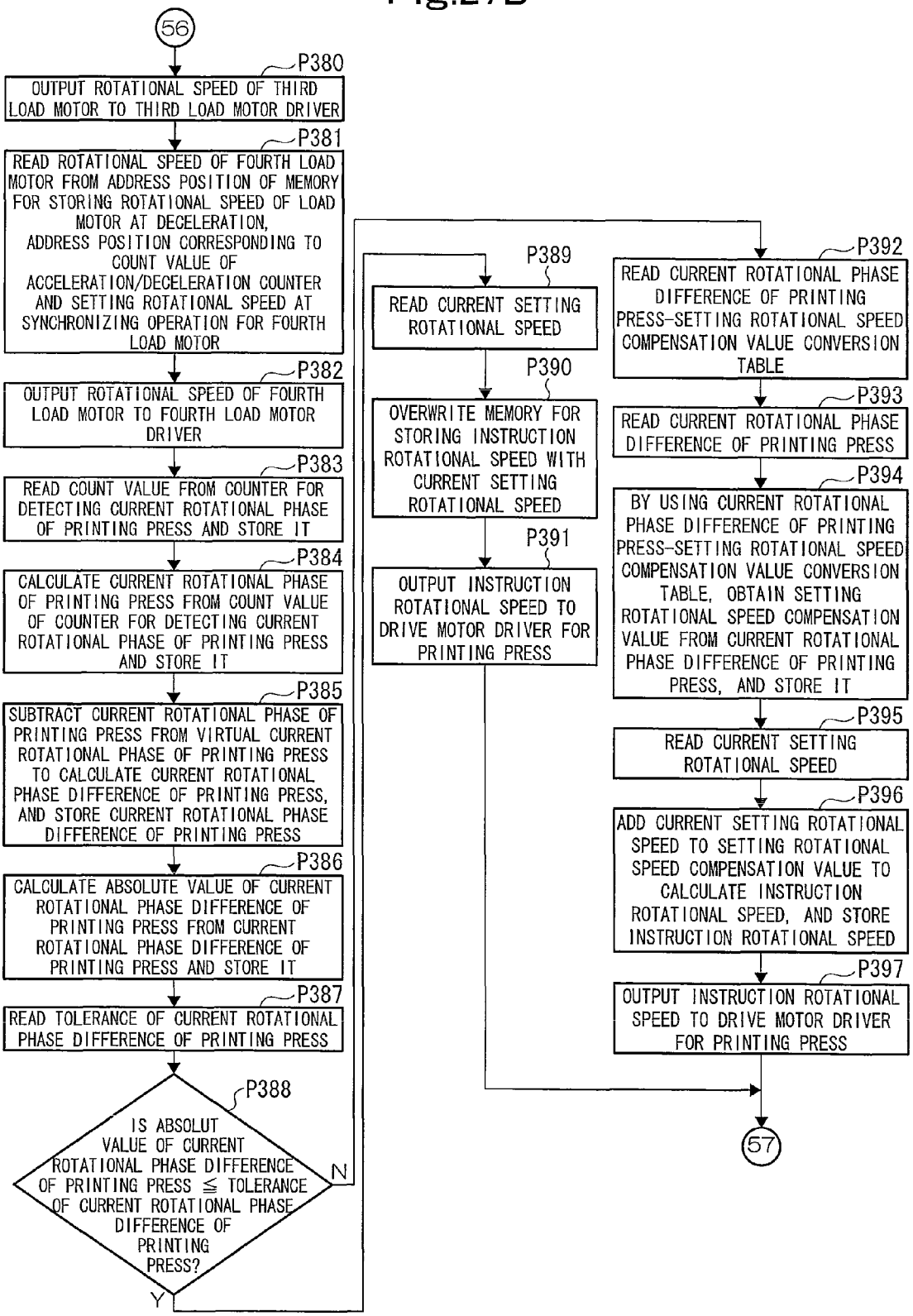
FIG. 27B is an operational flowchart of the drive controller of the printing press.
Figure 28:
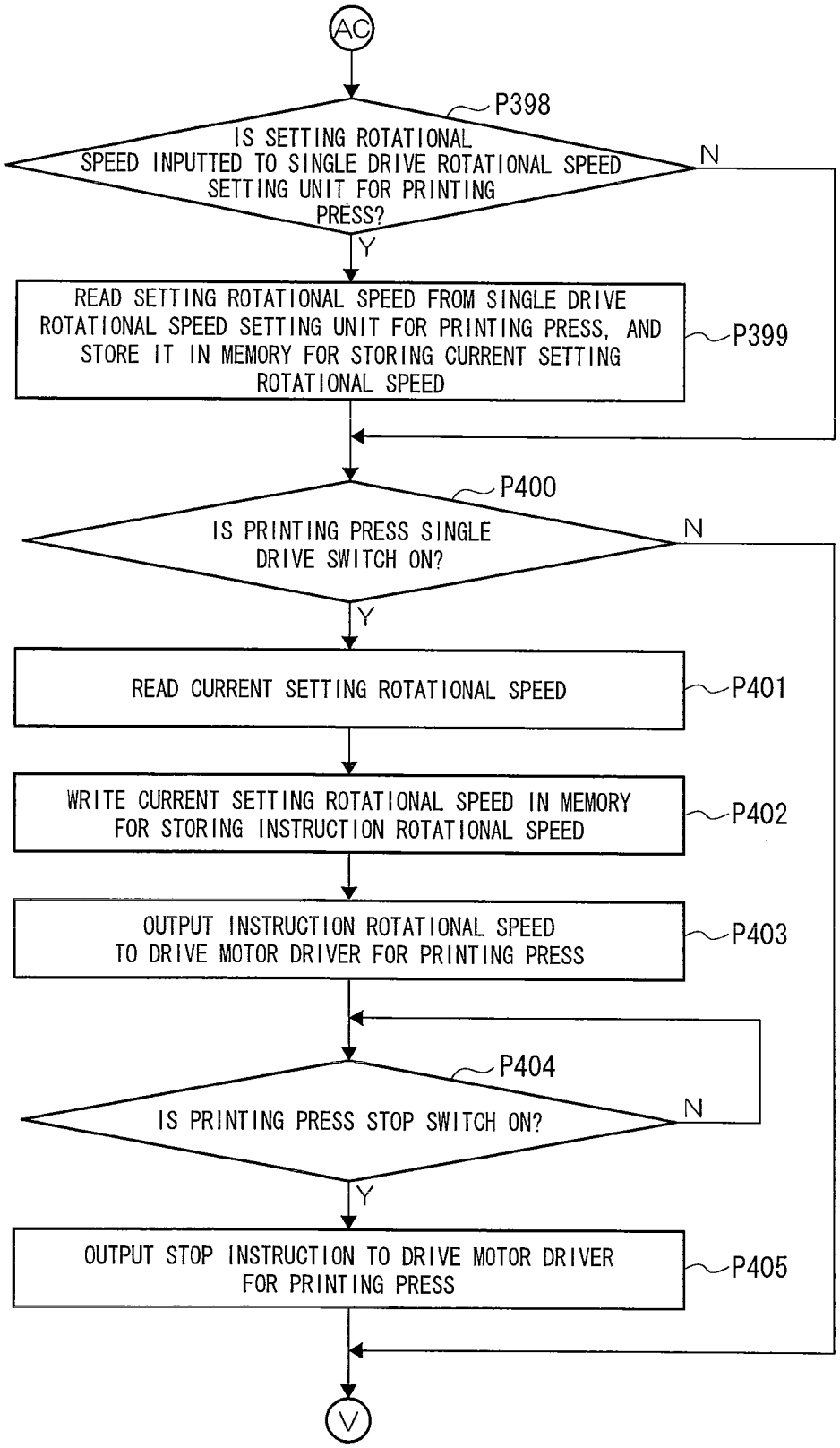
FIG. 28 is an operational flowchart of the drive controller of the printing press.

FIGS. 16A and 16B are operation flowcharts of the drive controller of the printing press. FIGS. 17A to 17E are operation flowcharts of the drive controller of the printing press. FIG. 18 is an operation flowchart of the drive controller of the printing press. FIGS. 19A to 19E are operation flowcharts of the drive controller of the printing press. FIG. 20 is an operation flowchart of the drive controller of the printing press. FIGS. 21A and 21B are operation flowcharts of the drive controller of the printing press. FIGS. 22A to 22E are operation flowcharts of the drive controller of the printing press. FIG. 23 is an operation flowchart of the drive controller of the printing press. FIGS. 24A and 24B are operation flowcharts of the drive controller of the printing press. FIGS. 25A and 25B are operation flowcharts of the drive controller of the printing press. FIG. 26 is an operation flowchart of the drive controller of the printing press. FIGS. 27A and 27B are operation flowcharts of the drive controller of the printing press. FIG. 28 is an operation flowchart of the drive controller of the printing press.

Figure 29A:
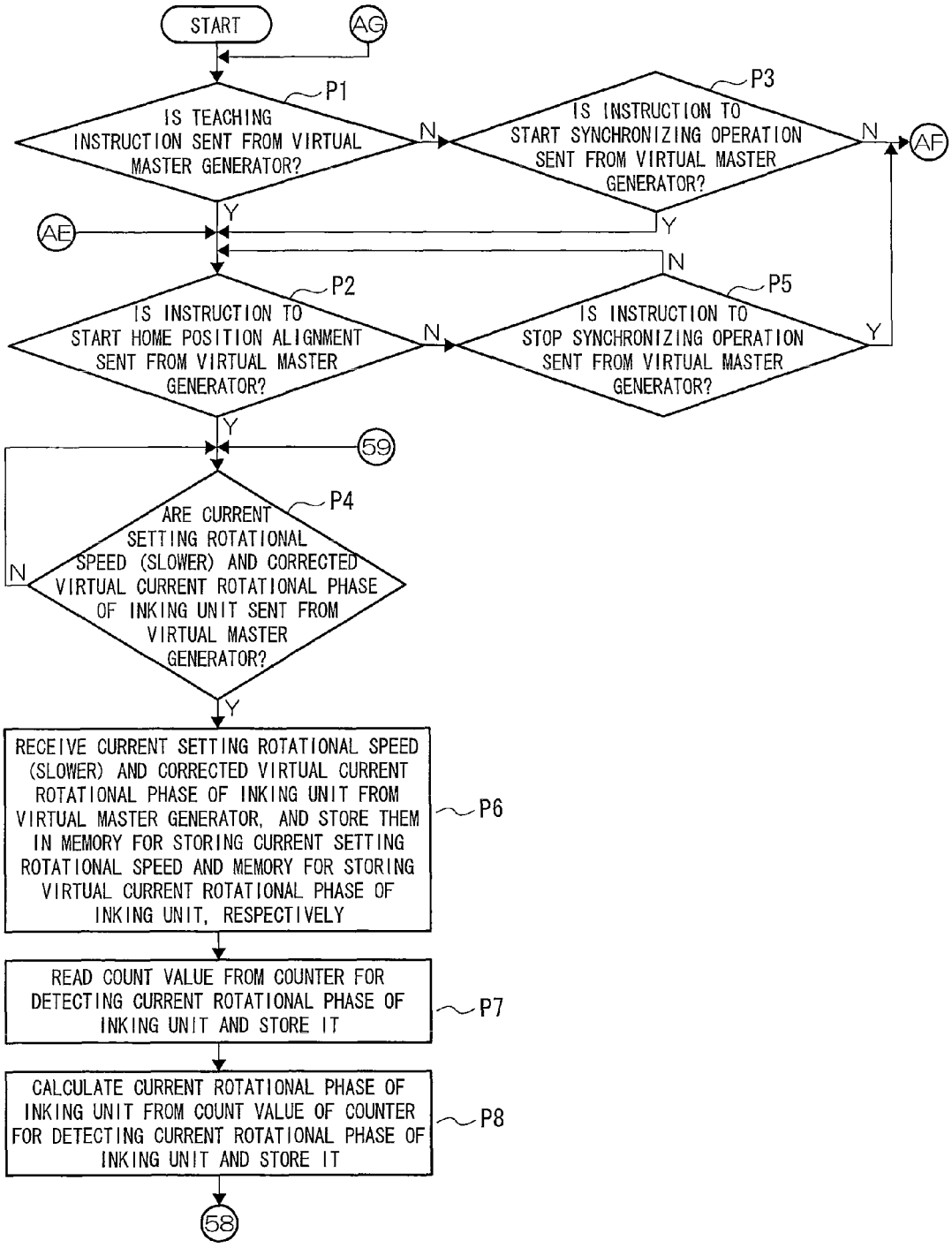
FIG. 29A is an operational flowchart of the drive controller of each of the first to fourth inking units.
Figure 29B:
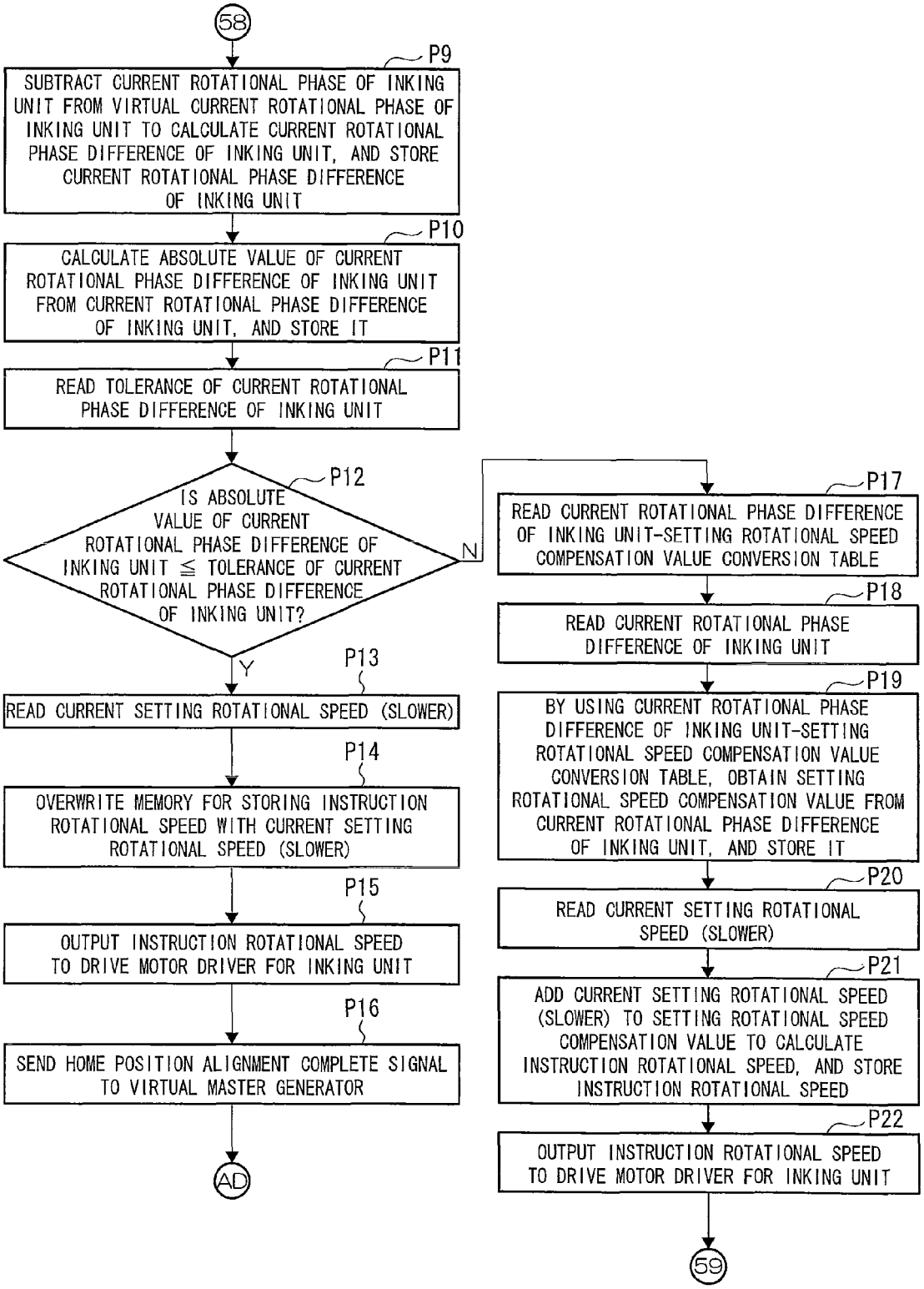
FIG. 29B is an operational flowchart of the drive controller of each of the first to fourth inking units.
Figure 30A:
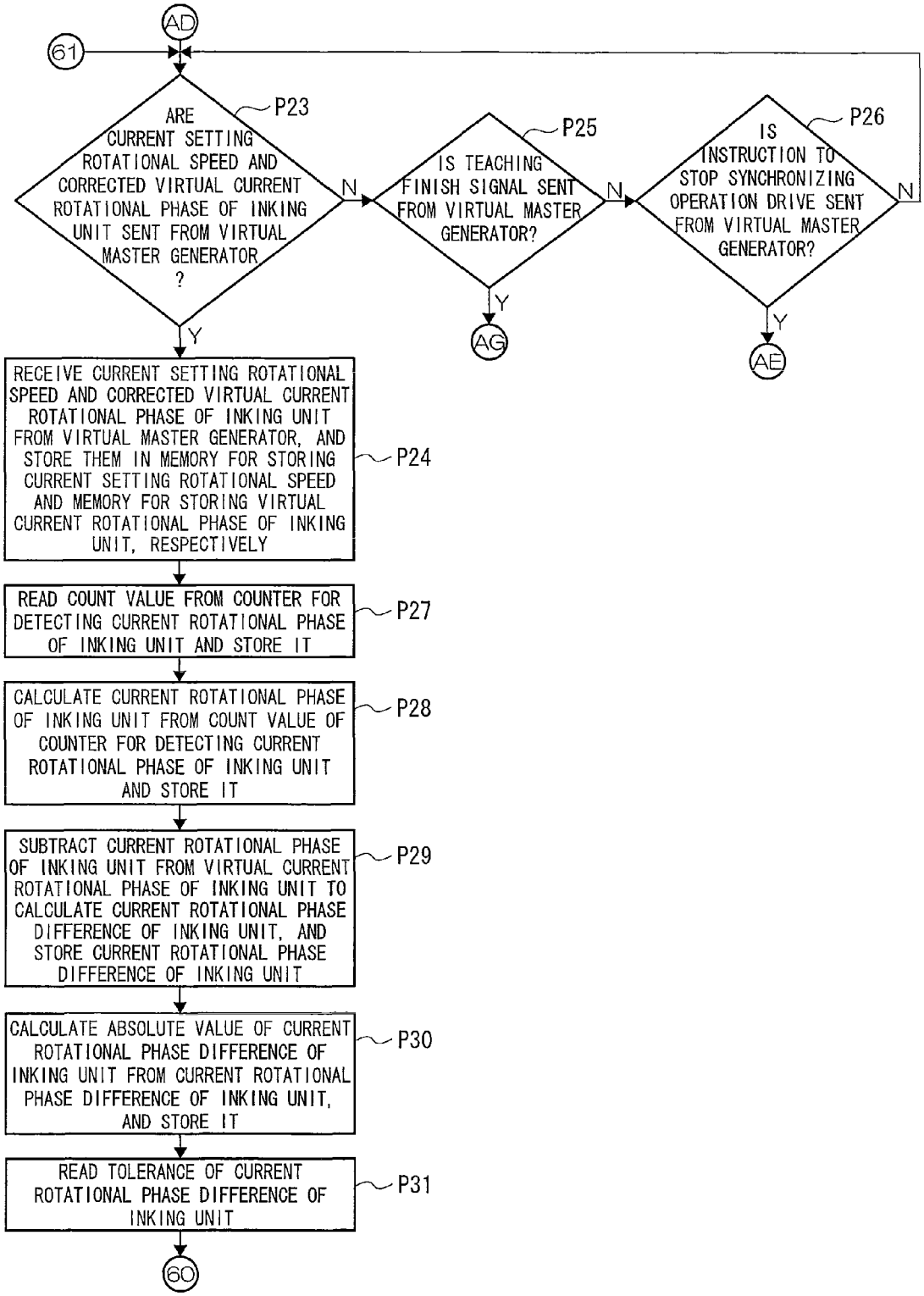
FIG. 30A is an operational flowchart of the drive controller of each of the first to fourth inking units.
Figure 30B:
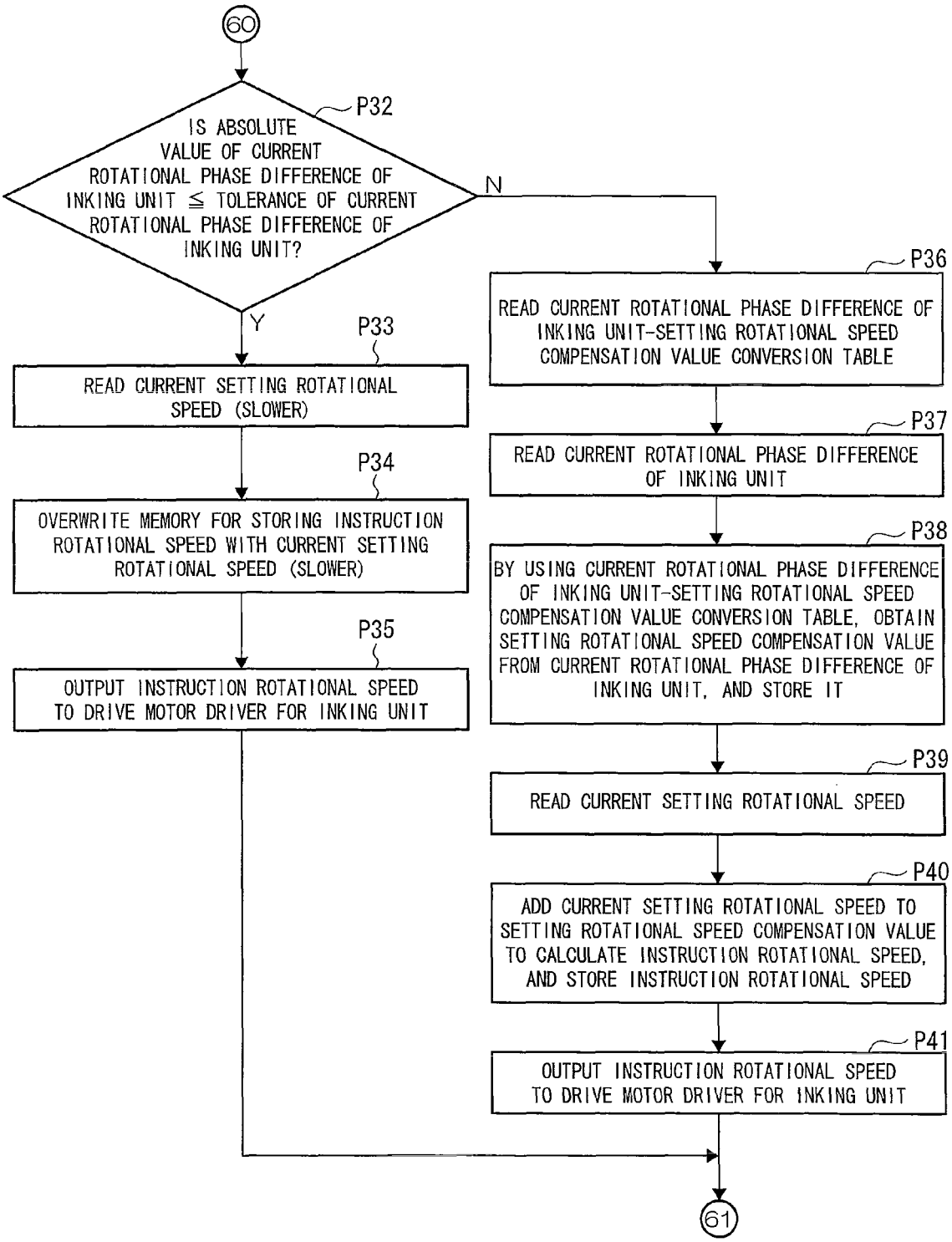
FIG. 30B is an operational flowchart of the drive controller of each of the first to fourth inking units.
Figure 31:
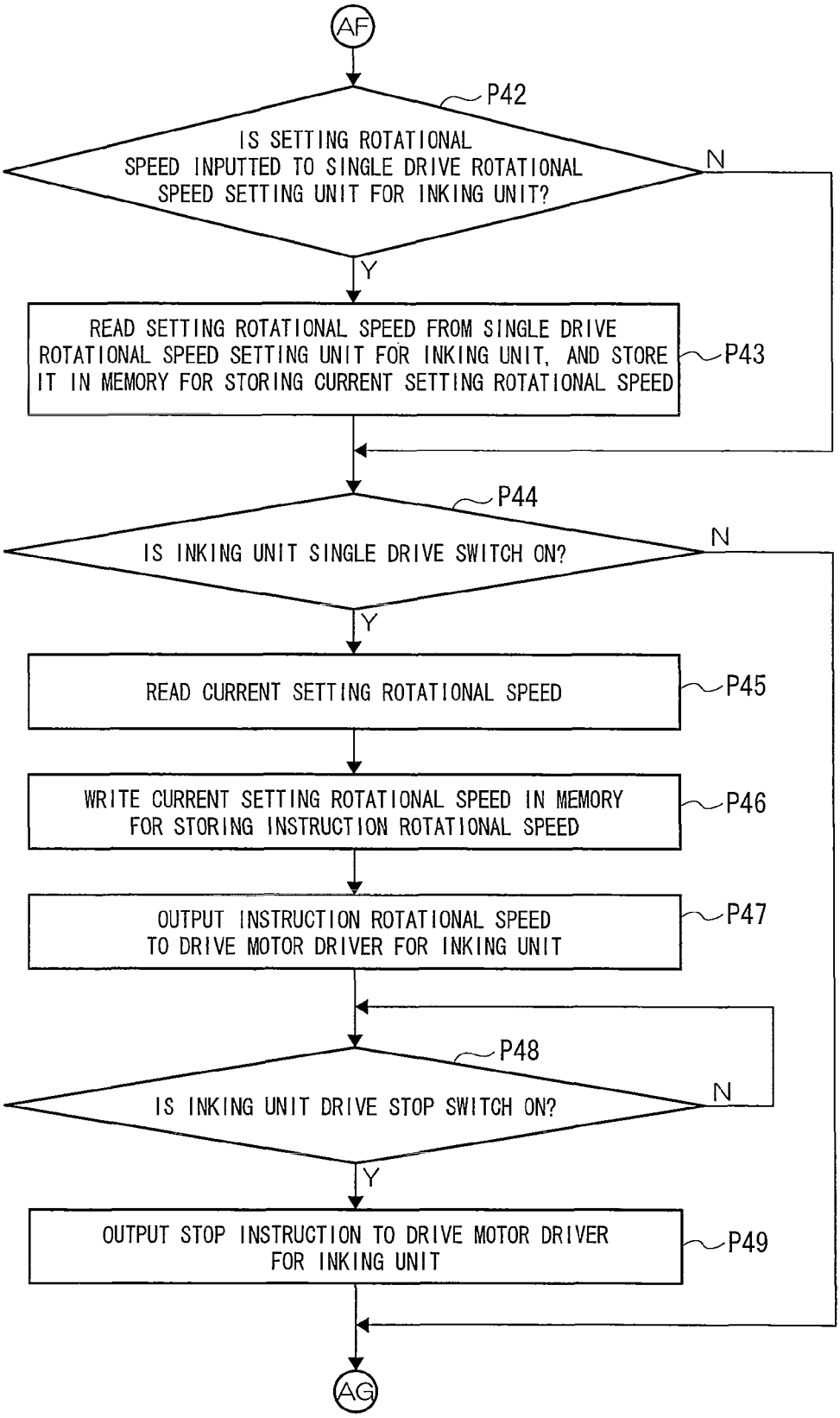
FIG. 31 is an operational flowchart of the drive controller of each of the first to fourth inking units.

FIGS. 29A and 29B are operation flowcharts of the drive controller of each of the first to fourth inking units. FIGS. 30A and 30B are operation flowcharts of the drive controller of each of the first to fourth inking units. FIG. 31 is an operation flowchart of the drive controller of each of the first to fourth inking units.

Figure 49:
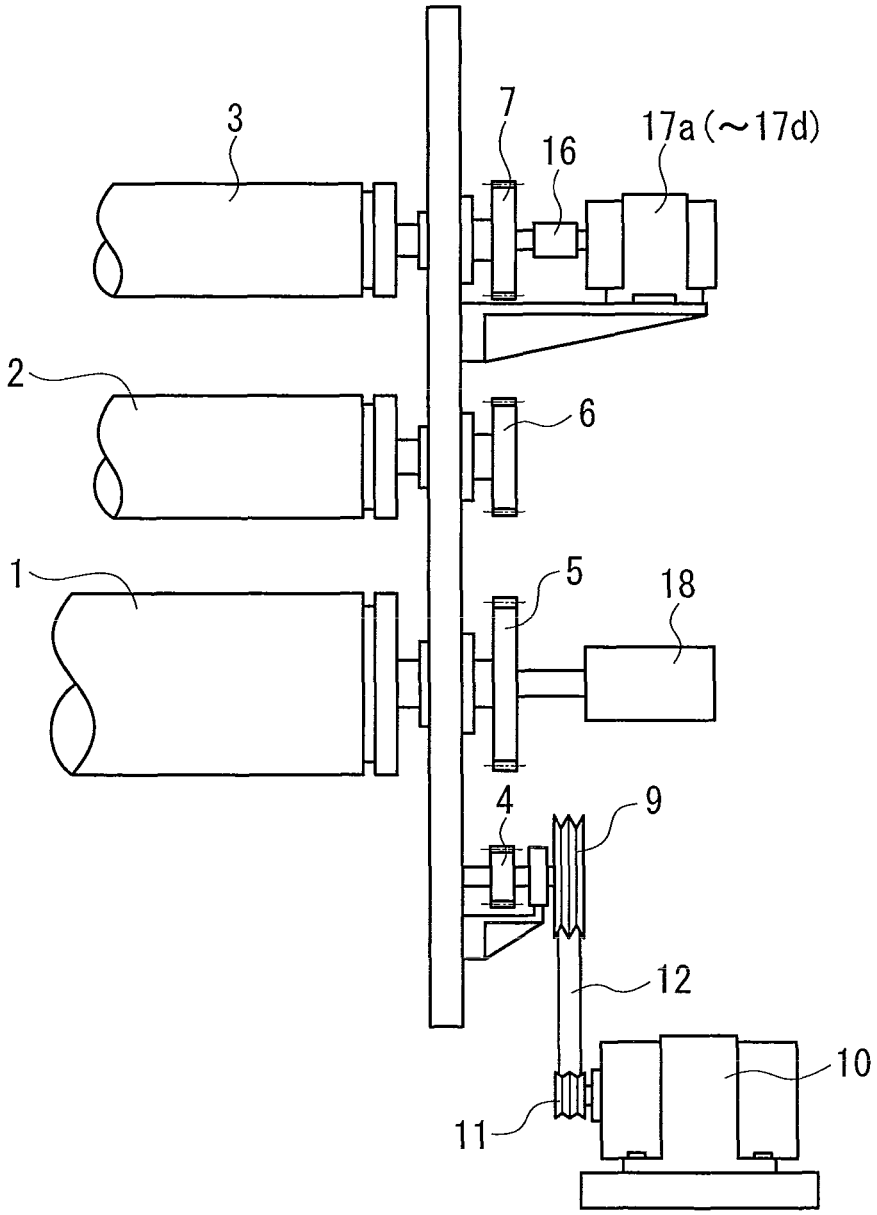
Figure 50:
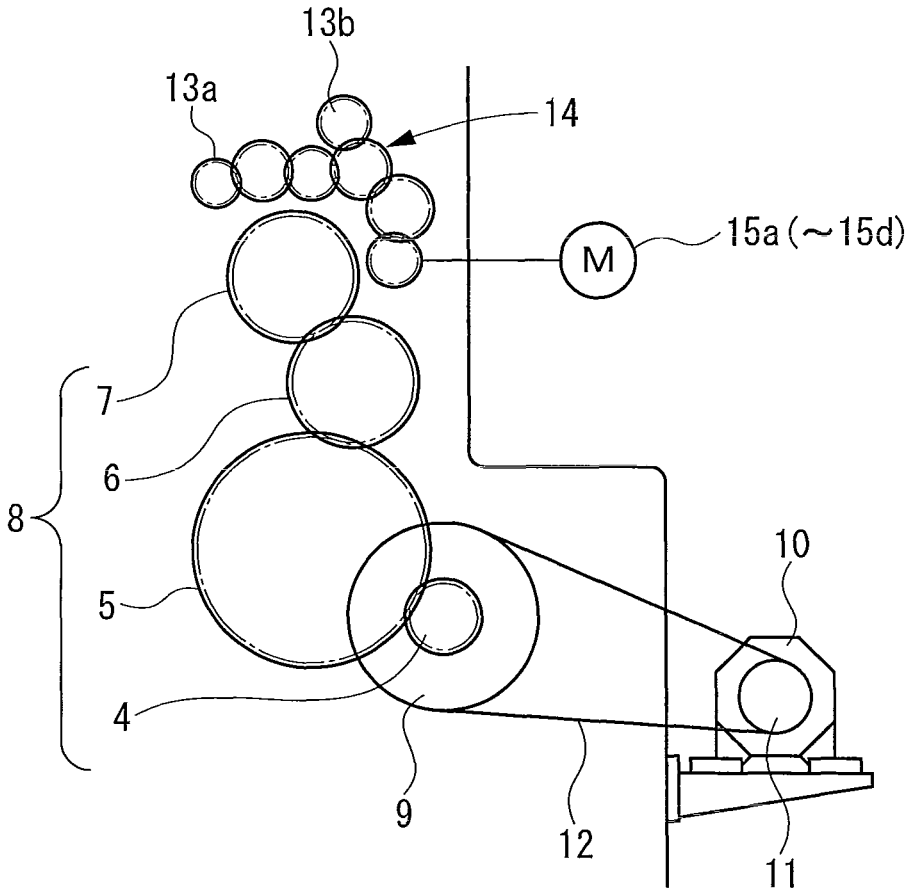

FIG. 49 is a front view showing the drive system on the printing press main body side in an offset printing press. FIG. 50 is a side view showing the drive system on the inking device side and the printing press main body side in the offset printing press.

As shown in FIG. 49 and FIG. 50, an impression cylinder 1, a blanket cylinder (first rotating body) 2 and a plate cylinder (second rotating body) 3 on the printing press main body side in an offset printing press of a four color model are driven by a drive motor (electric motor; first driving means) 10 of the printing press via a gear train 8 and a belt 12. The gear train 8 is configured of a drive pinion 4, an impression cylinder gear 5, a blanket cylinder gear (first driven means) 6 and a plate cylinder gear (second driven means) 7. The belt 12 is wound around a large pulley 9 fixed to a shaft of the drive pinion 4 and a small pulley 11 fixed to an output shaft of the drive motor 10 of the printing press. Note that, a notch (not shown) to which a gripper for supporting both ends of a not-shown blanket is provided on a circumferential surface of the blanket cylinder 2. Moreover, a notch (not shown) to which a plate fastening device for supporting both ends of a not-shown printing plate is provided on a circumferential surface of the plate cylinder 3.

On the other hand, the first to fourth inking units (inking devices) in the offset printing press are driven by drive motors (single drive motor; second driving means) 15*a* (to 15*d*) of the inking units via a gear train 14 configured of multiple roller gears including oscillating roller gears 13*a* and 13*b* (refer to FIG. 50).

In addition, to the shaft of the plate cylinder gear 7 for the plate cylinder 3 on the printing press main body side, a load motor (torque motor; braking means) 17*a* (to 17*d*) is connected with a coupling 16 interposed therebetween. In addition, to the shaft of the impression cylinder gear 5 for the impression cylinder 1, a rotary encoder 18 for detecting rotational phase of the printing press is connected.

In this embodiment, the drive motor 10 of the printing press and the first to fourth load motors 17*a* to 17*d* are driven and controlled by a later-described drive controller (control means) 80 of the printing press. The drive motors 15*a* to 15*d* of the first to fourth inking units are driven and controlled by later-described drive controllers (control means) 90*a* to 90*d* of the first to fourth inking units. In addition, braking force is provided to a gear train (drive system) on the printing press main body side by the load motors 17*a* to 17*d* according to fluctuation in load of the drive motor 10. Then, the electric power generated by the load motors 17*a* to 17*d* at this time is recovered as power for driving the drive motor 10.

In addition, in this embodiment, the drive controller 80 of the printing press and the drive controllers 90*a* to 90*d* of the first to fourth inking units are connected to a central controller (control means) 30 via a later-described virtual master generator (control means) 60. Then, (the drive motor 10 on) the printing press main body side and (the drive motors 15*a* to 15*d* of) the first to fourth inking units are controlled (operated) and synchronized by this central controller 30.

As shown in FIGS. 1A and 1B, the central controller 30 includes a CPU 31, a ROM 32, a RAM 33, input/output units 34*a* to 34*d* and an interface 35 which are connected to each other via a BUS (bus line).

The BUS is also connected to: a memory M1 for storing slower rotational speed; a memory M2 for storing setting rotational speed; a memory M3 for storing a time interval at which the setting rotational speed is sent to the virtual master generator (hereinafter, setting rotational speed transmission interval); a memory M4 for storing a count value of a counter for detecting current rotational phase of the printing press; a memory M5 for storing current rotational phase of the printing press; a memory M6 for storing rotational phase of the printing press at which acceleration is started (hereinafter, acceleration start rotational phase of the printing press); a memory M7 for storing rotational phase of the printing press at which detection of load at constant-speed operation is started (hereinafter, constant-speed operation load detection start rotational phase of the printing press); a memory M8 for storing rotational phase of the printing press at which the detection of load at constant-speed operation is terminated (hereinafter, constant-speed operation load detection finish rotational phase of the printing press); a memory M9 for storing rotational phase of the printing press at which deceleration is started (hereinafter, deceleration start rotational phase of the printing press); a memory M10 for storing outputs of F/V converters connected to the rotary encoders for the drive motor of the printing press and the drive motors of the inking units; a memory M11 for storing current rotational speed of the printing press and each of the inking units; and an internal clock counter 36.

The input/output unit 34*a* is connected to a teaching switch 37, a synchronizing operation switch 38, a printing press drive switch 39, a printing press drive stop switch 40, an input unit 41 including a keyboard, various types of switches, buttons and the like, display unit 42 including CRT, lamp and the like, and an output unit 43 including a printer, a floppy disk (registered trademark) drive and the like.

The input/output unit 34*b* is connected to a rotational speed setting unit 44. The input/output unit 34*c* is connected to the rotary encoder 18 for detecting current rotational phase of the printing press through the counter 45 for detecting current rotational phase of the printing press.

The input/output unit 34*d* is connected to a rotary encoder 48 for the drive motor of the printing press through an A/D converter 46 and an F/V converter 47. The input/output unit 34*d* is also connected to rotary encoders 51*a* to 51*d* for the drive motors of the first to fourth inking units through A/D converters 49*a* to 49*d* and F/V converters 50*a* to 50*d*, respectively.

The interface 35 is connected to a printing press controller 28 and the virtual master generator 60.

As shown in FIG. 2, the virtual master generator 60 includes a CPU 31*a*, a ROM 32*a*, a RAM 33*a*, and an interface 35*a* which are connected to each other through a BUS.

The BUS is also connected to: a memory M12 for storing virtual current rotational phase; a memory M13 for storing current setting rotational speed; a memory M14 for storing previous setting rotational speed; a memory M15 for storing a current rotational phase compensation value of the printing press; a memory M16 for storing corrected virtual current rotational phase of the printing press; a memory M17 for storing a current rotational phase compensation value of each inking unit; a memory M18 for storing corrected virtual current rotational phase of each inking unit; a memory M19 for storing a time interval at which the setting rotational speed is sent from the central controller to the virtual master generator; a memory M20 for storing a virtual current rotational phase correction value; and a memory M21 for storing corrected virtual current rotational phase.

The BUS is also connected to: a memory M22 for storing a number of the printing press or the inking units which has finished home position alignment; a memory M23 for storing setting rotational speed at teaching; a memory M6*a* for storing the acceleration start rotational phase of the printing press; a memory M24 for storing a rotational speed correction value at acceleration; a memory M25 for storing corrected current setting rotational speed; a memory M7*a* for storing constant-speed operation load detection start rotational phase of the printing press; a memory M8*a* for storing rotational phase of the printing press at which detection of load at constant-speed operation is terminated; a memory M9*a* for storing deceleration start rotational phase of the printing press; a memory M26 for storing a rotational speed correction value at deceleration; a memory M27 for storing setting rotational speed at synchronizing operation; and a memory M28 for storing a current state of the printing press.

The interface 35*a* is connected to the central controller 30, the drive controller 80 of the printing press, and the drive controllers 90*a* to 90*d* of the first to fourth inking units.

As shown in FIGS. 3A to 3C, the drive controller 80 of the printing press includes a CPU 31*b*, a ROM 32*b*, a RAM 33*b*, input/output units 34*e* to 34*p*, and an interface 35*b* which are connected to each other through a BUS.

The BUS is also connected to: a memory M13*b* for storing current setting rotational speed; a memory M29 for storing virtual current rotational phase of the printing press; a memory M4*b* for storing a count value of the counter for detecting current rotational phase of the printing press; a memory M5*b* for storing current rotational phase of the printing press; a memory M30 for storing current rotational phase difference of the printing press; a memory M31 for storing an absolute value of the current rotational phase difference of the printing press; a memory M32 for storing a tolerance of the current rotational phase difference of the printing press; a memory M33 for storing an instruction rotational speed; a memory M34 for storing a table for converting the current rotational phase difference of the printing press to the setting rotational speed compensation value (hereinafter, current rotational phase difference of the printing press-setting rotational speed compensation value conversion table); a memory M35 for storing a setting rotational speed compensation value; and a memory M23*b* for storing setting rotational speed at teaching.

The BUS is also connected to: a memory M36 for storing rotational speed of the first load motor; a memory M37 for storing rotational phase at which a notch of a first plate cylinder starts to move up (hereinafter, first plate-cylinder notch move-up start rotational phase); a memory M38 for storing rotational phase at which the notch of the first plate cylinder finishes moving up (hereinafter, first plate-cylinder notch move-up finish rotational phase); a memory M39 for storing a load motor rotational speed compensation value related to the move-up of the notch of the plate cylinder; a memory M40 for storing rotational speed of the second load motor; a memory M41 for storing rotational phase at which a notch of a second plate cylinder starts to move up (hereinafter, second plate-cylinder notch move-up start rotational phase); a memory M42 for storing rotational phase at which the notch of the second plate cylinder finishes moving up (hereinafter, second plate-cylinder notch move-up finish rotational phase); a memory M43 for storing rotational speed of a third load motor; a memory M44 for storing rotational phase at which a notch of the third plate cylinder starts to move up (hereinafter, third plate-cylinder notch move-up start rotational phase); and a memory M45 for storing rotational phase at which the notch of the third plate cylinder finishes moving up (hereinafter, third plate-cylinder notch move-up finish rotational phase).

The BUS is also connected to: a memory M46 for storing rotational speed of the fourth load motor; a memory M47 for storing rotational phase at which a notch of a fourth plate cylinder starts to move up (hereinafter, fourth plate-cylinder notch move-up start rotational phase); a memory M48 for storing rotational phase at which the notch of the fourth plate cylinder finishes moving up (hereinafter, fourth plate-cylinder notch move-up finish rotational phase); a memory M49 for storing a count value of an acceleration/deceleration counter; a memory M50 for storing an electric current value from a drive motor driver of the printing press; a memory M51 for storing a standard electric current value; a memory M52 for storing an electric current value difference; a memory M53 for storing a table for converting the electric current value difference to the load motor rotational speed compensation value (hereinafter, electric current value difference-load motor rotational speed compensation value conversion table); and a memory M54 for storing a load motor rotational speed compensation value.

In addition, the BUS is also connected to: a memory M55 for storing compensated rotational speed of the first load motor; a memory M56 for storing compensated rotational speed of the second load motor; a memory M57 for storing compensated rotational speed of the third load motor; a memory M58 for storing compensated rotational speed of the fourth load motor; a memory M59 for storing rotational speed of the load motor at acceleration; a memory M60 for storing rotational speeds of the load motors at constant-speed operation; a memory M61 for storing rotational speed of the load motor at deceleration; a memory M27*b* for storing setting rotational speed at synchronizing operation; and a memory M28*b* for storing the current state of the printing press.

The input/output unit 34*e* is connected to the drive motor 10 of the printing press through a D/A converter 61 and a drive motor driver 62 of the printing press. In addition, the drive motor driver 62 of the printing press is connected to the input/output unit 34*f*, and the rotary encoder 48 for the drive motor of the printing press, which is coupled with and driven by the drive motor 10 of the printing press. Moreover, the drive motor driver 62 of the printing press is connected to the first to fourth load motors 17*a* to 17*d* to be described later.

The input/output unit 34*g* is connected to the rotary encoder 18 for detecting rotational phase of the printing press through the counter 45 for detecting current rotational phase of the printing press. The input/output unit 34*h* is connected to the rotary encoder 18 for detecting rotational phase of the printing press through an acceleration/deceleration counter 63. The input/output unit 34*i* is connected to the rotary encoder 18 for detecting rotational phase of the printing press. The input/output unit 34*j* is connected to a load motor standard rotational speed setting unit 64.

The input/output unit 34*k* is connected to the first load motor 17*a* through a D/A converter 65*a* and a first load motor driver 66*a*. In addition, the first load motor driver 66*a* is connected to a first load motor rotary encoder 67*a* which is coupled with and driven by the first load motor 17*a*.

The input/output unit 34*l* is connected to the second load motor 17*b* through a D/A converter 65*b* and a second load motor driver 66*b*. In addition, the second load motor driver 66*b* is connected to the second load motor rotary encoder 67*b* which is coupled with and driven by the second load motor 17*b*.

The input/output unit 34*m* is connected to the third load motor 17*c* through a D/A converter 65*c* and a third load motor driver 66*c*. In addition, the third load motor driver 66*c* is connected to the third load motor rotary encoder 67*c* which is coupled with and driven by the third load motor 17*c*.

The input/output unit 34*n* is connected to the fourth load motor 17*d* through a D/A converter 65*d* and a fourth load motor driver 66*d*. In addition, the fourth load motor driver 66*d* is connected to the first load motor rotary encoder 67*d* which is coupled with and driven by the fourth load motor 17*d*.

The input/output unit 34*o* is connected to a single drive rotational speed setting unit 68 for the printing press. The input/output unit 34*p* is connected to a printing press single drive switch 69 and a printing press stop switch 70.

The interface 35*b* is connected to the virtual master generator 60.

As shown in FIG. 4, each of the drive controllers 90*a* to 90*d* of the first to fourth inking units includes a CPU 31*c*, a ROM 32*c*, a RAM 33*c*, input/output units 34*q* to 34*t*, and an interface 35*c* which are connected to each other through a BUS. Note that, the block diagram shown in FIG. 4 illustrates a configuration common to the drive controllers 90*a* to 90*d* of the first to fourth inking units.

The BUS is connected to: a memory M13*c* for storing current setting rotational speed; a memory M62 for storing virtual current rotational phase of the inking unit; a memory M63 for storing a count value of a counter for detecting current rotational phase of the inking unit; a memory M64 for storing the current rotational phase of the inking unit; a memory M65 for storing a current rotational phase difference of the inking unit; a memory M66 for storing an absolute value of the current rotational phase difference of the inking unit; a memory M67 for storing a tolerance of the current rotational phase difference of the inking unit; a memory M33*c* for storing the instruction rotational speed; a memory M68 for storing a table for converting the current rotational phase difference of the inking unit to the setting rotational speed compensation value (hereinafter, current rotational phase difference of the inking unit-setting rotational speed compensation value conversion table); and a memory M35*c* for storing the setting rotational speed compensation value.

The input/output unit 34*q* is connected to a drive motor 15 of the inking unit through a D/A converter 71 and a drive motor driver 72 of the inking unit. The drive motor driver 72 of the inking unit is connected to a rotary encoder 51 for the drive motor of the inking unit, which is coupled with and driven by the drive motor 15 of the inking unit.

The input/output unit 34*r* is connected to the rotary encoder 51 for the drive motor of the inking unit through a counter 73 for detecting current rotational phase of the inking unit.

The input/output unit 34*s* is connected to a single drive rotational speed setting unit 75 for the inking unit. The input/output unit 34*t* is connected to an inking unit single drive switch 76 and an inking unit drive stop switch 77.

The interface 35*c* is connected to the virtual master generator 60.

The central controller 30 is configured as described above and operates according to operational flows shown in FIGS. 5A to 5E, 6A to 6C, 7A to 7C, and 8A and 8B.

Specifically, in step P1, it is judged whether the teaching switch 37 is turned on. If yes, upon the printing press drive switch 39 being turned on in step P2, a teaching instruction is sent to the virtual master generator 60 in step P3.

On the other hand, if no in step P1, it is judged whether the synchronizing operation switch 38 is turned on in step P4. If yes in step P4, in step P5, an instruction to start synchronizing operation is sent to the virtual master generator 60, and then the process proceeds to later-described step P93. If no, in step P6, it is judged whether the setting rotational speed is inputted to the rotational speed setting unit 44. If yes in step P6, in step P7, the setting rotational speed is read from the rotational speed setting unit 44, and is stored in the memory M2, and the process then returns to step P1. If no in step P6, the process directly returns to step P1.

Next, in step P8, an instruction to start home position alignment is sent to the virtual master generator 60. The slower rotational speed is read from the memory M1 in step P9 and is written in the memory M2 for storing the setting rotation speed in step P10.

Next, in step P11, the internal clock counter 36 (for counting elapsed time) starts to count. In step P12, the setting rotational speed transmission interval is read from the memory M3. Subsequently, the count value of the internal clock counter 36 is read in step P13.

Next, in step P14, it is judged whether the count value of the internal clock counter is equal to or more than the setting rotational speed transmission interval. If yes, the setting rotational speed (slower) is read from the memory M2 in step P15 and is then sent to the virtual master generator 60 in step P16. The process then returns to step P11.

On the other hand, if no in step P14, in step P17, it is judged whether a home position alignment completion signal is sent from the virtual master generator 60. If yes, the setting rotational speed transmission interval is read from the memory M3 in step P18, and if no, the process returns to step P12.

Next, in step P19, the count value of the internal clock counter 36 is read, and in step P20, it is judged whether the count value of the internal clock counter is equal to or more than the setting rotational speed transmission interval. If yes, the setting rotational speed (slower) is read from the memory M2 in step P21, and is sent to the virtual master generator 60 in step P22. If no, the process returns to step P18.

Next, in step P23, the internal clock counter 36 (for counting elapsed time) starts to count. In step P24, the setting rotational speed transmission interval is then read from the memory M3, and then in step P25, the count value of the internal clock counter 36 is read.

Next in step P26, it is judged whether the count value of the internal clock counter is equal to or more than the setting rotational speed transmission interval. If yes, the setting rotational speed (slower) is read from the memory M2 in step P27, and is then sent to the virtual master generator 60 in step P28. The process then returns to step P23. On the other hand, if no in step P26, in step P29, a count value is read from the counter 45 for detecting current rotational phase of the printing press, and stored in the memory M4.

Next, in step P30, from the count value of the counter 45 for detecting current rotational phase of the printing press, the current rotational phase of the printing press is calculated and stored in the memory M5. In step P31, the acceleration start rotational phase of the printing press is read from the memory M6. In step P32, it is then judged whether the current rotational phase of the printing press is equal to the acceleration start rotational phase of the printing press.

If yes in step P32, an instruction to start printing is sent to the printing press controller 28 in step P33. If no in step P32, the process returns to step P24. In step P34, the setting rotational speed is read from the rotational speed setting unit 44, and is stored in the memory M2. In step P35, an instruction to start acceleration and the setting rotational speed are then sent to the virtual master generator 60.

Next, in step P36, the internal clock counter 36 (for counting elapsed time) starts to count. In step P37, the setting rotational speed transmission interval is read from the memory M3, and then in step P38, the count value of the internal clock counter 36 is read.

Next, in step P39, it is judged whether the count value of the internal clock counter is equal to or more than the setting rotational speed transmission interval. If yes, in step P40, the setting rotational speed is read from the rotational speed setting unit 44, and is stored in the memory M2. In step P41, the setting rotational speed is then sent to the virtual master generator 60, and the process returns to step P36.

If no in step P39, in step P42, it is judged whether a constant-speed operation start signal is sent from the virtual master generator 60. If yes, the setting rotational speed transmission interval is read from the memory M3 in step P43, and if no, the process returns to step P37.

Next, the count value of the internal clock counter 36 is read in step P44. In step P45, it is judged whether the count value of the internal clock counter is equal to or more than the setting rotational speed transmission interval. If yes, in step P46, the setting rotational speed is read from the rotational speed setting unit 44, and is stored in the memory M2. In step P47, the setting rotational speed is then sent to the virtual master generator 60. If no in step P45, the process returns to step P43.

Next, in step P48, the internal clock counter 36 (for counting elapsed time) starts to count. Subsequently, in step P49, the setting rotational speed transmission interval is read from the memory M3, and then in step P50, the count value of the internal clock counter 36 is read.

Next, in step P51, it is judged whether the count value of the internal clock counter is equal to or more than the setting rotational speed transmission interval. If yes, in step P52, the setting rotational speed is read from the rotational speed setting unit 44, and is stored in the memory M2. In step P53, the setting rotational speed is then sent to the virtual master generator 60, and the process returns to step P48. On the other hand, if no in step P51, in step P54, the count value of the counter 45 for detecting current rotational phase of the printing press is read and stored in the memory M4.

Next, in step P55, from the count value of the counter 45 for detecting current rotational phase of the printing press, the current rotational phase of the printing press is calculated and stored in the memory M5. In step P56, the constant-speed operation load detection start rotational phase of the printing press is read from the memory M7. Subsequently, it is judged whether the current rotational phase of the printing press is equal to the constant-speed operation load detection start rotational phase of the printing press in step P57.

If yes in step P57, in step P58, an instruction to start load detection at constant-speed operation is sent to the master generator 60. On the other hand, if no in step P57, the process returns to step P49.

Next, in step P59, the internal clock counter 36 (for counting elapsed time) starts to count. In step P60, the setting rotational phase sending interval is then read from the memory M3, and then in step P61, the count value of the internal clock counter 36 is read.

Next in step P62, it is judged whether the count value of the internal clock counter is equal to or more than the setting rotational phase transmission interval. If yes, the setting rotational speed (slower) is read from the rotational speed setting unit 44, and is stored the memory M2 in step P63. The setting rotational speed is then sent to the virtual master generator 60 in step P64. The process then returns to step P59. On the other hand, if no in step P62, in step P65, the count value is read from the counter 45 for detecting current rotational phase of the printing press, and stored in the memory M4.

Next, in step P66, from the count value of the counter 45 for detecting current rotational phase of the printing press, the current rotational phase of the printing press is calculated and stored in the memory M5. In step P67, the constant-speed operation load detection finish rotational phase of the printing press is read from the memory M8. In step P68, it is then judged whether the current rotational phase of the printing press is equal to the constant-speed operation load detection finish rotational phase of the printing press.

If yes in step P68, an instruction to finish load detection at constant-speed operation is sent to the virtual master generator 60 in step P69. On the other hand, if no in step P68, the process returns to step P60.

Next, in step P70, the internal clock counter 36 (for counting elapsed time) starts to count. In step P71, the setting rotational speed transmission interval is read from the memory M3, and in step P72, the count value of the internal clock counter 36 is read.

Next, in step P73, it is judged whether the count value of the internal clock counter is equal to or more than the setting rotational speed transmission interval. If yes in step P73, in step P74, the setting rotational speed is read from the rotational speed setting unit 44, and is stored in the memory M2. In step P75, the setting rotational speed is then sent to the virtual master generator 60, and the process returns to step P70. On the other hand, if no in step P73, in step P76, the count value of the counter 45 for detecting current rotational phase of the printing press is read and stored in the memory M4.

Next, in step P77, the current rotational phase of the printing press is calculated from the count value of the counter 45 for detecting current rotational phase of the printing press, and is stored in the memory M5. In step P78, the deceleration start rotational phase of the printing press is read from the memory M9. In step P79, it is then judged whether the current rotational phase of the printing press is equal to the deceleration start rotational phase of the printing press.

If yes in step P79, in step P780, an instruction to stop printing is sent to the printing press controller 28, and if no, the process returns to step P71.

Next, in step P81, an instruction to start deceleration is sent to the virtual master generator 60, and then in step P82, 0 is written in the memory M2 for storing the setting rotational speed. In step P83, the internal clock counter 36 (for counting elapsed time) starts to count.

Next, in step P84, the setting rotational speed transmission interval is read from the memory M3, and in step P85, the count value of the internal clock counter 36 is read. In step P86, it is judged whether the count value of the internal clock counter is equal to or more than the setting rotational speed transmission interval.

If yes in step P86, the setting rotational speed (0) is read from the memory M2 in step P87, and if no, the process returns to step P84. Subsequently, in step P88, the setting rotational speed (0) is sent to the virtual master generator 60. In step P89, outputs of the F/V converters 47 and 50*a* to 50*d*, which are connected to the rotary encoders 48 for the drive motor of the printing press, and 51*a* to 51*d* for the drive motors of the inking units, respectively, are read and stored in the memory M10.

Next, in step P90, from the outputs of the F/V converters 47 and 50*a* to 50*d*, which are connected to the rotary encoders 48 for the drive motor of the printing press, and 51*a* to 51*d* for the drive motors of the inking units, respectively, the current rotational speeds of the printing press and the inking units are calculated and stored in the memory M11. In step P91, it is then judged whether the current rotational speeds of the printing press and all of the inking units are equal to 0.

If yes in step P91, in step P92, an instruction to finish teaching is sent to the virtual master generator 60, and the process returns to step P1. If no in step P91, the process returns to step P83.

Next, in step P93, it is judged whether the printing press drive switch 39 is turned on. If yes, the instruction to start home position alignment is sent to the virtual master generator 60 in step P94. The slower rotational speed is then read from the memory M1 in step P95.

On the other hand, if no in step P93, in step P96, it is judged whether the synchronizing operation switch 38 is off. If yes in step P96, in step P97, an instruction to stop synchronizing operation is sent to the virtual master generator 60, and the process returns to step P1. If no in step P96, the process directly returns to step P93.

Next, the slower rotational speed is written in the memory M2 for storing the setting rotational speed in step P98. In step P99, the internal clock counter (for counting elapsed time) 36 starts to count. Subsequently, the setting rotational speed transmission interval is read from the memory M3 in step P100. In step P101, the count value of the internal clock counter 36 is read.

Next, in step P102, it is judged whether the count value of the internal clock counter is equal to or more than the setting rotational speed transmission interval. If yes in step P102, the setting rotational speed (slower) is read from the memory M2 in step P103, and is sent to the virtual master generator 60 in step P104. The process then returns to step P99.

On the other hand, if no in step P102, in step P105, it is judged whether the home position alignment completion signal is sent from the virtual master generator 60. If yes in step P105, in step P106, the setting rotational speed transmission interval is read from the memory M3. If no in step P105, the process returns to step P100.

Next, in step P107, the count value of the internal clock counter 36 is read. In step P108, it is judged whether the count value of the internal clock counter is equal to or more than the setting rotational speed transmission interval. If yes in step P108, the setting rotational speed (slower) is read from the memory M2 in step P109, and sent to the virtual master generator 60 in step P110. If no in step P108, the process returns to step P106.

Next, in step P111, the internal clock counter 36 (for counting elapsed time) starts to count. In step P112, the setting rotational speed transmission interval is read from the memory M3, and then in step P113, the count value of the internal clock counter 36 is read.

Next, in step P114, it is judged whether the count value of the internal clock counter is equal to or more than the setting rotational speed transmission interval. If yes in step P114, the setting rotational speed (slower) is read from the memory M2 in step P115, and is sent to the virtual master generator 60 in step P116. The process then returns to step P111.

On the other hand, if no in step P114, in step P117, the count value of the counter 45 for detecting current rotational phase of the printing press is read and stored in the memory M4. In step P118, from the count value of the counter 45 for detecting current rotational phase of the printing press, the current rotational phase of the printing press is calculated and stored in the memory M5.

Next, in step P119, the acceleration start rotational phase of the printing press is read from the memory M6. In step P120, it is judged whether the current rotational phase of the printing press is equal to the acceleration start rotational phase of the printing press. If yes in step P120, the instruction to start printing is sent to the printing press controller 28 in step P121, and if no, the process returns to step P112.

Next, in step P122, the setting rotational speed is read from the rotational speed setting unit 44, and is stored in the memory M2. In step P122, the instruction to start acceleration and the setting rotational speed are sent to the virtual master generator 60.

Next, in step P124, the internal clock counter 36 (for counting elapsed time) starts to count. In step P125, the setting rotational speed transmission interval is read from the memory M3, and in step P126, the count value of the internal clock counter 36 is read.

Next, in step P127, it is judged whether the count value of the internal clock counter is equal to or more than the setting rotational speed transmission interval. If yes in step P127, in step P128, the setting rotational speed is read from the rotational speed setting unit 44, and is stored in the memory M2. If no in step P127, the process returns to step P125.

Next, in step P129, the setting rotational speed is sent to the virtual master generator 60. In step P130, it is judged whether the printing press drive stop switch 40 is turned on. If yes in step P130, the process proceeds to later-described step P131, and if no, the process returns to step P124.

Next, in step P131, the internal clock counter 36 (for counting elapsed time) starts to count. In step P132, the setting rotational speed transmission interval is read from the memory M3, and in step P133, the count value of the internal clock counter 36 is read.

Next, in step P134, it is judged whether the count value of the internal clock counter is equal to or more than the setting rotational speed transmission interval. If yes in step P134, in step P135, the setting rotational speed is read from the rotational speed setting unit 44, and is stored in the memory M2. The setting rotational speed is then sent to the virtual master generator 60 in step P136. Thereafter, the process returns to step P131.

On the other hand, if no in step P134, in step P137, the count value of the counter 45 for detecting current rotational phase of the printing press is read and stored in the memory M4. In step P136, from the read count value of the counter 45 for detecting current rotational phase of the printing press, the current rotational phase of the printing press is calculated and stored in the memory M5.

Next, in step P139, the deceleration start rotational phase of the printing press is read from the memory M9. In step P140, it is judged whether the current rotational phase of the printing press is equal to the deceleration start rotational phase of the printing press. If yes in step P140, in step P141, the instruction to stop printing is sent to the printing press controller 28. If no in step P140, the process returns to step P132.

Next, in step P142, the instruction to start deceleration is sent to the virtual master generator 60. In step P143, 0 is then written in the memory M2 for storing the setting rotational speed. Subsequently, in step P144, the internal clock counter 36 (for counting elapsed time) starts to count, and in step P145, the setting rotational speed transmission interval is read from the memory M3.

Next, in step P146, the count value of the internal clock counter 36 is read. In step P147, it is then judged whether the count value of the internal clock counter is equal to or more than the setting rotational speed transmission interval.

If yes in step P147, the setting rotational speed (0) is read from the memory M2 in step P148, and in step P149, the setting rotational speed (0) is sent to the virtual master generator 60. If no in step P147, the process returns to step P145.

Next, in step P150, outputs of the F/V converters 47 and 50*a* to 50*d*, which are connected to the rotary encoders 48 for the drive motor of the printing press, and 51*a* to 51*d* for the drive motors of the inking units, respectively, are read and stored in the memory M10. In step P151, from the outputs of the F/V converters 47 and 50*a* to 50*d*, which are connected to the rotary encoders 48 for the drive motor of the printing press, and 51*a* to 51*d* for the drive motors of the inking units, respectively, the current rotational speeds of the printing press and the inking units are calculated and stored in the memory M11.

Next, in step P152, it is judged whether the current rotational speeds of the printing press and all of the inking units are equal to 0. If yes in step P152, in step P153, an instruction to stop drive of synchronizing operation is sent to the virtual master generator 60, and then the process returns to step P93. If no in step P152, the process returns to step P144. Hereinafter, the above described operations are repeated.

According to the aforementioned operational flows, the printing press drive instruction is sent to the printing press controller 28, and the teaching instruction and the synchronizing operation instruction are sent to the virtual master generator 60.

The virtual master generator 60 operates according to the operational flows shown in FIGS. 9A to 9C, 10A to 10C, 11A to 11C, 12A and 12B, 13A to 13C, 14A to 14D, and 15A and 15B.

Specifically, in step P1, it is judged whether the teaching instruction is sent from the central controller 30. If yes in step P1, in step P2, teaching instructions are sent to the drive controllers 80 of the printing press and 90*a* to 90*d* of the first to fourth inking units. If no in step P1, in step P3, it is judged whether the instruction to start synchronizing operation is sent from the central controller 30.

If yes in step P3, in step P4, the instruction to start synchronizing operation is sent to the drive controllers 80 of the printing press, and 90*a* to 90*d* of the inking units, and the process proceeds to later-described P151. If no in step P3, the process returns to step P1.

Next, when the instruction to start home position alignment is sent from the central controller 30 in step P5, in step P6, instructions to start home position alignment are sent to the drive controllers 80 of the printing press and 90*a* to 90*d* of the first to fourth inking units.

Next, in step P7, rotational phase (0) is written in the memory M12 for storing the virtual current rotational phase. When the setting rotational speed (slower) is sent from the central controller 30 in step P8, in step P9, the setting rotational speed (slower) is received from the central controller 30, and is stored in the memory M13 for storing the current setting rotational speed and the memory M14 for storing the previous setting rotational speed.

Next, in step P10, the virtual current rotational phase is read from the memory M12, and in step P11, the rotational phase compensation value of the printing press is read from the memory M15. Subsequently, in step P12, the virtual current rotational phase is added to the rotational phase compensation value of the printing press to calculate the corrected virtual current rotational phase of the printing press, and the corrected virtual current rotational phase of the printing press is then stored in the memory M16.

Next, in step P13, the compensation value of current rotational phase of each inking unit is read from the memory M17. In step P14, the virtual current rotational phase is added to the compensation value of current rotational phase of each inking unit to calculate the corrected virtual current rotational phase of each inking unit, which is then stored in the memory M18.

Next, in step P15, the current setting rotational speed (slower) and the corrected virtual current rotational phase of the printing press are sent to the drive controller 80 of the printing press. In step P16, the current setting rotational speed (slower) and the corrected virtual current rotational phase of each inking unit are sent to corresponding one of the drive controllers 90*a* to 90*d* of the inking units.

Next, in step P17, it is judged whether the setting rotational speed (slower) is sent from the central controller 30. If yes in step P17, in step P18, the setting rotational speed (slower) is received from the central controller 30, and is stored in the memory M13 for storing the current setting rotational speed. In step P19, the previous setting rotational speed is read from the memory M14.

Next, in step P20, the setting rotational speed transmission interval sent from the central controller 30 to the virtual master generator 60 is read from the memory M19. In step P21, from the previous setting rotational speed and the setting rotational speed transmission interval, the virtual current rotational phase correction value is calculated and stored in the memory M20. Specifically, the previous setting rotational speed is multiplied by the setting rotational speed transmission interval to calculate the virtual rotational phase by which each of the drive controllers 80 of the printing press and 90*a* to 90*d* of the first to fourth inking units has advanced between previous transmission at the setting rotational speed and current transmission. The calculated virtual rotational phase is stored as the virtual current rotational phase correction value.

Next, in step P22, the virtual current rotational phase is read from the memory M12. In step P23, the virtual current rotational phase correction value is added to the virtual current rotational phase to calculate the corrected virtual current rotational phase, which is then stored in the memory M21.

Next, in step P24, the rotational phase compensation value of the printing press is read from the memory M15. In step P25, the rotational phase compensation value of the printing press is added to the corrected virtual current rotational phase to calculate the corrected virtual current rotational phase of the printing press, which is then stored in the memory M16. In step P26, the current rotational phase compensation value of each inking unit is read from the memory M17.

Next, in step P27, the rotational phase compensation value of each inking unit is added to the corrected virtual current rotational phase to calculate the corrected virtual current rotational phase of each inking unit, which is then stored in the memory M18. In step P28, the current setting rotational speed (slower) and the corrected virtual current rotational phase of the printing press are sent to the drive controller 80 of the printing press.

Next, in step P29, the current setting rotational speed (slower) and the corrected virtual current rotational phase of each inking unit are sent to each of the inking units 90*a* to 90*d*. In step P30, the current setting rotational speed (slower) is then stored in the memory M14 for storing the previous setting rotational speed.

Next, in step P31, the corrected virtual current rotational phase is read from the memory M21, and in step P32, the memory M12 for storing the virtual current rotational phase is overwritten with the corrected virtual current rotational phase, and the process returns to step P17.

On the other hand, if no in step P17, in step P33, it is judged whether the home position alignment completion signal is sent from any of the drive controller 80 of the printing press and the drive controllers 90*a* to 90*d* of the first to fourth inking units. If yes in step P33, in step P34, the number of the printing press or the inking units which has sent the home position alignment completion signal is received, and is stored in the memory M22 for storing the number of any of the printing press and the inking units which finishes home position alignment. If no in step P33, the process returns to step P17.

Next, in step P35, the content of the memory M22 for storing the number of the printing press or the inking units which has finished home position alignment is read. In step P36, it is judged whether the home position alignment of all of the drive controller 80 of the printing press and the drive controllers 90*a* to 90*d* of the inking units is completed.

If yes in step P36, in step P37, the home position alignment completion signal is sent to the central controller 30, and the process proceeds to step P38. If no in step P36, the process returns to step P17.

Next, in step P38 it is judged whether the setting rotational speed (slower) is sent from the central controller 30. If yes in step P38, in step P39, the setting rotational speed (slower) is received from the central controller 30, and is stored in the memory M13 for storing the current setting rotational speed. In step P40, the previous setting rotational speed is read from the memory M14.

Next, in step P41, the setting rotational speed transmission interval is read from the memory M19. In step P42, from the previous setting rotational speed and the setting rotational speed transmission interval, the virtual current rotational phase correction value is calculated and stored in the memory M20.

Next, in step P43, the virtual current rotational phase is read from the memory M12. In step P44, the virtual current rotational phase is added to the virtual current rotational phase correction value to calculate the corrected virtual current rotational phase, which is then stored in the memory M21. Subsequently, in step P45, the current rotational phase compensation value of the printing press is read from the memory M15.

Next, in step P46, the corrected virtual current rotational phase is added to the current rotational phase compensation value of the printing press to calculate the corrected virtual current rotational phase of the printing press, which is then stored in the memory M16. In step P46, the rotational phase compensation value of the each inking unit is read from the memory M17.

In step P48, the corrected virtual current rotational phase is added to the current rotational phase compensation value of each inking unit to calculate the corrected virtual current rotational phase of each inking unit, which is then stored in the memory M18. In step P49, the current setting rotational speed (slower) and the corrected virtual current rotational phase of the printing press are sent to drive controller 80 of the printing press.

In step P50, the current setting rotational speed (slower) and the corrected virtual current rotational phase of each inking unit are sent to a corresponding one of the drive controllers 90*a* to 90*d* of the inking units. In step P51, the current setting rotational speed (slower) is then stored in the memory M14 for storing the previous setting rotational speed.

Next, in step P52, the corrected virtual current rotational phase is read from the memory M21. In step P53, the memory M12 for storing the virtual current rotational phase is overwritten with the corrected virtual current rotational phase, and the process returns to step p38.

On the other hand, if no in step P38, in step P54, it is judged whether the instruction to start acceleration and the setting rotational speed are sent from the central controller 30. If yes in step P54, in step P55, the setting rotational speed is received from the central controller 30, and is stored in the memory M23 for storing the setting rotational speed at teaching. If no in step P54, the process returns to step P38.

Next, the acceleration start rotational phase of the printing press is read from the memory M6*a* in step P56. In step P57, the memory M12 for storing the virtual current rotational phase is overwritten with the acceleration start rotational phase of the printing press. Subsequently, in step P58, the setting rotational speed at teaching is read from the memory M23.

Next, in step P59, acceleration signal and the setting rotational speed at teaching are sent to the drive controller 80 of the printing press. In step P60, it is judged whether the setting rotational speed is sent from the central controller 30. If yes in step P60, the setting rotational speed is received from the central controller 30 in step P61, and is stored in the memory M13 for storing the current setting rotational speed.

On the other hand, if no in step P60, in step P62, it is judged whether the instruction to start load detection at constant-speed operation is sent from the central controller 30. If yes in step P62, the process proceeds to later-described step P84, and if no, the process returns to step P60.

Next, in step P63, the previous setting rotational speed is read from the memory M14, and in step P64, the rotational speed correction value at acceleration is read from the memory M24. In step P65, the previous setting rotational speed is added to the rotational speed correction value at acceleration to calculate the corrected current setting rotational speed, which is then stored in the memory M25. In step P66, the current setting rotational speed is read from the memory M13.

Next, in step P67, it is judged whether the corrected current setting rotational speed is less than the current setting rotational speed. If yes in step P67, in step P68, the corrected current setting rotational speed is stored in the memory M13 for storing the current setting rotational speed, and in step P69, the previous setting rotational speed is read from the memory M14. If no in step P67, in step P70, the constant-speed operation start signal is sent to the central controller 30, and the process proceeds to step P69.

Next, in step P71, the setting rotational speed transmission interval is read from the memory M19. In step P72, from the previous setting rotational speed and the setting rotational speed transmission interval, the virtual current rotational phase correction value is calculated and stored in the memory M20.

Next, in step P73, the virtual current rotational phase is read from the memory M12, and then in step P74, the virtual current rotational phase is added to the virtual current rotational phase correction value to calculate the corrected virtual current rotational phase, which is then stored in the memory M21. In step P75, the current rotational phase compensation value of the printing press is read from the memory M15.

Next, in step P76, the corrected virtual current rotational phase is added to the current rotational phase compensation value of the printing press to calculate the corrected virtual current rotational phase of the printing press, which is then stored in the memory M16. In step P77, the current rotational phase compensation value of each inking unit is read from the memory M17.

In step P78, the corrected virtual current rotational phase is added to the current rotational phase compensation value of each inking unit to calculate the corrected virtual current rotational phase of each inking unit, which is then stored in the memory M18. In step P79, the current setting rotational speed and the corrected virtual current rotational phase of the printing press are sent to the drive controller 80 of the printing press.

Next, in step P80, the current setting rotational speed and the corrected virtual current rotational phase of each inking unit are sent to a corresponding one of the drive controllers 90*a* to 90*d* of the inking units. In step P81, the current setting rotational speed is stored in the memory M14 for storing the previous setting rotational speed.

Next, the corrected virtual current rotational phase is read from the memory M21 in step P82. In step P83, the memory M12 for storing the virtual current rotational phase is overwritten with the corrected virtual current rotational phase. The process then returns to step P60.

Next, the constant-speed operation load detection start rotational phase of the printing press is read from the memory M7*a* in the above-described step P84. In step P85, the memory M12 for storing the virtual current rotational phase is overwritten with the constant-speed operation load detection start rotational phase of the printing press.

Next, in step P86, constant-speed operation load detection start signal for the printing press is sent to the drive controller 80 of the printing press. In step P87, it is judged whether the setting rotational speed is sent from the central controller 30. If yes in step P87, in step P88, the setting rotational speed is received from the central controller 30, and is stored in the memory M13 for storing the current setting rotational speed.

Next, in step P89, the previous setting rotational speed is read from the memory M14, and in step P90, the setting rotational speed transmission interval is read from the memory M19. Subsequently, in step P91, from the previous setting rotational speed and the setting rotational speed transmission interval, the virtual current rotational phase correction value is calculated and stored in the memory M20.

Next, in step P92, the virtual current rotational phase is read from the memory M12. In step P93, the virtual current rotational phase is added to the virtual current rotational phase correction value to calculate the corrected virtual current rotational phase, which is then stored in the memory M21. Subsequently, in step P94, the current rotational phase compensation value of the printing press is read from the memory M15.

Next, in step P95, the corrected virtual current rotational phase is added to the current rotational phase compensation value of the printing press to calculate the corrected virtual current rotational phase of the printing press, which is stored in the memory M16. In step P96, the current rotational phase compensation value of each inking unit is read from the memory M17.

Next, in step P97, the corrected virtual current rotational phase is added to the current rotational phase compensation value of each inking unit to calculate the corrected virtual current rotational phase of each inking unit, which is stored in the memory M18. In step P98, the current setting rotational speed and the corrected virtual current rotational phase of the printing press are sent to the drive controller 80 of the printing press.

Next, in step P99, the current setting rotational speed and the corrected virtual current rotational phase of each inking unit are sent to a corresponding one of the drive controllers 90*a* to 90*d* of the inking units. In step P100, the current setting rotational speed is stored in the memory M14 for storing the previous setting rotational speed.

Next, in step P101, the corrected virtual current rotational phase is read from the memory M21. In step P102, the memory M12 for storing the virtual current rotational phase is overwritten with the corrected virtual current rotational phase, and the process returns to step P87.

On the other hand, if no in step P87, in step P103, it is judged whether the instruction to finish load detection is sent from the central controller 30. If yes in step P103, in step P104, the constant-speed operation load detection finish rotational phase of the printing press is read from the memory M8*a*. If no in step P87, the process returns to step P87.

Next, in step P105, the memory M12 for storing the virtual current rotational phase is overwritten with the constant-speed operation load detection finish rotational phase of the printing press. In step P106, constant-speed operation load detection finish signals for the printing groups are sent to the drive controller 80 of the printing press.

Next, in step P107, it is judged whether the setting rotational speed is sent from the central controller 30. If yes in step P107, in step P108, the setting rotational speed is received from the central controller 30, and is stored in the memory M13 for storing the current setting rotational speed. If no in step P107, in step P109, it is judged whether the instruction to start deceleration is sent from the central controller 30. Herein, if yes in step P109, the process proceeds to later-described step P124, and if no, the process returns to step P107.

Next, in step P110, the previous setting rotational speed is read from the memory M14, and then in step P111, the setting rotational speed transmission interval is read from the memory M19. In step P112, from the previous setting rotational speed and the setting rotational speed transmission interval, the virtual current rotational phase correction value is calculated and stored in the memory M20.

Next, in step P113, the virtual current rotational phase is read from the memory M12. In step P114, the virtual current rotational phase is added to the virtual current rotational phase correction value to calculate the corrected virtual current rotational phase, which is then stored in the memory M21. In step P115, the current rotational phase compensation value of the printing press is read from the memory M15.

Next, in step P116, the corrected virtual current rotational phase is added to the current rotational phase compensation value of the printing press to calculate the corrected virtual current rotational phase of the printing press, which is then stored in the memory M16. In step P117, the current rotational phase compensation value of each inking unit is read from the memory M17.

Next, in step P118, the corrected virtual current rotational phase is added to the current rotational phase compensation value of each inking unit to calculate the corrected virtual current rotational phase of each inking unit, which is then stored in the memory M18. In step P118, the current setting rotational speed and the corrected virtual current rotational phase of the printing press are sent to the upstream printing unit group drive controller 70A.

In step P120, the current setting rotational speed and the corrected virtual current rotational phase of each inking unit are sent to a corresponding one of the drive controllers 90*a* to 90*d* of the inking units. In step P121, the current setting rotational speed is stored in the memory M14 for storing the previous setting rotational speed.

Next, the corrected virtual current rotational phase is read from the memory M21 in step P122. The memory M12 for storing the virtual current rotational phase is overwritten with the corrected virtual current rotational phase in step P123. The process then returns to step P107.

Next, the deceleration start rotational phase of the printing press is read from the memory M9*a* in step P124. The memory M12 for storing the virtual current rotational phase is overwritten with the deceleration start rotational phase in step P125. In step P126, deceleration signals are then sent to the drive controller 80 of the printing press.

Next, in step P127, it is judged whether the setting rotational speed (0) is sent from the central controller 30. If yes in step P127, in step P128, the setting rotational speed (0) is received from the central controller 30, and is stored in the memory M13 for storing the current setting rotational speed. If no in step P127, in step P129, it is judged whether the instruction to finish teaching is sent from the central controller 30. If yes in step P129, in step P130, teaching finish signals are sent to the drive controller 80 of the printing press and the drive controllers 90*a* to 90*d* of the inking units, and the process returns to step P1. If no in step P129, the process returns to step P127.

Next, in step P131, the previous setting rotational speed is read from the memory M14, and in step P132, the rotational speed correction value at deceleration is read from the memory M26. In step P133, the rotational speed correction value at deceleration is subtracted from the previous setting rotational speed to calculate the corrected current setting rotational speed, which is then stored in the memory M25.

Next, in step P134, it is judged whether the corrected current setting rotational speed is less than 0. If yes in step P134, in step P135, the corrected current setting rotational speed in the memory M25 is updated with 0. In step P136, the corrected current setting rotational speed is stored in the memory M13 for storing the current rotational speed. If no in step P134, the process directly proceeds to step P136. Next, in step P137, the previous setting rotational speed is read from the memory M14.

Next, in step P138, the setting rotational speed transmission interval is read from the memory M19. In step P139, from the previous setting rotational speed and the setting rotational speed transmission interval, the virtual current rotational phase correction value is calculated and stored in the memory M20.

Next, in step P140, the virtual current rotational phase is read from the memory M12. In step P141, the virtual current rotational phase is added to the virtual current rotational phase correction value to calculate the corrected virtual current rotational phase, which is then stored in the memory M21. In step P142, the current rotational phase compensation value of the printing press is read from the memory M15.

In step P143, the corrected virtual current rotational phase is added to the current rotational phase compensation value of the printing press to calculate the corrected virtual current rotational phase of the printing press, which is then stored in the memory M16. In step P144, the current rotational phase compensation value of each inking unit is read from the memory M17.

In step P145, the corrected virtual current rotational phase is added to the rotational phase compensation value of each inking unit to calculate the corrected virtual current rotational phase of each inking unit, which is then stored in the memory M18. In step P146, the current setting rotational speed and the corrected virtual current rotational phase of the printing press are sent to the drive controller 80 of the printing press.

In step P147, the current setting rotational speed and the corrected virtual current rotational phase of each inking unit are sent to a corresponding one of the drive controllers 90*a* to 90*d* of the inking units. In step P148, the current setting rotational speed is stored in the memory M14 for storing the previous setting rotational speed.

Next, the corrected virtual current rotational phase is read from the memory M21 in step P149, and the memory M12 for storing the virtual current rotational phase is overwritten with the corrected virtual current rotational phase in step P150. Then, the process returns to step P127.

Next, in step P151 to which the process proceeds from step P4, it is judged whether the instruction to start home position alignment is sent from the central controller 30. If yes, in step P152, the instruction to start home position alignment is sent to the drive controllers 80 of the printing press, and 90*a* to 90*d* of the inking units. If no in step P151, in step P153, it is judged whether the instruction to stop synchronizing operation is sent from the central controller 30. If yes, in step P154, the instruction to stop synchronizing operation is sent to the drive controllers 80 of the printing press, and 90*a* to 90*d* of the inking units, and the process returns to step P1. If no in step P153, the process returns to step P151.

Next, in step P155, the rotational phase (0) is written in the memory M12 for storing the virtual current rotational phase. When the setting rotational speed (slower) is sent from the central controller 30 in step P156, in step P157, the setting rotational speed (slower) is received from the central controller 30, and is stored in the memory M13 for storing the current setting rotational speed and the memory M14 for storing the previous setting rotational speed.

Next, in step P158, the virtual current rotational phase is read from the memory M12, and in step P159, the current rotational phase compensation value of the printing press is read from the memory M15. In step P160, the virtual current rotational phase is added to the current rotational phase compensation value of the printing press to calculate the corrected virtual current rotational phase of the printing press, which is then stored in the memory M16.

Next, in step P161, the current rotational phase compensation value of each inking unit is read from the memory M17. In step P162, the virtual rotational phase is added to the current rotational phase compensation value of each inking unit to calculate the corrected virtual current rotational phase of each inking unit, which is then stored in the memory M18.

Next, in step P163, the current setting rotational speed (slower) and the corrected virtual current rotational phase of the printing press are sent to the drive controller 80 of the printing press. In step P164, the current setting rotational speed (slower) and the corrected virtual current rotational phase of each inking unit are sent to a corresponding one of the drive controllers 90*a* to 90*d* of the inking units.

Next, in step P165, it is judged whether the setting rotational speed (slower) is sent from the central controller 30. If yes in step P165, in step P166, the setting rotational speed (slower) is received from the central controller 30, and is stored in the memory M13 for storing the current setting rotational speed. In step P167, the previous setting rotational speed is read from the memory M14.

Next, in step P168, the setting rotational speed transmission interval is read from the memory M19. From the previous setting rotational speed and the setting rotational speed transmission interval, in step P169, the virtual current rotational phase correction value is calculated and stored in the memory M20.

Next, in step P170, the virtual current rotational phase is read from the memory M12. In step P171, the virtual current rotational phase is then added to the virtual current rotational phase correction value to calculate the corrected virtual current rotational phase, which is then stored in the memory M21.

Next, in step P172, the current rotational phase compensation value of the printing press is read from the memory M15. In step P173, the corrected virtual current rotational phase is added to the current rotational phase compensation value of the printing press to calculate the corrected virtual current rotational phase of the printing press, which is then stored in the memory M16. In step P174, the current rotational phase compensation value of each inking unit is read from the memory M17.

In step P175, the corrected virtual current rotational phase is then added to the rotational phase compensation value of each inking unit to calculate the corrected virtual current rotational phase of each inking unit, which is then stored in the memory M18. In step P176, the current setting rotational speed (slower) and the corrected virtual current rotational phase of the printing press are sent to the drive controller 80 of the printing press.

Next, in step P177, the current setting rotational speed (slower) and the corrected virtual current rotational phase of each inking unit are sent to a corresponding one of the drive controllers 90*a* to 90*d* of the inking units. In step P178, the current setting rotational speed (slower) is stored in the memory M14 for storing the previous setting rotational speed.

Next, in step P179, the corrected virtual current rotational phase is read from the memory M21. In step P180, the memory M12 for storing the virtual current rotational phase is overwritten with the corrected virtual current rotational phase, and the process returns to step P165.

On the other hand, if no in step P165, in step P181, it is judged whether the home position alignment completion signal is sent from any of the drive controller 80 of the printing press and the drive controllers 90*a* to 90*d* of the inking units. If yes in step P181, in step P182, the number of the printing press or the inking units which has sent the home position alignment completion signal is received, and is stored in the memory M22 for storing the number of the number of the printing press or the inking units which has finished home position alignment. If no in step P181, the process returns to step P165.

Next, in step P183, the content of the memory M22 for storing the number of the printing press and the inking units which has finished home position alignment is read, and then in step P184, it is judged whether the home position alignment of all of the drive controller 80 of the printing press and the drive controllers 90*a* to 90*d* of the inking units is completed.

If yes in step P184, in P185, the home position alignment completion signal is sent to the central controller 30, and the process proceeds to step P186. If no in step P184, the process returns to step P165.

Next, in step P186, it is judged whether the setting rotational speed (slower) is sent from the central controller 30. If yes in step P186, in step P187, the setting rotational speed (slower) is received from the central controller 30, and is stored in the memory M13 for storing the current setting rotational speed. In step P188, the previous setting rotational speed is read from the memory M14.

Next, in step P189, the setting rotational speed transmission interval is read from the memory M19. In step P190, from the previous setting rotational speed and the setting rotational speed transmission interval, the virtual current rotational phase correction value is calculated and stored in the memory M20.

Next, in step P191, the virtual current rotational phase is read from the memory M12. In step P192, the virtual current rotational phase is added to the virtual current rotational phase correction value to calculate the corrected virtual current rotational phase, which is then stored in the memory M21. In step P193, the current rotational phase compensation value of the printing press is read from the memory M15.

Next, in step P194, the corrected virtual current rotational phase is added to the current rotational phase compensation value of the printing press to calculate the corrected virtual current rotational phase of the printing press, which is then stored in the memory M16. In step P195, the current rotational phase compensation value of each inking unit is read from the memory M17.

Next, in step P196, the corrected virtual current rotational phase is added to the rotational phase compensation value of each inking unit to calculate the corrected virtual current rotational phase of each inking unit, which is then stored in the memory M18. In step P197, the current setting rotational speed (slower) and the corrected virtual current rotational phase of the printing press are sent to the drive controller 80 of the printing press.

Next, in step P198, the current setting rotational speed (slower) and the corrected virtual current rotational phase of each inking unit are sent to a corresponding one of the drive controllers 90*a* to 90*d* of the inking units. In step P199, the current setting rotational speed (slower) is stored in the memory M14 for storing the previous setting rotational speed.

Next, the corrected virtual current rotational phase is read from the memory M21 in step P200. The memory M12 for storing the virtual current rotational phase is overwritten with the corrected virtual current rotational phase in step P201. The process then returns to step P186.

If no in step P186, in step P202, it is judged whether the instruction to start acceleration and the setting rotational speed are sent from the central controller 30. If yes in step P202, in step P203, the setting rotational speed is received from the central controller 30, and is stored in the memory M27 for storing the setting rotational speed at synchronizing operation. If no in step P202, the process returns to step P186.

Next, in step P204, the acceleration start rotational phase of the printing press is read from the memory M6*a*. In step P205, the memory M12 for storing the virtual current rotational phase is overwritten with the acceleration start rotational phase of the printing press. In step P206, setting rotational speed at synchronizing operation is read from the memory M27.

Next, in step P207, the acceleration signal and the setting rotational speed at synchronizing operation are sent to the drive controller 80 of the printing press. In step P208, it is judged whether the setting rotational speed is sent from the central controller 30.

If yes in step P208, in step P209, the setting rotational speed is received from the central controller 30, and is stored in the memory M13 for storing the current setting rotational speed. If no in step P208, in step P210, it is judged whether the instruction to start deceleration is sent from the central controller 30. If yes in step P210, the process proceeds to later-described step P235, and if no, the process returns to step P208.

Next, in step P211, the previous setting rotational speed is read from the memory M14. In step P212, it is judged whether the setting rotational speed received from the central controller 30 is equal to the previous setting rotational speed. If yes in step P212, in step P213, the memory M28 for storing the current state of the printing press is overwritten with 0 (indicating a constant-speed state).

Next, in step P214, the previous setting rotational speed is read from the memory M14. In step P215, the setting rotational speed transmission interval is read from the memory M19. In step P216, from the previous setting rotational speed and the setting rotational speed transmission interval, the virtual current rotational phase correction value is calculated and stored in the memory M20.

Next, in step P217, the virtual current rotational phase is read from the memory M12. In step P218, the virtual current rotational phase is added to the virtual current rotational phase correction value to calculate the corrected virtual current rotational phase, which is then stored in the memory M21. In step P219, the current rotational phase compensation value of the printing press is read from the memory M15.

Next, in step P220, the corrected virtual current rotational phase is added to the current rotational phase compensation value of the printing press to calculate the corrected virtual current rotational phase of the printing press, which is then stored in the memory M16. In step P221, the current rotational phase compensation value of each inking unit is read from the memory M17.

Next, in step P222, the corrected virtual current rotational phase is added to the rotational phase compensation value of each inking unit to calculate the corrected virtual current rotational phase of each inking unit, which is then stored in the memory M18. In step P223, the current state of the printing press is read from the memory M28.

Next, in step P224, the current state of the printing press, the current setting rotational speed, and the corrected virtual current rotational phase of the printing press are sent to the drive controller 80 of the printing press. In step P225, the current setting rotational speed and the corrected virtual current rotational phase of each inking unit are sent to a corresponding one of the drive controllers 90*a* to 90*d* of the inking units.

Next, in step P226, the current setting rotational speed is stored in the memory M14 for storing the previous setting rotational speed. The corrected virtual current rotational phase is read from the memory M21 in step P227. The memory M12 for storing the virtual current rotational phase is overwritten with the corrected virtual current rotational phase in step P228. The process then returns to step P208.

On the other hand, if no in step P212, in step P229, the memory M28 for storing the current state of the printing press is overwritten with 1 (indicating an accelerating state). In step P230, the rotational speed correction value at acceleration is read from the memory M24.

Next, in step P231, the previous setting rotational speed is added to the rotational speed correction value at acceleration to calculate the corrected current setting rotational speed, which is then stored in the memory M25. In step P232, the current setting rotational speed is read from the memory M13.

Next, in step P233, it is judged whether the corrected current setting rotational speed is less than the current setting rotational speed. If yes in step P233, in step P234, the corrected current setting rotational speed is stored in the memory M13 for storing the current setting rotational speed, and the process then proceeds to step P214. If no in step P233, the process directly proceeds to step P214.

Next, in step P235 to which the process proceeds from step P210, the deceleration start rotational phase of the printing press is read from the memory M9*a*. In step P236, the memory M12 for storing the virtual current rotational phase is overwritten with the deceleration start rotational phase of the printing press.

Next, in step P237, the deceleration signals are sent to the drive controller 80 of the printing press. In step P238, it is then judged whether the setting rotational speed is sent from the central controller 30. If yes in step P238, in step P239, the setting rotational speed is received from the central controller 30 and stored in the memory M13 for storing the current setting rotational speed.

On the other hand, if no in step P238, in step P240, it is judged whether an instruction to stop synchronizing operation is sent from the central controller 30. If yes in step P240, in step P241, instructions to stop synchronizing operation are sent to the drive controller 80 of the printing press and the drive controllers 90*a* to 90*d* of the inking units, and the process returns to step P151. If no in steps P240, the process returns to step P238.

Next, in step P242, the previous setting rotational speed is read from the memory M14. In step P243, the memory M28 for storing the current state of the printing press is overwritten with 2 (indicating a decelerating state). In step P244, the rotational speed correction value at deceleration is read from the memory M26. In step P245, the rotational speed correction value at deceleration is subtracted from the previous setting rotational speed to calculate the corrected current setting rotational speed, which is stored in the memory M25.

Next, in step P246, it is judged whether the corrected current setting rotational speed is less than 0. If yes in step P246, in step P247, the corrected current setting rotational speed in the memory M25 is updated with 0, and in step P248, the corrected current setting rotational speed is stored in the memory M13 for storing the current setting rotational speed. If no in step P246, the process directly proceeds to step P248.

Next, in step P249, the previous setting rotational speed is read from the memory M14, and in step P250, the setting rotational speed transmission interval is read from the memory M19.

Next, in step P251, from the previous setting rotational speed and the setting rotational speed transmission interval, the virtual current rotational phase correction value is calculated and stored in the memory M20. In step P252, the virtual current rotational phase is read from the memory M12.

Next, in step P253, the virtual current rotational phase is added to the virtual current rotational phase correction value to calculate the corrected virtual current rotational phase, which is then stored in the memory M21. In step P254, the current rotational phase compensation value of the printing press is read from the memory M15.

Next, in step P255, the corrected virtual current rotational phase is added to the current rotational phase compensation value of the printing press to calculate the corrected virtual current rotational phase of the printing press, which is then stored in the memory M16. In step P256, the current rotational phase compensation value of each inking unit is read from the memory M17.

Next, in step P257, the corrected virtual current rotational phase is added to the rotational phase compensation value of each inking unit to calculate the corrected virtual current rotational phase of each inking unit, which is then stored in the memory M18. In step P258, the current state of the printing press is read from the memory M28.

Next, in step P259, the current state of the printing press, the current setting rotational speed, and the corrected virtual current rotational phase of the printing press are sent to the drive controller 80 of the printing press. In step P260, the current setting rotational speed and the corrected virtual current rotational phase of each inking unit are sent to a corresponding one of the drive controllers 90*a* to 90*d* of the inking units.

Next, in step P261, the current setting rotational speed is stored in the memory M14 for storing the previous setting rotational speed, and then in step P262, the corrected virtual current rotational phase is read from the memory M21. In step P263, the memory M12 for storing the virtual current rotational phase is overwritten with the corrected virtual current rotational phase, and the process returns to step P238. Hereinafter, the aforementioned steps are repeated.

According to the above-described operational flows, the teaching instruction and the synchronizing operation instruction are sent to the drive controller 80 of the printing press and the drive controllers 90*a* to 90*d* of the inking units.

The drive controller 80 of the printing press operates according to the operational flows shown in FIGS. 16A and 16B, 17A to 17E, 18, 19A to 19E, 20, 21A and 21B, 22A to 22E, 23, 24A and 24B, 25A and 25B, 26, 27A and 27B, and 28.

Specifically, in step P1, it is judged whether the teaching instruction is sent from the virtual master generator 60. If yes in step P1, the process proceeds to step P2. When the instruction to start home position alignment is sent from the virtual master generator 60 in step P2, in step P3, it is judged whether the current setting rotational speed (slower) and the corrected virtual current rotational phase of the printing press are sent from the virtual master generator 60. If no in step P1, the process proceeds to later-described step P302.

If yes in step P3, in step P4, the current setting rotational speed (slower) and the corrected virtual current rotational phase of the printing press are received from the virtual master generator 60, and are stored in the memory M13*b* for storing the current setting rotational speed and the memory M29 for storing the virtual current rotational phase of the printing press, respectively. In step P5, the count value is read from the counter 45 for detecting current rotational phase of the printing press, and is stored in the memory M4*b*.

Next, in step P6, from the count value of the counter 45 for detecting current rotational phase of the printing press, the current rotational phase of the printing press is calculated and stored in the memory M5*b*. In step P7, the current rotational phase of the printing press is subtracted from the virtual current rotational phase of the printing press to calculate the current rotational phase difference of the printing press, which is then stored in the memory M30.

Next, in step P8, from the current rotational phase difference of the printing press, the absolute value of the current rotational phase difference of the printing press is calculated and stored in the memory M31. In step P9, the tolerance of the current rotational phase difference of the printing press is read from the memory M32.

Next, in step P10, it is judged whether the absolute value of the current rotational phase difference of the printing press is equal to or less than the tolerance of the current rotational phase difference of the printing press. If yes in step P10, the current setting rotational speed (slower) is read from the memory M13*b* in step P11, and if no, the process proceeds to later-described step P15.

Next, in step P12, the memory M33 for storing the instruction rotational speed is overwritten with the current setting rotational speed (slower). In step P13, the instruction rotational speed is outputted to the drive motor driver 62. In step P14, the home position alignment completion signal is sent to the virtual master generator 60, and the process returns to step P3.

Next, in step P15, the current rotational phase difference of the printing press-setting rotational speed compensation value conversion table is read from the memory M34, and in step P16, the current rotational phase difference of the printing press is read from the memory M30.

Next, in step P17, by using the current rotational phase difference of the printing press-setting rotational speed compensation value conversion table, the setting rotational speed compensation value is obtained from the current rotational phase difference of the printing press, and is stored in the memory M35. In step P18, the current setting rotational speed (slower) is read from the memory M13*b*.

Next, in step P19, the current setting rotational speed (slower) is added to the setting rotational speed compensation value to calculate the instruction rotational speed, which is then stored in the memory M33. In step P20, the instruction rotational speed is outputted to the drive motor driver 62, and the process returns to step P3.

If no in step P3, in step P21, it is judged whether the acceleration signal and setting rotational speed at teaching are sent from the virtual master generator. If yes in step P21, in step P22, the setting rotational speed is received from the virtual master generator 60, and is stored in the memory M23*b* for storing the setting rotational speed at teaching. If no in step P21, the process returns to step P3.

Next, in step P23, reset and enable signals are outputted to the acceleration/deceleration counter 63, and in step P24, the output of the reset signal to the acceleration/deceleration counter 63 is stopped.

Next, in step P25, it is judged whether clock pulse is outputted from the rotary encoder 18 for detecting rotational phase of the printing press. If yes in step P25, in step P26, a standard rotational speed of the load motor is read from the load motor standard rotational speed (torque value) setting unit 64, and is stored in the memory M36 for storing the rotational speed of the first load motor. If no in step P25, the process proceeds to step P27.

Next, in step P27, it is judged whether the current setting rotational speed and the corrected virtual current rotational phase of the printing press are sent from the virtual master generator 60. If yes, the process proceeds to later-described step P95. On the other hand, if no in step P27, in step P28, it is judged whether the constant-speed operation load detection start signal for the printing press is sent from the virtual master generator 60. If yes in step P28, the process proceeds to later-described step P111. If no, the process returns to step P25.

Next, in step P29, the count value is read from the counter 45 for detecting current rotational phase of the printing press, and is stored in the memory M4*b*. In step P30, from the count value of the counter 45 for detecting current rotational phase of the printing press, the current rotational phase of the printing press is calculated and stored in the memory M5*b*.

Next, in step P31, the first plate-cylinder notch move-up start rotational phase is read from the memory M37. In step P32, the first plate-cylinder notch move-up finish rotational phase is read from the memory M38. Next, in step P33, it is judged whether the current rotational phase of the printing press is equal to or more than the first plate-cylinder notch move-up start rotational phase, and is equal to or less than the first plate-cylinder notch move-up finish rotational phase.

If yes in step P33, in step P34, the rotational speed of the first load motor 17*a* is read from the memory M36, and if no, the process proceeds to later-described step P37. Next, in step P35, the load motor rotational speed compensation value related to move-up of the notch of the plate cylinder is read from the memory M39. In step P36, the load motor rotational speed compensation value related to move-up of the notch of the plate cylinder is subtracted from the rotational speed of the first load motor 17*a*, and the memory M36 for storing the rotational speed of the first load motor is overwritten with the result.

Next, in step P37, the standard rotational speed of the load motor is read from the load motor standard rotational speed (torque value) setting unit 64, and is stored in the memory M40 for storing the rotational speed of the second load motor.

Then, in step P38, the current rotational phase of the printing press is read from the memory M5*b*.

Next, in step P39, the second plate-cylinder notch move-up start rotational phase is read from the memory M41. In step P40, the second plate-cylinder notch move-up finish rotational phase is read from the memory M42. Next, in step P41, it is judged whether the current rotational phase of the printing press is equal to or more than the second plate-cylinder notch move-up start rotational phase, and is equal to or less than the second plate-cylinder notch move-up finish rotational phase.

If yes in step P41, in step P42, the rotational speed of the second load motor 17*b* is read from the memory M40, and if no, the process proceeds to later-described step P45. Next, in step P43, the load motor rotational speed compensation value related to move-up of the notch of the plate cylinder is read from the memory M39. In step P44, the load motor rotational speed compensation value related to move-up of the notch of the plate cylinder is subtracted from rotational speed of the second load motor, and the memory M40 for storing the rotational speed of the second load motor is overwritten with the result.

Next, in step P45, the standard rotational speed of the load motor is read from the load motor standard rotational speed (torque value) setting unit 64, and is stored in the memory M43 for storing the rotational speed of the third load motor. Then, in step P46, the current rotational phase of the printing press is read from the memory M5*b*.

Next, in step P47, the third plate-cylinder notch move-up start rotational phase is read from the memory M44. In step P48, the third plate-cylinder notch move-up finish rotational phase is read from the memory M45.

Next, in step P49, it is judged whether the current rotational phase of the printing press is equal to or more than the third plate-cylinder notch move-up start rotational phase, and is equal to or less than the third plate-cylinder notch move-up finish rotational phase. If yes in step P49, in step P50, the rotational speed of the third load motor 17*c* is read from the memory M43. If no in step P49, the process proceeds to later-described step P53.

Next, in step P51, the load motor rotational speed compensation value related to move-up of the notch of the plate cylinder is read from the memory M39. In step P52, the load motor rotational speed compensation value related to move-up of the notch of the plate cylinder is subtracted from the rotational speed of the third load motor, and the memory M43 for storing the rotational speed of third load motor is overwritten with the result.

Next, in step P53, the standard rotational speed of the load motor is read from the load motor standard rotational speed (torque value) setting unit 64, and is stored in the memory M46 for storing the rotational speed of the fourth load motor. Then, in step P54, the current rotational phase of the printing press is read from the memory M5*b*.

Next, in step P55, the fourth plate-cylinder notch move-up start rotational phase is read from the memory M47. In step P56, the fourth plate-cylinder notch move-up finish rotational phase is read from the memory M48. In step P57, it is judged whether the current rotational phase of the printing press is equal to or more than the fourth plate-cylinder notch move-up start rotational phase, and is equal to or less than the fourth plate-cylinder notch move-up finish rotational phase.

If yes in step P41, in step P57, the rotational speed of the fourth load motor 17*d* is read from the memory M46, and if no, the process proceeds to later-described step P61. Next, in step P59, the load motor rotational speed compensation value related to move-up of the notch of the plate cylinder is read from the memory M39. In step P60, the load motor rotational speed compensation value related to move-up of the notch of the plate cylinder is subtracted from the rotational speed of the fourth load motor, and the memory M46 for storing the rotational speed of the fourth motor is overwritten with the result.

Next, in step P61, the rotational speed of the first load motor 17*a* is read from the memory M36. In step P62, the rotational speed of the first load motor 17*a* is outputted to the first load motor driver 66*a*.

Next, in step P63, the rotational speed of the second load motor 17*b* is read from the memory M40. In step P64, the rotational speed of the second load motor 17*b* is outputted to the second load motor driver 66*b*.

Next, in step P65, the rotational speed of the third load motor 17*c* is read from the memory M43. In step P66, the rotational speed of the third load motor 17*c* is outputted to the third load motor driver 66*c*.

Next, in step P67, the rotational speed of the fourth load motor 17*d* is read from the memory M46. In step P68, the rotational speed of the fourth load motor 17*d* is outputted to the fourth load motor driver 66*d*.

Next, in step P69, the count value is read from the acceleration/deceleration counter 63, and is stored in the memory M49. In step P70, the electric current value is read from the drive motor driver 62, and is stored in the memory M50. Next, in step P71, the standard electric current value is read from the memory M51.

Next, in step P72, the standard electric current value is subtracted from the electric current value to calculate the electric current value difference, which is then stored in the memory M52. Next, in step P73, the electric current value difference-load motor rotational speed compensation value conversion table is read from the memory M53. In step P74, by using the electric current value difference-load motor rotational speed compensation value conversion table, the load motor rotational speed compensation value is obtained from the electric current value difference, and is stored in the memory M54.

Next, in step P75, the rotational speed of the first load motor 17*a* is read from the memory M36. In step P76, the load motor rotational speed compensation value is subtracted from the rotational speed of the first load motor 17*a* to calculate the compensated rotational speed of the first load motor, which is then stored in the memory M55. Next, in step P77, the setting rotational speed at teaching is read from the memory M23*b*.

Next, in step P78, the count value of the acceleration/deceleration counter 63 is read from the memory M49. In step P79, the compensated rotational speed of the first load motor 17*a* is stored at an address position of the memory M59 for storing the rotational speed of the load motor at acceleration, the address position corresponding to the count value of the acceleration/deceleration counter for the setting rotational speed at teaching for the first load motor.

Next, in step P80, the rotational speed of the second load motor 17*b* is read from the memory M40. In step P81, the load motor rotational speed compensation value is subtracted from the rotational speed of the second load motor 17*b* to calculate the compensated rotational speed of the second load motor, which is then stored in the memory M56. Next, in step P82, the setting rotational speed at teaching is read from the memory M23*b*.

Next, in step P83, the count value of the acceleration/deceleration counter 63 is read from the memory M49. In step P84, the compensated rotational speed of the second load motor 17*b* is stored at an address position of the memory M59 for storing the rotational speed of the load motor at acceleration, the address position corresponding to the count value of the acceleration/deceleration counter for the setting rotational speed at teaching for the second load motor.

Next, in step P85, the rotational speed of the third load motor 17*c* is read from the memory M43. In step P86, the load motor rotational speed compensation value is subtracted from the rotational speed of the third load motor 17*c* to calculate the compensated rotational speed of the third load motor, which is then stored in the memory M57. Next, in step P87, the setting rotational speed at teaching is read from the memory M23*b*.

Next, in step P88, the count value of the acceleration/deceleration counter 63 is read from the memory M49. Next, in step P89, the compensated rotational speed of the third load motor 17*c* is stored at an address position of the memory M59 for storing the rotational speed of the load motor at acceleration, the address position corresponding to the count value of the acceleration/deceleration counter for the setting rotational speed at teaching for the third load motor.

Next, in step P90, the rotational speed of the fourth load motor 17*d* is read from the memory M46. In step P91, the load motor rotational speed compensation value is subtracted from the rotational speed of the fourth load motor 17*d* to calculate the compensated rotational speed of the fourth load motor, which is then stored in the memory M58. Next, in step P92, the setting rotational speed at teaching is read from the memory M23*b*.

Next, in step P93, the count value of the acceleration/deceleration counter 63 is read from the memory M49. Next, in step P94, the compensated rotational speed of the fourth load motor 17*d* is stored at an address position of the memory M59 for storing the rotational speed of the load motor at acceleration, the address position corresponding to the count value of the acceleration/deceleration counter for the setting rotational speed at teaching for the fourth load motor. Then, the process returns to step P25.

Next, in step P95 to which the process proceeds from step P27, the current setting rotational speed and the corrected virtual current rotational phase of the printing press are received from the virtual master generator 60, and stored in the memory M13*b* for storing the current setting rotational speed and the memory M29 for storing the virtual current rotational phase of the printing press, respectively. In step P96, the count value is read from the counter 45 for detecting current rotational phase of the printing press, and is stored in the memory M4*b*.

Next, in step P97, from the count value of the counter 45 for detecting current rotational phase of the printing press, the current rotational phase of the printing press is calculated and is stored in the memory M5*b*. In step P98, the current rotational phase of the printing press is subtracted from the virtual current rotational phase of the printing press to calculate the current rotational phase difference of the printing press, which is then stored in the memory M30.

Next, in step P99, from the current rotational phase difference of the printing press, the absolute value of the current rotational phase difference of the printing press is calculated and stored in the memory M31. In step P100, the tolerance of the current rotational phase difference of the printing press is read from the memory M32.

Next, in step P101, it is judged whether the absolute value of the current rotational phase difference of the printing press is equal to or less than the tolerance of the current rotational phase difference of the printing press. If yes in step P101, the current setting rotational speed is read from the memory M13*b* in step P102, and if no, the process proceeds to later-described step P105.

Next, in step P103, the memory M33 for storing the instruction rotational speed is overwritten with the current setting rotational speed. In step P104, the instruction rotational speed is outputted to the drive motor driver 62, and the process returns to step P25. Next, in step P105, the current rotational phase difference of the printing press-setting rotational speed compensation value conversion table is read from the memory M34.

Next, in step P106, the current rotational phase difference of the printing press is read from the memory M30. In step P107, by using the current rotational phase difference of the printing press-setting rotational speed compensation value conversion table, the setting rotational speed compensation value is obtained from the current rotational phase difference of the printing press, and is stored in the memory M35.

Next, in step P108, the current setting rotational speed is read from the memory M13*b*. In step P109, the current setting rotational speed is added to the setting rotational speed compensation value to calculate the instruction rotational speed, which is then stored in the memory M33. Next, in step P110, the instruction rotational speed is outputted to the drive motor driver 62, and the process returns to step P25.

Next, in step P111 to which the process proceeds from step P28, it is judged whether clock pulse is outputted from the rotary encoder 18 for detecting rotational phase of the printing press. If yes in step P111, in step P112, the standard rotational speed of the load motor is read from the load motor standard rotational speed (torque value) setting unit 64, and is stored in the memory M36 for storing the rotational speed of the first load motor. If no in step P111, the process proceeds to step P113.

Next, in step P113, it is judged whether the current rotational speed and the corrected virtual current rotational phase of the printing press are sent from the virtual master generator 60. If yes, the process proceeds to later-described step P180. On the other hand, if no in step P113, in step P114, it is judged whether the constant-speed operation load detection finish signal of the printing press is sent from the virtual master generator 60. If yes in step P114, the process proceeds to later-described step P196. If no, the process returns to step P111.

Next, in step P115, the count value is read from the counter 45 for detecting current rotational phase of the printing press, and is stored in the memory M4*b*. In step P116, from the count value of the counter 45 for detecting current rotational phase of the printing press, the current rotational phase of the printing press is calculated and stored in the memory M5*b*.

Next, in step P117, the first plate-cylinder notch move-up start rotational phase is read from the memory M37. In step P118, the first plate-cylinder notch move-up finish rotational phase is read from the memory M38. Next, in step P119, it is judged whether the current rotational phase of the printing press is equal to or more than the first plate-cylinder notch move-up start rotational phase, and is equal to or less than the first plate-cylinder notch move-up finish rotational phase.

If yes in step P119, in step P120, the rotational speed of the first load motor 17*a* is read from the memory M36, and if no, the process proceeds to later-described step P123. Next, in step P121, the load motor rotational speed compensation value related to move-up of the notch of the plate cylinder is read from the memory M39. In step P122, the load motor rotational speed compensation value related to move-up of the notch of the plate cylinder is subtracted from rotational speed of the first load motor 17*a*, and the memory M36 for storing the rotational speed of the first load motor is overwritten with the result.

Next, in step P123, standard rotational speed of the load motor is read from the load motor standard rotational speed (torque value) setting unit 64, and is stored in the memory M40 for storing the rotational speed of the second load motor. Then, in step P124, the current rotational phase of the printing press is read from the memory M5*b*.

Next, in step P125, the second plate-cylinder notch move-up start rotational phase is read from the memory M41. In step P126, the second plate-cylinder notch move-up finish rotational phase is read from the memory M42. Next, in step P127, it is judged whether the current rotational phase of the printing press is equal to or more than the second plate-cylinder notch move-up start rotational phase, and is equal to or less than the second plate-cylinder notch move-up finish rotational phase.

If yes in step P127, in step P128, the rotational speed of the second load motor 17*b* is read from the memory M40, and if no, the process proceeds to later-described step P131. Next, in step P129, the load motor rotational speed compensation value related to move-up of the notch of the plate cylinder is read from the memory M39. In step P130, the load motor rotational speed compensation value related to move-up of the notch of the plate cylinder is subtracted from rotational speed of the second load motor, and the memory M40 for storing the rotational speed of the second load motor is overwritten with the result.

Next, in step P131, the standard rotational speed of the load motor is read from the load motor standard rotational speed (torque value) setting unit 64, and is stored in the memory M43 for storing the rotational speed of the third load motor. Then, in step P132, the current rotational phase of the printing press is read from the memory M5*b*.

Next, in step P133, the third plate-cylinder notch move-up start rotational phase is read from the memory M44. In step P134, the third plate-cylinder notch move-up finish rotational phase is read from the memory M45.

Next, in step P135, it is judged whether the current rotational phase of the printing press is equal to or more than the third plate-cylinder notch move-up start rotational phase, and is equal to or less than the third plate-cylinder notch move-up finish rotational phase. If yes in step P135, in step P136, the rotational speed of the third load motor 17*c* is read from the memory M43, and if no, the process proceeds to later-described step P139.

Next, in step P137, the load motor rotational speed compensation value related to move-up of the notch of the plate cylinder is read from the memory M39. In step P138, the load motor rotational speed compensation value related to move-up of the notch of the plate cylinder is subtracted from the rotational speed of the third load motor, and the memory M43 for storing the rotational speed of third load motor is overwritten with the result.

Next, in step P139, the standard rotational speed of the load motor is read from the load motor standard rotational speed (torque value) setting unit 64, and is stored in the memory M46 for storing the rotational speed of the fourth load motor. Then, in step P140, the current rotational phase of the printing press is read from the memory M5*b*.

Next, in step P141, the fourth plate-cylinder notch move-up start rotational phase is read from the memory M47. In step P142, the fourth plate-cylinder notch move-up finish rotational phase is read from the memory M48. In step P143, it is judged whether the current rotational phase of the printing press is equal to or more than the fourth plate-cylinder notch move-up start rotational phase, and is equal to or less than the fourth plate-cylinder notch move-up finish rotational phase.

If yes in step P143, in step P144, the rotational speed of the fourth load motor 17*d* is read from the memory M46, and if no, the process proceeds to later-described step P147. Next, in step P145, the load motor rotational speed compensation value related to move-up of the notch of the plate cylinder is read from the memory M39. In step P146, the load motor rotational speed compensation value related to move-up of the notch of the plate cylinder is subtracted from the rotational speed of the fourth load motor, the memory M46 for storing the rotational speed of the fourth motor is overwritten with the result.

Next, in step P147, rotational speed of the first load motor 17*a* is read from the memory M36. In step P148, the rotational speed of the first load motor 17*a* is outputted to the first load motor driver 66*a*.

Next, in step P149, rotational speed of the second load motor 17*b* is read from the memory M40. In step P150, the rotational speed of the second load motor 17*b* is outputted to the second load motor driver 66*b*.

Next, in step P151, the rotational speed of the third load motor 17*c* is read from the memory M43. In step P152, the rotational speed of the third load motor 17*c* is outputted to the third load motor driver 66*c*.

Next, in step P153, the rotational speed of the fourth load motor 17*d* is read from the memory M46. In step P154, the rotational speed of the fourth load motor 17*d* is outputted to the fourth load motor driver 66*d*.

Next, in step P155, the electric current value is read from the drive motor driver 62, and is stored in the memory M50. Next, in step P156, the standard electric current value is read from the memory M51.

Next, in step P157, the standard electric current value is subtracted from the electric current value to calculate the electric current value difference, which is then stored in the memory M52. Next, in step P158, the electric current value difference-load motor rotational speed compensation value conversion table is read from the memory M53. In step P159, by using the electric current value difference-load motor rotational speed compensation value conversion table, the load motor rotational speed compensation value is obtained from the electric current value difference, and is stored in the memory M54.

Next, in step P160, the rotational speed of the first load motor 17*a* is read from the memory M36. In step P161, the load motor rotational speed compensation value is subtracted from the rotational speed of the first load motor 17*a* to calculate the compensated rotational speed of the first load motor, which is then stored in the memory M55. Next, in step P162, the setting rotational speed at teaching is read from the memory M23*b*.

Next, in step P163, the current rotational phase of the printing press is read from the memory M5*b*. In step P164, the compensated rotational speed of the first load motor 17*a* is stored at an address position of the memory M60 for storing the rotational speed of the load motor at constant-speed operation, the address position corresponding to the current rotational phase of the printing press for the setting rotational speed at teaching for the first load motor.

Next, in step P162, the rotational speed of the second load motor 17*b* is read from the memory M40. In step P166, the load motor rotational speed compensation value is subtracted from the rotational speed of the second load motor 17*b* to calculate the compensated rotational speed of the second load motor, which is then stored in the memory M56. Next, in step P167, the setting rotational speed at teaching is read from the memory M23*b*.

Next, in step P168, the current rotational phase of the printing press is read from the memory M5*b*. In step P169, the compensated rotational speed of the second load motor 17*b* is stored at an address position of the memory M60 for storing the rotational speed of the load motor at constant-speed operation, the address position corresponding to the current rotational phase of the printing press for the setting rotational speed at teaching for the second load motor.

Next, in step P170, the rotational speed of the third load motor 17*c* is read from the memory M43. In step P171, the load motor rotational speed compensation value is subtracted from the rotational speed of the third load motor 17*c* to calculate the compensated rotational speed of the third load motor, which is then stored in the memory M57. Next, in step P172, the setting rotational speed at teaching is read from the memory M23*b*.

Next, in step P173, the current rotational phase of the printing press is read from the memory M5*b*. In step P174, the compensated rotational speed of the third load motor 17*c* is stored at an address position of the memory M60 for storing the rotational speed of the load motor at constant-speed operation, the address position corresponding to the current rotational phase of the printing press for the setting rotational speed at teaching for the third load motor.

Next, in step P175, the rotational speed of the fourth load motor 17*d* is read from the memory M46. In step P176, the load motor rotational speed compensation value is subtracted from the rotational speed of the fourth load motor 17*d* to calculate the compensated rotational speed of the fourth load motor, which is then stored in the memory M58. Next, in step P177, the setting rotational speed at teaching is read from the memory M23*b*.

Next, in step P178, the current rotational phase of the printing press is read from the memory M5*b*. In step P179, the compensated rotational speed of the fourth load motor 17*d* is stored at an address position of the memory M60 for storing the rotational speed of the load motor at constant-speed operation, the address position corresponding to the current rotational phase of the printing press for the setting rotational speed at teaching for the fourth load motor. Then, the process returns to step P111.

Next, in step P180 to which the process proceeds from step P113, the current setting rotational speed and the corrected virtual current rotational phase of the printing press are received from the virtual master generator 60, and stored in the memory M13*b* for storing the current setting rotational speed and the memory M29 for storing the virtual current rotational phase of the printing press, respectively. In step P181, the count value is read from the counter 45 for detecting current rotational phase of the printing press and stored in the memory M4*b*.

Next, in step P182, from the count value of the counter 45 for detecting current rotational phase of the printing press, the current rotational phase of the printing press is calculated and stored in the memory M5*b*. In step P183, the current rotational phase of the printing press is subtracted from the virtual current rotational phase of the printing press to calculate the current rotational phase difference of the printing press, which is then stored in the memory M30.

Next, in step P184, from the current rotational phase difference of the printing press, the absolute value of the current rotational phase difference of the printing press is calculated and stored in the memory M31. In step P185, the tolerance of the current rotational phase difference of the printing press is read from the memory M32.

Next, in step P186, it is judged whether the absolute value of the current rotational phase difference of the printing press is equal to or less than the tolerance of the current rotational phase difference of the printing press. If yes in step P186, the current setting rotational speed is read from the memory M13*b* in step P187, and if no, the process proceeds to later-described step P190.

Next, in step P188, the memory M33 for storing the instruction rotational speed is overwritten with the current setting rotational speed. In step P189, the instruction rotational speed is outputted to the drive motor driver 62, and the process returns to step P111. Next, in step P190, the current rotational phase difference of the printing press-setting rotational speed compensation value conversion table is read from the memory M34.

Next, in step P191, the current rotational phase difference of the printing press is read from the memory M30. In step P192, by using the current rotational phase difference of the printing press-setting rotational speed compensation value conversion table, the setting rotational speed compensation value is obtained from the current rotational phase difference of the printing press, and is stored in the memory M35.

Next, in step P193, the current setting rotational speed is read from the memory M13*b*. In step P194, the current setting rotational speed is added to the setting rotational speed compensation value to calculate the instruction rotational speed, which is then stored in the memory M33. Next, in step P195, the instruction rotational speed is outputted to the drive motor driver 62, and the process returns to step P111.

Next, in step P196 to which the process proceeds from step P114, it is judged whether the current setting rotational speed and the corrected virtual current rotational phase of the printing press are sent from the virtual master generator 60. If yes in step P196, in step P97, the current setting rotational speed and the corrected virtual current rotational phase of the printing press are received from the virtual master generator 60 and stored in the memory M13*b* for storing the current setting rotational speed and the memory M29 for storing the virtual current rotational phase of the printing press, respectively.

Next, in step P198, the count value is read from the counter 45 for detecting current rotational phase of the printing press and stored in the memory M4*b*. In step P199, from the count value of the counter 45 for detecting current rotational phase of the printing press, the current rotational phase of the printing press is calculated and stored in the memory M5*b*. Next, in step P200, the current rotational phase of the printing press is subtracted from the virtual current rotational phase of the printing press to calculate the current rotational phase difference of the printing press, which is then stored in the memory M30.

Next, in step P201, from the current rotational phase difference of the printing press, the absolute value of the current rotational phase difference of the printing press is calculated and stored in the memory M31. In step P202, the tolerance of the current rotational phase difference of the printing press is read from the memory M32.

Next, in step P203, it is judged whether the absolute value of the current rotational phase difference of the printing press is equal to or less than the tolerance of the current rotational phase difference of the printing press. If yes in step P203, the current setting rotational speed (slower) is read from the memory M13*b* in step P204, and if no, the process proceeds to later-described step P207.

Next, in step P205, the memory M33 for storing the instruction rotational speed is overwritten with the current setting rotational speed. In step P206, the instruction rotational speed is outputted to the drive motor driver 62, and the process returns to step P196. In step P207, the current rotational phase difference of the printing press-setting rotational speed compensation value conversion table is read from the memory M34.

Next, in step P208, the current rotational phase difference of the printing press is read from the memory M30. In step P209, by using the current rotational phase difference of the printing press-setting rotational speed compensation value conversion table, the setting rotational speed compensation value is obtained from the current rotational phase difference of the printing press, and is stored in the memory M35.

Next, in step P210, the current setting rotational speed is read from the memory M13*b*. In step P211, the current setting rotational speed is added to the setting rotational speed compensation value to calculate the instruction rotational speed, which is then stored in the memory M33. In step P212, the instruction rotational speed is outputted to the drive motor driver 62, and the process returns to step P196.

On the other hand, if no in step P196, in step P213, it is judged whether the deceleration signal is sent from the virtual master generator 60. If yes in step P213, the process proceeds to step P214, and if no, the process returns to step P196.

Next, in step P214, the reset and enable signals are outputted to the acceleration/deceleration counter 63, and in step P215, the output of the reset signal to the acceleration/deceleration counter 63 is stopped.

Next, in step P216, it is judged whether clock pulse is outputted from the rotary encoder 18 for detecting rotational phase of the printing press. If yes in step P216, in step P217, standard rotational speed of the load motor is read from the load motor standard rotational speed (torque value) setting unit 64, and is stored in the memory M36 for storing the rotational speed of the first load motor. If no in step P216, the process proceeds to step P218.

Next, in step P218, it is judged whether the current setting rotational speed and the corrected virtual current rotational phase of the printing press are sent from the virtual master generator 60. If yes, the process proceeds to later-described step P286. On the other hand, if no in step P218, in step P219, it is judged whether the teaching finish signal is sent from the virtual master generator 60. If yes in step P219, the process returns to step P1. If no, the process returns to step P216.

Next, in step P220, the count value is read from the counter 45 for detecting current rotational phase of the printing press, and is stored in the memory M4*b*. In step P221, from the count value of the counter 45 for detecting current rotational phase of the printing press, the current rotational phase of the printing press is calculated and stored in the memory M5*b*.

Next, in step P222, the first plate-cylinder notch move-up start rotational phase is read from the memory M37. In step P223, the first plate-cylinder notch move-up finish rotational phase is read from the memory M38. Next, in step P224, it is judged whether the current rotational phase of the printing press is equal to or more than the first plate-cylinder notch move-up start rotational phase, and is equal to or less than the first plate-cylinder notch move-up finish rotational phase.

If yes in step P224, in step P225, the rotational speed of the first load motor 17*a* is read from the memory M36, and if no, the process proceeds to later-described step P228. Next, in step P226, the load motor rotational speed compensation value related to move-up of the notch of the plate cylinder is read from the memory M39. In step P227, the load motor rotational speed compensation value related to move-up of the notch of the plate cylinder is subtracted from the rotational speed of the first load motor 17*a*, and the memory M36 for storing the rotational speed of the first load motor is overwritten with the result.

Next, in step P228, the standard rotational speed of the load motor is read from the load motor standard rotational speed (torque value) setting unit 64, and is stored in the memory M40 for storing the rotational speed of the second load motor. Then, in step P229, the current rotational phase of the printing press is read from the memory M5*b*.

Next, in step P230, the second plate-cylinder notch move-up start rotational phase is read from the memory M41. In step P231, the second plate-cylinder notch move-up finish rotational phase is read from the memory M42. Next, in step P232, it is judged whether the current rotational phase of the printing press is equal to or more than the second plate-cylinder notch move-up start rotational phase, and is equal to or less than the second plate-cylinder notch move-up finish rotational phase.

If yes in step P232, in step P233, the rotational speed of the second load motor 17*b* is read from the memory M40, and if no, the process proceeds to later-described step P236. Next, in step P234, the load motor rotational speed compensation value related to move-up of the notch of the plate cylinder is read from the memory M39. In step P235, the load motor rotational speed compensation value related to move-up of the notch of the plate cylinder is subtracted from rotational speed of the second load motor, and the memory M40 for storing the rotational speed of the second load motor is overwritten with the result.

Next, in step P236, the standard rotational speed of the load motor is read from the load motor standard rotational speed (torque value) setting unit 64, and is stored in the memory M43 for storing the rotational speed of the third load motor. Then, in step P237, the current rotational phase of the printing press is read from the memory M5*b*.

Next, in step P238, the third plate-cylinder notch move-up start rotational phase is read from the memory M44. In step P239, the third plate-cylinder notch move-up finish rotational phase is read from the memory M45.

Next, in step P240, it is judged whether the current rotational phase of the printing press is equal to or more than the third plate-cylinder notch move-up start rotational phase, and is equal to or less than the third plate-cylinder notch move-up finish rotational phase. If yes in step P240, in step P241, the rotational speed of the third load motor 17*c* is read from the memory M43. If no in step P240, the process proceeds to later-described step P244.

Next, in step P242, the load motor rotational speed compensation value related to move-up of the notch of the plate cylinder is read from the memory M39. In step P243, the load motor rotational speed compensation value related to move-up of the notch of the plate cylinder is subtracted from the rotational speed of the third load motor, and the memory M43 for storing the rotational speed of third load motor is overwritten with the result.

Next, in step P244, the standard rotational speed of the load motor is read from the load motor standard rotational speed (torque value) setting unit 64, and is stored in the memory M46 for storing the rotational speed of the fourth load motor. Then, in step P245, the current rotational phase of the printing press is read from the memory M5*b*.

Next, in step P246, the fourth plate-cylinder notch move-up start rotational phase is read from the memory M47. In step P247, the fourth plate-cylinder notch move-up finish rotational phase is read from the memory M48. In step P248, it is judged whether the current rotational phase of the printing press is equal to or more than the fourth plate-cylinder notch move-up start rotational phase, and is equal to or less than the fourth plate-cylinder notch move-up finish rotational phase.

If yes in step P248, in step P249, the rotational speed of the fourth load motor 17*d* is read from the memory M46, and if no, the process proceeds to later-described step P252. Next, in step P250, the load motor rotational speed compensation value related to move-up of the notch of the plate cylinder is read from the memory M39. In step P251, the load motor rotational speed compensation value related to move-up of the notch of the plate cylinder is subtracted from the rotational speed of the fourth load motor, and the memory M46 for storing the rotational speed of the fourth motor is overwritten with the result.

Next, in step P252, the rotational speed of the first load motor 17*a* is read from the memory M36. In step P253, the rotational speed of the first load motor 17*a* is outputted to the first load motor driver 66*a*.

Next, in step P254, the rotational speed of the second load motor 17*b* is read from the memory M40. In step P255, the rotational speed of the second load motor 17*b* is outputted to the second load motor driver 66*b*.

Next, in step P256, the rotational speed of the third load motor 17*c* is read from the memory M43. In step P257, the rotational speed of the third load motor 17*c* is outputted to the third load motor driver 66*c*.

Next, in step P258, the rotational speed of the fourth load motor 17*d* is read from the memory M46. In step P259, the rotational speed of the fourth load motor 17*d* is outputted to the fourth load motor driver 66*d*.

Next, in step P260, the count value is read from the acceleration/deceleration counter 63, and is stored in the memory M49. In step P261, the electric current value is read from the drive motor driver 62, and is stored in the memory M50. Next, in step P262, the standard electric current value is read from the memory M51.

Next, in step P263, the standard electric current value is subtracted from the electric current value to calculate the electric current value difference, which is then stored in the memory M52. Next, in step P264, the electric current value difference-load motor rotational speed compensation value conversion table is read from the memory M53. In step P265, by using the electric current value difference-load motor rotational speed compensation value conversion table, the load motor rotational speed compensation value is obtained from the electric current value difference, and is stored in the memory M54.

Next, in step P266, the rotational speed of the first load motor 17*a* is read from the memory M36. In step P267, the load motor rotational speed compensation value is subtracted from the rotational speed of the first load motor 17*a* to calculate the compensated rotational speed of the first load motor, which is then stored in the memory M55. Next, in step P268, the setting rotational speed at teaching is read from the memory M23*b*.

Next, in step P269, the count value of the acceleration/deceleration counter 63 is read from the memory M49. In step P270, the compensated rotational speed of the first load motor 17*a* is stored at an address position of the memory M61 for storing the rotational speed of the load motor at deceleration, the address position corresponding to the count value of the acceleration/deceleration counter for the setting rotational speed at teaching for the first load motor.

Next, in step P271, the rotational speed of the second load motor 17*b* is read from the memory M40. In step P272, the load motor rotational speed compensation value is subtracted from the rotational speed of the second load motor 17*b* to calculate the compensated rotational speed of the second load motor, which is then stored in the memory M56. Next, in step P273, the setting rotational speed at teaching is read from the memory M23*b*.

Next, in step P274, the count value of the acceleration/deceleration counter 63 is read from the memory M49. In step P275, the compensated rotational speed of the second load motor 17*b* is stored at an address position of the memory M61 for storing the rotational speed of the load motor at deceleration, the address position corresponding to the count value of the acceleration/deceleration counter for the setting rotational speed at teaching for the second load motor.

Next, in step P276, the rotational speed of the third load motor 17*c* is read from the memory M43. In step P277, the load motor rotational speed compensation value is subtracted from the rotational speed of the third load motor 17*c* to calculate the compensated rotational speed of the third load motor, which is then stored in the memory M57. Next, in step P278, the setting rotational speed at teaching is read from the memory M23*b*.

Next, in step P279, the count value of the acceleration/deceleration counter 63 is read from the memory M49. Next, in step P280, the compensated rotational speed of the third load motor 17*c* is stored at an address position of the memory M61 for storing the rotational speed of the load motor at deceleration, the address position corresponding to the count value of the acceleration/deceleration counter for the setting rotational speed at teaching for the third load motor.

Next, in step P281, the rotational speed of the fourth load motor 17*d* is read from the memory M46. In step P282, the load motor rotational speed compensation value is subtracted from the rotational speed of the fourth load motor 17*d* to calculate the compensated rotational speed of the fourth load motor, which is then stored in the memory M58. Next, in step P283, the setting rotational speed at teaching is read from the memory M23*b*.

Next, in step P284, the count value of the acceleration/deceleration counter 63 is read from the memory M49. Next, in step P285, the compensated rotational speed of the fourth load motor 17*d* is stored at an address position of the memory M61 for storing the rotational speed of the load motor at deceleration, the address position corresponding to the count value of the acceleration/deceleration counter for the setting rotational speed at teaching for the fourth load motor. Then, the process returns to step P216.

Next, in step P286 to which the process proceeds from step P218, the current setting rotational speed and the corrected virtual current rotational phase of the printing press are received from the virtual master generator 60, and stored in the memory M13*b* for storing the current setting rotational speed and the memory M29 for storing the virtual current rotational phase of the printing press, respectively. In step P278, the count value is read from the counter 45 for detecting current rotational phase of the printing press, and is stored in the memory M4*b*.

Next, in step P288, from the count value of the counter 45 for detecting current rotational phase of the printing press, the current rotational phase of the printing press is calculated and stored in the memory M5*b*. In step P289, the current rotational phase of the printing press is subtracted from the virtual current rotational phase of the printing press to calculate the current rotational phase difference of the printing press, which is then stored in the memory M30.

Next, in step P290, from the current rotational phase difference of the printing press, the absolute value of the current rotational phase difference of the printing press is calculated and stored in the memory M31. In step P291, the tolerance of the current rotational phase difference of the printing press is read from the memory M32.

Next, in step P292, it is judged whether the absolute value of the current rotational phase difference of the printing press is equal to or less than the tolerance of the current rotational phase difference of the printing press. If yes in step P292, the current setting rotational speed is read from the memory M13*b* in step P293, and if no, the process proceeds to later-described step P296.

Next, in step P294, the memory M33 for storing the instruction rotational speed is overwritten with the current setting rotational speed. In step P295, the instruction rotational speed is outputted to the drive motor driver 62, and the process returns to step P216. Next, in step P296, the current rotational phase difference of the printing press-setting rotational speed compensation value conversion table is read from the memory M34.

Next, in step P297, the current rotational phase difference of the printing press is read from the memory M30. In step P298, by using the current rotational phase difference of the printing press-setting rotational speed compensation value conversion table, the setting rotational speed compensation value is obtained from the current rotational phase difference of the printing press, and is stored in the memory M35.

Next, in step P299, the current setting rotational speed is read from the memory M13*b*. In step P300, the current setting rotational speed is added to the setting rotational speed compensation value to calculate the instruction rotational speed, which is then stored in the memory M33. Next, in step P301, the instruction rotational speed is outputted to the drive motor driver 62, and the process returns to step P216.

Next, in step P302 to which the process proceeds from step P1, it is judged whether the instruction to start synchronizing operation is sent to the virtual master generator 60. If yes in step P302, in step P303, it is judged whether the instruction to start home position alignment is sent from the virtual master generator 60. If no in step P302, the process proceeds to later-described step P398.

If yes in step P303, in step P304, it is judged whether the current rotational speed (slower) and the corrected virtual current rotational phase of the printing press are sent from the virtual master generator 60. On the other hand, if no in step P303, in step P305, it is judged whether the instruction to start synchronizing operation is sent to the virtual master generator 60. If yes in step P305, the process proceeds to later-described step P398. If no in step P305, the process returns to step P303.

If yes in step P304, in step P306, the current setting rotational speed (slower) and the corrected virtual current rotational phase of the printing press are received from the virtual master generator 60, and are stored in the memory M13*b* for storing the current setting rotational speed and the memory M29 for storing the virtual current rotational phase of the printing press, respectively. In step P307, the count value is read from the counter 45 for detecting current rotational phase of the printing press, and is stored in the memory M4*b*.

Next, in step P308, from the count value of the counter 45 for detecting current rotational phase of the printing press, the current rotational phase of the printing press is calculated and stored in the memory M5*b*. In step P309, the current rotational phase of the printing press is subtracted from the virtual current rotational phase of the printing press to calculate the current rotational phase difference of the printing press, which is then stored in the memory M30.

Next, in step P310, from the current rotational phase difference of the printing press, the absolute value of the current rotational phase difference of the printing press is calculated and stored in the memory M31. In step P311, the tolerance of the current rotational phase difference of the printing press is read from the memory M32.

Next, in step P312, it is judged whether the absolute value of the current rotational phase difference of the printing press is equal to or less than the tolerance of the current rotational phase difference of the printing press. If yes in step P312, the current setting rotational speed (slower) is read from the memory M13*b* in step P313, and if no, the process proceeds to later-described step P317.

Next, in step P314, the memory M33 for storing the instruction rotational speed is overwritten with the current setting rotational speed (slower). In step P315, the instruction rotational speed is outputted to the drive motor driver 62. In step P316, the home position alignment completion signal is sent to the virtual master generator 60, and the process returns to step P304.

Next, in step P317, the current rotational phase difference of the printing press-setting rotational speed compensation value conversion table is read from the memory M34, and in step P318, the current rotational phase difference of the printing press is read from the memory M30.

Next, in step P319, by using the current rotational phase difference of the printing press-setting rotational speed compensation value conversion table, the setting rotational speed compensation value is obtained from the current rotational phase difference of the printing press, and is stored in the memory M35. In step P320, the current setting rotational speed (slower) is read from the memory M13*b*.

Next, in step P321, the current setting rotational speed (slower) is added to the setting rotational speed compensation value to calculate the instruction rotational speed, which is then stored in the memory M33. In step P322, the instruction rotational speed is outputted to the drive motor driver 62, and the process returns to step P304.

If no in step P304, in step P323, it is judged whether the acceleration signal and setting rotational speed at synchronizing operation are sent from the virtual master generator 60. If yes in step P323, in step P324, the setting rotational speed is received from the virtual master generator 60, and is stored in the memory M27*b* for storing the setting rotational speed at synchronizing operation. If no in step P323, the process returns to step P304.

Next, in step P325, the reset and enable signals are outputted to the acceleration/deceleration counter 63, and in step P326, the output of the reset signal to the acceleration/deceleration counter 63 is stopped.

Next, in step P327, it is judged whether the current state of the printing press, the current setting rotational speed, and the corrected virtual current rotational phase of the printing press are sent from the virtual master generator 60. If yes in step P327, in step P328, the current state of the printing press, the current setting rotational speed, and the corrected virtual current rotational phase of the printing press are received from the virtual master generator 60, and are stored in the memory M28*b* for storing the current state of the printing press, the memory M13*b* for storing the current setting rotational speed and the memory M29 for storing the virtual current rotational phase of the printing press, respectively. On the other hand, if no in step P327, in step P329, it is judged whether the deceleration signal is sent from the virtual master generator 60.

If yes in step P329, in step P330, the reset and enable signals are outputted to the acceleration/deceleration counter 63, and in step P331, the output of the reset signal to the acceleration/deceleration counter 63 is stopped. Then, the process proceeds to later-described step P370. If no in step P329, the process returns to step P327.

Next, in step P332, the current state of the printing press is read from the memory M28*b*, and in step P333, it is judged whether the current state of the printing press is equal to 1. If yes in step P333, in step P334, the setting rotational speed at synchronizing operation is read from the memory M27*b*. In step P335, the count value is read from the acceleration/deceleration counter 63, and is stored in the memory M49.

Next, in step P336, the rotational speed of the first load motor 17*a* is read from an address position of the memory M59 for storing the rotational speed of the load motor at acceleration, the address position corresponding to the count value of the acceleration/deceleration counter 63 for the setting rotational speed at synchronizing operation for the first load motor. In step P337, the rotational speed of the first load motor 17*a* is outputted to the first load motor driver 66*a*. Note that, the address position of the memory M59 for storing the rotational speed of the load motor at acceleration, the address position corresponding to the count value of the acceleration/deceleration counter 63 for the setting rotational speed at synchronizing operation for the first load motor, corresponds to the address position of the memory M59, the address position corresponding to the count value of the acceleration/deceleration counter for the setting rotational speed at teaching for the first load motor, the memory M59 storing the compensated rotational speed of the first load motor in step P79 when the setting rotational speed at teaching is equal to the setting rotational speed at synchronizing operation, and when the count value of the acceleration/deceleration counter has a same count value.

Next, in step P338, the rotational speed of the second load motor is read from an address position of the memory M59 for storing the rotational speed of the load motor at acceleration, the address position corresponding to the count value of the acceleration/deceleration counter 63 for the setting rotational speed at synchronizing operation for the second load motor. In step P339, the rotational speed of the second load motor 17*b* is outputted to the second load motor driver 66*b*.

Next, in step P340, the rotational speed of the third load motor is read from an address position of the memory M59 for storing the rotational speed of the load motor at acceleration, the address position corresponding to the count value of the acceleration/deceleration counter 63 for the setting rotational speed at synchronizing operation for the third load motor. In step P341, the rotational speed of the third load motor 17*c* is outputted to the third load motor driver 66*c*.

Next, in step P342, the rotational speed of the fourth load motor is read from an address position of the memory M59 for storing the rotational speed of the load motor at acceleration, the address position corresponding to the count value of the acceleration/deceleration counter 63 for the setting rotational speed at synchronizing operation for the fourth load motor. In step P343, the rotational speed of the fourth load motor 17*d* is outputted to the fourth load motor driver 66*d*. Then, the process proceeds to later-described step P355.

If no in step P333, in step P344, the setting rotational speed at synchronizing operation is read from the memory M27*b*. In step P345, the count value is read from the counter 45 for detecting current rotational phase of the printing press, and is stored in the memory M4*b*. Next, in step P346, from the count value of the counter 45 for detecting current rotational phase of the printing press, the current rotational phase of the printing press is calculated and stored in the memory M5*b*.

Next, in step P347, the rotational speed of the is read from an address position of the memory M60 for storing the rotational speed of the load motor at constant-speed operation, the address position corresponding to the current rotational phase of the printing press for the setting rotational speed at synchronizing operation for the first load motor. In step P348, the rotational speed of the first load motor 17*a* is outputted to the first load motor driver 66*a*. Note that, the address position of the memory M60 for storing the rotational speed of the load motor at constant-speed operation, the address position corresponding to the current rotational phase of the printing press for the setting rotational speed at synchronizing operation for the first load motor, corresponds to the address position of the memory M60, the address position corresponding to the current rotational phase for the setting rotational speed at teaching for the first load motor, the memory M60 storing the compensated rotational speed of the first load motor in step P164 when the setting rotational speed at teaching is equal to the setting rotational speed at synchronizing operation, and when the current rotational phase of the printing press is the same.

Next, in step P349, the rotational speed of the second load motor 17*b* is read from an address position of the memory M60 for storing the rotational speed of the load motor at constant-speed operation, the address of the position corresponding to the current rotational phase of the printing press for the setting rotational speed at synchronizing operation for the second load motor. In step P350, the rotational speed of the second load motor 17*b* is outputted to the second load motor driver 66*b*.

Next, in step P351, the rotational speed of the third load motor 17*c* is read from an address position of the memory M60 for storing the rotational speed of the load motor at constant-speed operation, the address position corresponding to the current rotational phase of the printing press for the setting rotational speed at synchronizing operation for the third load motor. In step P352, the rotational speed of the third load motor 17*c* is outputted to the third load motor driver 66*c*.

Next, in step P353, the rotational speed of the fourth load motor 17*d* is read from an address position of the memory M60 for storing the rotational speed of the load motor at constant-speed operation, the address position corresponding to the current rotational phase of the printing press for the setting rotational speed at synchronizing operation for the fourth load motor. In step P354, the rotational speed of the fourth load motor 17*d* is outputted to the fourth load motor driver 66*d*.

Next, in step P355, the count value is read from the counter 45 for detecting current rotational phase of the printing press, and is stored in the memory M4*b*.

Next, in step P356, from the count value of the counter 45 for detecting current rotational phase of the printing press, the current rotational phase of the printing press is calculated and stored in the memory M5*b*. In step P357, the current rotational phase of the printing press is subtracted from the virtual current rotational phase of the printing press to calculate the current rotational phase difference of the printing press, which is then stored in the memory M30.

Subsequently, in step P358, the absolute value of the current rotational phase difference of the printing press is calculated from the current rotational phase difference of the printing press, and is stored in the memory M31. In step P359, the tolerance of the current rotational phase difference of the printing press is read from the memory M32.

Next, in step P360, it is judged whether the absolute value of the current rotational phase difference of the printing press is equal to or less than the tolerance of the current rotational phase difference of the printing press. If yes in step P360, in step P361, the current setting rotational speed is read from the memory M13*b*. If no in step P360, the process proceeds to later-described step P364.

Next, in step P362, the memory M33 for storing the instruction rotational speed is overwritten with the current setting rotational speed, and in step P363, the instruction rotational speed is outputted to the drive motor driver 62. The process then returns to step P327. Subsequently, in step P364, the current rotational phase difference of the printing press-setting rotational speed compensation value conversion table is read from the memory M34.

Next, in step P365, the current rotational phase difference of the printing press is read from the memory M30. In step P366, by using the current rotational phase difference of the printing press-setting rotational speed compensation value conversion table, the setting rotational speed compensation value is obtained from the current rotational phase difference of the printing press, and is stored in the memory M35.

Next, in step P367, the current setting rotational speed is read from the memory M13*b*. In step P368, the current setting rotational speed is added to the setting rotational speed compensation value to calculate the instruction rotational speed, which is then stored in the memory M33. In step P369, the instruction rotational speed is outputted to the drive motor driver 62, and the process returns to step P327.

Next, in step P370 to which the process proceeds from step P331, it is judged whether the current state of the printing press, the current setting rotational speed, and the corrected virtual current rotational phase of the printing press are sent from the virtual master generator 60. If yes in step P370, in step P371, the current state of the printing press, the current setting rotational speed, and the corrected virtual current rotational phase of the printing press are received from the virtual master generator 60, and stored in the memory M28*b* for storing the current state of the printing press, the memory M13*b* for storing the current setting rotational speed, and the memory M29 for storing the virtual current rotational phase of the printing press, respectively.

On the other hand, if no in step P370, it is judged in step P372 whether the instruction to stop synchronizing operation is sent from the virtual master generator 60. If yes in step P372, the process returns to step P303, and if no, the process returns to step P370.

Next, in step P373, the setting rotational speed at synchronizing operation is read from the memory M27*b*. Then, in step P374, the count value is read from the acceleration/deceleration counter 63, and is stored in the memory M49.

Next, in step P375, the rotational speed of the first load motor 17*a* is read from an address position of the memory M61 for storing the rotational speed of the load motor at deceleration, the address position corresponding to the count value of the acceleration/deceleration counter 63 for the setting rotational speed at synchronizing operation for the first load motor. In step P376, the rotational speed of the first load motor 17*a* is outputted to the first load motor driver 66*a*. Note that, the address position of the memory M61 for storing the rotational speed of the load motor at deceleration, the address position corresponding to the count value of the acceleration/deceleration counter for the setting rotational speed at synchronizing operation for the first load motor, corresponds to the address position of the memory M61, the address position corresponding to the count value of the acceleration/deceleration counter for the setting rotational speed at teaching for the first load motor, the memory M61 storing the compensated rotational speed of the first load motor in step P270 when the setting rotational speed at teaching is equal to the setting rotational speed at synchronizing operation, and when the count value of the acceleration/deceleration counter has a same count value.

Next, in step P377, the rotational speed of the second load motor is read from an address position of the memory M61 for storing the rotational speed of the load motor at deceleration, the address position corresponding to the count value of the acceleration/deceleration counter 63 for the setting rotational speed at synchronizing operation for the second load motor. In step P378, the rotational speed of the second load motor 17*b* is outputted to the second load motor driver 66*b*.

Next, in step P379, the rotational speed of the third load motor is read from an address position of the memory M61 for storing the rotational speed of the load motor at deceleration, the address position corresponding to the count value of the acceleration/deceleration counter 63 for the setting rotational speed at synchronizing operation for the third load motor. In step P380, the rotational speed of the third load motor 17*c* is outputted to the third load motor driver 66*c*.

Next, in step P381, the rotational speed of the fourth load motor is read from an address position of the memory M61 for storing the rotational speed of the load motor at deceleration, the address position corresponding to the count value of the acceleration/deceleration counter 63 for the setting rotational speed at synchronizing operation for the fourth load motor. In step P382, the rotational speed of the fourth load motor 17*d* is outputted to the fourth load motor driver 66*d*.

Next, in step P383, the count value is read from the counter 45 for detecting current rotational phase of the printing press, and is stored in the memory M4*b*.

Next, in step P384, from the count value of the counter 45 for detecting current rotational phase of the printing press, the current rotational phase of the printing press is calculated and stored in the memory M5*b*. In step P385, the current rotational phase of the printing press is subtracted from the virtual current rotational phase of the printing press to calculate the current rotational phase difference of the printing press, which is then stored in the memory M30.

Next, in step P386, the absolute value of the current rotational phase difference of the printing press is calculated from the current rotational phase difference of the printing press, and is stored in the memory M31. In step P387, the tolerance of the current rotational phase difference of the printing press is read from the memory M32.

Next, in step P388, it is judged whether the absolute value of the current rotational phase difference of the printing press is equal to or less than the tolerance of the current rotational phase difference of the printing press. If yes in step P388, the current setting rotational speed is read from the memory M13*b* in step P389. If no, the process proceeds to later-described step P392.

Next, in step P390, the memory M33 for storing the instruction rotational speed is overwritten with the current setting rotational speed, and in step P391, the instruction rotational speed is outputted to the drive motor driver 62. The process then returns to step P370. Subsequently, in step P392, the current rotational phase difference of the printing press-setting rotational speed compensation value conversion table is read from the memory M34.

Next, in step P393, the current rotational phase difference of the printing press is read from the memory M30. In step P394, by using the current rotational phase difference of the printing press-setting rotational speed compensation value conversion table, the setting rotational speed compensation value is obtained from the current rotational phase difference of the printing press, and is stored in the memory M35.

Next, in step P395, the current setting rotational speed is read from the memory M13*b*. In step P396, the current setting rotational speed is added to the setting rotational speed compensation value to calculate the instruction rotational speed, which is then stored in the memory M33. In step P397, the instruction rotational speed is outputted to the drive motor driver 62, and the process returns to step P370.

Next, in step P398 to which the process proceeds from step P302, it is judged whether the setting rotational speed is inputted to the single drive rotational speed setting unit 68 for the printing press. If yes in step P398, in step P399, the setting rotational speed is read from the single drive rotational speed setting unit 68 for the printing press, and is stored in the memory M13*b* for storing the current setting rotational speed. The process then proceeds to step P400. If no in step P398, the process directly proceeds to step P400.

Next, in step P400, it is judged whether the single drive switch 69 for the printing press is turned on. If yes in step P400, in step P401, the current setting rotational speed is read from the memory M13*b*, and if no, the process returns to step P1.

Next, in step P402, the current setting rotational speed is written in the memory M33 for storing the instruction rotational speed, and in step P403, the instruction rotational speed is outputted to the drive motor driver 62.

Next, when the printing press stop switch 70 is turned on in step P404, a stop instruction is then outputted to the drive motor driver 62 in step P405. The process then returns to step P1. Hereinafter, the aforementioned process is repeated.

According to the above-described operational flows, upon the instructions from the virtual master generator 60, the drive controller 80 of the printing press performs the teaching processing and the synchronizing operation processing of the drive motor 10 of the printing press, and carries out the breaking force control of the first to fourth load motors 17*a* to 17*d* at synchronizing operation.

The drive controllers 90*a* to 90*d* of the first to fourth inking units operate according to the operational flows shown in FIGS. 29A and 29B, 30A and 30B, and 31.

Specifically, in step P1, it is judged whether the teaching instruction is sent from the virtual master generator 60. If yes in step P1, in step P2, it is judged whether the instruction to start home position alignment is sent from the virtual master generator 60. If no in step P1, in step P3, it is judged whether the instruction to start synchronizing operation is sent from the virtual master generator 60. If yes in step P3, the process returns to step P2. If no in step P3, the process proceeds to later-described step P42.

If yes in step P2, the process proceeds to step P4. If no in step P2, in step P5, it is judged whether the instruction to stop synchronizing operation is sent from the virtual master generator 60. If yes in step P5, the process proceeds to later-described step P42. If no, the process returns to step P2.

Next, when the current setting rotational speed (slower) and the corrected virtual current rotational phase of the inking unit are sent from the virtual master generator 60 in step P4, in step P6, the current setting rotational speed (slower) and the corrected virtual current rotational phase of the inking unit are received from the virtual master generator 60, and stored in the memory M13*c* for storing the current setting rotational speed and the memory M62 for storing the virtual current rotational phase of the inking unit, respectively.

Next, in step P7, the count value is read from the counter 73 for detecting current rotational phase of the inking unit, and is stored in the memory M63. In step P8, the current rotational phase of the inking unit is calculated from the count value of the counter 73 for detecting current rotational phase of the inking unit, and is stored in the memory M64. In step P9, the current rotational phase of the inking unit is subtracted from the virtual current rotational phase of the inking unit to calculate the current rotational phase difference of the inking unit, which is then stored in the memory M65.

Next, in step P10, the absolute value of the current rotational phase difference of the inking unit is calculated from the current rotational phase difference of the inking unit, and is stored in the memory M66. In step P11, the tolerance of the current rotational phase difference of the inking unit is read from the memory M67.

Next, in step P12, it is judged whether the absolute value of the current rotational phase difference of the inking unit is equal to or less than the tolerance of the current rotational phase difference of the inking unit. If yes in step P12, in step P13, the current setting rotational speed (slower) is read from the memory M13*c*, and if no, the process proceeds to later-described step P17.

Next, in step P14, the memory M33*c* for storing the instruction rotational speed is overwritten with the current setting rotational speed (slower). In step P15, the instruction rotational speed is outputted to the drive motor driver 72 of the inking unit. In step P16, the home position alignment completion signal is sent to the virtual master generator 60, and the process proceeds to later-described step P23.

Next, in step P17, the current rotational phase difference of the inking unit-setting rotational speed compensation value conversion table is read from the memory M68, and in step P18, the current rotational phase difference of the inking unit is read from the memory M65.

Next, in step P19, by using the current rotational phase difference of the inking unit-setting rotational speed compensation value conversion table, the setting rotational speed compensation value is obtained from the current rotational phase difference of the inking unit, and is stored in the memory M35*c*. In step P20, the current setting rotational speed (slower) is read from the memory M13*c*.

Next, in step P21, the current setting rotational speed (slower) is added to the setting rotational speed compensation value to calculate the instruction rotational speed, which is then stored in the memory M33*c*. In step P22, the instruction rotational speed is outputted to the drive motor driver 72 of the inking unit, and the process returns to step P4.

Next, in step P23 to which the process proceeds from step P16, it is judged whether the current setting rotational speed and the corrected virtual current rotational phase of the inking unit are sent from the virtual master generator 60. If yes in step P23, the process proceeds to step P24. If no in step P23, in step P25, it is judged whether the teaching finish signal is sent from the virtual master generator 60.

If yes in step P25, the process returns to step P1. If no in step P25, in step P26, it is judged whether the instruction to stop drive of synchronizing operation is sent from the virtual master generator 60. If yes in step P26, the process returns to step P2. If no, the process returns to step P23.

Next, in step P24, the current setting rotational speed and the corrected virtual current rotational phase of the inking unit are received from the virtual master generator 60, and are stored in the memory M13*c* for storing the current setting rotational speed and the memory M62 for storing the virtual current rotational phase of the inking unit, respectively. In step P27, the count value is read from the counter 73 for detecting current rotational phase of the inking unit, and is stored in the memory M63.

Next, in step P28, from the count value of the counter 73 for detecting current rotational phase of the inking unit, the current rotational phase of the inking unit is calculated and stored in the memory M64. In step P29, the current rotational phase of the inking unit is subtracted from the virtual current rotational phase of the inking unit to calculate the current rotational phase difference of the inking unit, which is then stored in the memory M65.

Next, in step P30, the absolute value of the current rotational phase difference of the inking unit is calculated from the current rotational phase difference of the inking unit, and is stored in the memory M66. In step P31, the tolerance of the current rotational phase difference of the inking unit is read from the memory M67.

Next, in step P32, it is judged whether the absolute value of the current rotational phase difference of the inking unit is equal to or less than the tolerance of the current rotational phase difference of the inking unit. If yes in step P32, in step P33, the current setting rotational speed is read from the memory M13*c*, and if no, the process proceeds to later-described step P36.

Next, in step P34, the memory M33*c* for storing the instruction rotational speed is overwritten with the current setting rotational speed. In step P35, the instruction rotational speed is outputted to the drive motor driver 72 of the inking unit, and the process then returns to step P23. Next, in step P36, the current rotational phase difference of the inking unit-setting rotational speed compensation value conversion table is read from the memory M68.

Next, in step P37, the current rotational phase difference of the inking unit is read from the memory M65. In step P38, by using the current rotational phase difference of the inking unit-setting rotational speed compensation value conversion table, the setting rotational speed compensation value is obtained from the current rotational phase difference of the inking unit and stored in the memory M35*c*.

Next, in step P39, the current setting rotational speed is read from the memory M13*c*. In step P40, the current setting rotational speed is added to the setting rotational speed compensation value to calculate the instruction rotational speed, which is then stored in the memory M33*c*. In step P41, the instruction rotational speed is outputted to the drive motor driver 72 of the inking unit, and the process returns to step P23.

Next, in step P42 to which the process proceeds from step P3 or step P5, it is judged whether the setting rotational speed is inputted to the single drive rotational speed setting unit 75 for the inking unit. If yes in step P42, in step P43, the setting rotational speed is read from the single drive rotational speed setting unit 75 for the inking unit, and is stored in the memory M13*c* for storing the current setting rotational speed. The process then proceeds to step P44. If no in step P42, the process directly proceeds to step P44.

Next, in step P44, it is judged whether the inking unit single drive switch 76 is turned on. If yes in step P44, in step P45, the current setting rotational speed is read from the memory M13*c*, and if no, the process returns to step P1.

Next, in step P46, the current setting rotational speed is written in the memory M33*c* for storing the instruction rotational speed, and in step P47, the instruction rotational speed is outputted to the drive motor driver 72 of the inking unit.

Next, when the inking unit drive stop switch 77 is turned on in step P48, the stop instruction is then outputted to the drive motor driver 72 of the inking unit in step P49, and the process returns to step P1. Hereinafter, the aforementioned process is repeated.

According to the above-described operational flows, upon the instructions from the virtual master generator 60, the drive controllers 90*a* to 90*d* of the first to fourth inking units performs the teaching processing and synchronizing operation processing of the drive motors 15 (15*a* to 15*d*) of the inking units.

As described above, in this embodiment, the drive motor 10 and the drive motors 15 (15*a* to 15*d*) separately provide driving forces in such a way that the main body of the printing press is driven by the drive motor 10, and the inking units are driven by the drive motors 15 (15*a* to 15*d*). Accordingly, the drive motor 10 and the drive motors 15 (15*a* to 15*d*) can be reduced in size and capacity, and the printing press of the present invention can achieve lower cost and higher speed operation. Furthermore, the load motors 17*a* to 17*d* as the braking means are provided to eliminate non-uniform rotation of the plate cylinder 3, and this makes it possible to prevent occurrence of printing faults such as mackle.

Moreover, the braking means is composed of the load motors (torque motors) 17*a* to 17*d*. This eliminates the need to replace the components, unlike the case of brakes, and the braking means can be made maintenance-free. Moreover, the electric power generated by the load motors (torque motors) 17*a* to 17*d* is recovered as electric power for driving the drive motor 10, thus achieving energy savings.

Embodiment 2

Figure 32A:
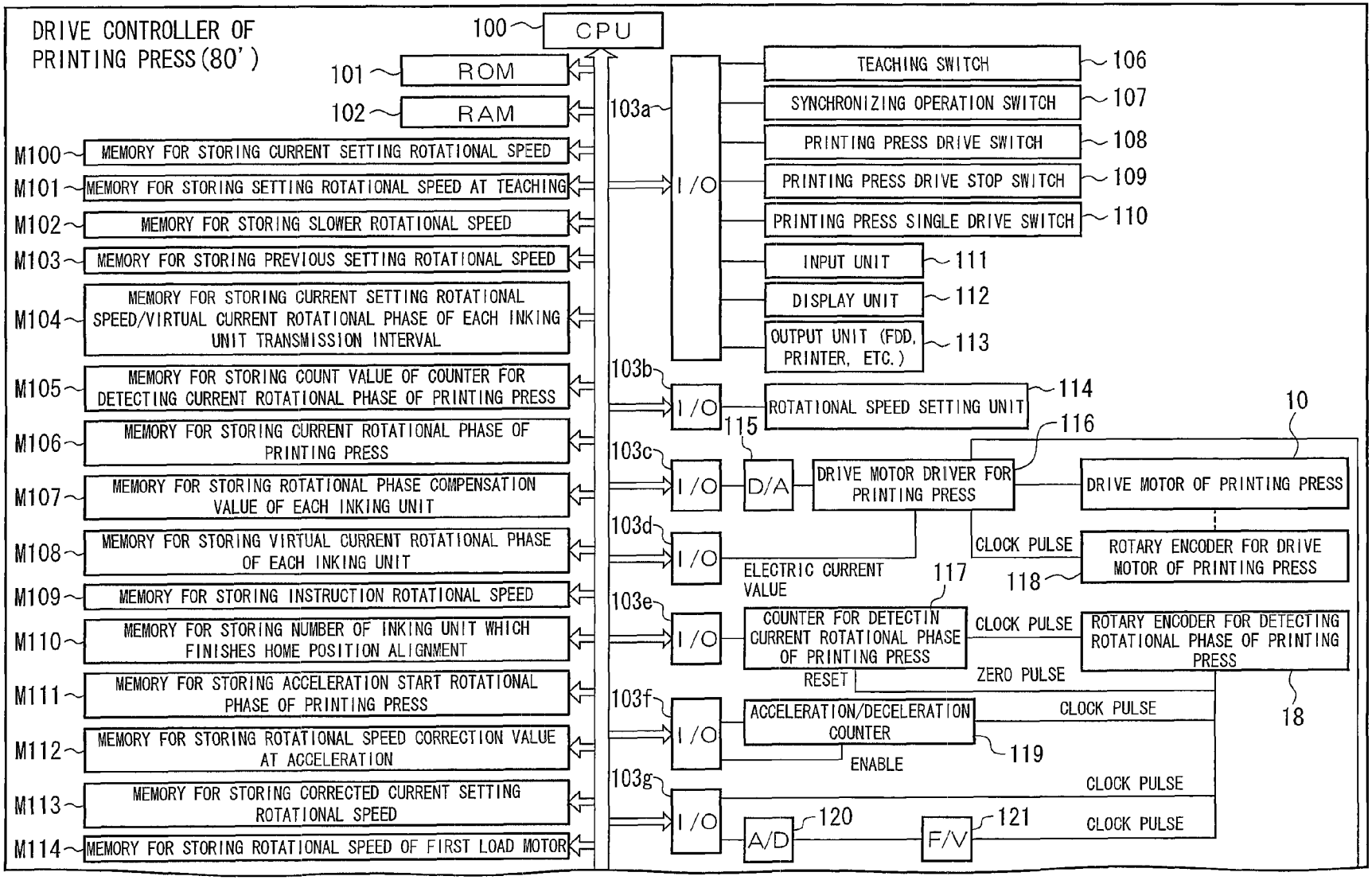
FIG. 32A is a hardware block diagram of a drive controller of a printing press according to Embodiment 2 of the present invention.
Figure 32B:
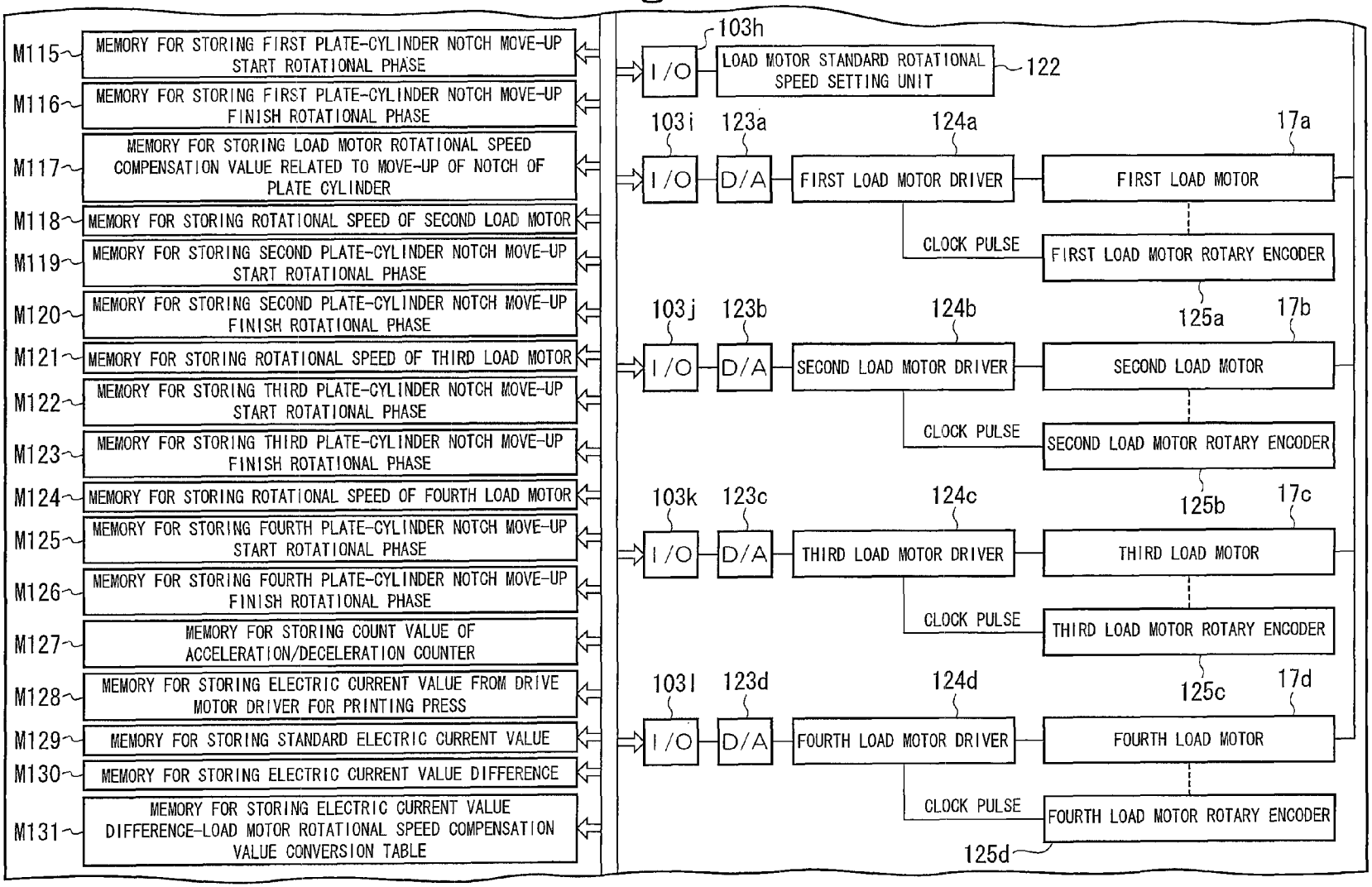
FIG. 32B is a hardware block diagram of the drive controller of the printing press according to Embodiment 2 of the present invention.
Figure 32C:
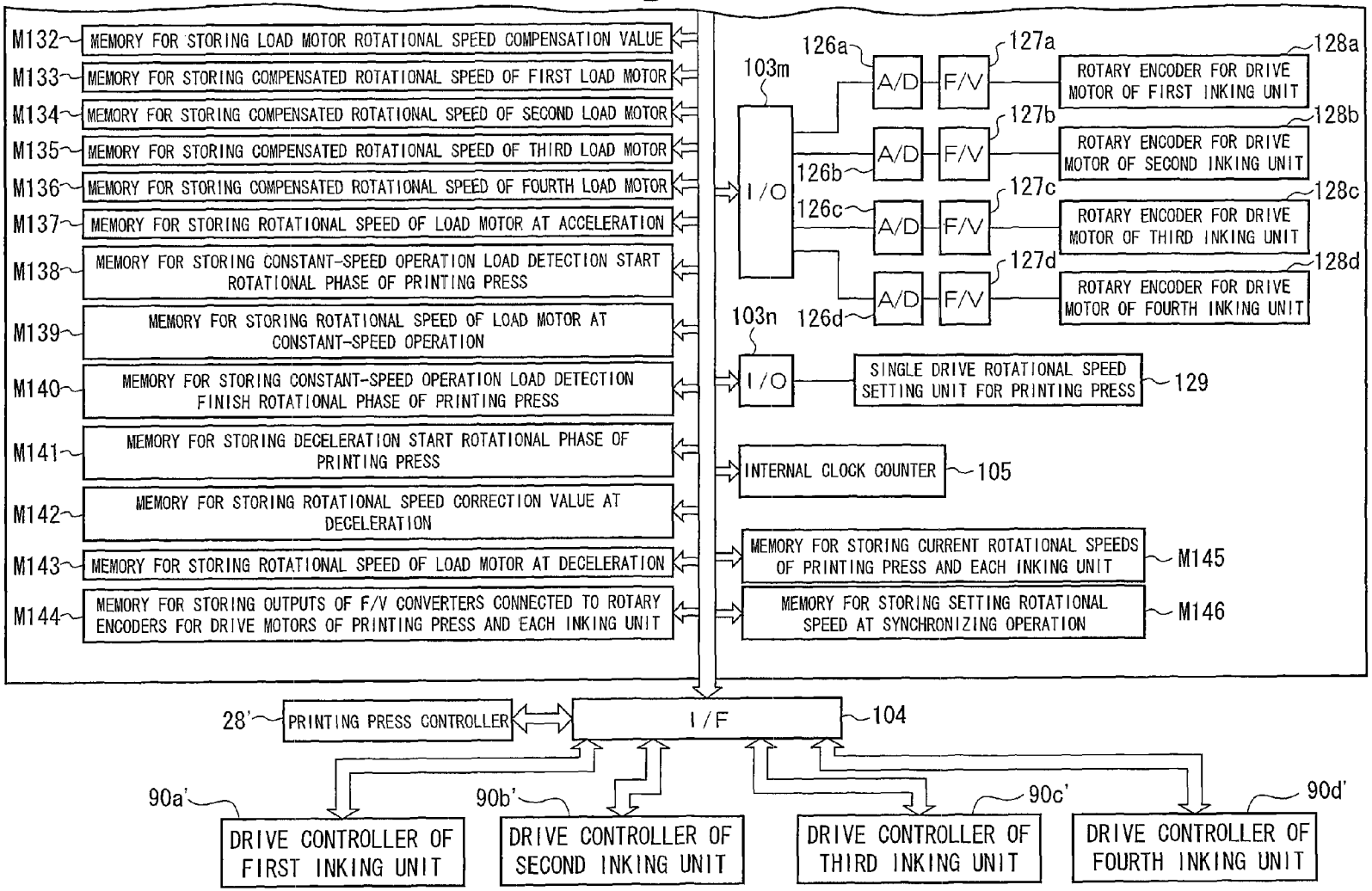
FIG. 32C is a hardware block diagram of the drive controller of the printing press according to Embodiment 2 of the present invention.
Figure 33:
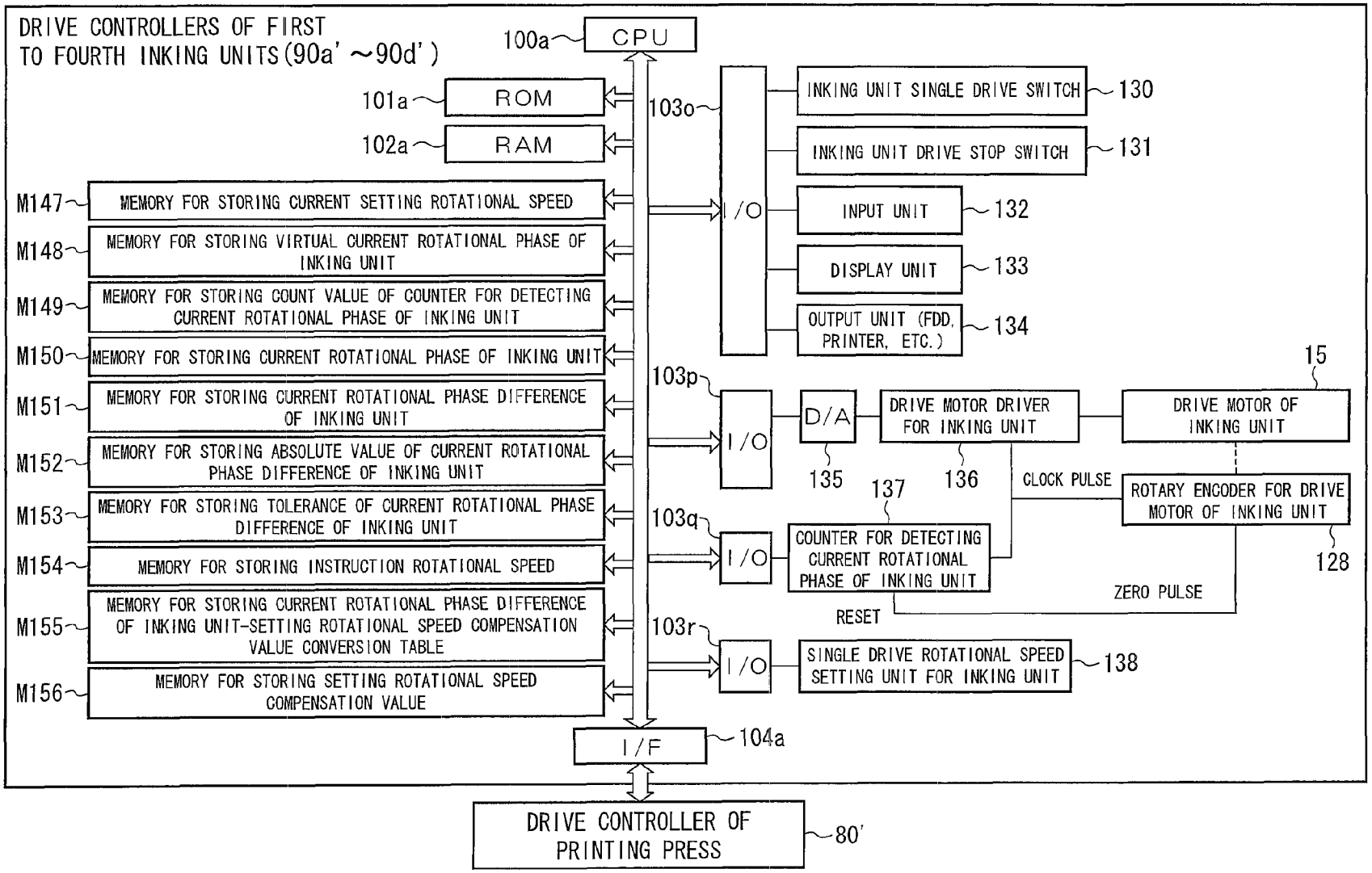
FIG. 33 is a hardware block diagram of a drive controller of each of first to fourth inking units.
Figure 34A:
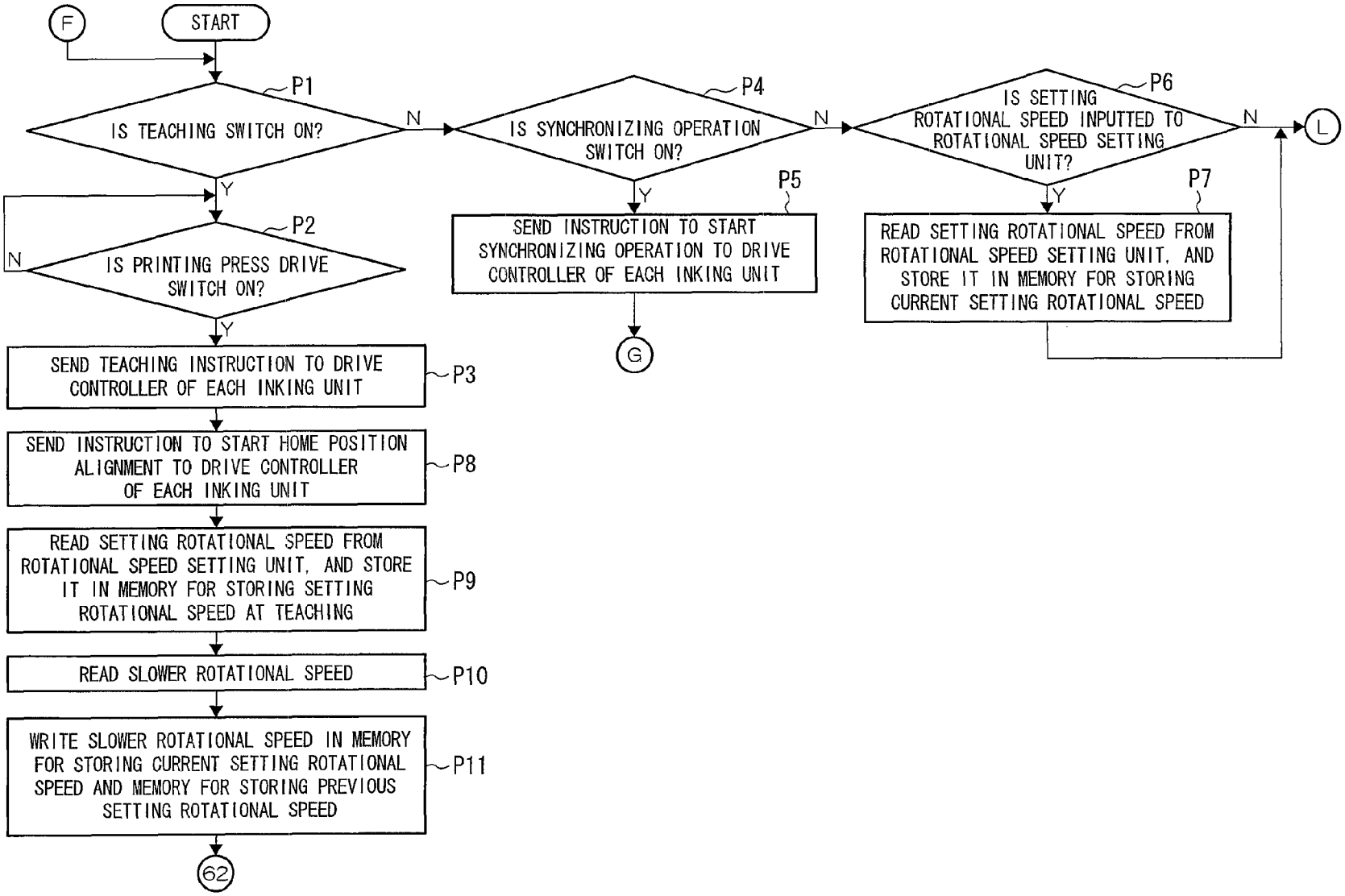
FIG. 34A is an operational flowchart of the drive controller of the printing press.
Figure 34B:
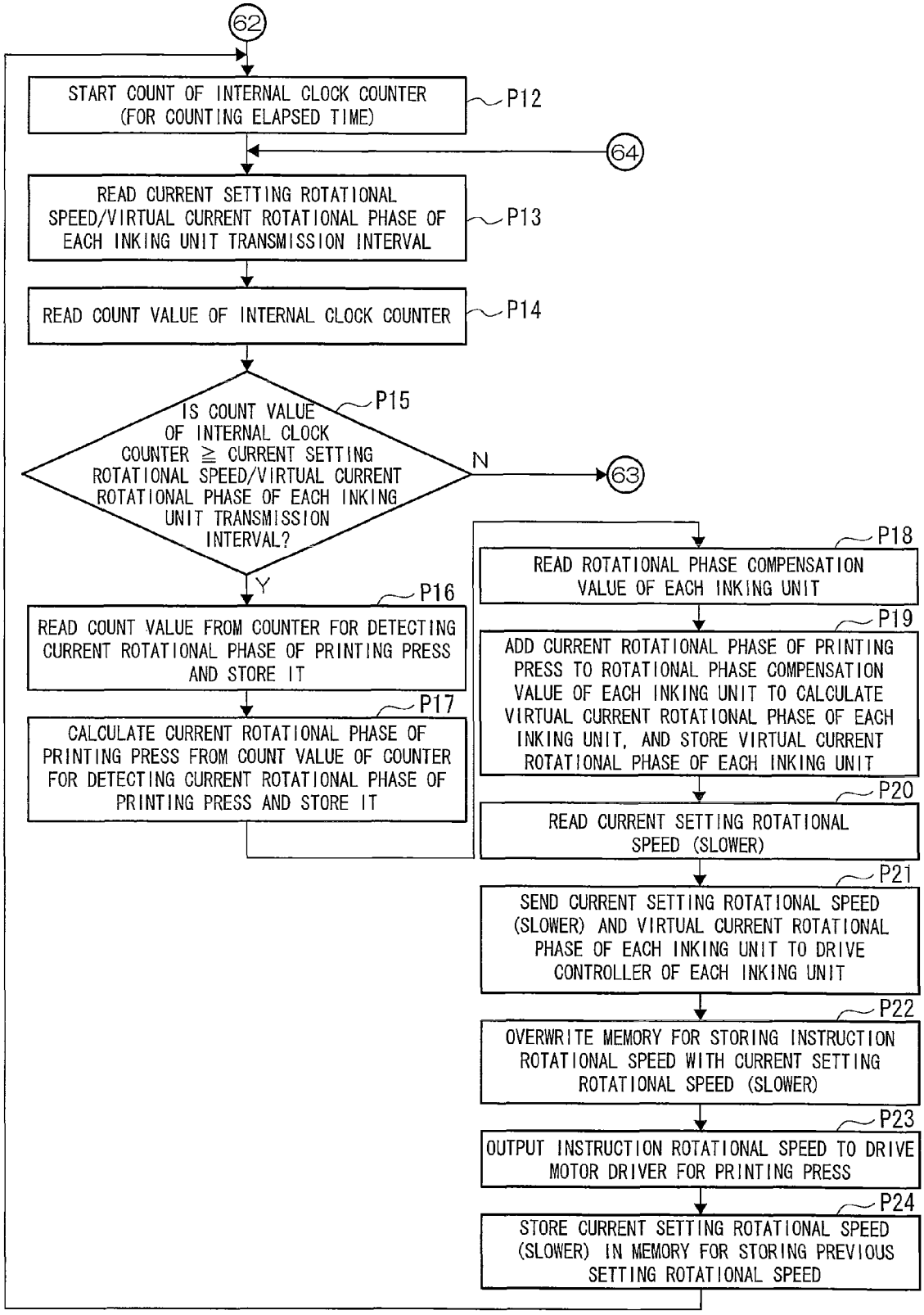
FIG. 34B is an operational flowchart of the drive controller of the printing press.
Figure 34C:
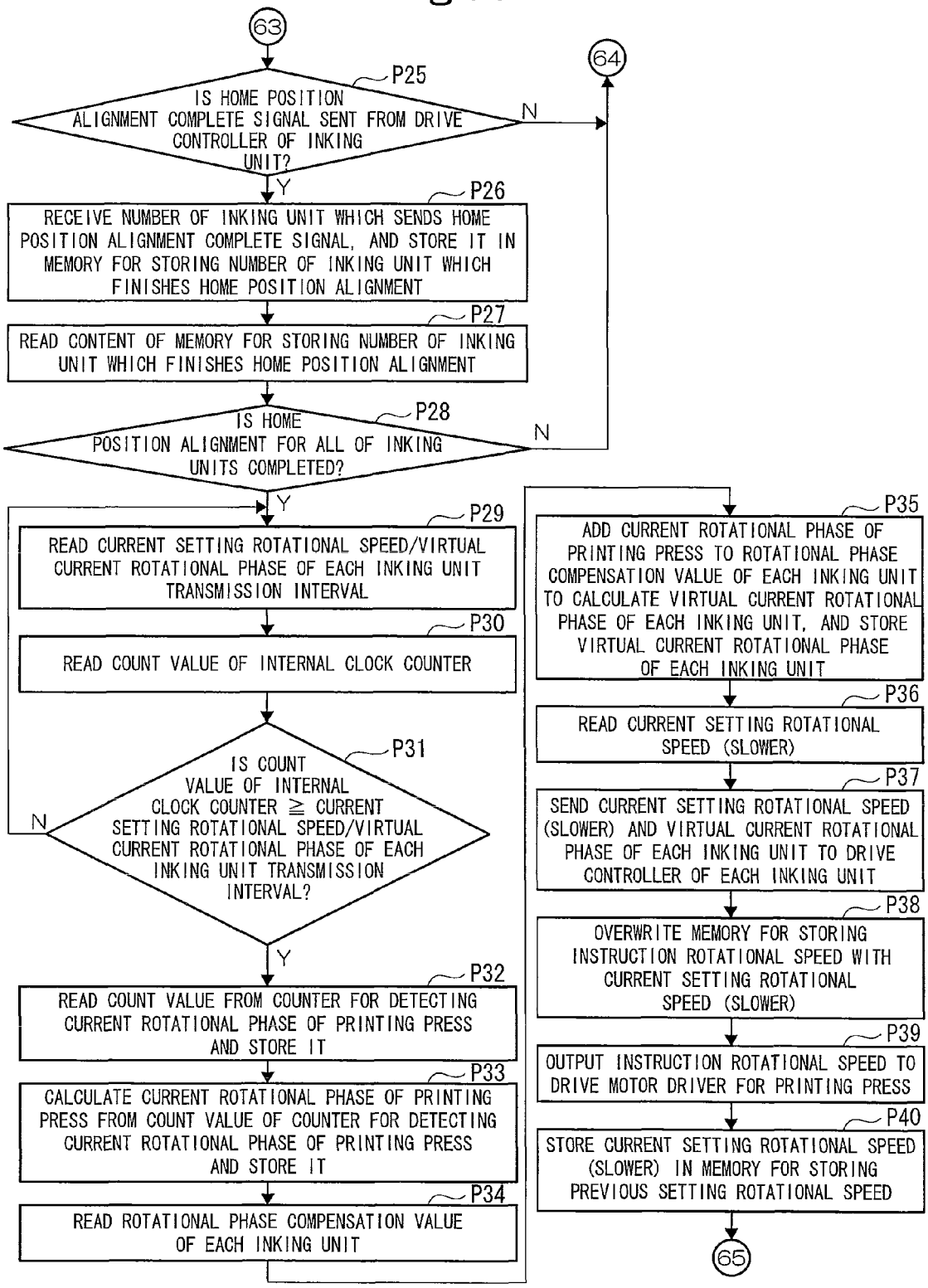
FIG. 34C is an operational flowchart of the drive controller of the printing press.
Figure 34D:
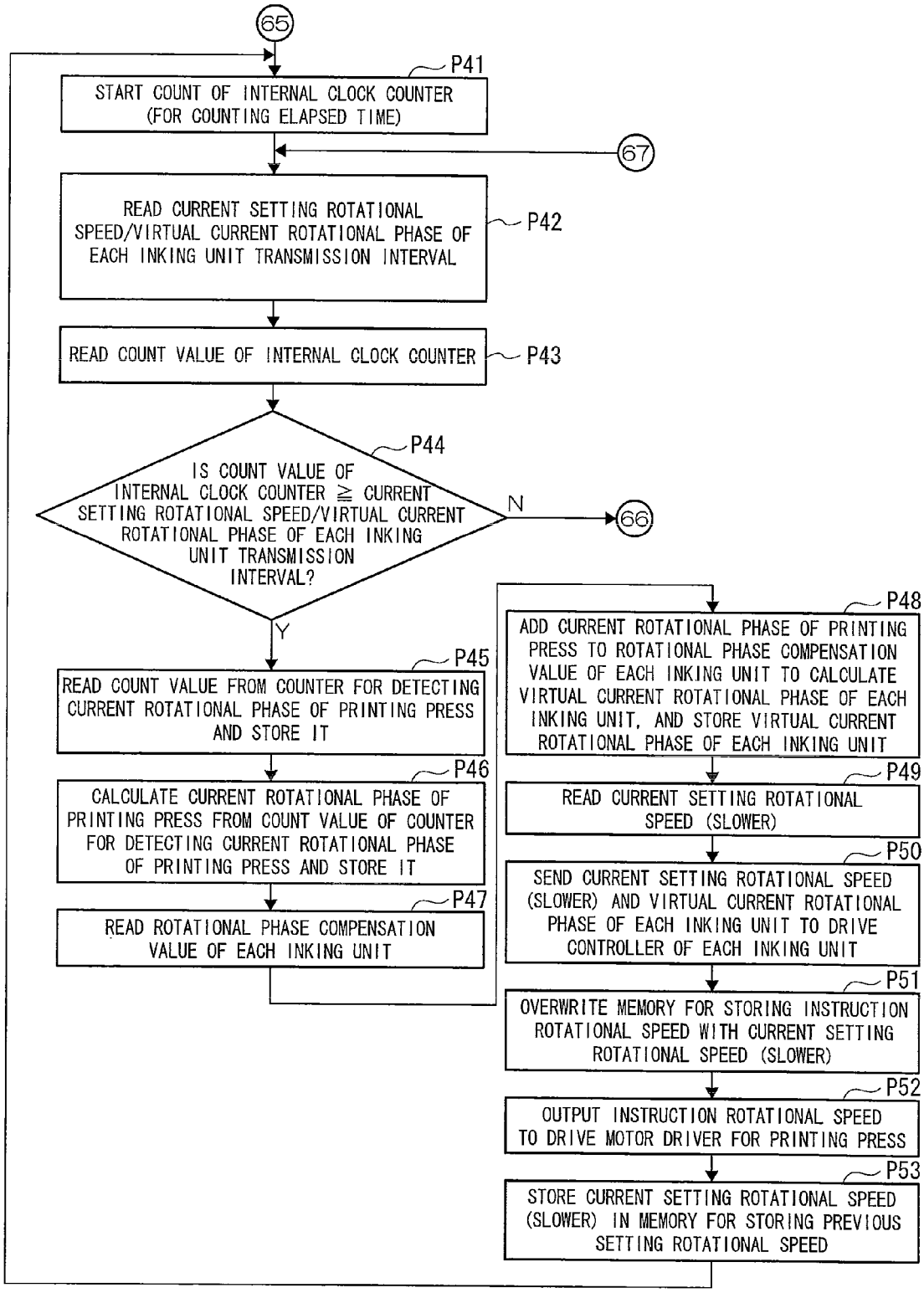
FIG. 34D is an operational flowchart of the drive controller of the printing press.
Figure 34E:
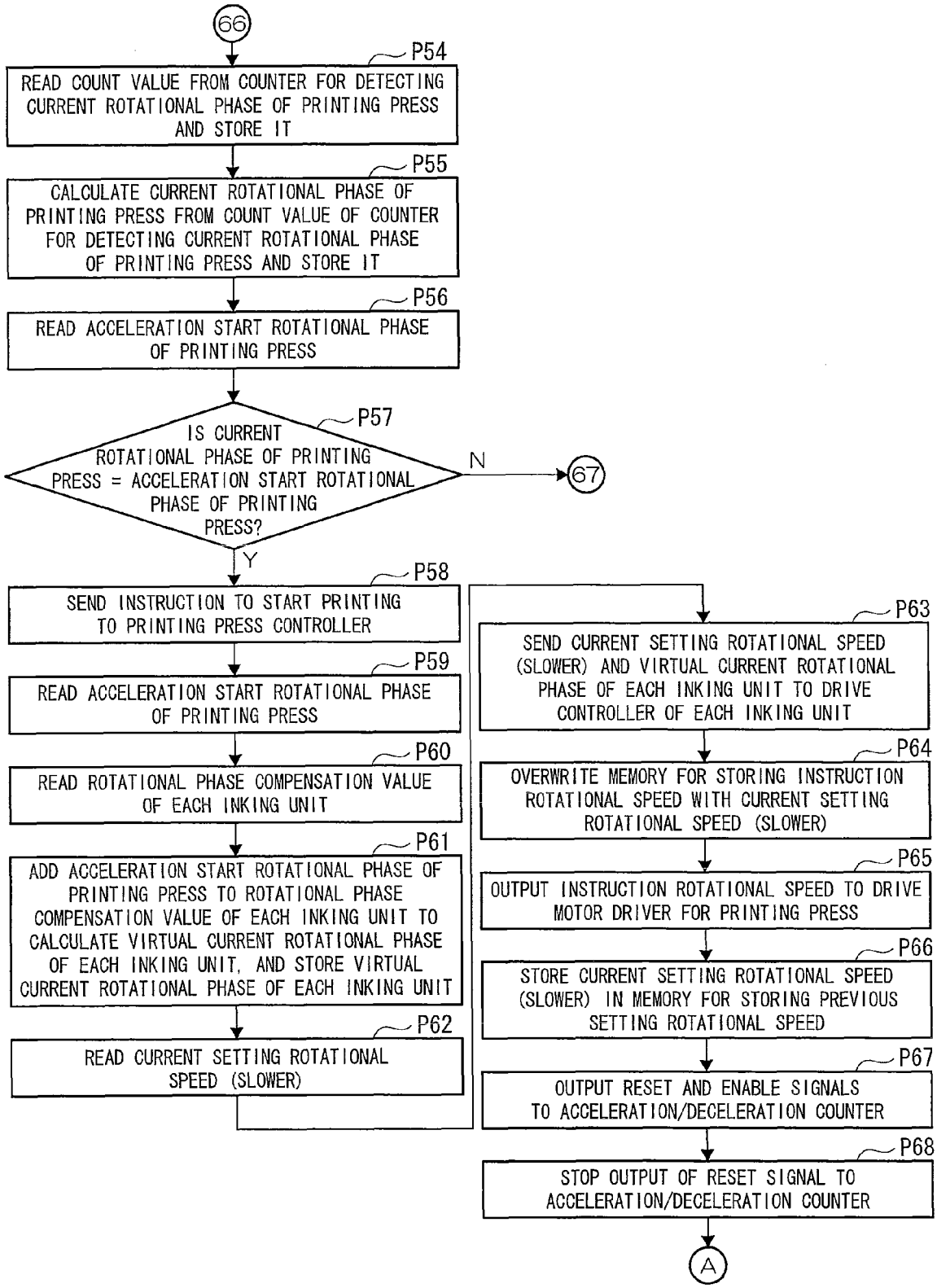
FIG. 34E is an operational flowchart of the drive controller of the printing press.
Figure 35A:
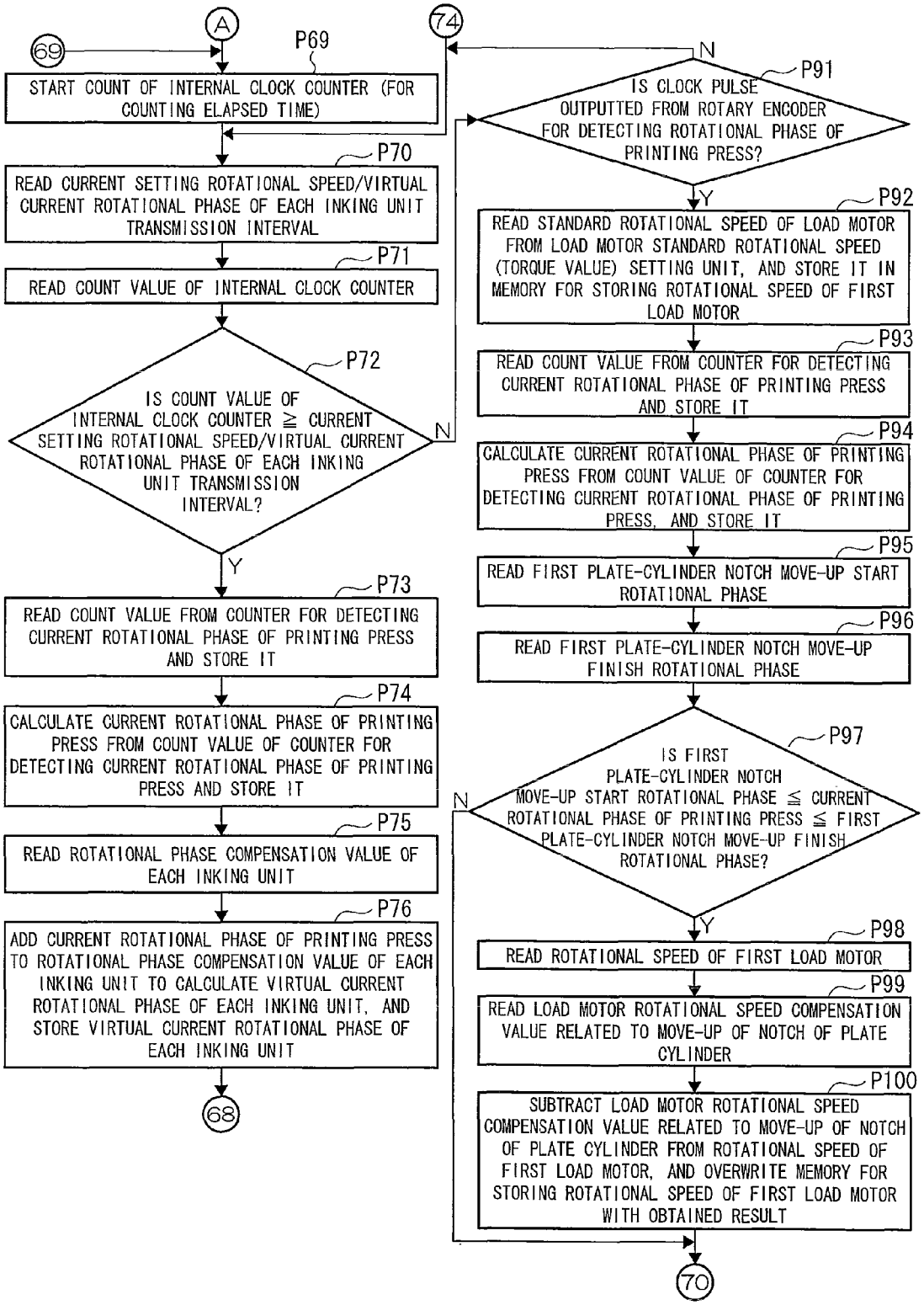
FIG. 35A is an operational flowchart of the drive controller of the printing press.
Figure 35B:
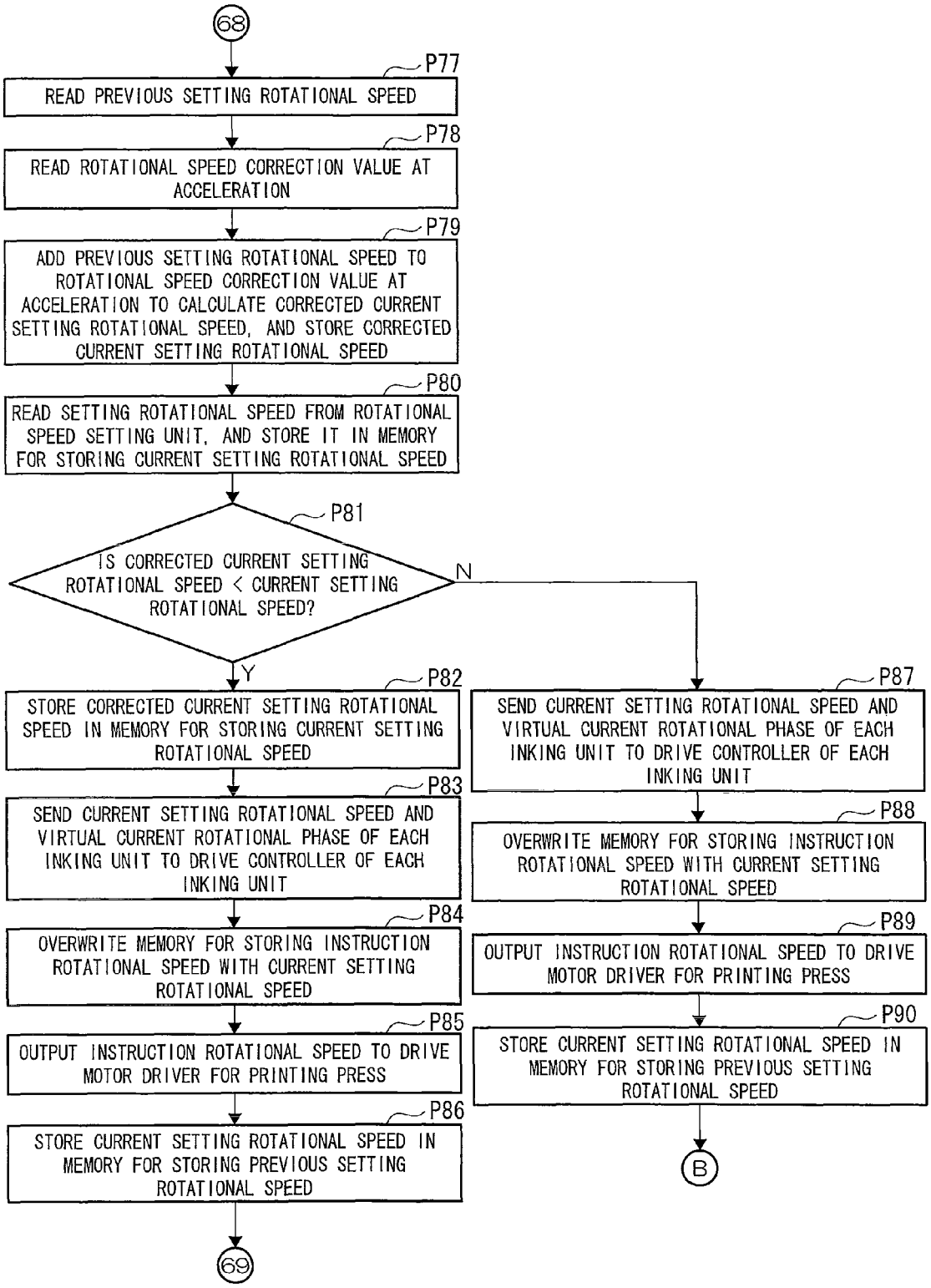
FIG. 35B is an operational flowchart of the drive controller of the printing press.
Figure 35C:
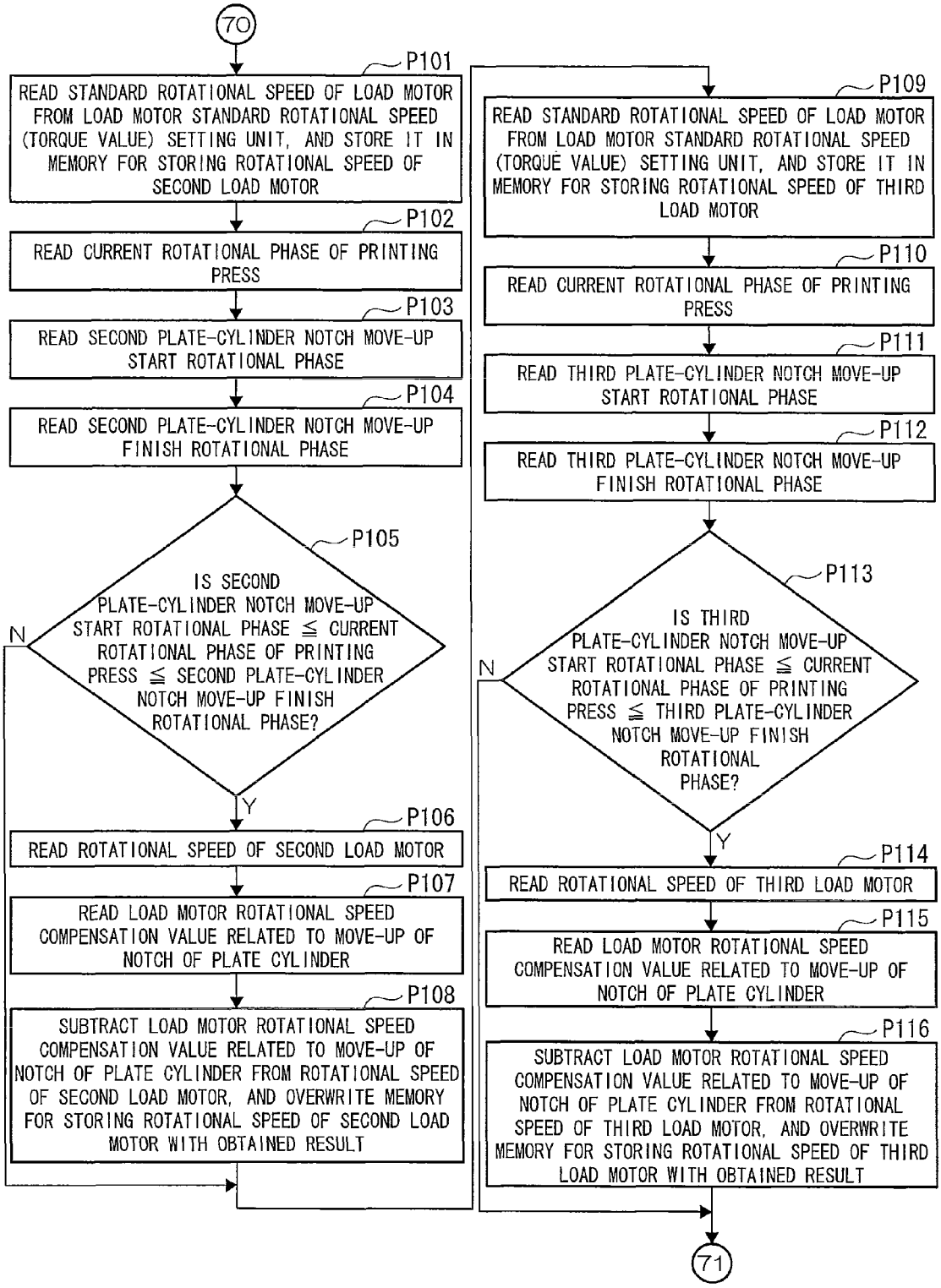
FIG. 35C is an operational flowchart of the drive controller of the printing press.
Figure 35D:
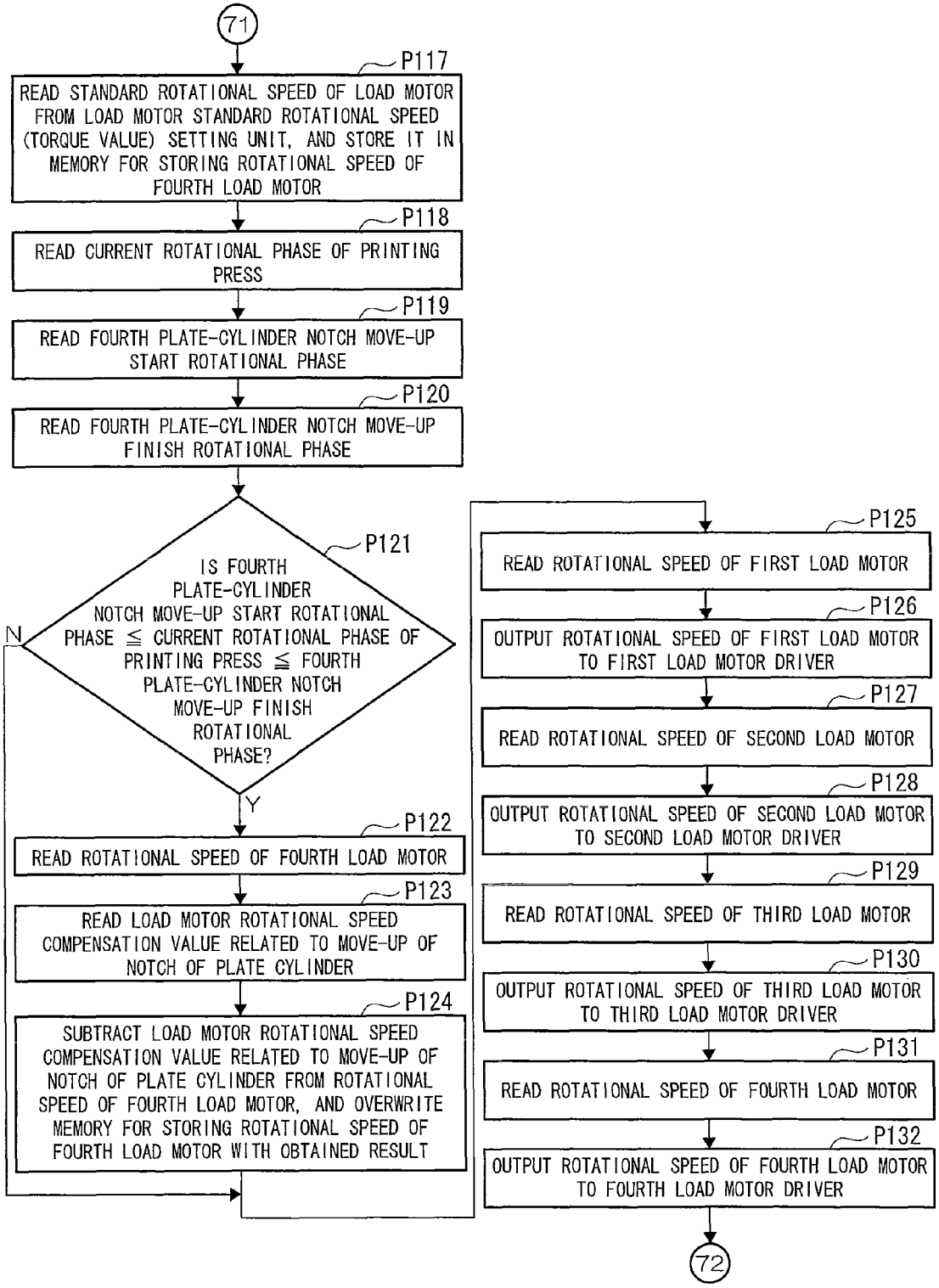
FIG. 35D is an operational flowchart of the drive controller of the printing press.
Figure 35E:
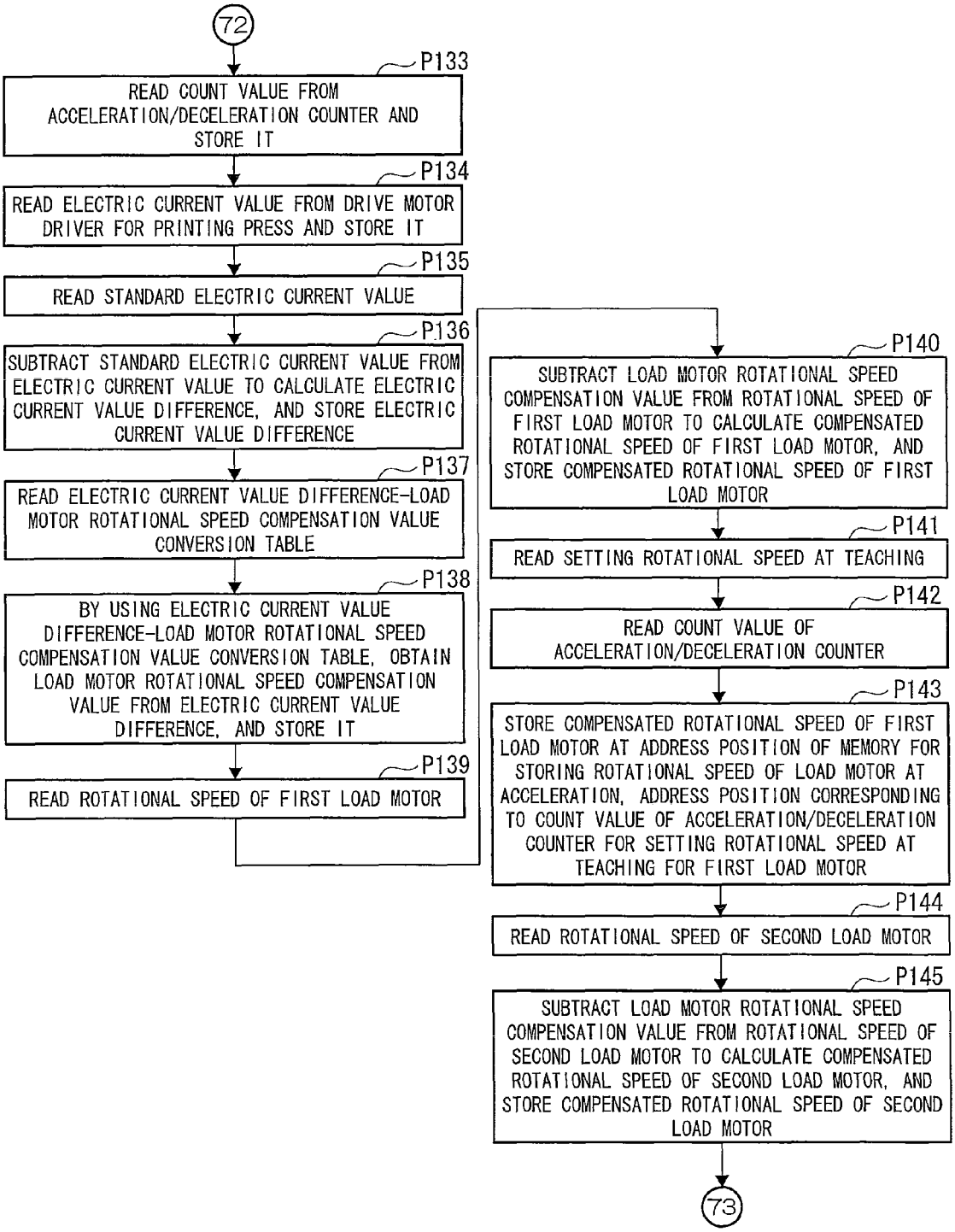
FIG. 35E is an operational flowchart of the drive controller of the printing press.
Figure 35F:
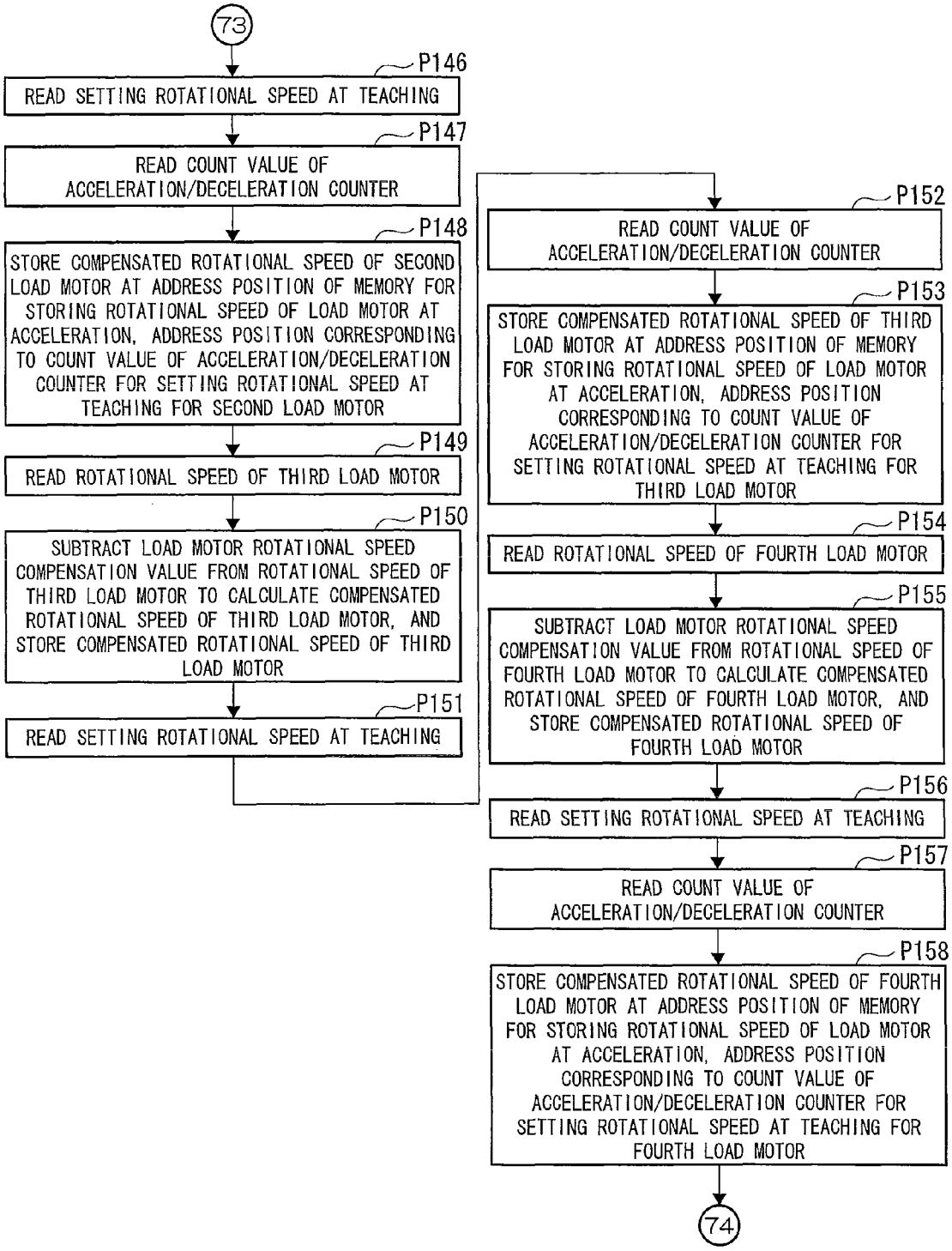
FIG. 35F is an operational flowchart of the drive controller of the printing press.

FIGS. 32A to 32C are hardware block diagrams of a printing press according to Embodiment 2 of the present invention. FIG. 33 is a hardware block diagram of a drive controller of each of first to fourth inking units.

Figure 36A:
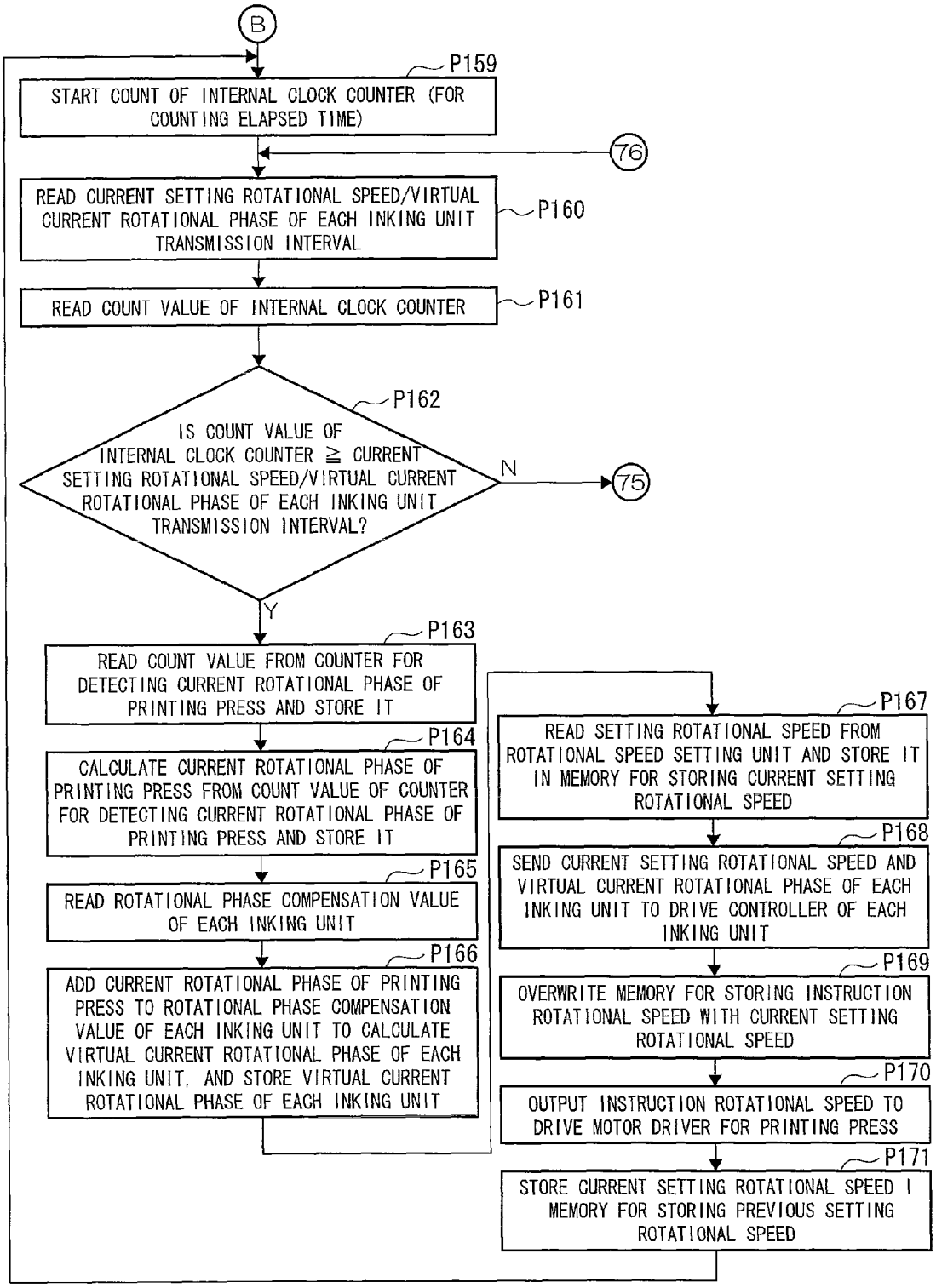
FIG. 36A is an operational flowchart of the drive controller of the printing press.
Figure 36B:
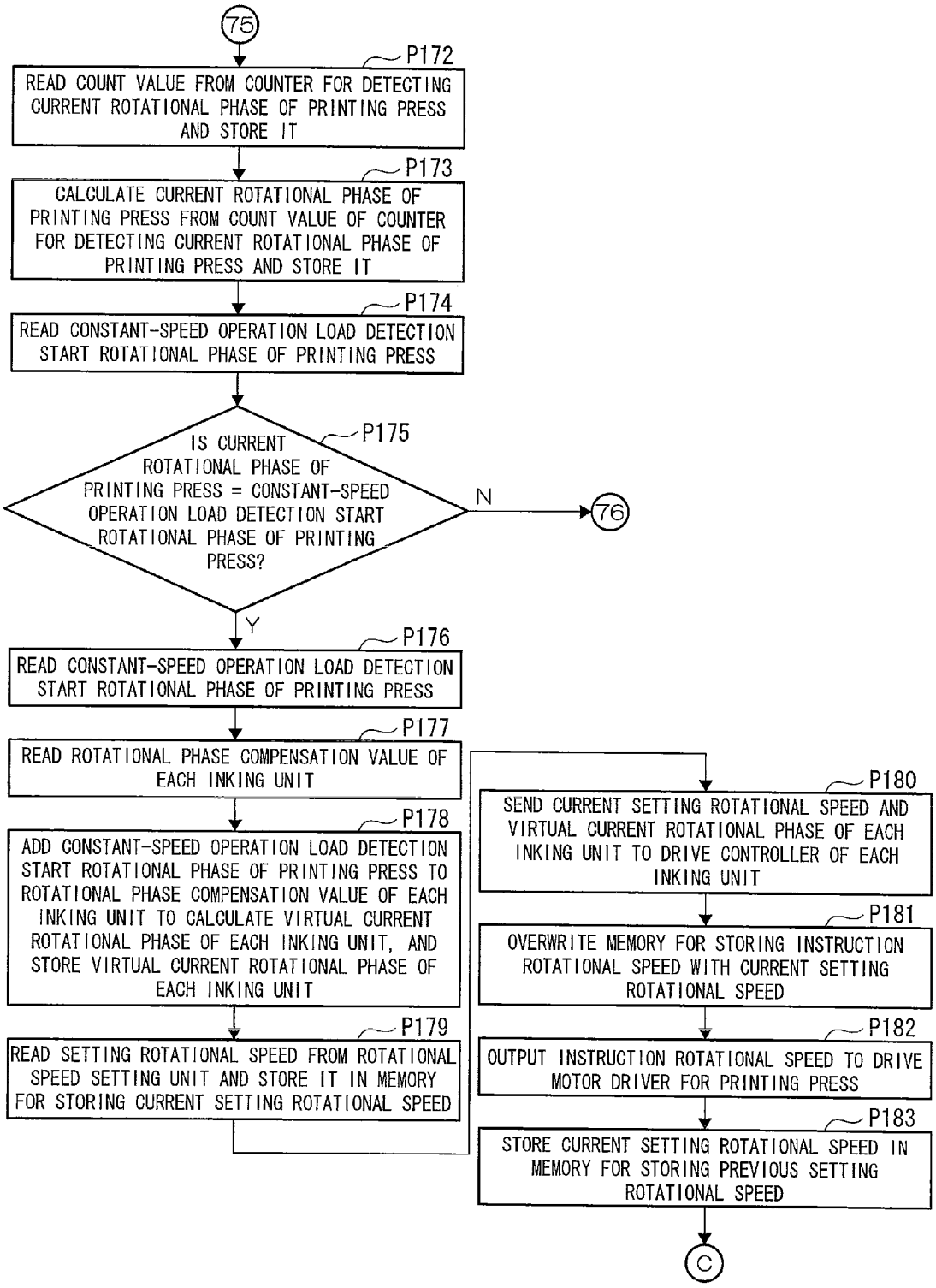
FIG. 36B is an operational flowchart of the drive controller of the printing press.
Figure 37A:
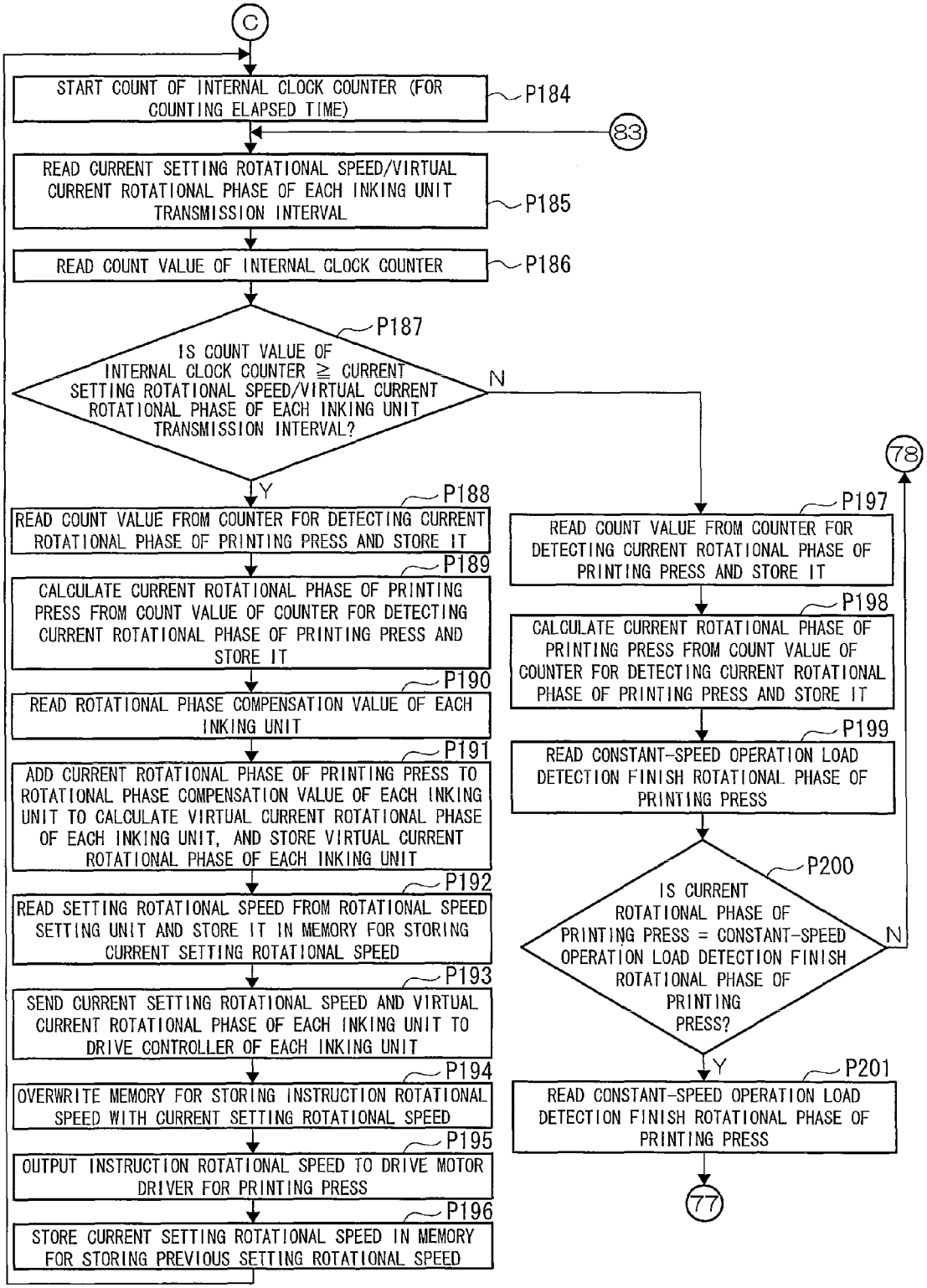
FIG. 37A is an operational flowchart of the drive controller of the printing press.
Figure 37B:
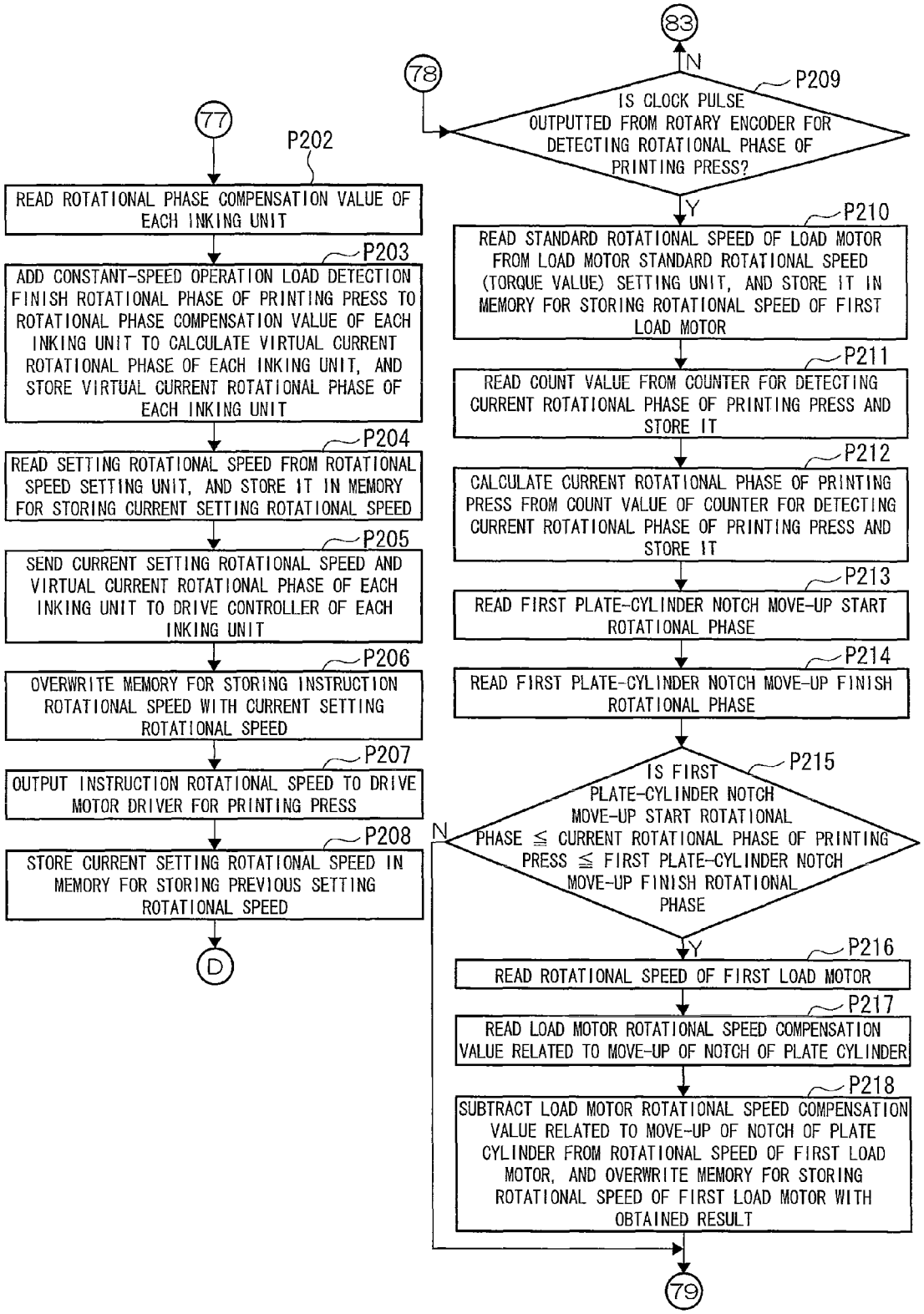
FIG. 37B is an operational flowchart of the drive controller of the printing press.
Figure 37C:
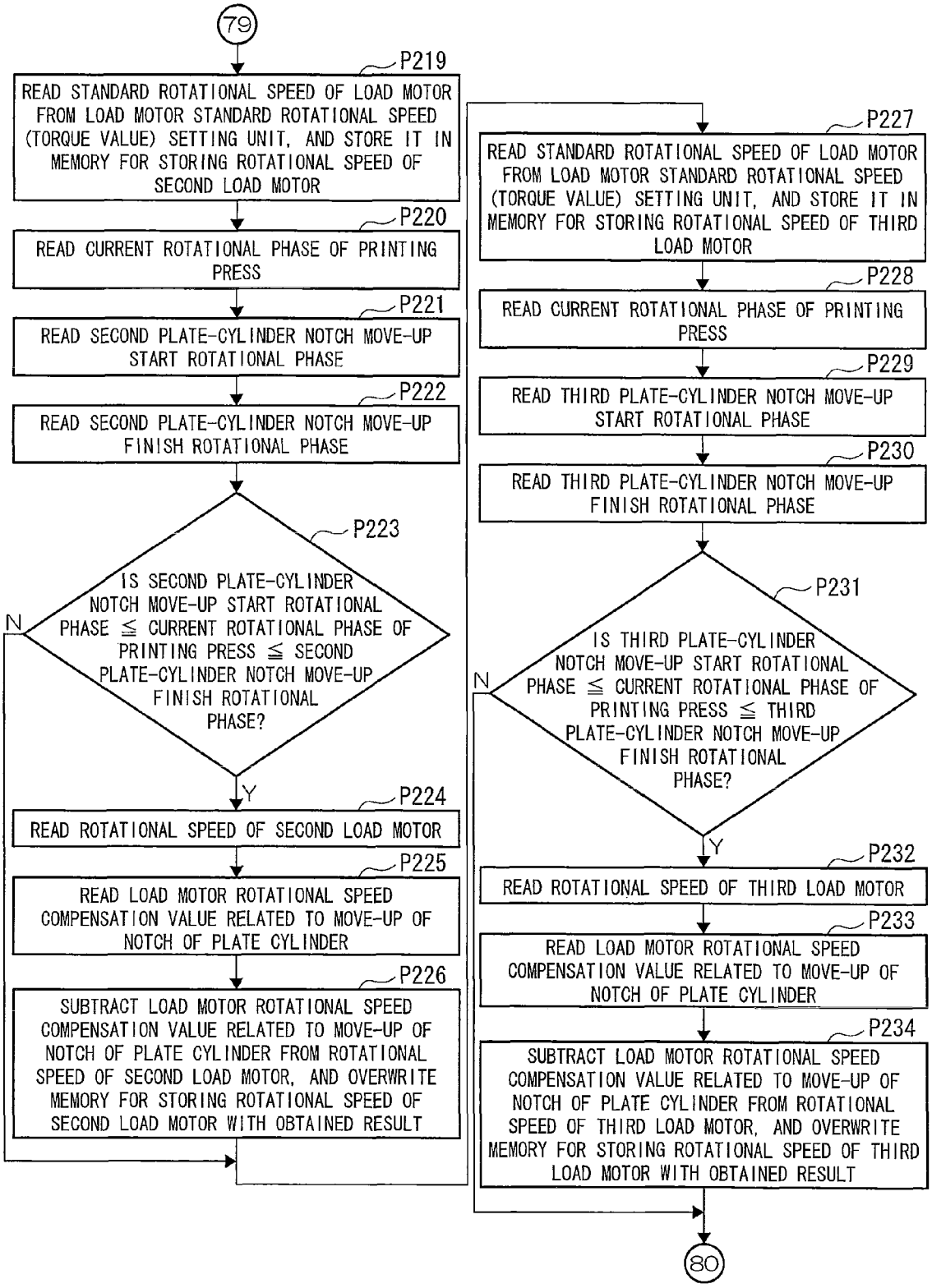
FIG. 37C is an operational flowchart of the drive controller of the printing press.
Figure 37D:
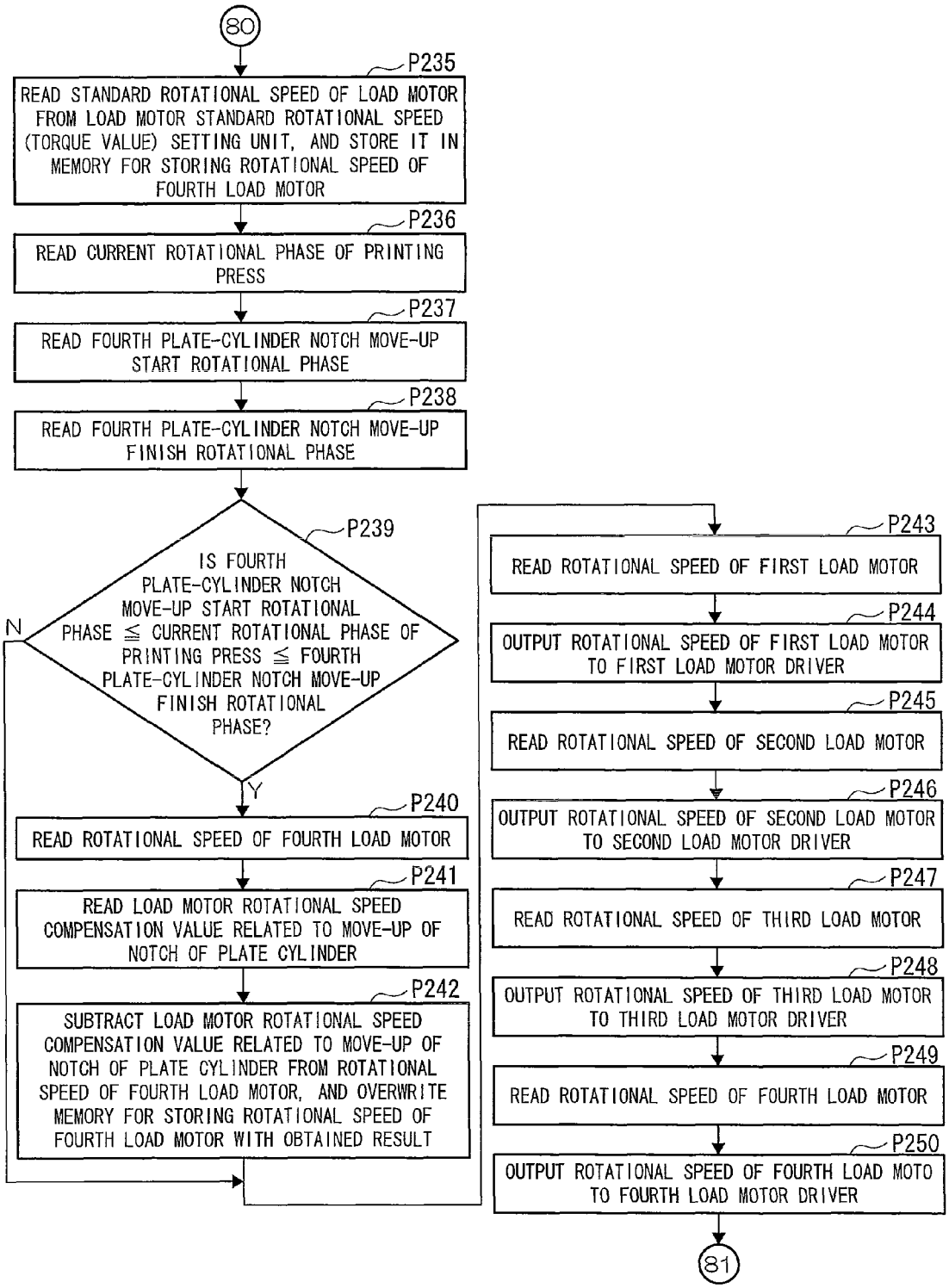
FIG. 37D is an operational flowchart of the drive controller of the printing press.
Figure 37E:
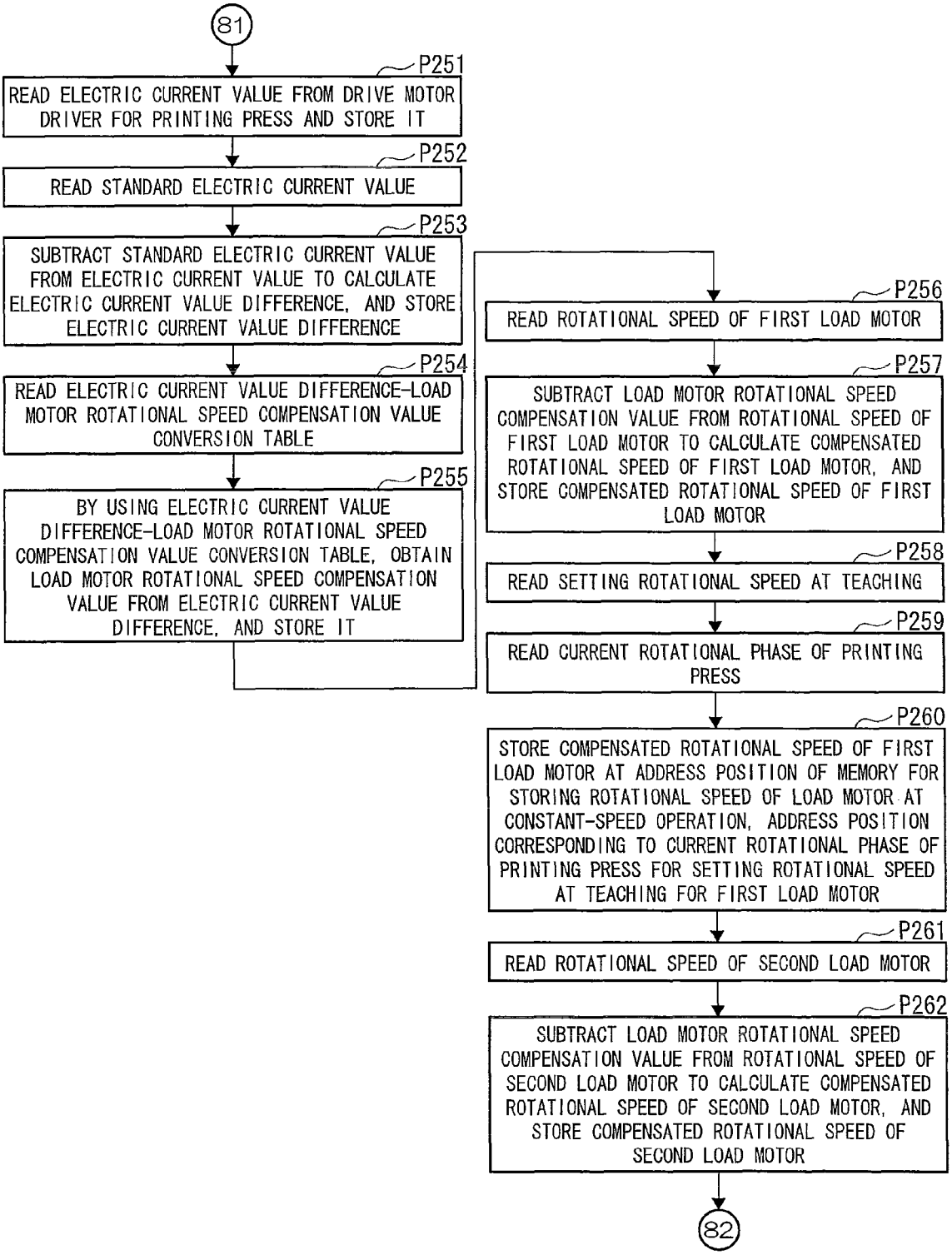
FIG. 37E is an operational flowchart of the drive controller of the printing press.
Figure 37F:
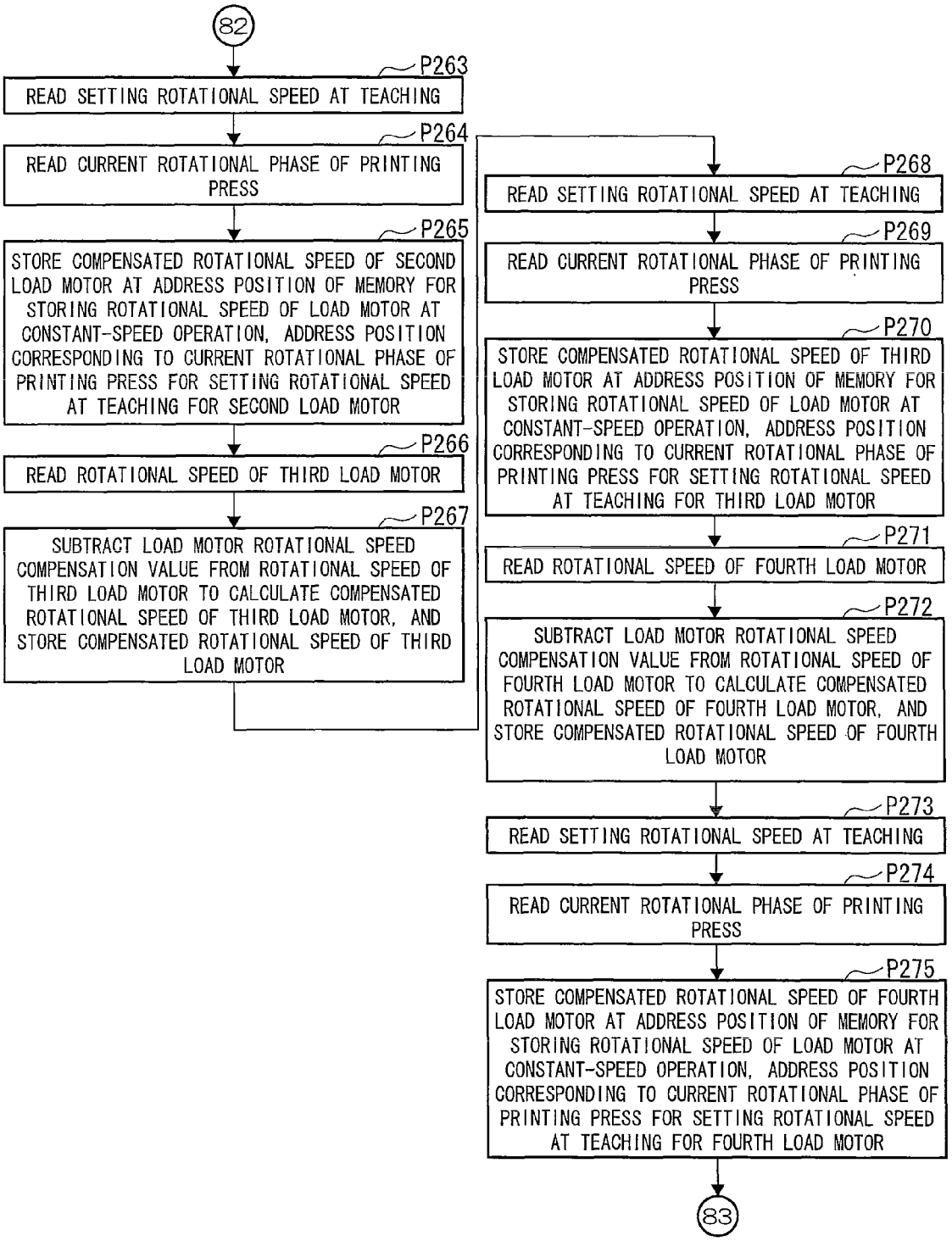
FIG. 37F is an operational flowchart of the drive controller of the printing press.
Figure 38A:
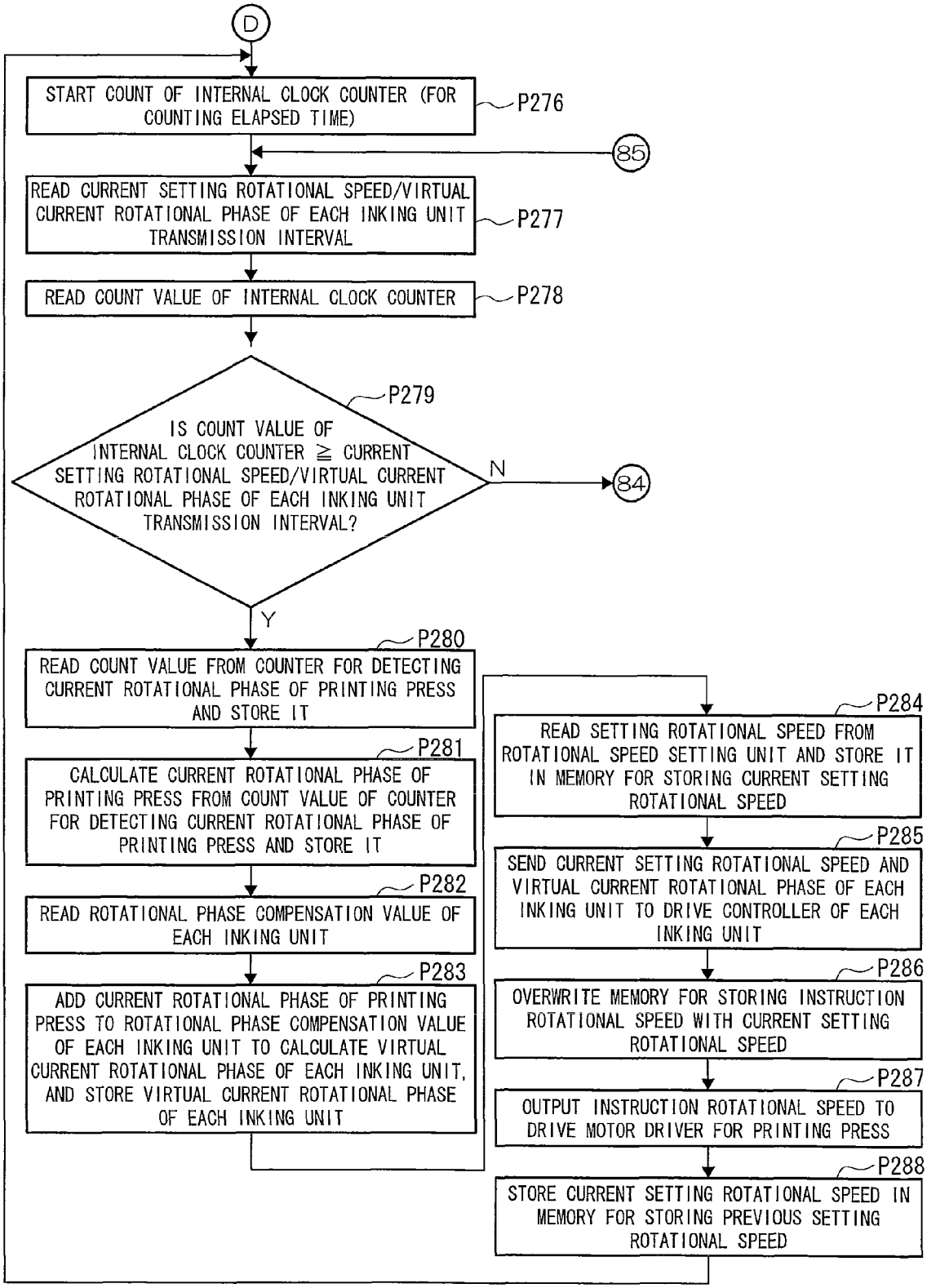
FIG. 38A is an operational flowchart of the drive controller of the printing press.
Figure 38B:
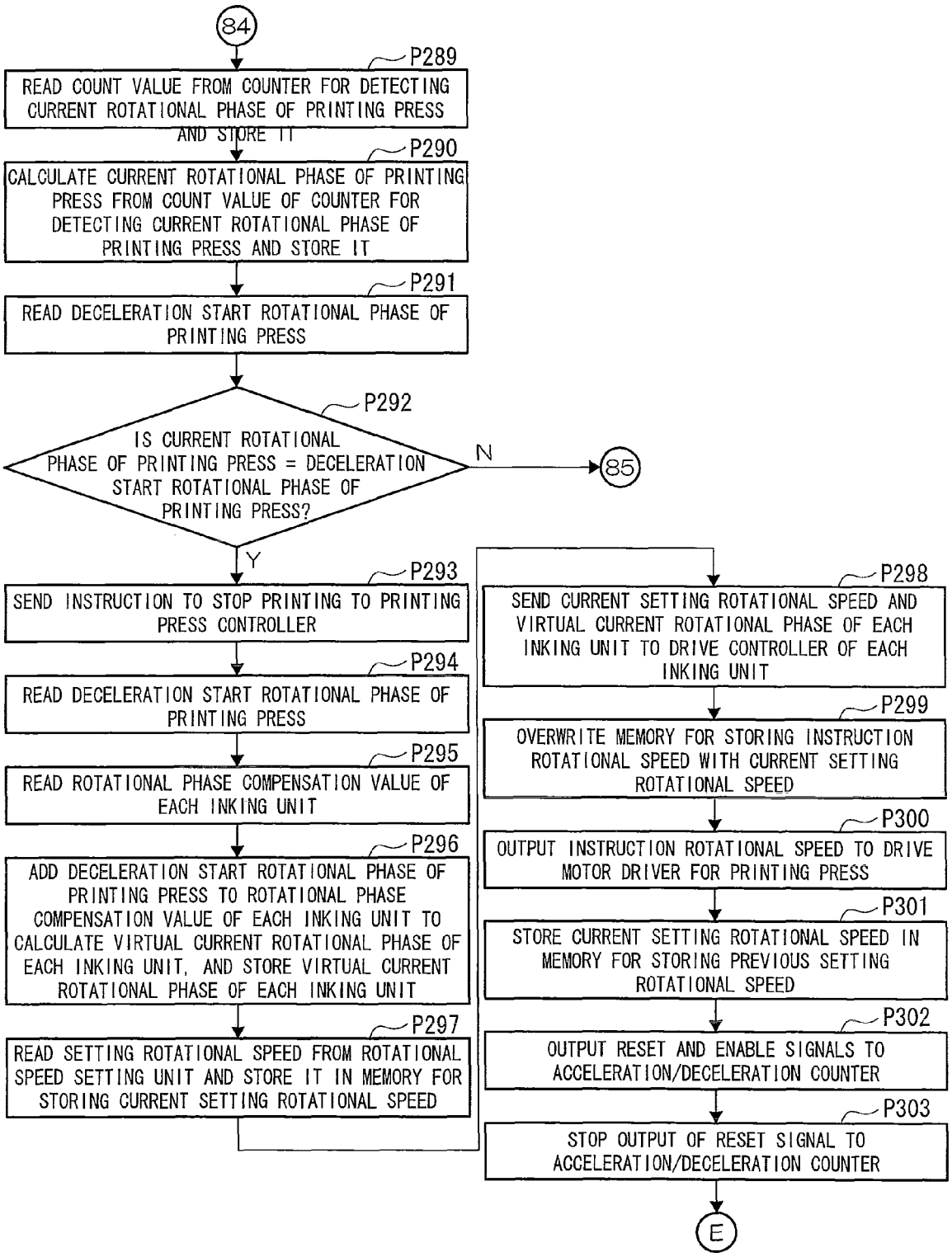
FIG. 38B is an operational flowchart of the drive controller of the printing press.
Figure 39A:
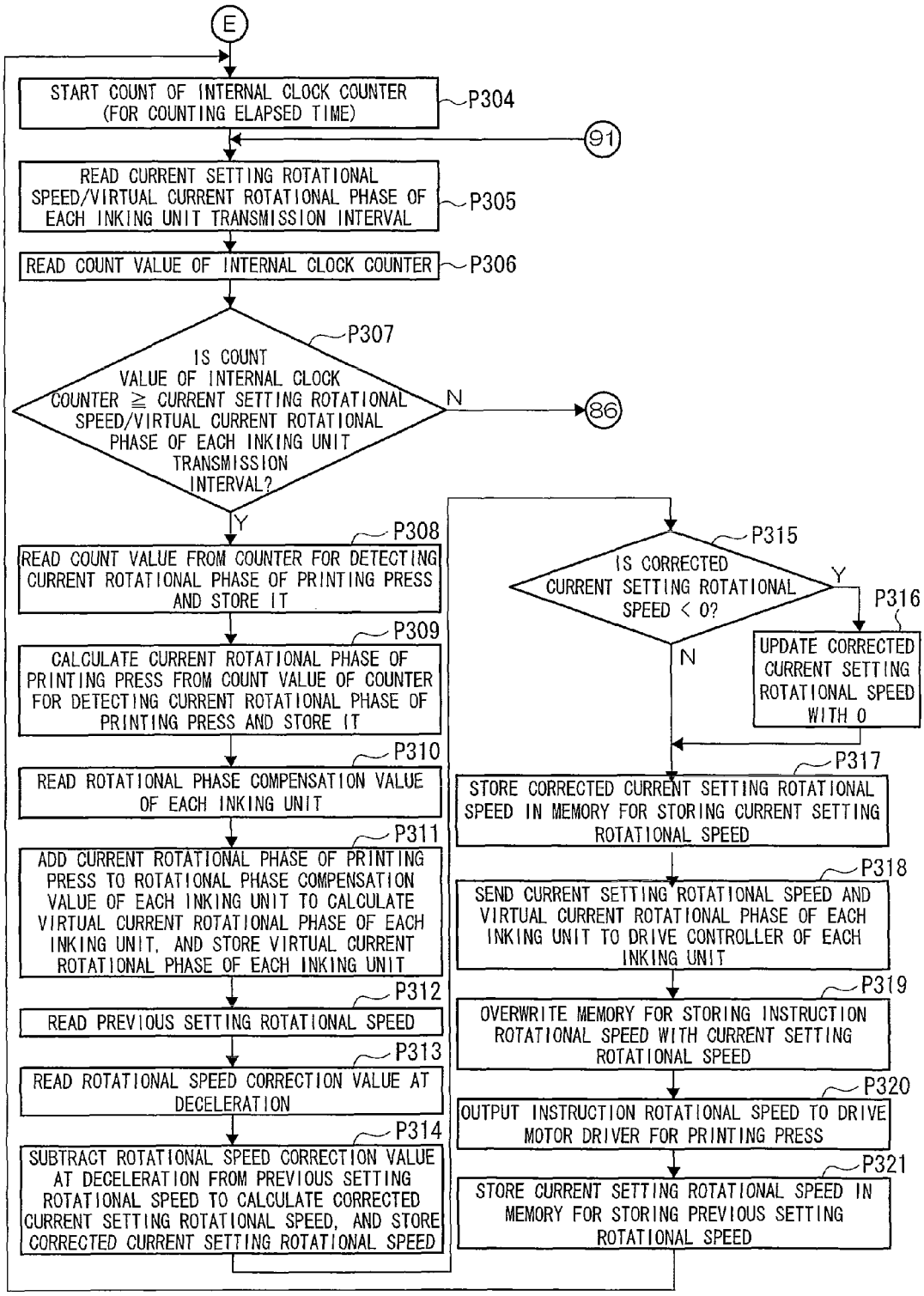
FIG. 39A is an operational flowchart of the drive controller of the printing press.
Figure 39B:
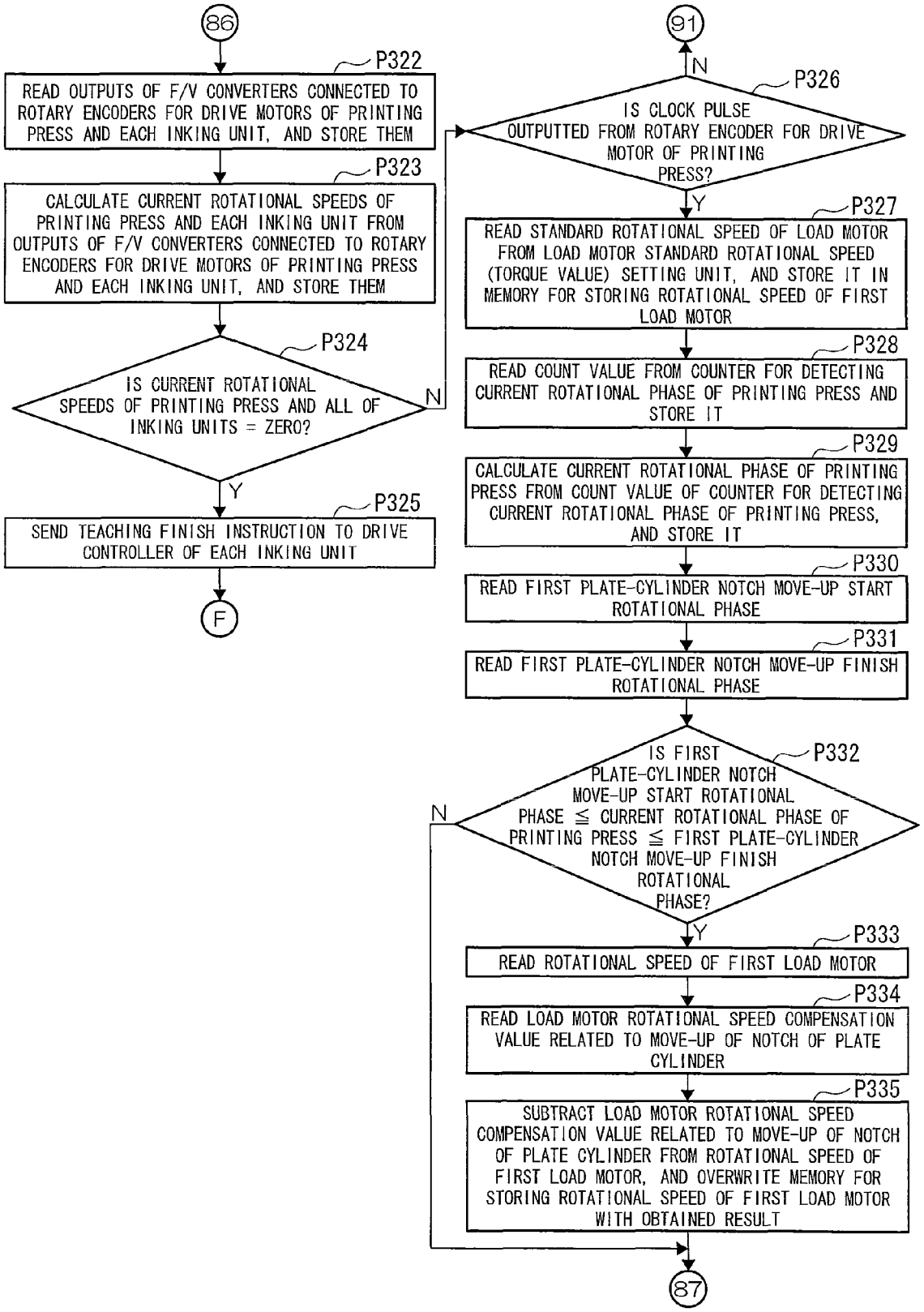
FIG. 39B is an operational flowchart of the drive controller of the printing press.
Figure 39C:
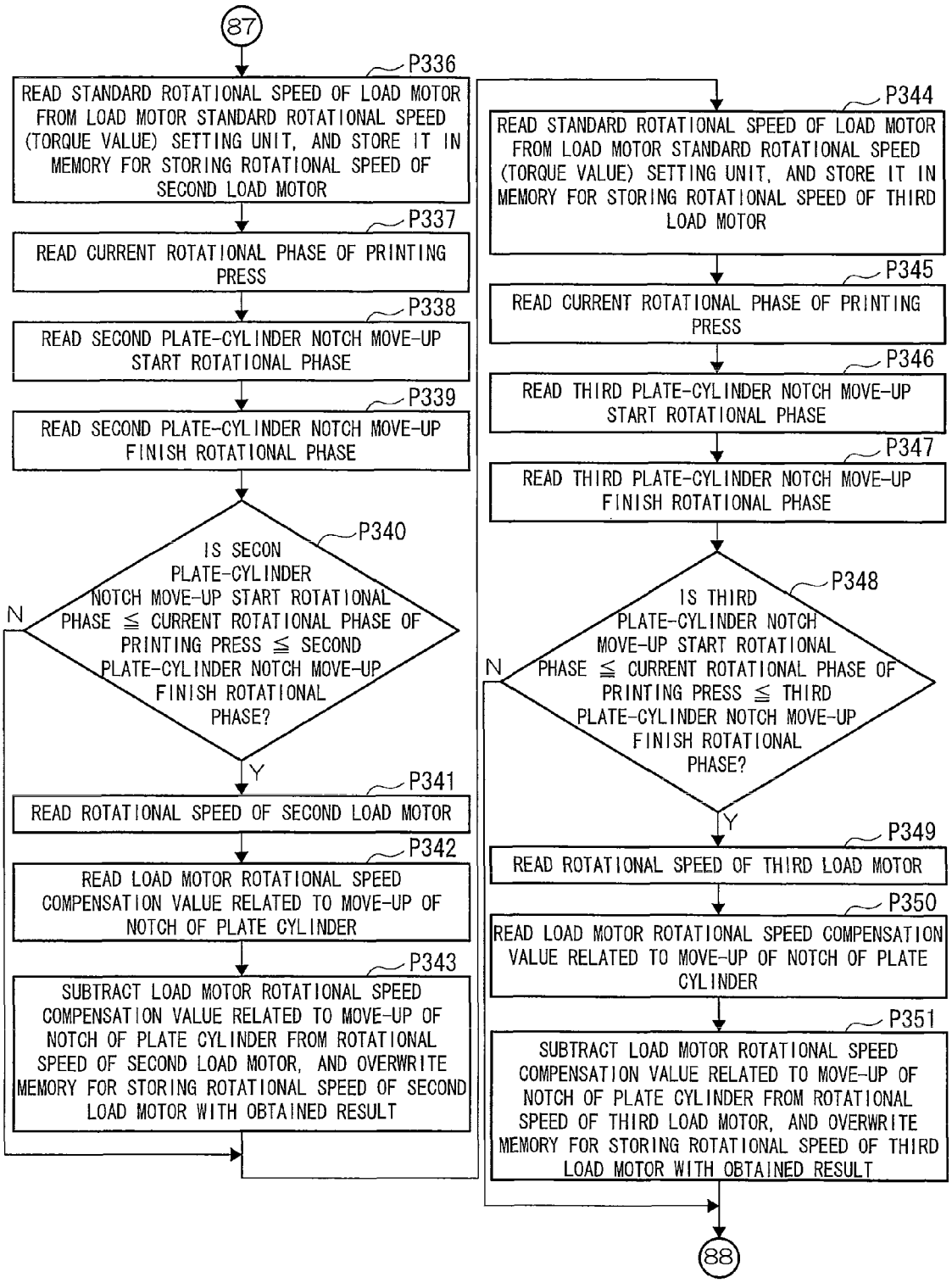
FIG. 39C is an operational flowchart of the drive controller of the printing press.
Figure 39D:
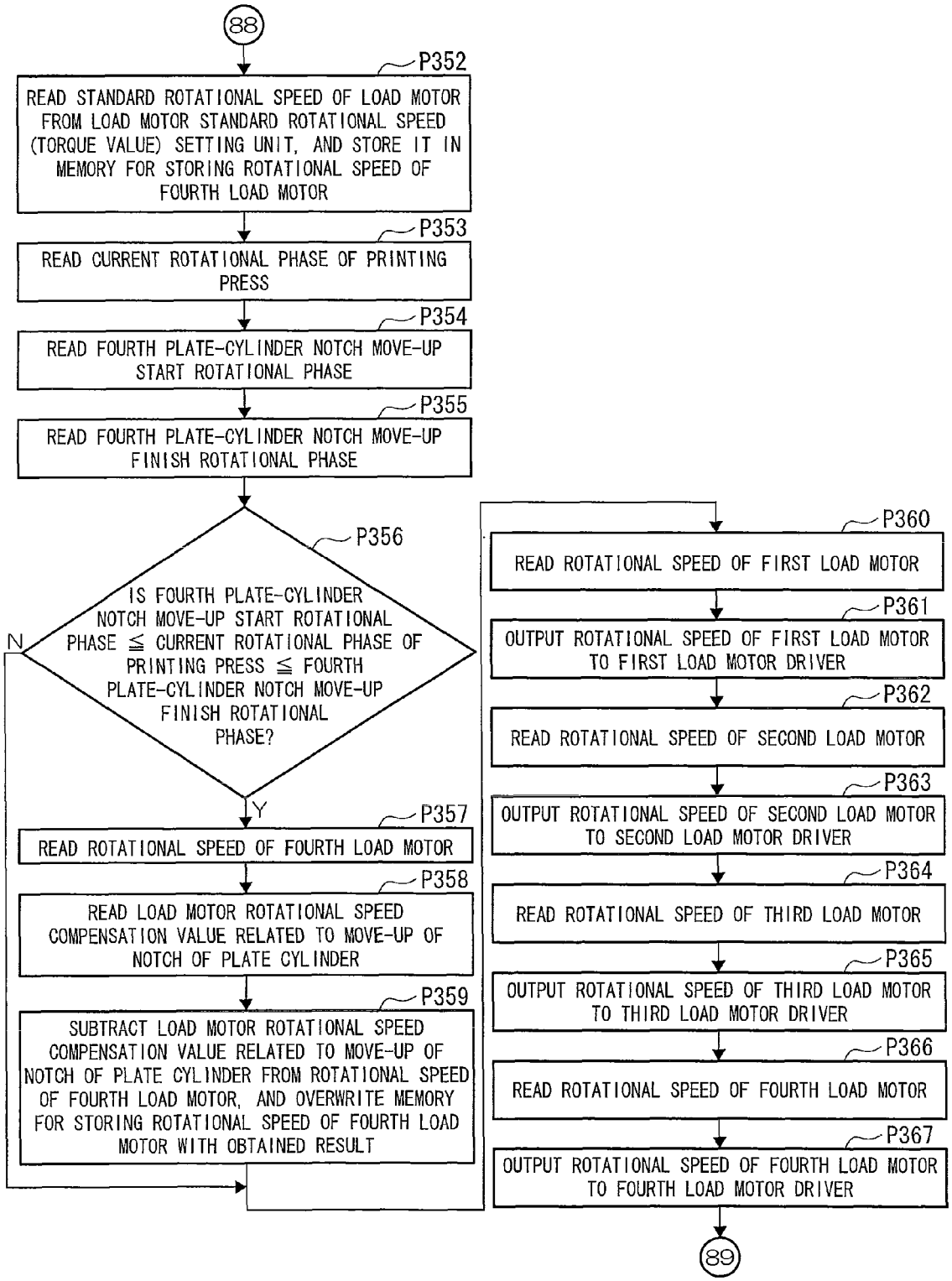
FIG. 39D is an operational flowchart of the drive controller of the printing press.
Figure 39E:
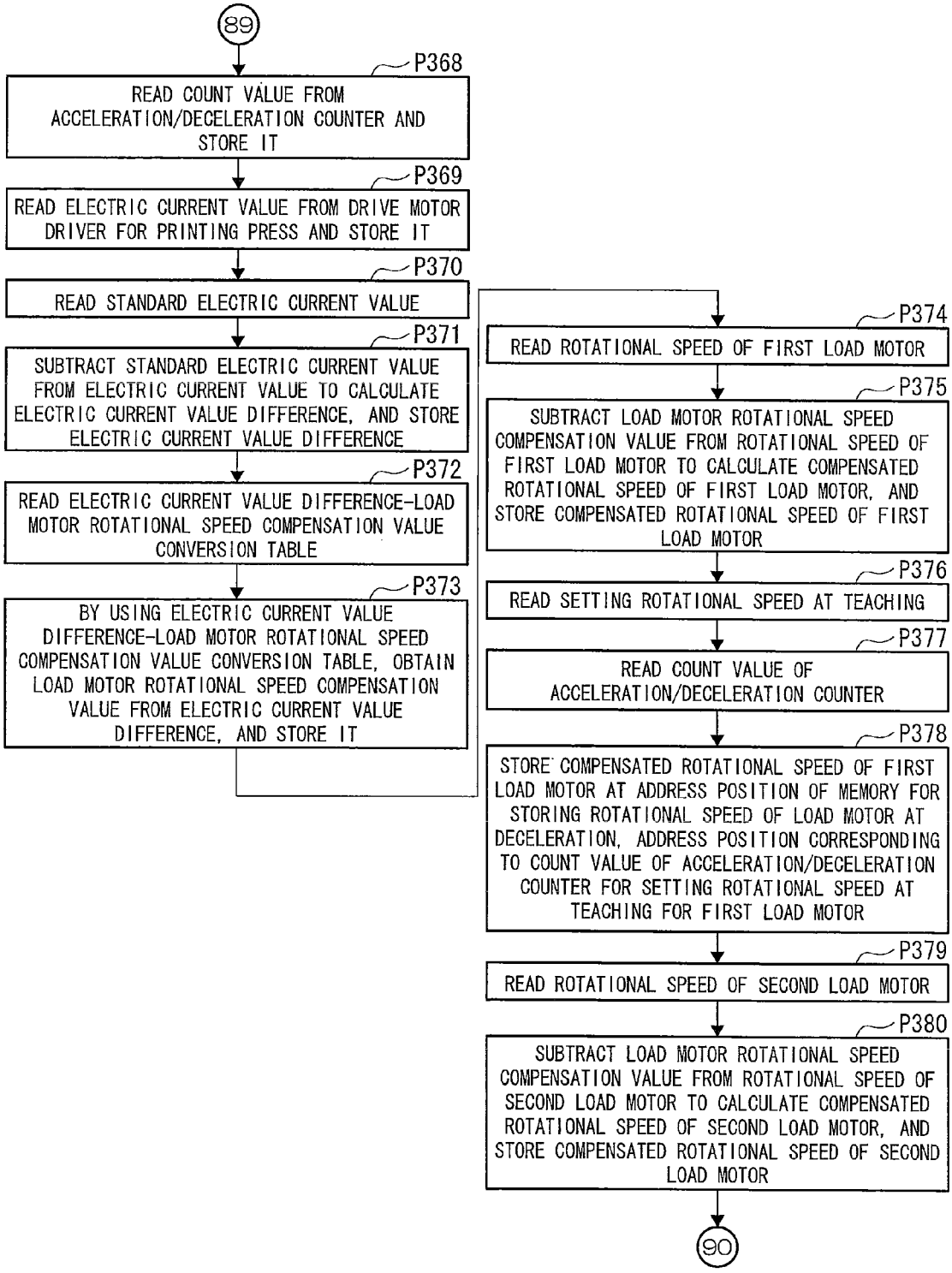
FIG. 39E is an operational flowchart of the drive controller of the printing press.
Figure 39F:
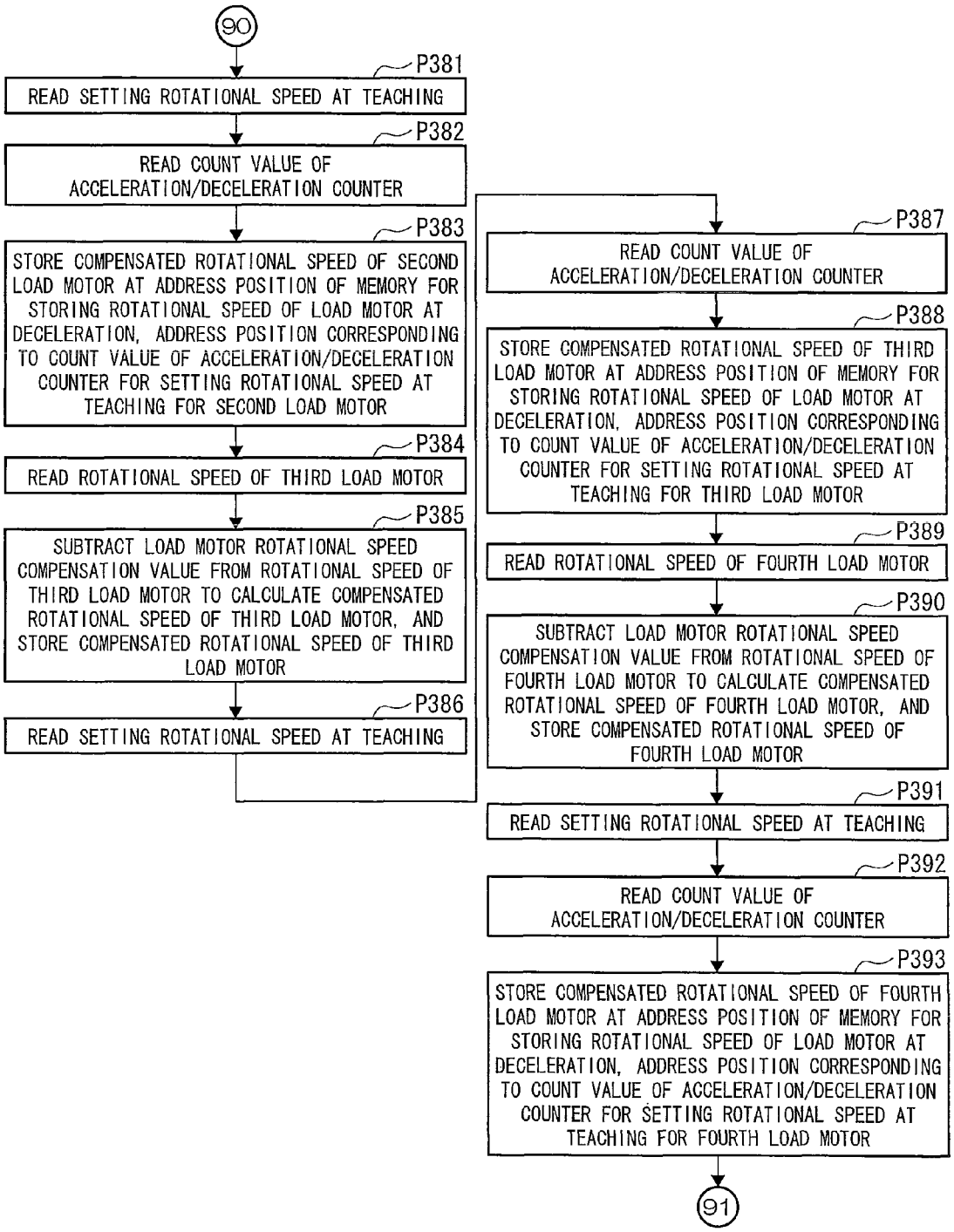
FIG. 39F is an operational flowchart of the drive controller of the printing press.
Figure 40A:
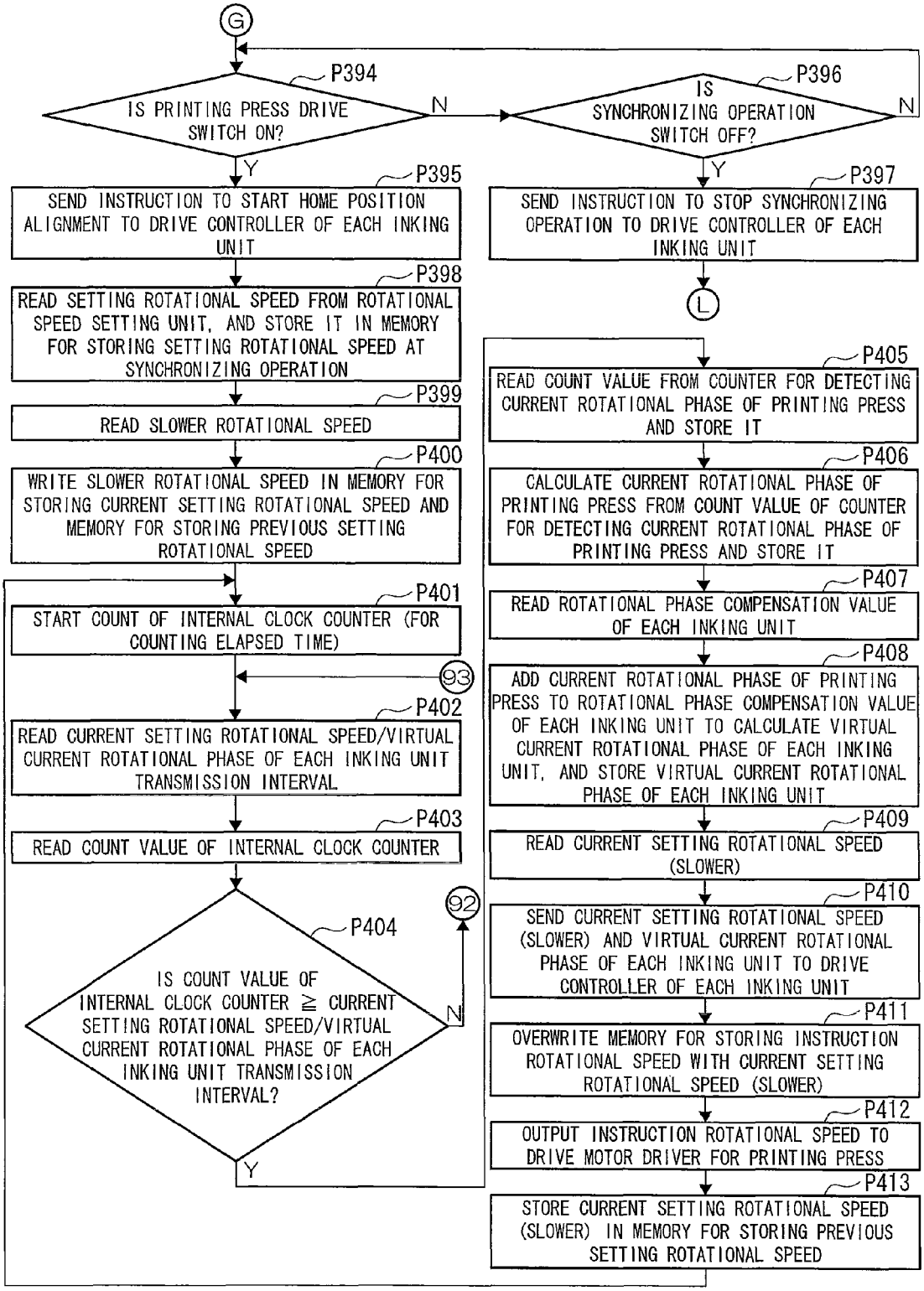
FIG. 40A is an operational flowchart of the drive controller of the printing press.
Figure 40B:
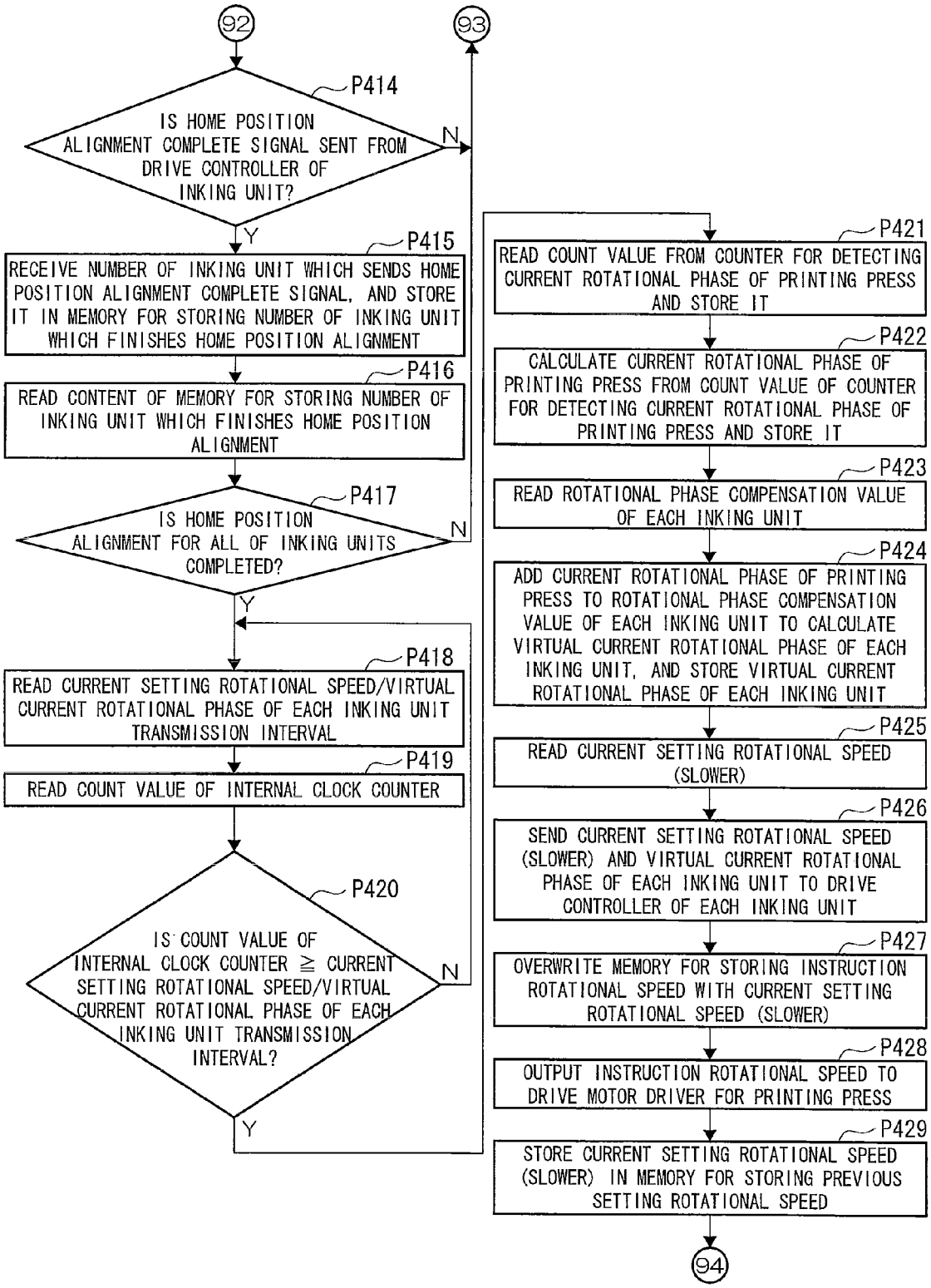
FIG. 40B is an operational flowchart of the drive controller of the printing press.
Figure 40C:
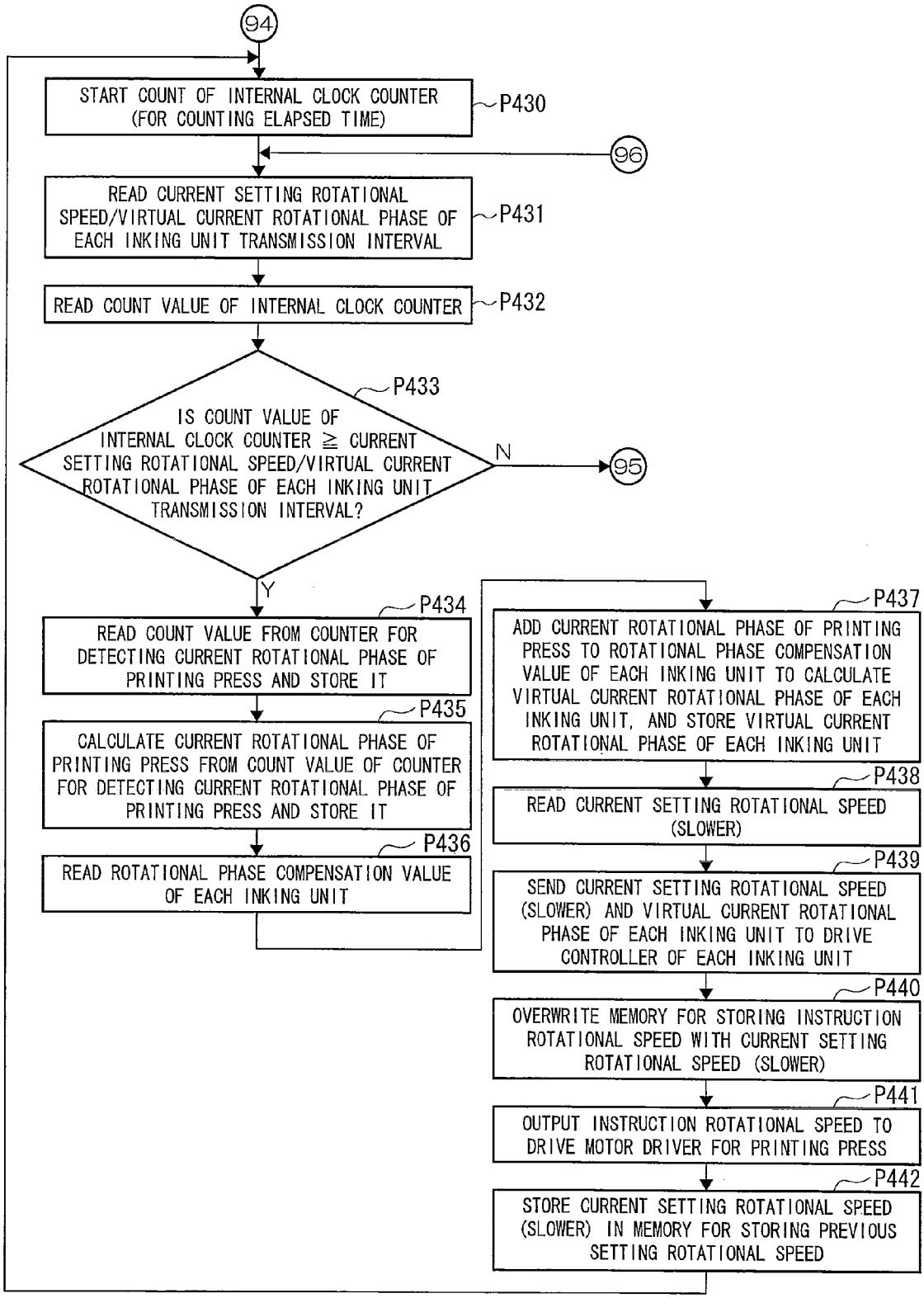
FIG. 40C is an operational flowchart of the drive controller of the printing press.
Figure 40D:
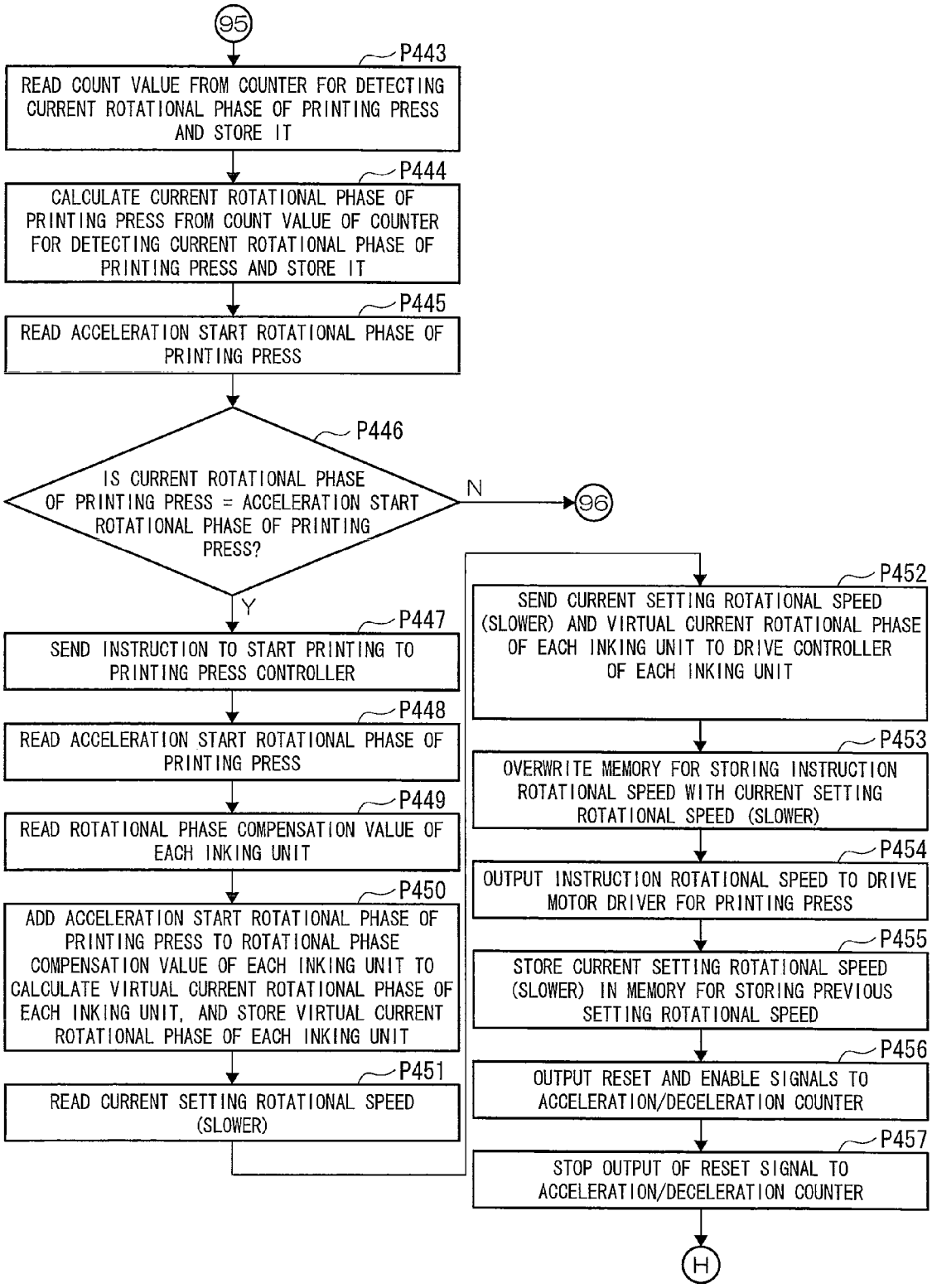
FIG. 40D is an operational flowchart of the drive controller of the printing press.
Figure 41A:
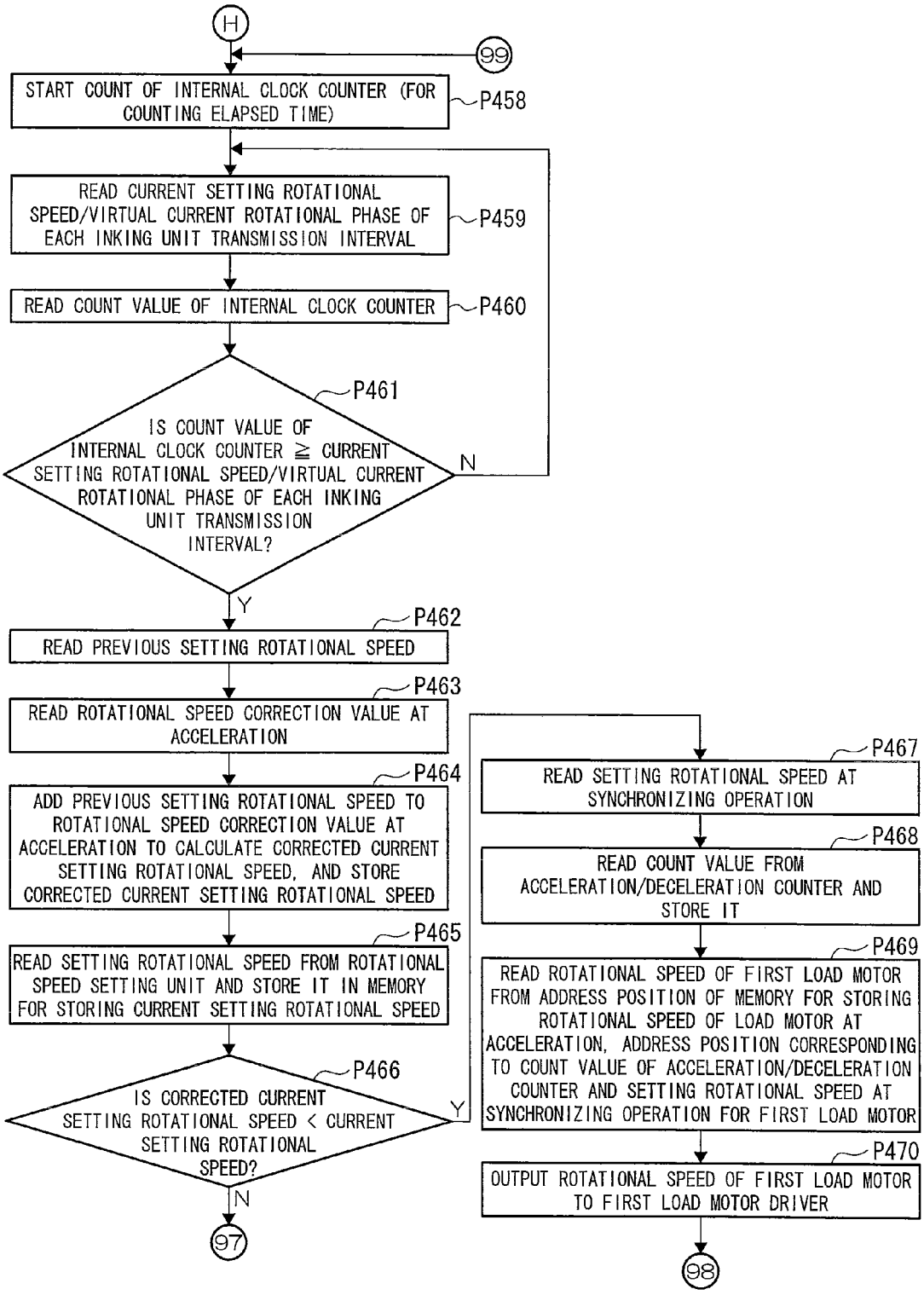
FIG. 41A is an operational flowchart of the drive controller of the printing press.
Figure 41B:
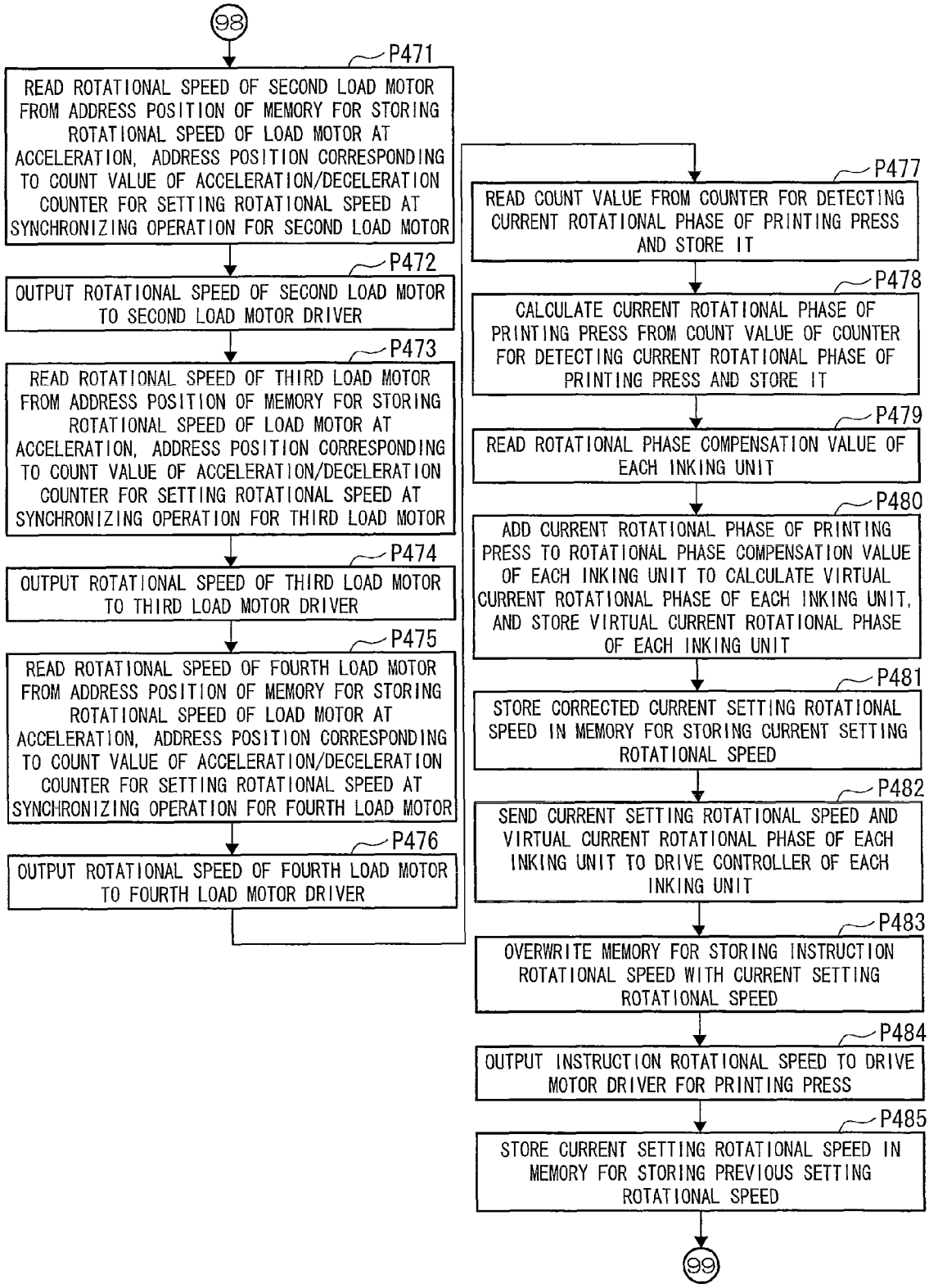
FIG. 41B is an operational flowchart of the drive controller of the printing press.
Figure 41C:
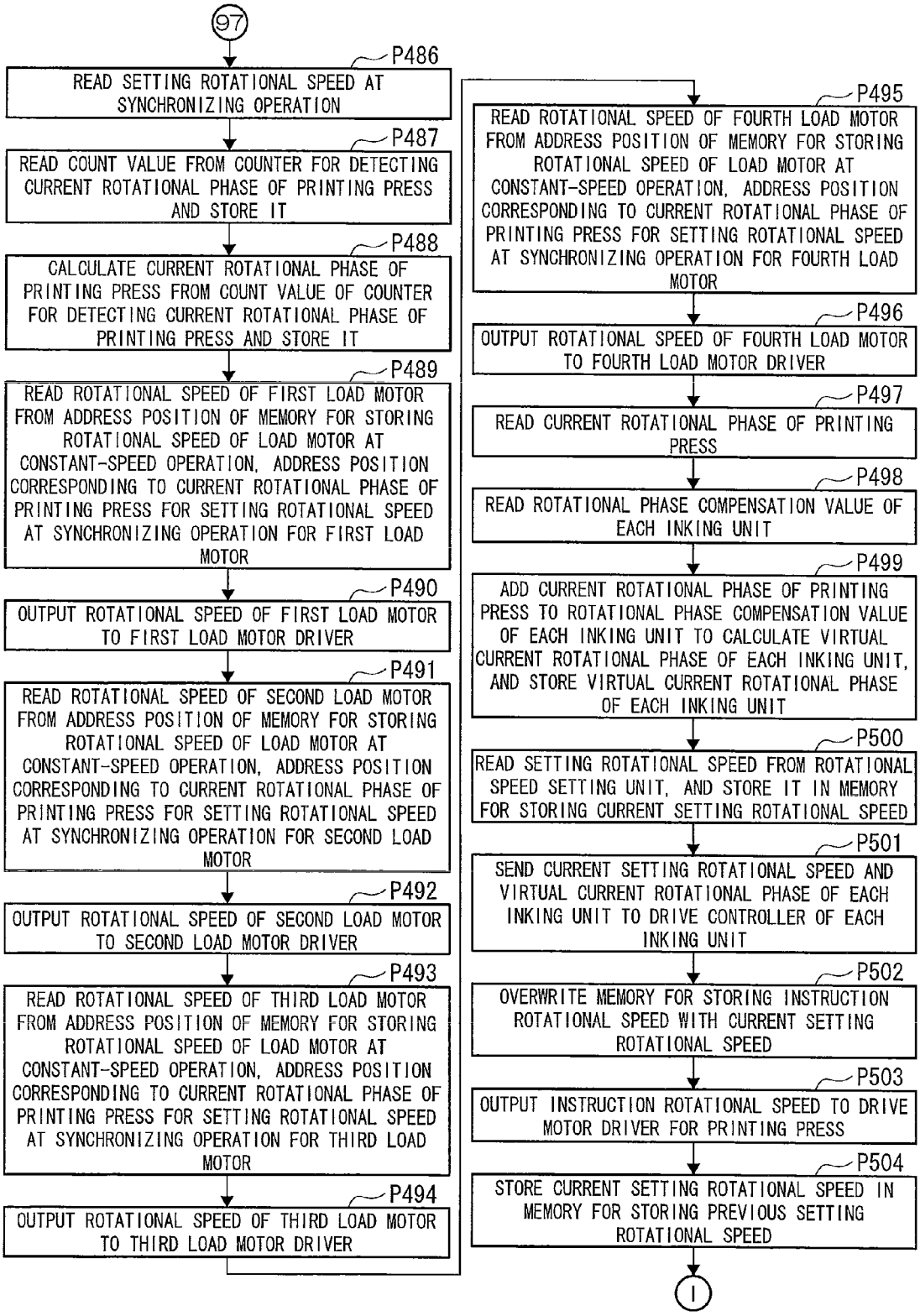
FIG. 41C is an operational flowchart of the drive controller of the printing press.
Figure 42A:
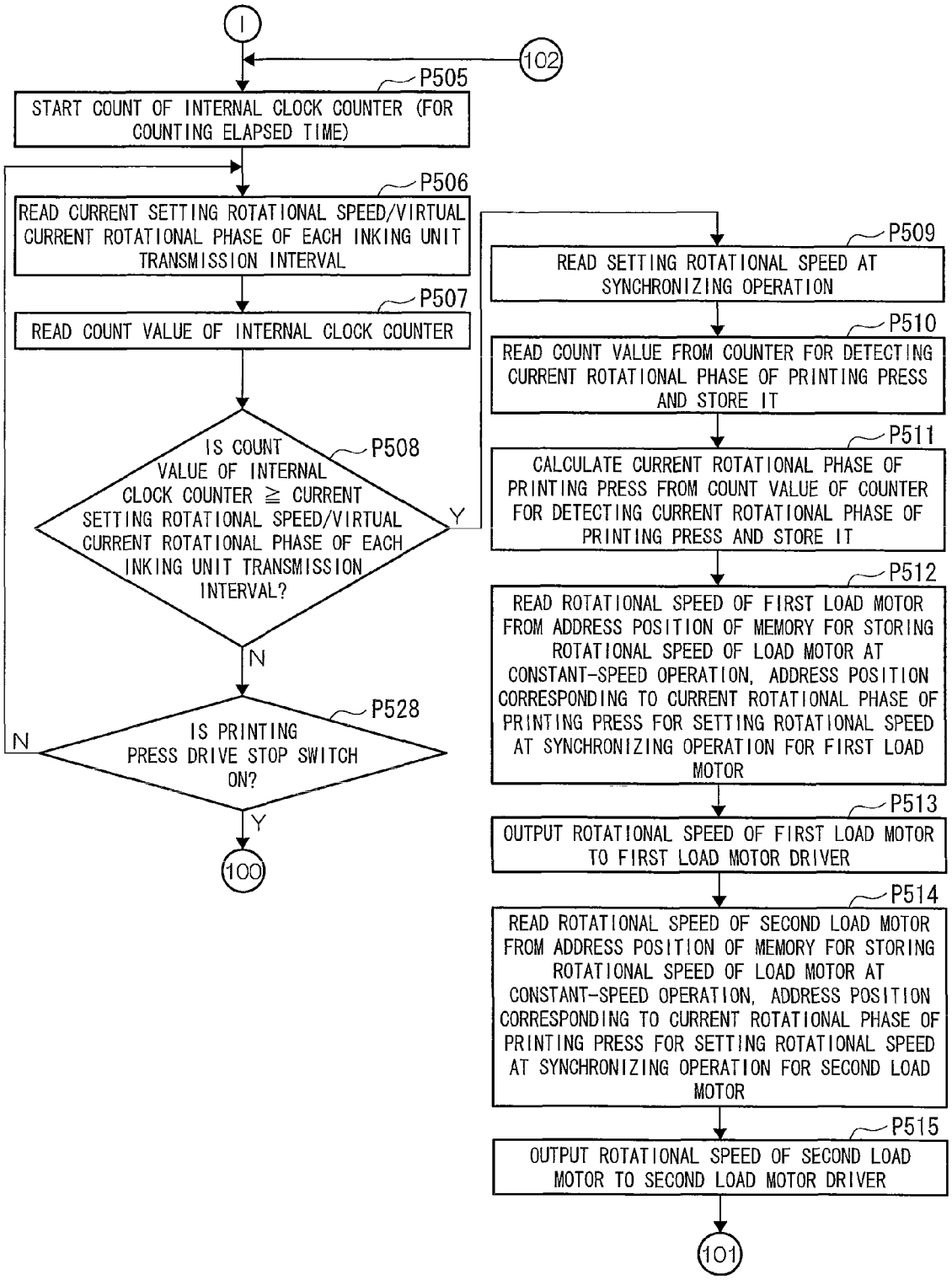
FIG. 42A is an operational flowchart of the drive controller of the printing press.
Figure 42B:
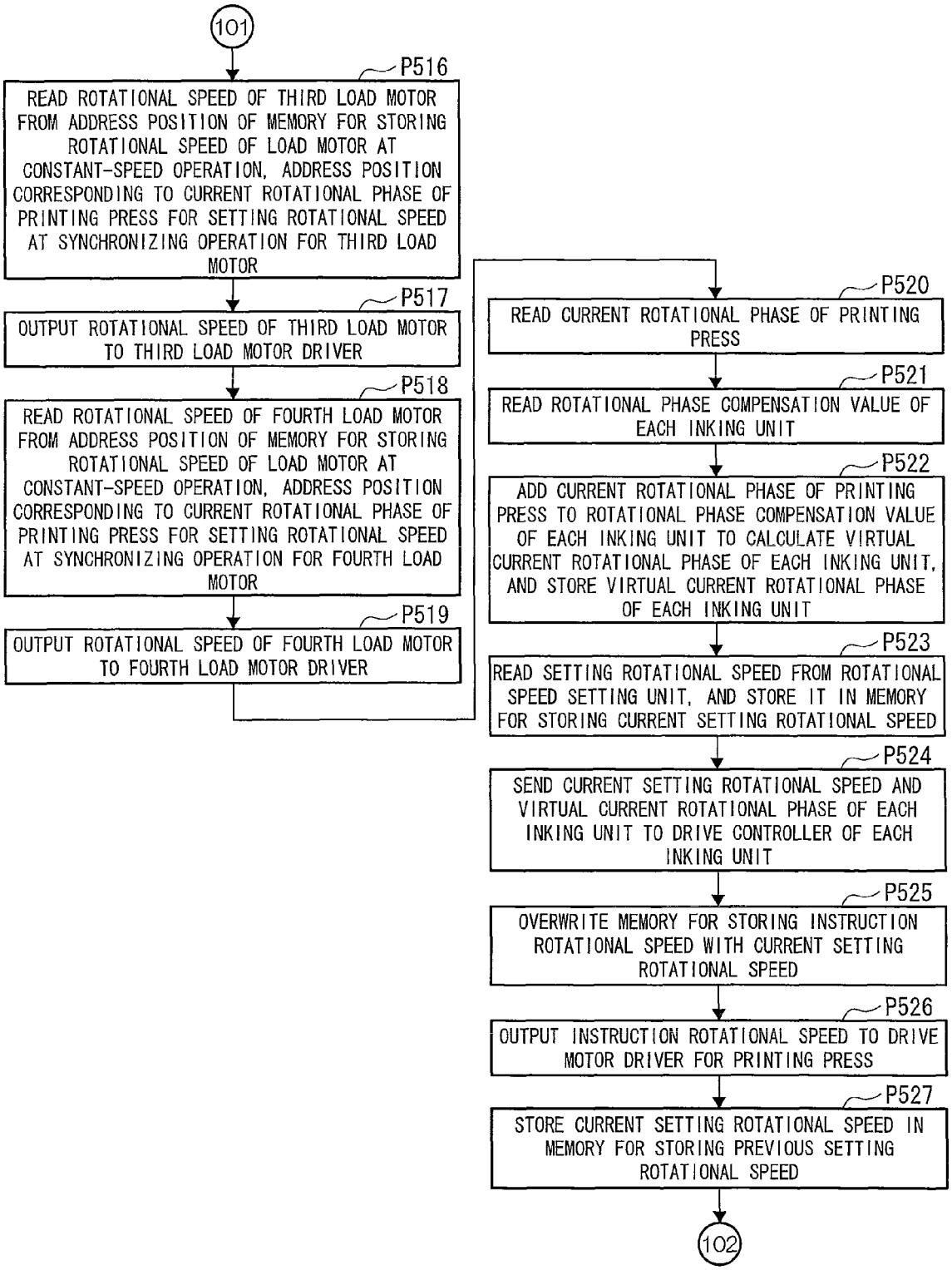
FIG. 42B is an operational flowchart of the drive controller of the printing press.
Figure 42C:
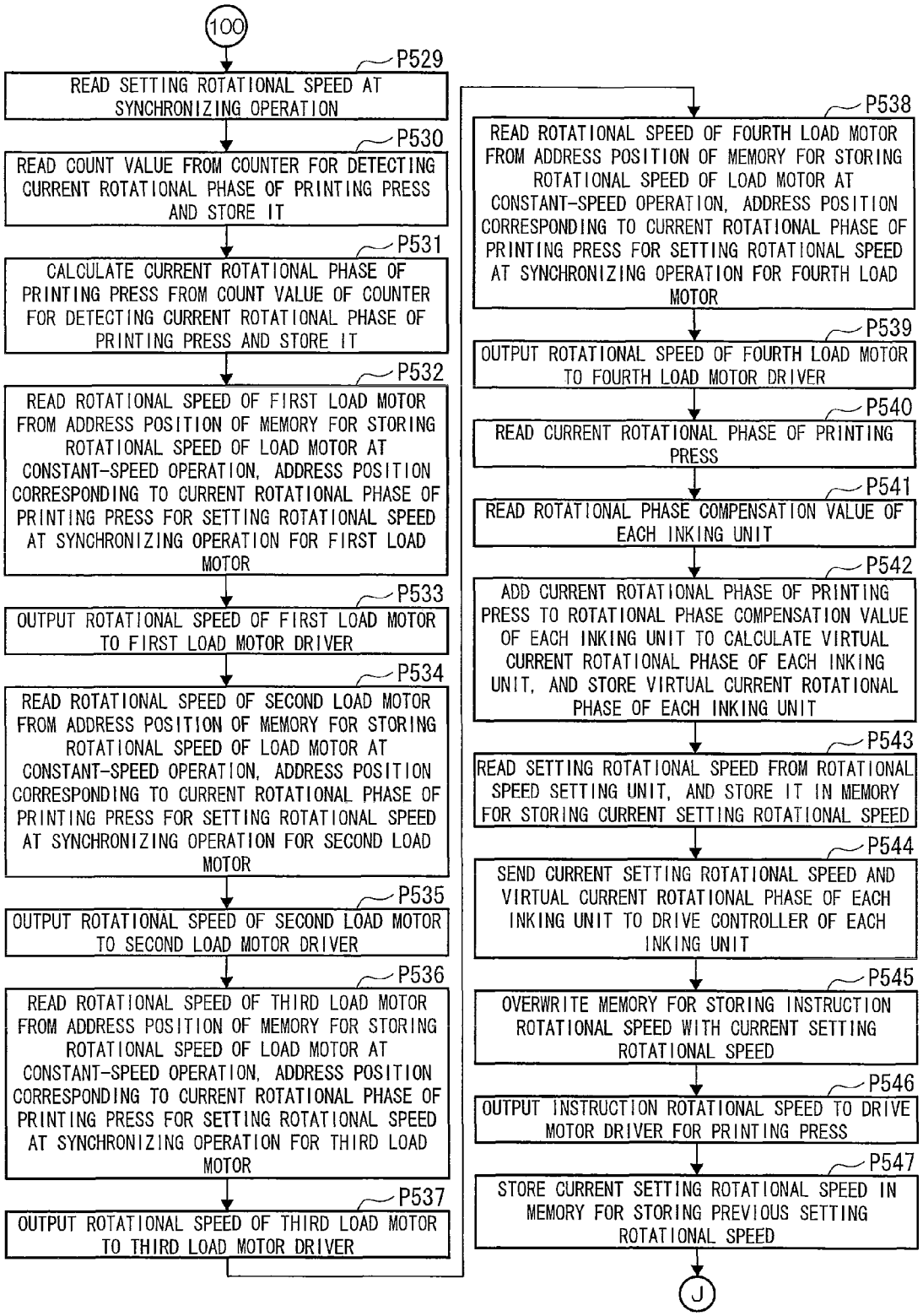
FIG. 42C is an operational flowchart of the drive controller of the printing press.
Figure 43A:
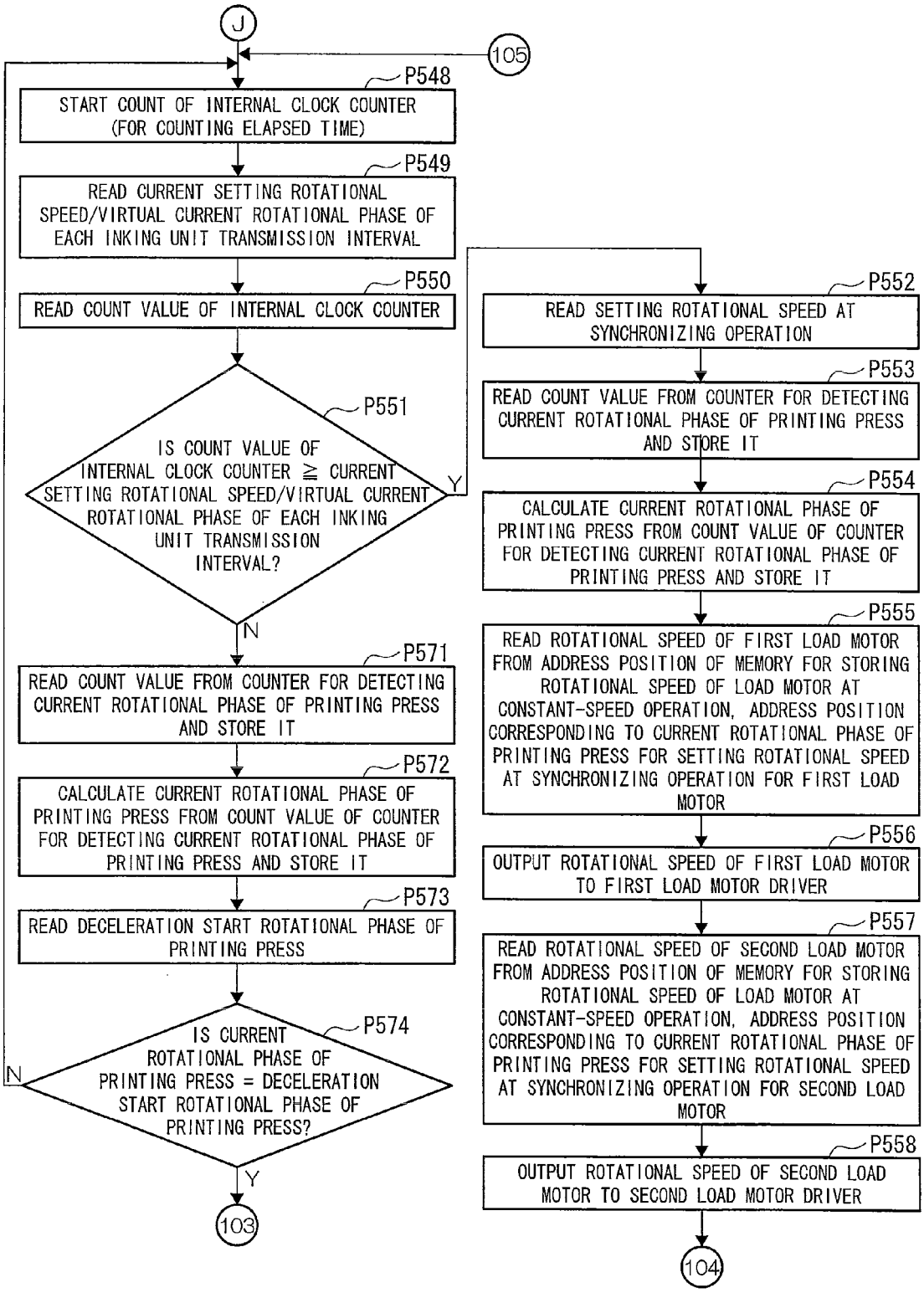
FIG. 43A is an operational flowchart of the drive controller of the printing press.
Figure 43B:
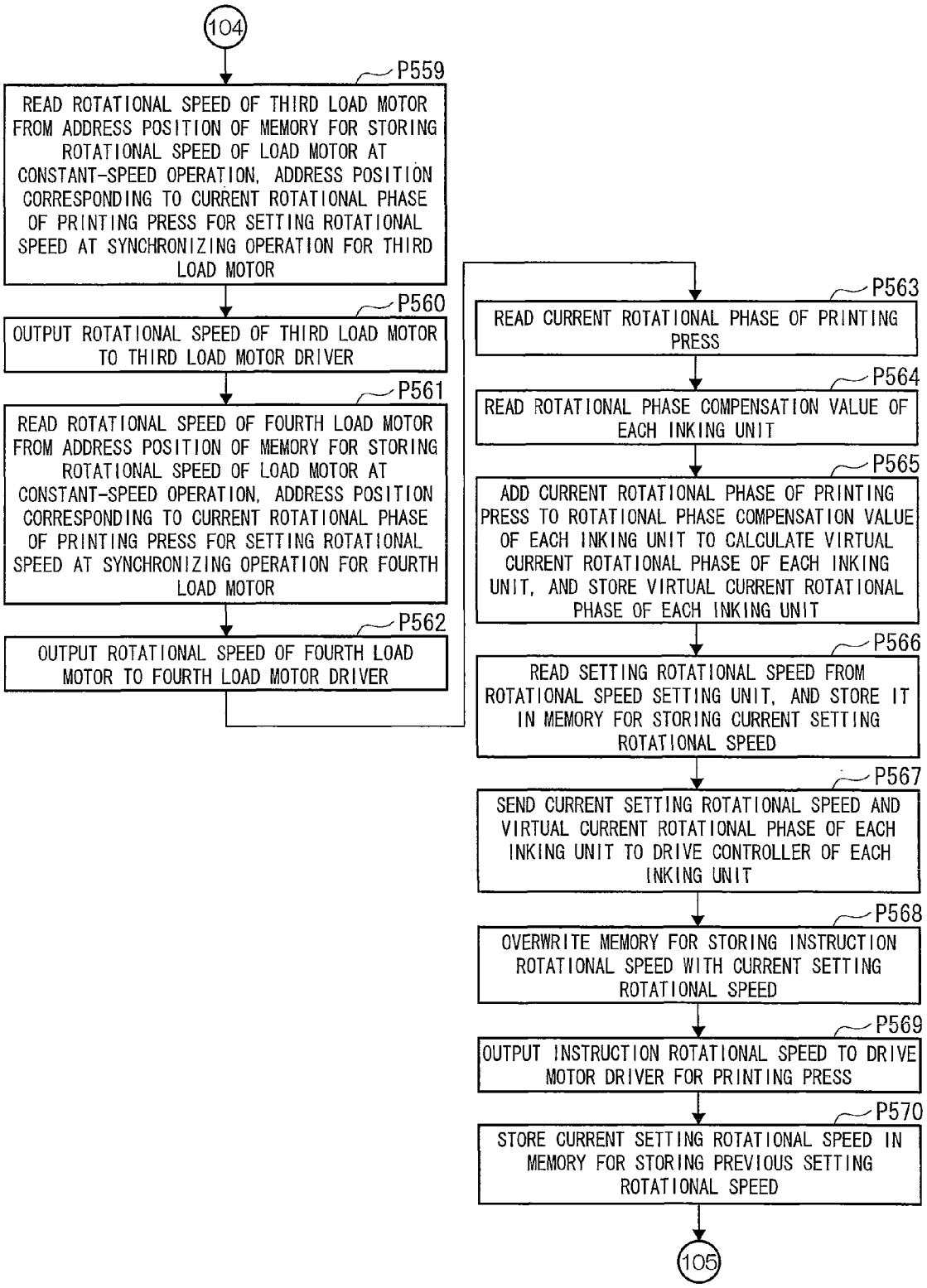
FIG. 43B is an operational flowchart of the drive controller of the printing press.
Figure 43C:
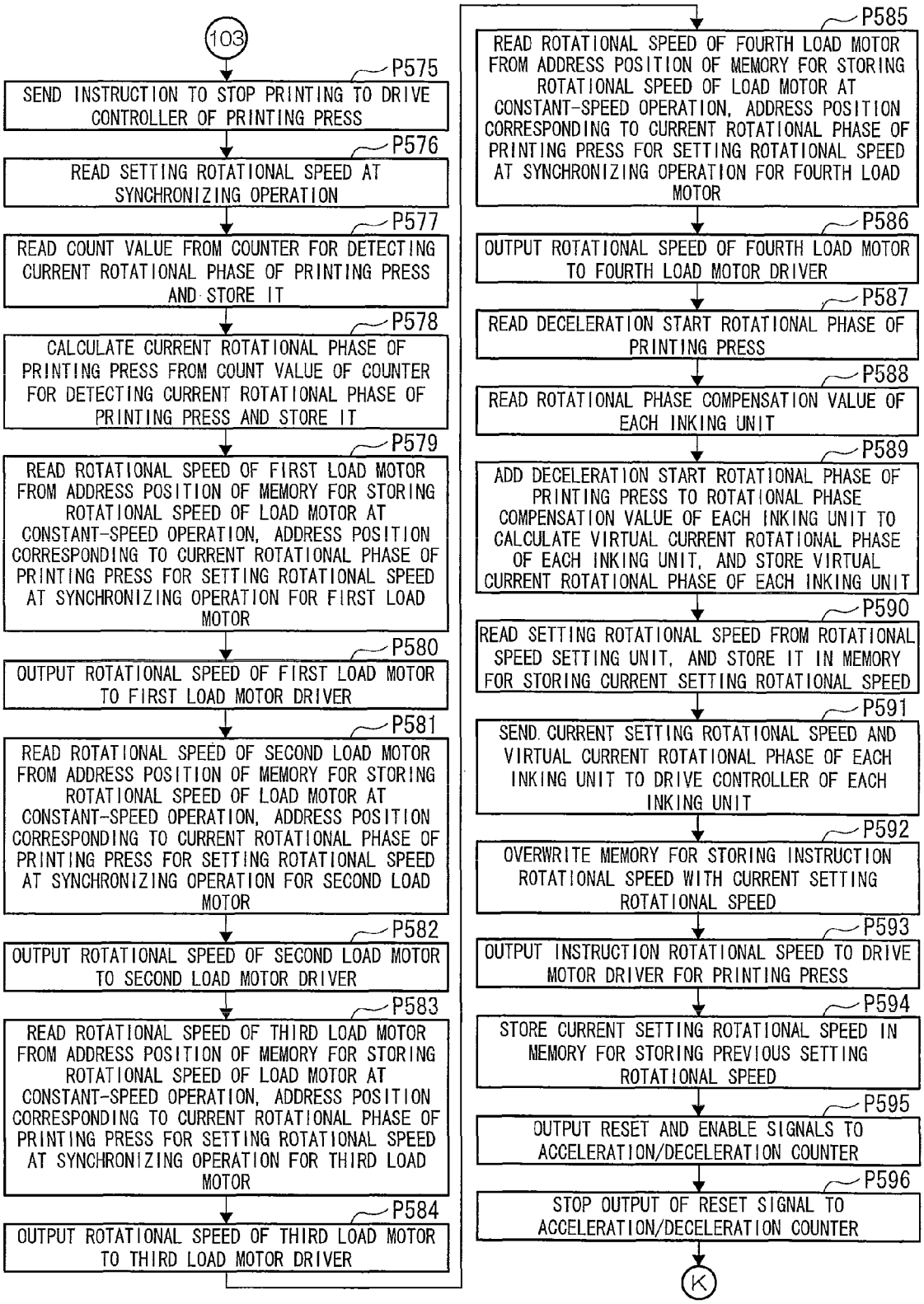
FIG. 43C is an operational flowchart of the drive controller of the printing press.
Figure 44A:
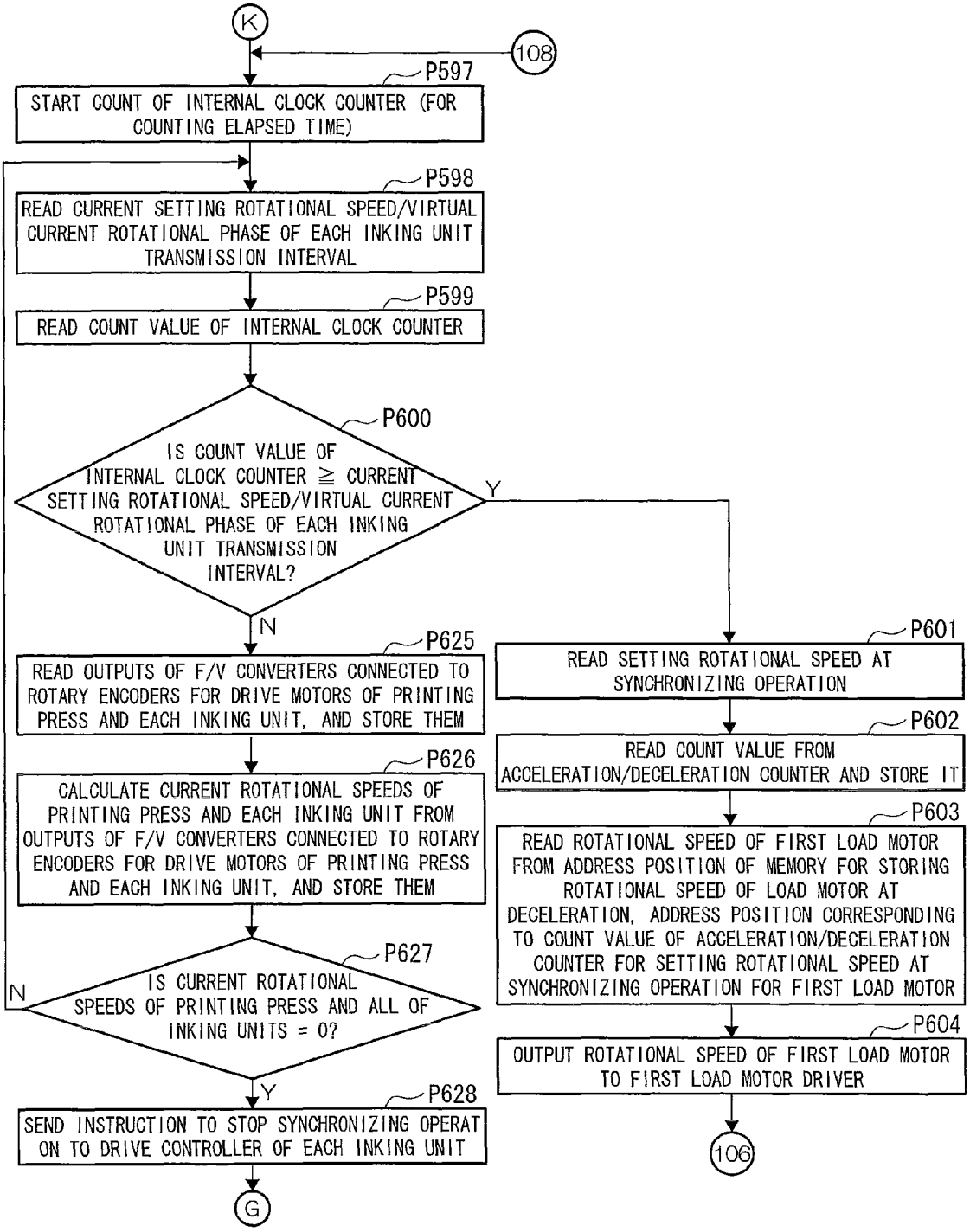
Figure 44B:
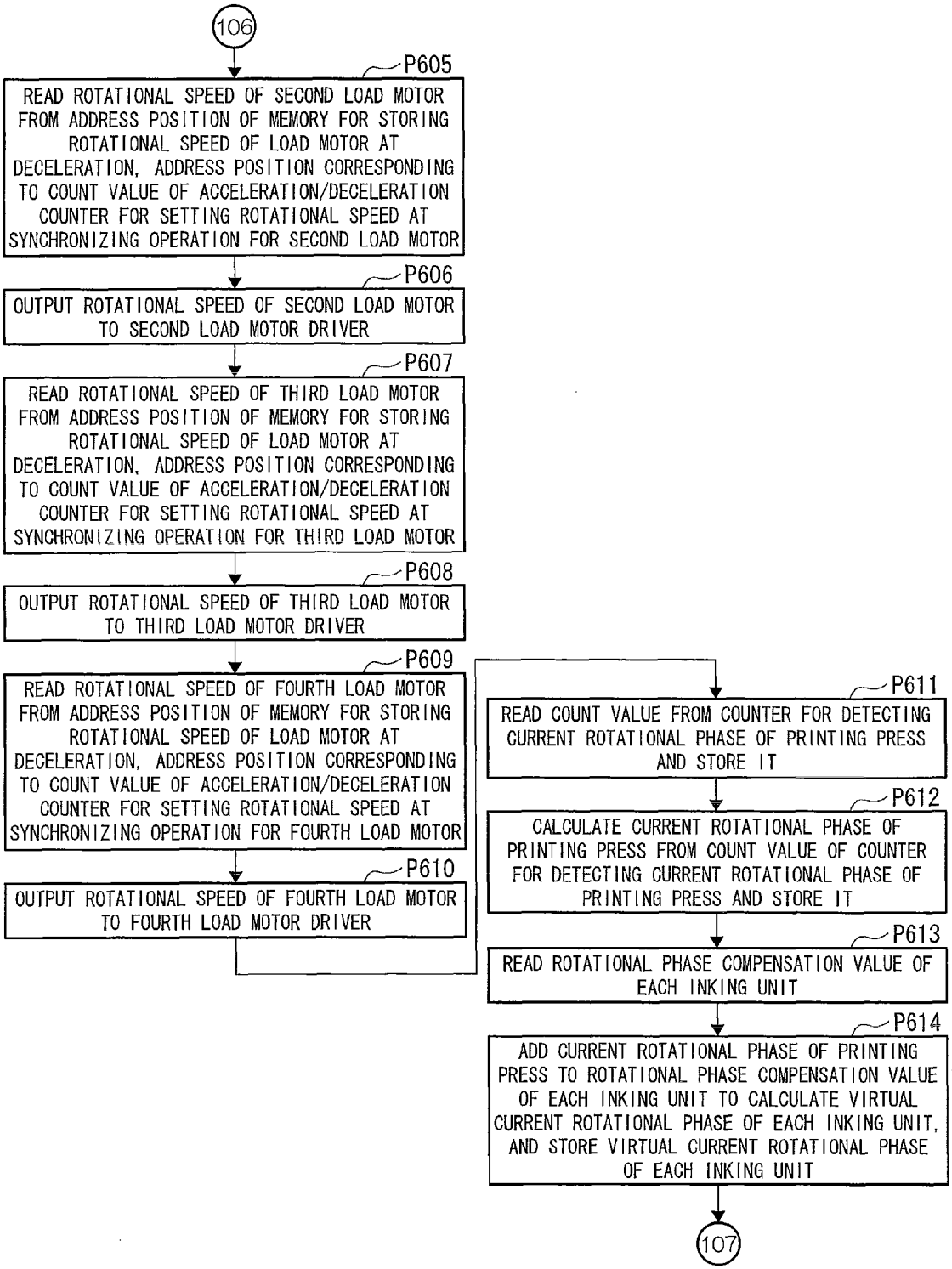
Figure 44C:
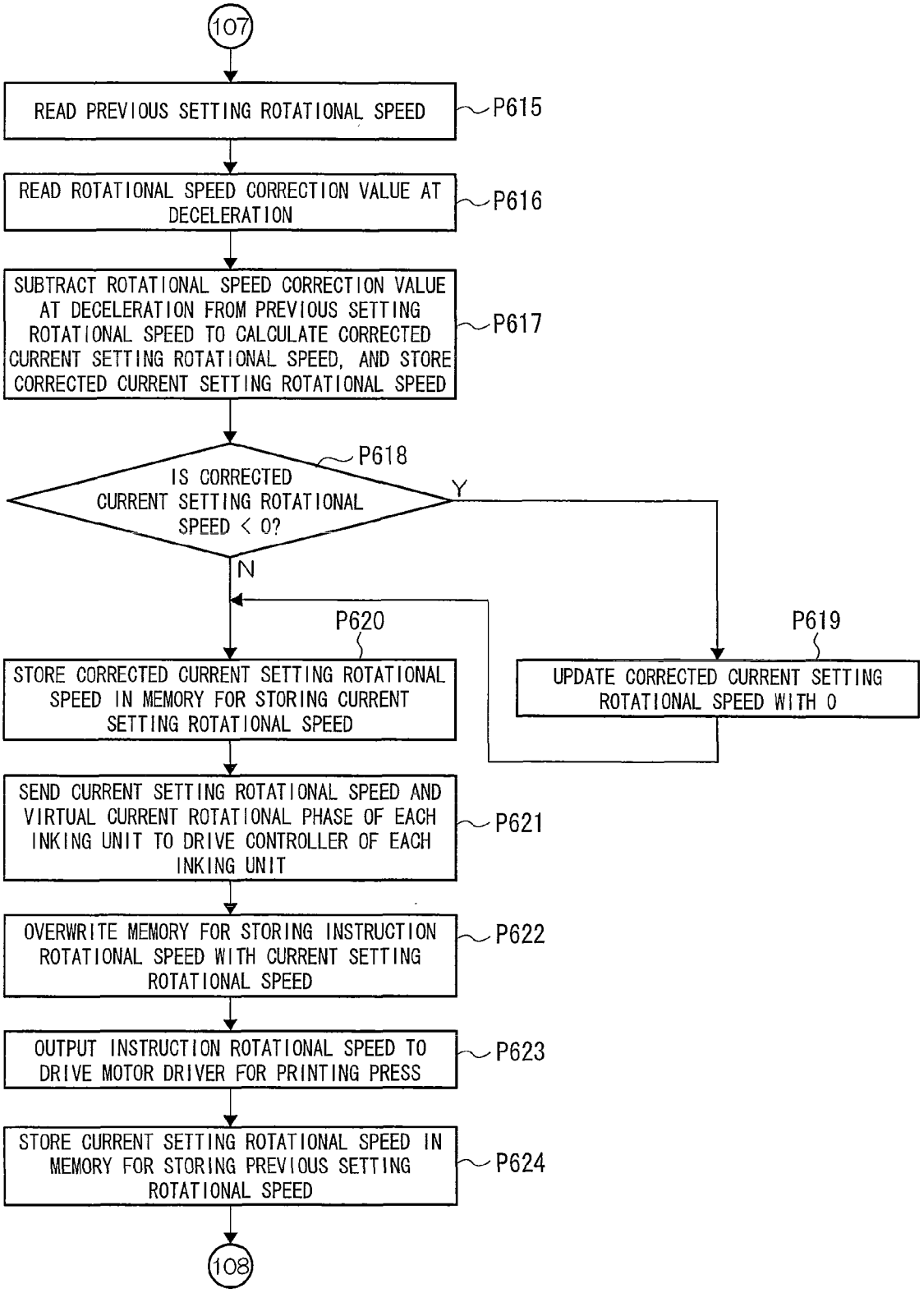
Figure 45:
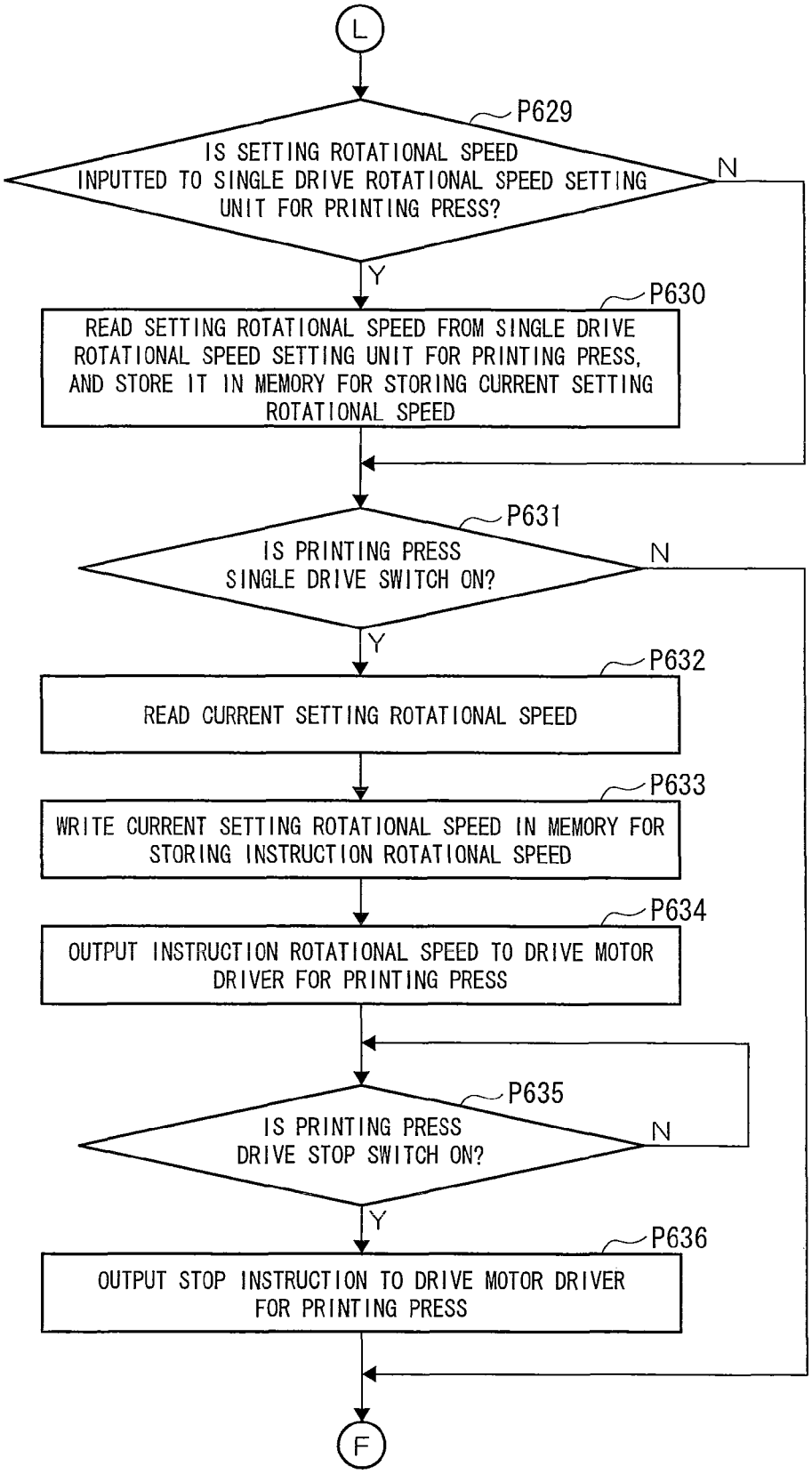

FIGS. 34A to 34E are operational flowcharts of the drive controller of the printing press. FIGS. 35A to 35F are operational flowcharts of the drive controller of the printing press. FIGS. 36A and 36B are operational flowcharts of the drive controller of the printing press. FIGS. 37A to 37F are operational flowcharts of the drive controller of the printing press. FIGS. 38A and 38B are operational flowcharts of the drive controller of the printing press. FIGS. 39A to 39F are operational flowcharts of the drive controller of the printing press. FIGS. 40A to 40D are operational flowcharts of the drive controller of the printing press. FIGS. 41A to 41C are operational flowcharts of the drive controller of the printing press. FIGS. 42A to 42C are operational flowcharts of the drive controller of the printing press. FIGS. 43A to 43C are operational flowcharts of the drive controller of the printing press. FIGS. 44A to 44C are operational flowcharts of the drive controller of the printing press. FIG. 45 is an operational flowchart of the drive controller of the printing press.

Figure 46A:
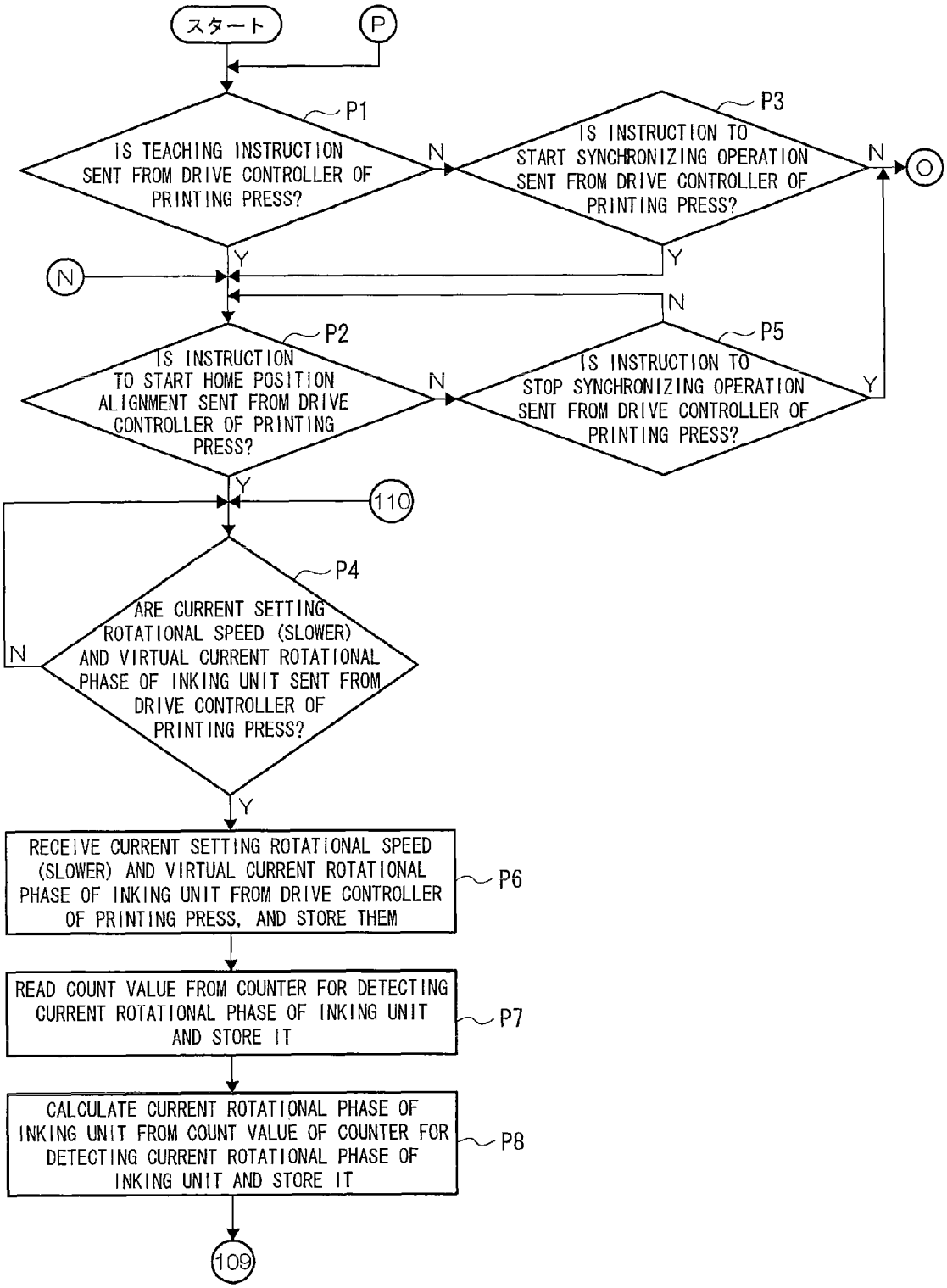
Figure 46B:
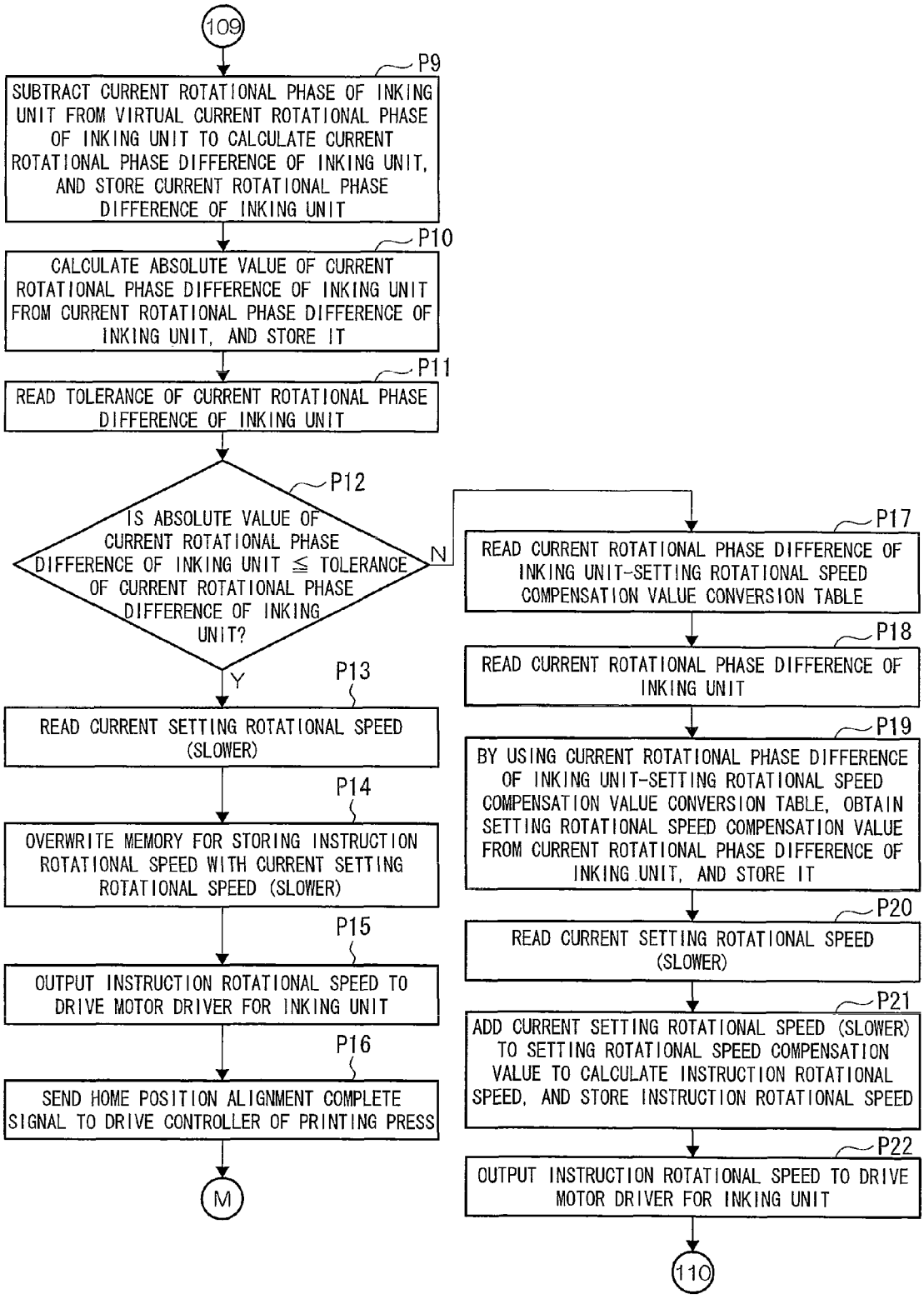
Figure 47A:
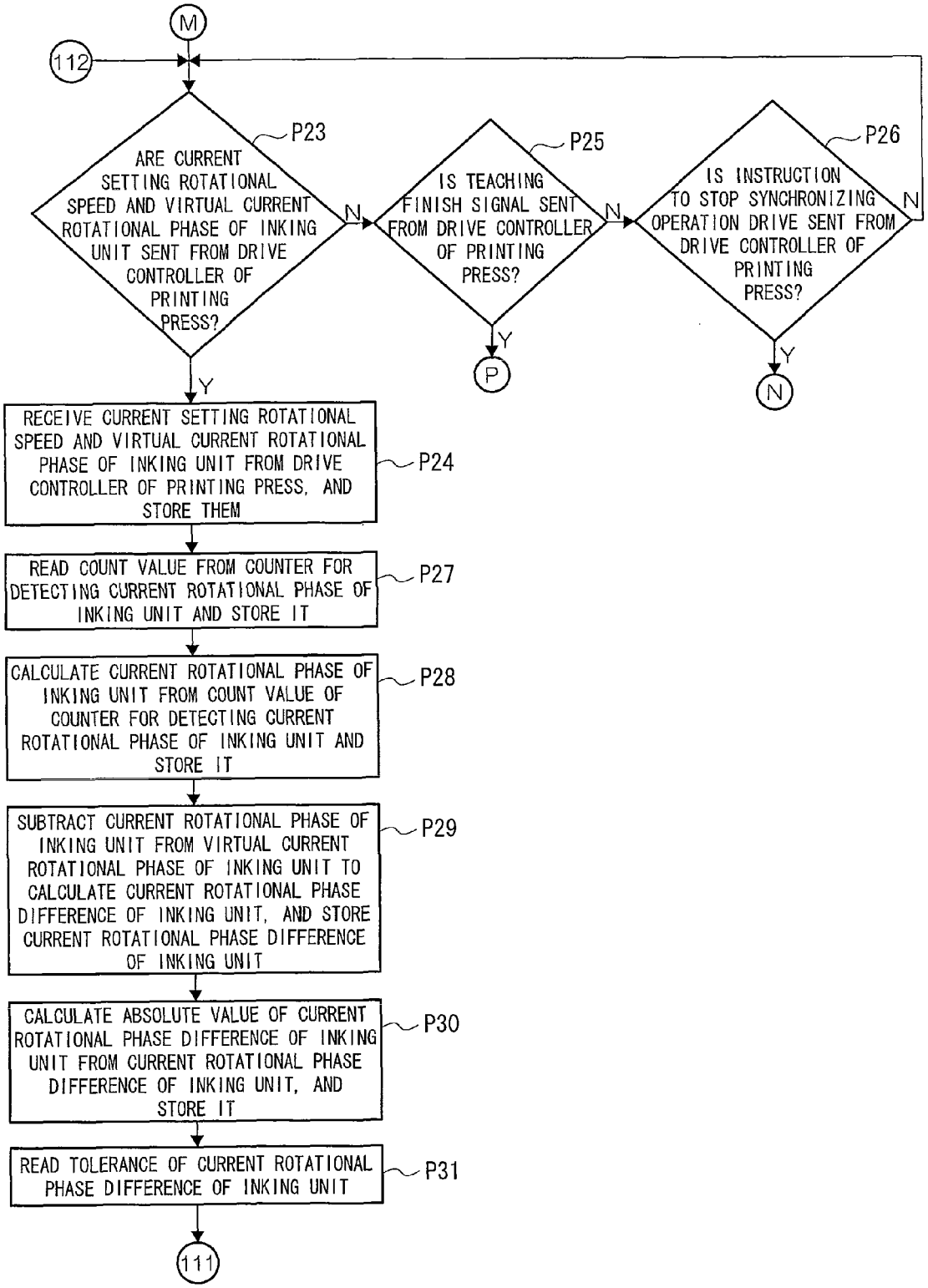
Figure 47B:
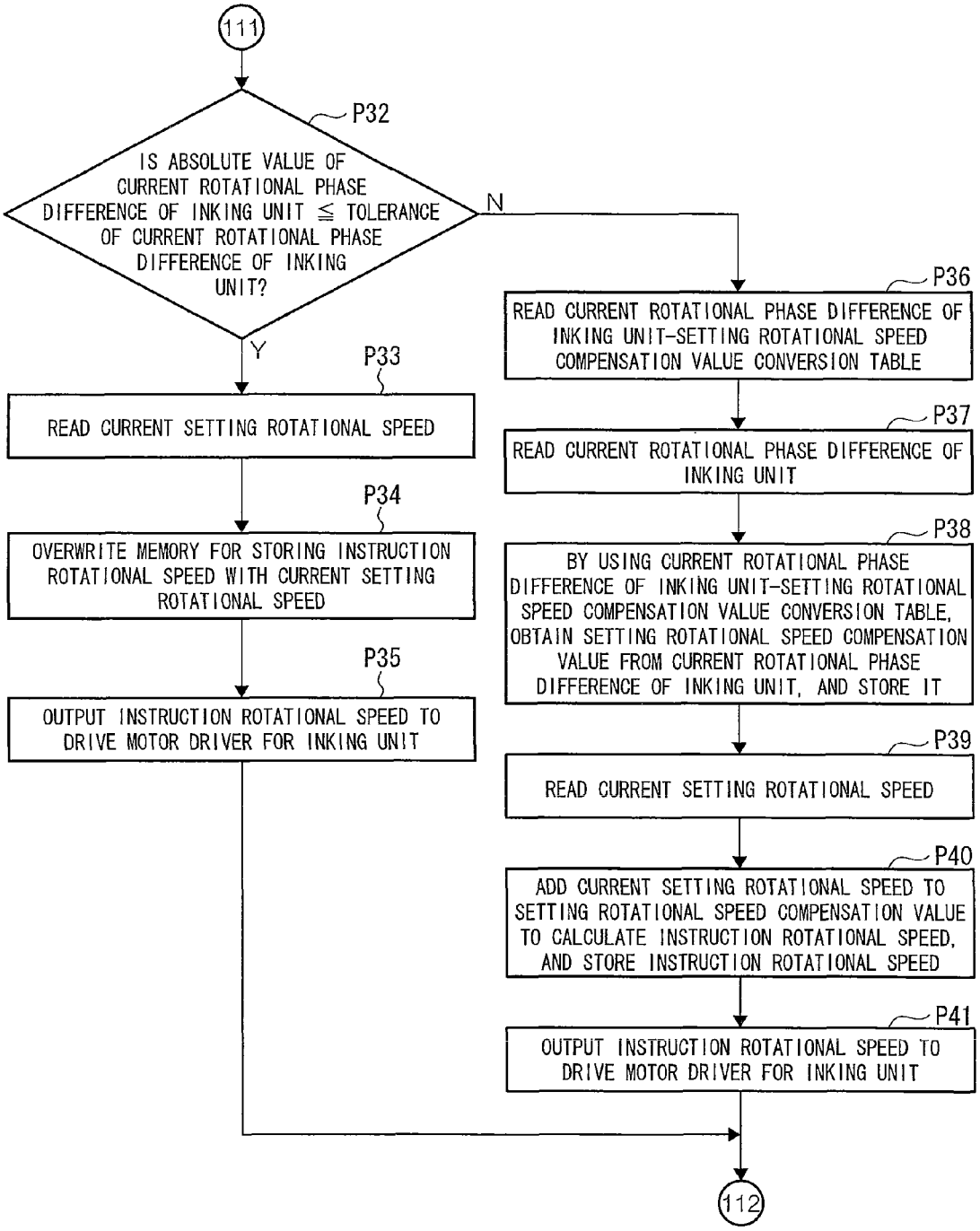
Figure 48:
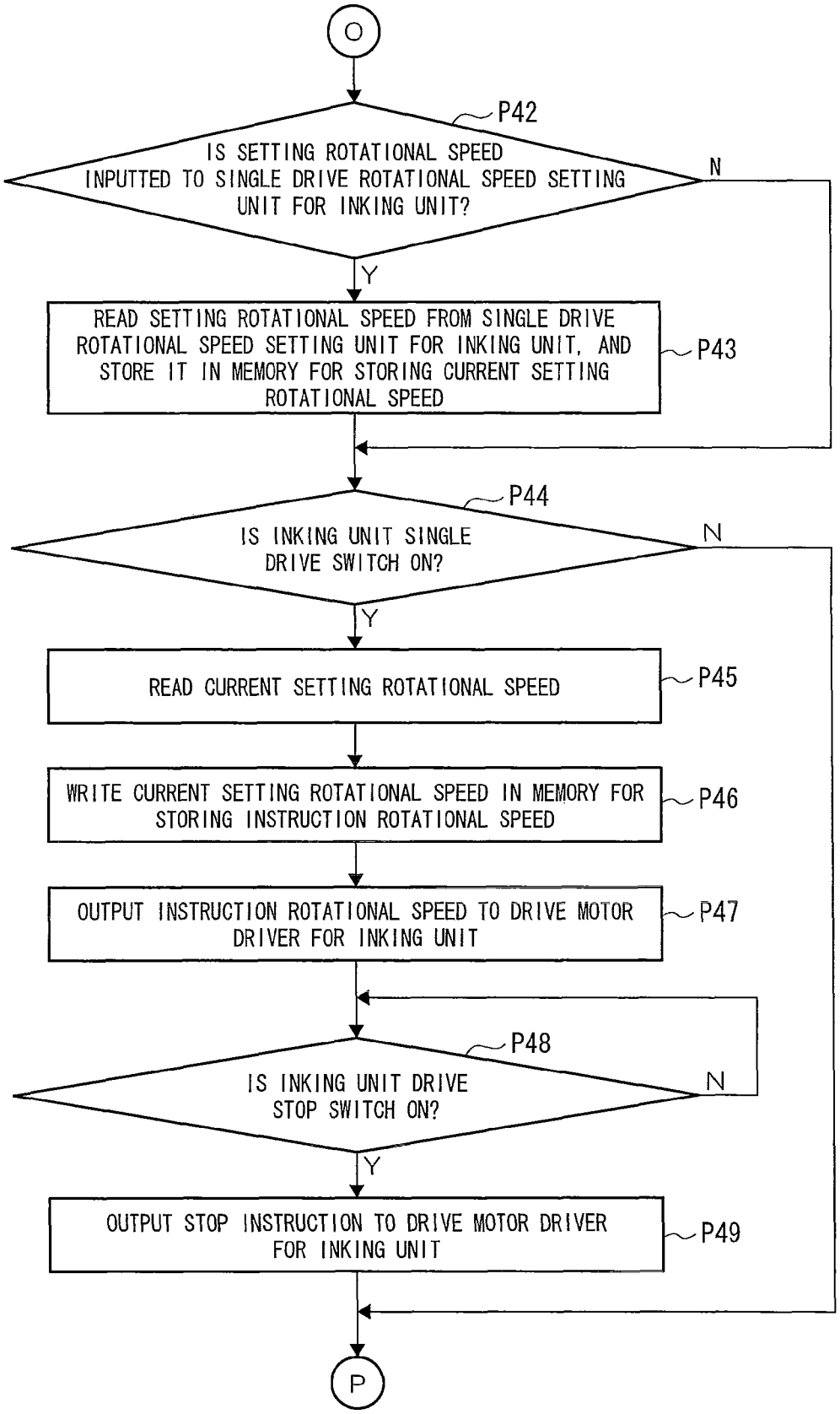

FIGS. 46A and 46B are operational flowcharts of the drive controller of each of the first to fourth inking units. FIGS. 47A and 47B are operational flowcharts of the drive controller of each of the first to fourth inking units. FIG. 48 is an operational flowchart of the drive controller of each of the first to fourth inking units.

In this embodiment, the main body of the printing press (the drive motor 10 thereof) and the first to fourth inking units (the drive motors 15*a* to 15*d* thereof, respectively) are configured to be synchronously controlled (operated), without using the virtual master generator 60 (and the central controller 30) in Embodiment 1, by directly connecting the drive controller 80' of the printing press and the drive controllers 90*a*' to 90*d*' of the first to fourth inking unit. The other constitution is the same as that of Embodiment 1. Thus, the description thereof with reference to FIGS. 49 and 50 is omitted.

As shown in FIGS. 32A to 32C, the drive controller 80*a*' of the printing press includes a CPU 100, a ROM 101, a RAM 102, input/output units 103*a* to 103*n*, an interface 104, and an internal clock counter 105, which are connected via a BUS (bus line).

The BUS is also connected to: a memory M100 for storing current setting rotational speed; a memory M101 for storing setting rotational speed at teaching; a memory M102 for storing slower rotational speed; a memory M103 for storing previous setting rotational speed; a memory M104 for storing a time interval at which the current setting rotational speed and the virtual current rotational phase of each inking unit are sent to a corresponding one of the drive controllers of the inking units (hereinafter, current setting rotational speed/virtual current rotational phase of each inking unit transmission interval); a memory M105 for storing a count value of a counter for detecting current rotational phase of the printing press; a memory M106 for storing current rotational phase of the printing press; a memory M107 for storing a rotational phase compensation value of each inking unit; and a memory M108 for storing virtual current rotational phase of each inking unit; and a memory M109 for storing instruction rotational speed.

The BUS is also connected to: a memory M110 for storing a number of the inking unit which has finished home position alignment; a memory M111 for storing acceleration start rotational phase of the printing press; a memory M112 for storing a rotational speed correction value at acceleration; a memory M113 for storing corrected current setting rotational speed; a memory M114 for storing rotational speed of a first load motor; a memory M115 for storing first plate-cylinder notch move-up start rotational phase; a memory M116 for storing first plate-cylinder notch move-up finish rotational phase; and a memory M117 for storing a load motor rotational speed compensation value related to move-up of the notch of the plate cylinder.

The BUS is also connected to; a memory M118 for storing rotational speed of a second load motor; a memory M119 for storing second plate-cylinder notch move-up start rotational phase; a memory M120 for storing second plate-cylinder notch move-up finish rotational phase; a memory M121 for storing rotational speed of a third load motor; a memory M122 for storing third plate-cylinder notch move-up start rotational phase; a memory M123 for storing third plate-cylinder notch move-up finish rotational phase; a memory M124 for storing rotational speed of a fourth load motor; a memory M125 for storing fourth plate-cylinder notch move-up finish rotational phase; and a memory M126 for storing fourth plate-cylinder notch move-up finish rotational phase.

The BUS is also connected to: a memory M127 for storing a count value of an acceleration/deceleration counter; a memory M128 for storing an electric current value of a drive motor driver of the printing press; a memory M129 for storing a standard electric current value; a memory M130 for storing an electric current value difference; a memory M131 for storing a electric current value difference-load motor rotational speed compensation value conversion table; a memory M132 for storing a load motor rotational speed compensation value; a memory M133 for storing compensated rotational speed of the first load motor; a memory M134 for storing compensated rotational speed of the second load motor; a memory M135 for storing compensated rotational speed of the third load motor; and a memory M136 for storing compensated rotational speed of the fourth load motor.

The BUS is also connected to: a memory M137 for storing rotational speed of the load motor at acceleration; a memory M138 for storing constant-speed operation load detection start rotational phase of the printing press; a memory M139 for storing rotational speed of the load motor at constant-speed operation; a memory M140 for storing constant-speed operation load detection finish rotational phase of the printing press; a memory M141 for storing deceleration start rotational phase of the printing press; a memory M142 for storing rotational speed correction value at deceleration; a memory M143 for storing rotational speed of the load motor at deceleration; a memory M144 for storing outputs of the F/V converters connected to the rotary encoders for the drive motor of the printing press and the drive motors of the inking units, respectively; a memory M145 for storing current rotational speeds of the printing press and the inking units, respectively; and a memory M146 for storing setting rotational speed at synchronizing operation.

The input/output unit 103*a* is connected to a teaching switch 106, a synchronizing operation switch 107, a printing press drive switch 108, a printing press drive stop switch 109, a printing press single drive switch 110, an input unit 111 such as a keyboard and various types of switches and buttons, a display unit 112 such as a CRT and a lamp, and an output unit 113 such as a printer and a floppy disk (registered trademark) drive.

The input/output unit 103*b* is connected to a rotational speed setting unit 114.

The input/output unit 103*c* is connected to the drive motor 10 of the printing press through a D/A converter 115 and a drive motor driver 116 of the printing press. In addition, the aforementioned drive motor driver 116 of the printing press is connected to the input/output unit 103*d* and a rotary encoder 118 for the drive motor of the printing press, which is coupled to and driven by the drive motor 10 of the printing press. The drive motor driver 116 of the printing press is also connected to the later-described first to fourth load motors 17*a* to 17*d*.

The input/output unit 103*e* is connected to a rotary encoder 18 for detecting rotational phase of the printing press through a counter 117 for detecting the current rotational phase of the printing press. The input/output unit 103*f* is connected to the rotary encoder 18 for detecting rotational phase of the printing press through an acceleration/deceleration counter 119. The input/output unit 103*g* is directly connected to the rotary encoder 18 for detecting rotational phase of the printing press and is also connected to the rotary encoder 18 for detecting rotational phase of the printing press through the A/D converter 120 and F/V converter 121.

The input/output unit 103*h* is connected to the load motor standard rotational speed setting unit 122.

The input/output unit 103*i* is connected to the first load motor 17*a* through a D/A converter 123*a* and a first load motor driver 124*a*. The first load motor driver 124*a* is connected to the first load motor rotary encoder 125*a* coupled to and driven by the first load motor 17*a*.

The input/output unit 103*j* is connected to the second load motor 17*b* through a D/A converter 123*b* and a second load motor driver 124*b*. The second load motor driver 124*b* is connected to the second load motor rotary encoder 125*b* coupled to and driven by the second load motor 17*b*.

The input/output unit 103*k* is connected to the third load motor 17*c* through a D/A converter 123*c* and a third load motor driver 124*c*. The third load motor driver 124*c* is connected to the third load motor rotary encoder 125*c* coupled to and driven by the third load motor 17*c*.

The input/output unit 103*l* is connected to the fourth load motor 17*d* through a D/A converter 123*d* and a fourth load motor driver 124*d*. The fourth load motor driver 124*d* is connected to the fourth load motor rotary encoder 125*d* coupled to and driven by the fourth load motor 17*d*.

The input/output unit 103*m* is connected to rotary encoders 128*a* to 128*d* for the drive motors of the first to fourth of the inking units through A/D converters 126*a* to 126*d* and F/V converters 127*a* to 127*d*, respectively.

The input/output unit 103*n* is connected to a single drive rotational speed setting unit 129 for the printing press.

The interface 104 is connected to a printing press controller 28' and the drive controllers 90*a*' to 90*d*' of the first to fourth inking units.

As shown in FIG. 33, each of the drive controllers 90*a*' to 90*d*' of the first to fourth inking units includes a CPU 100*a*, a ROM 101*a*, a RAM 102*a*, input/output units 103*o* to 103*r*, and an interface 104*a*, which are connected via a BUS (bus line). Note that, the block diagram shown in FIG. 33 illustrates a configuration common to the drive controllers 90*a* to 90*d* of the first to fourth inking units.

The BUS is also connected to: a memory M147 for storing current setting rotational speed; a memory M148 for storing virtual current setting rotational phase of the inking unit; a memory M149 for storing a count value of a counter for detecting current rotational phase of the inking unit; a memory M150 for storing current rotational phase of the inking unit; a memory M151 for storing a current rotational phase difference of the inking unit; a memory M152 for storing an absolute value of the current rotational phase difference of the inking unit; a memory M153 for storing a tolerance of the current rotational phase difference of the inking unit; a memory M154 for storing instruction rotational speed; a memory M155 for storing a current rotational phase difference of the inking unit-setting rotational speed compensation value conversion table; and a memory M156 for storing a setting rotational speed compensation value.

The input/output unit 103*o* is connected to: an inking unit single drive switch 130; an inking unit drive stop switch 131; an input unit 132 such as a keyboard and various types of switches and buttons, a display unit 133 such as a CRT or a lamp, and an output unit 134 such as a printer and a floppy disk (registered trademark) drive.

The input/output unit 103*p* is connected to the drive motor 15 of the inking unit through a D/A converter 135 and a drive motor driver 136 of the inking unit. The drive motor driver 136 of the inking unit is connected to a rotary encoder 128 for a drive motor of the inking unit, which is coupled to and driven by the drive motor 15 of the inking unit.

The input/output unit 103*q* is connected to the rotary encoder 128 for the drive motor of the inking unit through a counter 137 for detecting current rotational phase of the inking unit.

The input/output unit 103*r* is connected to a single drive rotational speed setting unit 138 for the inking unit.

The interface 104*a* is connected to the drive controller 80' of the printing press.

The drive controller 80' of the printing press is configured as described above, and operates according to the operational flows shown in FIGS. 34A to 34E, 35A to 35F, 36A and 36B, 37A to 37F, 38A and 38B, 39A to 39F, 40A to 40D, 41A to 41C, 42A to 42C, 43A to 43C, 44A and 44*c*, and 45.

Specifically, in step P1, it is judged whether the teaching switch 106 is turned on. If yes in step P1, the process proceeds to step P2. If the printing press drive switch 108 is turned on in step P2, in step P3, a teaching instruction is sent to the drive controllers 90*a*' to 90*d*' of the inking units. If no in step P1, in step P4, it is judged whether the synchronizing operation switch 107 is turned on.

If yes in step P4, in step P5, an instruction to start synchronizing operation is sent to the drive controllers 90*a*' to 90*d*' of the inking units, and then the process proceeds to later-described step P394. If no in step P4, in step P6, it is judged whether setting rotational speed is inputted to the rotational speed setting unit 114.

If yes in step P6, in step P7, the setting rotational speed is read from the rotational speed setting unit 114, and is stored in the memory M100 for storing the current setting rotational speed. Then, the process proceeds to later-described step P629. If no in step P6, the process directly proceeds to later-described step P629.

In step P8, an instruction to start home position alignment is sent to the drive controllers 90*a*' to 90*d*' of the inking units. In step P9, the setting rotational speed is read from the rotational speed setting unit 114, and is stored in the memory M101 for storing the setting rotational speed at teaching.

Next, slower rotational speed is read from the memory M102 in step P10, and is written in the memory M100 for storing the current setting rotational speed and the memory M103 for storing the previous setting rotational speed in step P11.

In step P12, the internal clock counter 105 (for counting elapsed time) starts to count. In step P13, the current setting rotational speed/virtual current rotational phase of each inking unit transmission interval is read from the memory M104.

Next, in step P14, the count value of the internal clock counter 105 is read, and in step P15, it is judged whether the count value of the internal clock counter is equal to or more than the current setting rotational speed/virtual current rotational phase of each inking unit transmission interval.

If yes in step P15, in step P16, the count value is read from the counter 117 for detecting the current rotational phase of the printing press, and is stored in the memory M105. In step P17, from the count value of the counter 117 for detecting the current rotational phase of the printing press, the current rotational phase of the printing press is calculated and stored in the memory M106.

Next, in step P18, the rotational phase compensation value of each inking unit is read from the memory M107. In step P19, the current rotational phase of the printing press is added to the rotational phase compensation value of each inking unit to calculate the virtual current rotational phase of each inking unit, which is then stored in the memory M108.

Next, in step P20, the current setting rotational speed (slower) is read from the memory M100, and in step P21, the current setting rotational speed (slower) and the virtual current rotational phase of each inking unit are sent to a corresponding one of the drive controllers 90*a*' to 90*d*' of the inking units.

Next, in step P22, the memory M109 for storing the instruction rotational speed is overwritten with the current setting rotational speed (slower). Thereafter, in step P23, the instruction rotational speed is outputted to the drive motor driver 116. Subsequently, in step P24, the current setting rotational speed (slower) is stored in the memory M103 for storing the previous setting rotational speed, and the process returns to step P12.

On the other hand, if no in step P15, in step P25, it is judged whether a home position alignment completion signal is sent from any of the drive controllers 90*a*' to 90*d*' of the inking units. If yes in step P25, in step P26, the number of the inking unit which has sent the home position alignment completion signal is received, and is stored in the memory M110 for storing the number of the inking unit which has finished home position alignment, and if no, the process returns to step P13.

Next, in step P27, the content of the memory M110 for storing the number of the inking unit which has finished home position alignment is read, and in step P28, it is judged whether home position alignment is finished for all of the inking units.

If yes in step P28, in step P29, the current setting rotational speed/virtual current rotational phase of each inking unit transmission interval is read from the memory M104. If no in step P28, the process returns to step P13.

Next, in step P30, the count value of the internal clock counter 105 is read, and in step P31, it is judged whether the count value of the internal clock counter is equal to or more than the current setting rotational speed/virtual current rotational phase of each inking unit transmission interval.

If yes in step P31, in step P32, the count value is read from the counter 117 for detecting the current rotational phase of the printing press, and is stored in the memory M105. If no in step P31, the process returns to step P29.

Next, in step P33, from the count value of the counter 117 for detecting the current rotational phase of the printing press, the current rotational phase of the printing press is calculated and stored in the memory M106. In step P34, the rotational phase compensation value of each inking unit is read from the memory M107.

Next, in step P35, the current rotational phase of the printing press is added to the rotational phase compensation value of each inking unit to calculate the virtual current rotational phase of each inking unit, which is then stored in the memory M108. In step P36, the current setting rotational speed (slower) is read from the memory M100.

Next, in step P37, the current setting rotational speed (slower) and the virtual current rotational phase of each inking unit are sent to a corresponding one of the drive controllers 90*a*' to 90*d*' of the inking units. In step P38, the memory M109 for storing the instruction rotational speed is overwritten with the current setting rotational speed (slower).

Next, in step P39, the instruction rotational speed is outputted to the drive motor driver 116. In step P40, the current setting rotational speed (slower) is stored in the memory M103 for storing the previous setting rotational speed.

Next, in step P41, the internal clock counter 105 (for counting elapsed time) starts to count. In step P42, the current setting rotational speed/virtual current rotational phase of each inking unit transmission interval is read from the memory M104.

Next, in step P43, the count value of the internal clock counter 105 is read. In step P44, it is judged whether the count value of the internal clock counter is equal to or more than the current setting rotational speed/virtual current rotational phase of each inking unit transmission interval.

If yes in step P44, in step P45, the count value is read from the counter 117 for detecting the current rotational phase of the printing press, and is stored in the memory M105. In step P46, from the count value of the counter 117 for detecting the current rotational phase of the printing press, the current rotational phase of the printing press is calculated and stored in the memory M106.

Next, in step P47, the rotational phase compensation value of each inking unit is read from the memory M107. In step P48, the current rotational phase of the printing press is added to the rotational phase compensation value of each inking unit to calculate the virtual current rotational phase of each inking unit, which is then stored in the memory M108.

Next, in step P49, the current setting rotational speed (slower) is read from the memory M100. In step P50, the current setting rotational speed (slower) and the virtual current rotational phase of each inking unit are sent to a corresponding one of the drive controllers 90*a*' to 90*d*' of the inking units.

Next, in step P51, the memory M109 for storing the instruction rotational speed is overwritten with the current setting rotational speed (slower), and in step P52, the instruction rotational speed is outputted to the drive motor driver 116. Subsequently, in step P53, the current setting rotational speed (slower) is stored in the memory M103 for storing the previous setting rotational speed, and the process returns to step P41.

On the other hand, if no in step P44, in step P54, the count value is read from the counter 117 for detecting the current rotational phase of the printing press, and is stored in the memory M105. In step P55, from the count value of the counter 117 for detecting the current rotational phase or the printing press, the current rotational phase of the printing press is calculated and stored in the memory M106.

Next, in step P56, the acceleration start rotational phase of the printing press is read from the memory M111. In step P57, it is then judged whether the current rotational phase of the printing press is equal to the acceleration start rotational phase of the printing press. If yes in step P57, in step P58, an instruction to start printing is sent to the printing press controller 28', and if no, the process returns to step P42.

Next, in step P59, the acceleration start rotational phase of the printing press is read from the memory M111, and in step P60, the rotational phase compensation value of each inking unit is read from the memory M107. Subsequently, in step P61, the acceleration start rotational phase of the printing press is added to the rotational phase compensation value of each inking unit to calculate the virtual current rotational phase of each inking unit, which is then stored in the memory M108.

Next, in step P62, the current setting rotational speed (slower) is read from the memory M100, and in step P63, the current setting rotational speed (slower) and the virtual current rotational phase of each inking unit are sent to a corresponding one of the drive controllers 90*a*' to 90*d*' of the inking units.

Next, in step P64, the memory M109 for storing the instruction rotational speed is overwritten with the current setting rotational speed (slower), and in step P65, the instruction rotational speed is outputted to the drive motor driver 116. Subsequently, in step P66, the current setting rotational speed (slower) is stored in the memory M103 for storing the previous setting rotational speed.

Next, in step P67, reset and enable signals are outputted to the acceleration/deceleration counter 119, and in step P68, the output of the reset signal to the acceleration/deceleration counter 119 is stopped.

Next, in step P69, the internal clock counter (for counting elapsed time) 105 starts to count. In step P70, the current setting rotational speed/virtual current rotational phase of each inking unit transmission interval is read from the memory M104.

In step P71, the count value of the internal clock counter 105 is read. In step P72, it is judged whether the count value of the internal clock counter is equal to or more than the current setting rotational speed/virtual current rotational phase of each inking unit transmission interval.

If yes in step P72, in step P73, the count value is read from the counter 117 for detecting the current rotational phase of the printing press, and is stored in the memory M105. In step P74, from the count value of the counter 117 for detecting the current rotational phase of the printing press, the current rotational phase of the printing press is calculated and stored in the memory M106.

Next, in step P75, the rotational phase compensation value of each inking unit is read from the memory M107. In step P76, the current rotational phase of the printing press is added to the rotational phase compensation value of each inking unit to calculate the virtual current rotational phase of each inking unit, which is stored in the memory M108.

Next, in step P77, the previous setting rotational speed is read from the memory M103, and in step P78, the rotational speed correction value at acceleration is read from the memory M112. Subsequently, in step P79, the previous setting rotational speed is added to the rotational speed correction value at acceleration to calculate the corrected current setting rotational speed, which is then stored in the memory M113.

Next, in step P80, the setting rotational speed is read from the rotational speed setting unit 114, and is stored in the memory M100 for storing the current setting rotational speed. In step P81, it is judged whether the corrected current setting rotational speed is less than the current setting rotational speed.

If yes in step P81, in step P82, the corrected current setting rotational speed is stored in the memory M100 for storing the current setting rotational speed. In step P83, the current setting rotational speed and the virtual current rotational phase of each inking unit are sent to a corresponding one of the drive controllers 90*a*' to 90*d*' of the inking units.

Next, in step P84, the memory M109 for storing the instruction rotational speed is overwritten with the current setting rotational speed, and in step P85, the instruction rotational speed is outputted to the drive motor driver 116. Subsequently, in step P86, the current setting rotational speed is stored in the memory M103 for storing the previous setting rotational speed, and the process returns to step P67.

On the other hand, if no in step P81, in step P87, the current setting rotational speed and the virtual current rotational phase of each inking unit are sent to a corresponding one of the drive controllers 90*a*' to 90*d*' of the inking units. In step P88, the memory M109 for storing the instruction rotational speed is overwritten with the current setting rotational speed.

Next, in step P89, the instruction rotational speed is outputted to the drive motor driver 117, and in step P90, the current setting rotational speed is stored in the memory M103 for storing the previous setting rotational speed. The process then proceeds to later-described step P159.

If no in step P72, in step P91, it is judged whether a clock pulse is outputted from the rotary encoder 18 for detecting rotational phase of the printing press. If yes in step P91, in step P92, the standard rotational speed of the load motor is read from the load motor standard rotational speed (torque value) setting unit 122, and is then stored in the memory M114 for storing the rotational speed of the first load motor. If no in step P91, the process returns to step P70.

Next, in step P93, the count value is read from the counter 117 for detecting the current rotational phase of the printing press, and is stored in the memory M105. In step P94, from the count value of the counter 117 for detecting the current rotational phase of the printing press, the current rotational phase of the printing press is calculated and stored in the memory M106.

Next, in step P95, the first plate-cylinder notch move-up start rotational phase is read from the memory M115, and in step P96, the first plate-cylinder notch move-up finish rotational phase is read from the memory M116. Subsequently, in step P97, it is judged whether the current rotational phase of the printing press is equal to or more than the first plate-cylinder notch move-up start rotational phase, and is equal to or less than the first plate-cylinder notch move-up finish rotational phase.

If yes in step P97, in step P98, the rotational speed of the first load motor 17*a* is read from the memory M114, and if no, the process proceeds to later-described step P101. Next, the load motor rotational speed compensation value related to move-up of the notch of the plate cylinder is read from the memory M117 in step P99. In step P100, the load motor rotational speed compensation value related to move-up of the notch of the plate cylinder is subtracted from the rotational speed of the first load motor 17*a*, and the memory M114 for storing the first load motor rotational speed is overwritten with the result.

Next, in step P101, the standard rotational speed of the load motor is read from the load motor standard rotational speed (torque value) setting unit 122, and is then stored in the memory M118 for storing the rotational speed of the second load motor. In step P102, the current rotational phase of the printing press is read from the memory M106.

Next, in step P103, the second plate-cylinder notch move-up start rotational phase is read from the memory M119, and in step P104, the second plate-cylinder notch move-up finish rotational phase is read from the memory M120. Subsequently, in step P105, it is judged whether the current rotational phase of the printing press is equal to or more than the second plate-cylinder notch move-up start rotational phase, and is equal to or less than the second plate-cylinder notch move-up finish rotational phase.

If yes in step P105, in step P106, the rotational speed of the second load motor 17*b* is read from the memory M118, and if no, the process proceeds to later-described step P109. Next, the load motor rotational speed compensation value related to move-up of the notch of the plate cylinder is read from the memory M117 in step P107. In step P108, the load motor rotational speed compensation value related to move-up of the notch of the plate cylinder is subtracted from the rotational speed of the second load motor, and the memory M118 for storing the rotational speed of the second load motor is overwritten with the result.

Next, in step P109, the standard rotational speed of the load motor is read from the load motor standard rotational speed (torque value) setting unit 122, and is then stored in the memory M121 for storing the rotational speed of the third load motor. In step P110, the current rotational phase of the printing press is read from the memory M106.

Next, in step P111, the third plate-cylinder notch move-up start rotational phase is read from the memory M122, and in step P112, the third plate-cylinder notch move-up finish rotational phase is read from the memory M123.

Next, in step P113, it is judged whether the current rotational phase of the printing press is equal to or more than the third plate-cylinder notch move-up start rotational phase, and is equal to or less than the third plate-cylinder notch move-up finish rotational phase. If yes in step P113, in step P114, the rotational speed of the third load motor 17*c* is read from the memory M121, and if no, the process proceeds to later-described step P117.

Next, the load motor rotational speed compensation value related to move-up of the notch of the plate cylinder is read from the memory M117 in step P115. In step P116, the load motor rotational speed compensation value related to move-up of the notch of the plate cylinder is subtracted from the rotational speed of the third load motor, and the memory M121 for storing the rotational speed of the third load motor is overwritten with the result.

Next, in step P117, the standard rotational speed of the load motor is read from the load motor standard rotational speed (torque value) setting unit 122, and is then stored in the memory M124 for storing the rotational speed of the fourth load motor. In step P118, the current rotational phase of the printing press is read from the memory M106.

Next, in step P119, the fourth plate-cylinder notch move-up start rotational phase is read from the memory M125, and in step P120, the fourth plate-cylinder notch move-up finish rotational phase is read from the memory M126. Subsequently, in step P121, it is judged whether the current rotational phase of the printing press is equal to or more than the fourth plate-cylinder notch move-up start rotational phase, and is equal to or less than the fourth plate-cylinder notch move-up finish rotational phase.

If yes in step P121, in step P122, the rotational speed of the fourth load motor 17*d* is read from the memory M124, and if no, the process proceeds to later-described step P125. Next, the load motor rotational speed compensation value related to move-up of the notch of the plate cylinder is read from the memory M117 in step P123. In step P124, the load motor rotational speed compensation value related to move-up of the notch of the plate cylinder is subtracted from the rotational speed of the fourth load motor, and the memory M124 for storing the rotational speed of the fourth load motor is overwritten with the result.

Next, in step P125, the rotational speed of the first load motor 17*a* is read from the memory M114. In step P126, the rotational speed of the first load motor 17*a* is outputted to the first load motor driver 124*a*.

Next, in step P127, the rotational speed of the second load motor 17*b* is read from the memory M118. In step P128, the rotational speed of the second load motor 17*b* is outputted to the second load motor driver 124*b*.

Next, in step P129, the rotational speed of the third load motor 17*c* is read from the memory M121. In step P130, the rotational speed of the third load motor 17*c* is outputted to the third load motor driver 124*c*.

Next, in step P131, the rotational speed of the fourth load motor 17*d* is read from the memory M124. In step P132, the rotational speed of the fourth load motor 17*d* is outputted to the fourth load motor driver 124*d*.

Next, in step P133, the count value is read from the acceleration/deceleration counter 119, and is stored in the memory M127. In step P134, the electric current value is read from the drive motor driver 116, and is stored in the memory M128. Subsequently, in step P135, the standard electric current value is read from the memory M129.

Next, in step P136, the standard electric current value is subtracted from the electric current value to calculate the electric current value difference, which is then stored in the memory M130. In step P137, the electric current value difference-load motor rotational speed compensation value conversion table is read from the memory M131. In step P138, by using the electric current value difference-load motor rotational speed compensation value conversion table, the load motor rotational speed compensation value is obtained from the electric current value difference, and is stored in the memory M132.

Next, in step P139, the rotational speed of the first load motor 17*a* is read from the memory M114. In step P140, the load motor rotational speed compensation value is subtracted from the rotational speed of the first load motor 17*a* to calculate the compensated rotational speed of the first load motor, which is then stored in the memory M133. In step P141, the setting rotational speed at teaching is read from the memory M101.

Next, in step P142, the count value of the acceleration/deceleration counter 119 is read from the memory M127. In step P143, the compensated rotational speed of the first load motor 17*a* is stored at an address position of the memory M137 for storing the rotational speed of the load motor at acceleration, the address position corresponding to the count value of the acceleration/deceleration counter 119 for the setting rotational speed at teaching for the first load motor.

Next, in step P144, the rotational speed of the second load motor 17*b* is read from the memory M118. In step P145, the load motor rotational speed compensation value is subtracted from the rotational speed of the second load motor 17*b* to calculate the compensated rotational speed of the second load motor, which is then stored in the memory M134. In step P146, the setting rotational speed at teaching is read from the memory M101.

Next, in step P147, the count value of the acceleration/deceleration counter 119 is read from the memory M127. In step P148, the compensated rotational speed of the second load motor 17*b* is stored at an address position of the memory M137 for storing the rotational speed of the load motor at acceleration, the address position corresponding to the count value of the acceleration/deceleration counter 119 for the setting rotational speed at teaching for the second load motor.

Next, in step P149, the rotational speed of the third load motor 17*c* is read from the memory M121. In step P150, the load motor rotational speed compensation value is subtracted from the rotational speed of the third load motor 17*c* to calculate the compensated rotational speed of the third load motor, which is then stored in the memory M135. In step P151, the setting rotational speed at teaching is read from the memory M101.

Next, in step P152, the count value of the acceleration/deceleration counter 119 is read from the memory M127. In step P153, the compensated rotational speed of the third load motor 17*c* is stored at an address position of the memory M137 for storing the rotational speed of the load motor at acceleration, the address position corresponding to the count value of the acceleration/deceleration counter 119 for the setting rotational speed at teaching for the third load motor.

Next, in step P154, the rotational speed of the fourth load motor 17*d* is read from the memory M124. In step P155, the load motor rotational speed compensation value is subtracted from the rotational speed of the fourth load motor 17*d* to calculate the compensated rotational speed of the fourth load motor, which is then stored in the memory M136. In step P156, the setting rotational speed at teaching is read from the memory M101.

Next, in step P157, the count value of the acceleration/deceleration counter 119 is read from the memory M127. In step P158, the compensated rotational speed of the fourth load motor 17*d* is stored at an address position of the memory M137 for storing the rotational speed of the load motor at acceleration, the address position corresponding to the count value of the acceleration/deceleration counter for the setting rotational speed at teaching for the fourth load motor. Then, the process returns to step P70.

Next, in step P159 to which the process proceeds from step P90, the internal clock counter 105 (for counting elapsed time) starts to count. In step P160, the current setting rotational speed/virtual current rotational phase of each inking unit transmission interval is read from the memory M104.

Next, in step P161, the count value of the internal clock counter 105 is read, and in step P162, it is judged whether the count value of the internal clock counter is equal to or more than the current setting rotational speed/virtual current rotational phase of each inking unit transmission interval.

If yes in step P162, in step P163, the count value is read from the counter 117 for detecting the current rotational phase of the printing press, and is stored in the memory M105. In step P164, from the count value of the counter 117 for detecting the current rotational phase of the printing press, the current rotational phase of the printing press is calculated and stored in the memory M106.

Next, in step P165, the rotational phase compensation value of each inking unit is read from the memory M107. In step P166, the current rotational phase of the printing press is added to the rotational phase compensation value of each inking unit to calculate the virtual current rotational phase of each inking unit, which is then stored in the memory M108.

Next, in step P167, the setting rotational speed is read from the rotational speed setting unit 114, and is then stored in the memory M100 for storing the current setting rotational speed. In step P168, the current setting rotational speed and the virtual current rotational phase of each inking unit are sent to a corresponding one of the drive controllers 90*a*' to 90*d*' of the inking units.

Next, in step P169, the memory M109 for storing the instruction rotational speed is overwritten with the current setting rotational speed. Thereafter, in step P170, the instruction rotational speed is outputted to the drive motor driver 116. Subsequently, in step P171, the current setting rotational speed is stored in the memory M103 for storing the previous setting rotational speed, and the process returns to step P159.

On the other hand, if no in step P162, in step P172, the count value is read from the counter 117 for detecting the current rotational phase of the printing press, and is stored in the memory M105. In step P173, from the count value of the counter 117 for detecting the current rotational phase of the printing press, the current rotational phase of the printing press is calculated and stored in the memory M106.

Next, in step P174, the constant-speed operation load detection start rotational phase of the printing press is read from the memory M138. In step P175, it is judged whether the current rotational phase of the printing press is equal to the constant-speed operation load detection start rotational phase of the printing press.

If yes in step P175, in step P176, the constant-speed operation load detection start rotational phase of the printing press is read from the memory M138. If no in step P175, the process returns to step P160. In step P177, the rotational phase compensation value of each inking unit is read from the memory M107.

Next, in step P178, the constant-speed operation load detection start rotational phase of the printing press is added to the rotational phase compensation value of each inking unit to calculate the virtual current rotational phase of each inking unit, which is then stored in the memory M108. In step P179, the setting rotational speed is read from the rotational speed setting unit 114, and is stored in the memory M100 for storing the current setting rotational speed.

Next, in step P180, the current setting rotational speed and the virtual current rotational phase of each inking unit are sent to a corresponding one of the drive controllers 90*a*' to 90*d*' of the inking units. In step P181, the memory M109 for storing the instruction rotational speed is overwritten with the current setting rotational speed.

Next, in step P182, the instruction rotational speed is outputted to the drive motor driver 116, and in step P183, the current setting rotational speed is stored in the memory M103 for storing the previous setting rotational speed.

Next, in step P184, the internal clock counter 105 (for counting elapsed time) starts to count. In step P185, the current setting rotational speed/virtual current rotational phase of each inking unit transmission interval is read from the memory M104.

In step P186, the count value of the internal clock counter 105 is read. In step P187, it is judged whether the count value of the internal clock counter is equal to or more than the current setting rotational speed/virtual current rotational phase of each inking unit transmission interval.

If yes in step P187, in step P188, the count value is read from the counter 117 for detecting the current rotational phase of the printing press and is stored in the memory M105. In step P189, from the count value of the counter 117 for detecting the current rotational phase of the printing press, the current rotational phase of the printing press is calculated and stored in the memory M106.

Next, in step P190, the rotational phase compensation value of each inking unit is read from the memory M107. In step P191, the current rotational phase of the printing press is added to the rotational phase compensation value of each inking unit to calculate the virtual current rotational phase of each inking unit, which is then stored in the memory M108.

Next, in step P192, the setting rotational speed is read from the rotational speed setting unit 114, and is stored in the memory M100 for storing the current setting rotational speed. In step P193, the current setting rotational speed and the virtual current rotational phase of each inking unit are sent to a corresponding one of the drive controllers 90*a*' to 90*d*' of the inking units.

Next, in step P194, the memory M109 for storing the instruction rotational speed is overwritten with the current setting rotational speed. In step P195, the instruction rotational speed is outputted to the drive motor driver 116. Subsequently, in step P196, the current setting rotational speed is stored in the memory M103 for storing the previous setting rotational speed, and the process returns to step P184.

On the other hand, if no in step P187, in step P197, the count value is read from the counter 117 for detecting the current rotational phase of the printing press, and is stored in the memory M105. In step P198, from the count value of the counter 117 for detecting the current rotational phase of the printing press, the current rotational phase of the printing press is calculated and stored in the memory M106.

Next, in step P199, the constant-speed operation load detection finish rotational phase of the printing press is read from the memory M140. In step P200, it is judged whether the current rotational phase of the printing press is equal to the constant-speed operation load detection finish rotational phase of the printing press.

If yes in step P200, in step P201, the constant-speed operation load detection finish rotational phase of the printing press is read from the memory M14*o*. If no in step P200, the process proceeds to later-described step P209. In step P202, the rotational phase compensation value of each inking unit is read from the memory M107.

Next, in step P203, the constant-speed operation load detection finish rotational phase of the printing press is added to the rotational phase compensation value of each inking unit to calculate the virtual current rotational phase of each inking unit, which is then stored in the memory M108. In step P204, the setting rotational speed is read from the rotational speed setting unit 114, and is stored in the memory M100 for storing the current setting rotational speed.

Next, in step P205, the current setting rotational speed and the virtual current rotational phase of each inking unit are sent to a corresponding one of the drive controllers 90*a*' to 90*d*' of the inking units. In step P206, the memory M109 for storing the instruction rotational speed is overwritten with the current setting rotational speed.

Next, in step P207, the instruction rotational speed is outputted to the drive motor driver 116, and in step P208, the current setting rotational speed is stored in the memory M103 for storing the previous setting rotational speed, and the process then proceeds to later-described step P276.

Next, in step P209, it is judged whether clock pulse is outputted from the rotary encoder 18 for detecting rotational phase of the printing press. If yes in step P209, in step P210, the standard rotational speed of the load motor is read from the load motor standard rotational speed (torque value) setting unit 122, and is then stored in the memory M114 for storing the rotational speed of the first load motor. If no in step P209, the process returns to step P185.

Next, in step P211, the count value is read from the counter 117 for detecting the current rotational phase of the printing press, and is stored in the memory M105. In step P212, from the count value of the counter 117 for detecting the current rotational phase of the printing press, the current rotational phase of the printing press is calculated and stored in the memory M106.

Next, in step P213, the first plate-cylinder notch move-up start rotational phase is read from the memory M115, and in step P214, the first plate-cylinder notch move-up finish rotational phase is read from the memory M116. In step P215, it is judged whether the current rotational phase of the printing press is equal to or more than the first plate-cylinder notch move-up start rotational phase, and is equal to or less than the first plate-cylinder notch move-up finish rotational phase.

If yes in step P215, in step P216, the rotational speed of the first load motor 17*a* is read from the memory M114, and if no, the process proceeds to later-described step P219. Subsequently, the load motor rotational speed compensation value related to move-up of the notch of the plate cylinder is read from the memory M117 in step P217. In step P218, the load motor rotational speed compensation value related to move-up of the notch of the plate cylinder is subtracted from the rotational speed of the first load motor 17*a*, and the memory M114 for storing the current speed of the first load motor is overwritten with the result.

Next, in step P219, the standard rotational speed of the load motor is read from the load motor standard rotational speed (torque value) setting unit 122, and is then stored in the memory M118 for storing the rotational speed of the second load motor. In step P220, the current rotational phase of the printing press is read from the memory M106.

Next, in step P221, the second plate-cylinder notch move-up start rotational phase is read from the memory M119, and in step P222, the second plate-cylinder notch move-up finish rotational phase is read from the memory M120. Subsequently, in step P223, it is judged whether the current rotational phase of the printing press is equal to or more than the second plate-cylinder notch move-up start rotational phase, and is equal to or less than the second plate-cylinder notch move-up finish rotational phase.

If yes in step P223, in step P224, the rotational speed of the second load motor 17*b* is read from the memory M118, and if no, the process proceeds to later-described step P227. Next, the load motor rotational speed compensation value related to move-up of the notch of the plate cylinder is read from the memory M117 in step P225. In step P226, the load motor rotational speed compensation value related to move-up of the notch of the plate cylinder is subtracted from the rotational speed of the second load motor, and the memory M118 for storing the rotational speed of the second load motor is overwritten with the result.

Next, in step P227, the standard rotational speed of the load motor is read from the load motor standard rotational speed (torque value) setting unit 122, and is then stored in the memory M121 for storing the rotational speed of the third load motor. In step P228, the current rotational phase of the printing press is read from the memory M106.

Next, in step P229, the third plate-cylinder notch move-up start rotational phase is read from the memory M122, and in step P230, the third plate-cylinder notch move-up finish rotational phase is read from the memory M123.

Next, in step P231, it is judged whether the current rotational phase of the printing press is equal to or more than the third plate-cylinder notch move-up start rotational phase, and is equal to or less than the third plate-cylinder notch move-up finish rotational phase. If yes in step P231, in step P232, the rotational speed of the third load motor 17*c* is read from the memory M121, and if no, the process proceeds to later-described step P235.

Next, the load motor rotational speed compensation value related to move-up of the notch of the plate cylinder is read from the memory M117 in step P233. In step P234, the load motor rotational speed compensation value related to move-up of the notch of the plate cylinder is subtracted from the rotational speed of the third load motor, and the memory M121 for storing the rotational speed of the third load motor is overwritten with the result.

Next, in step P235, the standard rotational speed of the load motor is read from the load motor standard rotational speed (torque value) setting unit 122, and is then stored in the memory M124 for storing the rotational speed of the fourth load motor. In step P236, the current rotational phase of the printing press is read from the memory M106.

Next, in step P237, the fourth plate-cylinder notch move-up start rotational phase is read from the memory M125, and in step P238, the fourth plate-cylinder notch move-up finish rotational phase is read from the memory M126. Subsequently, in step P239, it is judged whether the current rotational phase of the printing press is equal to or more than the fourth plate-cylinder notch move-up start rotational phase, and is equal to or less than the fourth plate-cylinder notch move-up finish rotational phase.

If yes in step P239, in step P240, the rotational speed of the fourth load motor 17*d* is read from the memory M124, and if no, the process proceeds to later-described step P243. Next, the load motor rotational speed compensation value related to move-up of the notch of the plate cylinder is read from the memory M117 in step P241. In step P242, the load motor rotational speed compensation value related to move-up of the notch of the plate cylinder is subtracted from the rotational speed of the fourth load motor, and the memory M124 for storing the rotational speed of the fourth load motor is overwritten with the result.

Next, in step P243, the rotational speed of the first load motor 17*a* is read from the memory M114. In step P244, the rotational speed of the first load motor 17*a* is outputted to the first load motor driver 124*a*.

Next, in step P245, the rotational speed of the second load motor 17*b* is read from the memory M118. In step P246, the rotational speed of the second load motor 17*b* is outputted to the second load motor driver 124*b*.

Next, in step P247, the rotational speed of the third load motor 17*c* is read from the memory M121. In step P248, the rotational speed of the third load motor 17*c* is outputted to the third load motor driver 124*c*.

Next, in step P249, the rotational speed of the fourth load motor 17*d* is read from the memory M124. In step P250, the rotational speed of the fourth load motor 17*d* is outputted to the fourth load motor driver 124*d*.

Next, in step P251, the electric current value is read from the drive motor driver 116, and is stored in the memory M128. In step P252, the standard electric current value is read from the memory M129.

Next, in step P253, the standard electric current value is subtracted from the electric current value to calculate the electric current value difference, which is then stored in the memory M130. In step P254, the electric current value difference-load motor rotational speed compensation value conversion table is read from the memory M131. In step P255, by using the electric current value difference-load motor rotational speed compensation value conversion table, the load motor rotational speed compensation value is obtained from the electric current value difference, and is stored in the memory M132.

Next, in step P256, the rotational speed of the first load motor 17*a* is read from the memory M114. In step P257, the load motor rotational speed compensation value is subtracted from the rotational speed of the first load motor 17*a* to calculate the compensated rotational speed of the first load motor, which is then stored in the memory M133. In step P258, the setting rotational speed at teaching is read from the memory M101.

Next, in step P259, the current rotational phase of the printing press is read from the memory M106. In step P260, the compensated rotational speed of the first load motor 17*a* is stored at an address position of the memory M139 for storing the rotational speed of the load motor at constant-speed operation, the address position corresponding to the current rotational phase of the printing press for the setting rotational speed at teaching for the first load motor.

Next, in step P261, the rotational speed of the second load motor 17*b* is read from the memory M118. In step P262, the load motor rotational speed compensation value is subtracted from the rotational speed of the second load motor 17*b* to calculate the compensated rotational speed of the second load motor, which is then stored in the memory M134. In step P146, the setting rotational speed at teaching is read from the memory M101.

Next, in step P264, the current rotational phase of the printing press is read from the memory M106. In step P265, the compensated rotational speed of the second load motor 17*b* is stored at an address position of the memory M139 for storing the rotational speed of the load motor at constant-speed operation, the address position corresponding to the current rotational phase of the printing press for the setting rotational speed at teaching for the second load motor.

Next, in step P266, the rotational speed of the third load motor 17*c* is read from the memory M121. In step P267, the load motor rotational speed compensation value is subtracted from the rotational speed of the third load motor 17*c* to calculate the compensated rotational speed of the third load motor, which is then stored in the memory M135. In step P268, the setting rotational speed at teaching is read from the memory M101.

Next, in step P269, the current rotational phase of the printing press is read from the memory M106. In step P270, the compensated rotational speed of the third load motor 17*c* is stored at an address position of the memory M139 for storing the rotational speed of the load motor at constant-speed operation, the address position corresponding to the current rotational phase of the printing press for the setting rotational speed at teaching for the third load motor.

Next, in step P271, the rotational speed of the fourth load motor 17*d* is read from the memory M124. In step P272, the load motor rotational speed compensation value is subtracted from the rotational speed of the fourth load motor 17*d* to calculate the compensated rotational speed of the fourth load motor, which is then stored in the memory M136. In step P273, the setting rotational speed at teaching is read from the memory M101.

Next, in step P274, the current rotational phase of the printing press is read from the memory M106. In step P275, the compensated rotational speed of the fourth load motor 17*d* is stored at an address position of the memory M139 for storing the rotational speed of the load motor at constant-speed operation, the address position corresponding to the current rotational phase of the printing press for the setting rotational speed at teaching for the fourth load motor. Then, the process returns to step P185.

Next, in step P276 to which the process proceeds from step P208, the internal clock counter 105 (for counting elapsed time) starts to count. In step P277, the current setting rotational speed/virtual current rotational phase of each inking unit transmission interval is read from the memory M104.

Next, in step P278, the count value of the internal clock counter 105 is read, and in step P279, it is judged whether the count value of the internal clock counter is equal to or more than the current setting rotational speed/virtual current rotational phase of each inking unit transmission interval.

If yes in step P279, in step P280, the count value is read from the counter 117 for detecting the current rotational phase of the printing press, and is stored in the memory M105. In step P281, from the count value of the counter 117 for detecting the current rotational phase of the printing press, the current rotational phase of the printing press is calculated and stored in the memory M106.

Next, in step P282, the rotational phase compensation value of each inking unit is read from the memory M107. In step P283, the current rotational phase of the printing press is added to the rotational phase compensation value of each inking unit to calculate the virtual current rotational phase of each inking unit, which is then stored in the memory M108.

Next, in step P284, the setting rotational speed is read from the rotational speed setting unit 114, and is stored in the memory M100 for storing the current setting rotational speed. In step P285, the current setting rotational speed and the virtual current rotational phase of each inking unit are sent to a corresponding one of the drive controllers 90*a*' to 90*d*' of the inking units.

Next, in step P286, the memory M109 for storing the instruction rotational speed is overwritten with the current setting rotational speed. Thereafter, in step P287, the instruction rotational speed is outputted to the drive motor driver 116. Subsequently, in step P288, the current setting rotational speed is stored in the memory M103 for storing the previous setting rotational speed, and the process returns to step P276.

On the other hand, if no in step P279, in step P289, the count value is read from the counter 117 for detecting the current rotational phase of the printing press, and is stored in the memory M105. In step P290, from the count value of the counter 117 for detecting the current rotational phase of the printing press, the current rotational phase of the printing press is calculated and stored in the memory M106.

Next, in step P291, the deceleration start rotational phase of the printing press is read from the memory M141. In step P292, it is then judged whether the current rotational phase of the printing press is equal to the deceleration start rotational phase of the printing press.

If yes in step P292, in step P293, an instruction to stop printing is sent to the printing press controller 28', and if no in step P292, the process returns to step P277. In step P294, the deceleration start rotational phase of the printing press is read from the memory M141.

Next, in step P295, the rotational phase compensation value of each inking unit is read from the memory M107. In step P296, the deceleration start rotational phase of the printing press is added to the rotational phase compensation value of each inking unit to calculate the virtual current rotational phase of each inking unit, which is then stored in the memory M108.

Next, in step P297, the setting rotational speed is read from the rotational speed setting unit 114, and is stored in the memory M100 for storing the current setting rotational speed. In step P298, the current setting rotational speed and the virtual current rotational phase of each inking unit are sent to a corresponding one of the drive controllers 90*a*' to 90*d*' of the inking units.

Next, in step P299, the memory M109 for storing the instruction rotation speed is overwritten with the current setting rotational speed. In step P300, the instruction rotational speed is outputted to the drive motor driver 116. In step P301, the current setting rotational speed is stored in the memory M103 for storing the previous setting rotational speed.

Next, in step P302, the reset and enable signals are outputted to the acceleration/deceleration counter 119, and in step P303, the output of the reset signal to the acceleration/deceleration counter 119 is stopped.

In step P304, the internal clock counter 105 (for counting elapsed time) starts to count. In step P305, the current setting rotational speed/virtual current rotational phase of each inking unit transmission interval is read from the memory M104.

Next, in step P306, the count value of the internal clock counter 105 is read, and in step P307, it is judged whether the count value of the internal clock counter is equal to or more than the current setting rotational speed/virtual current rotational phase of each inking unit transmission interval.

If yes in step P307, in step P308, the count value is read from the counter 117 for detecting the current rotational phase of the printing press, and is stored in the memory M105. In step P309, from the count value of the counter 117 for detecting the current rotational phase of the printing press, the current rotational phase of the printing press is calculated and stored in the memory M106.

Next, in step P310, the rotational phase compensation value of each inking unit is read from the memory M107. In step P311, the current rotational phase of the printing press is added to the rotational phase compensation value of each inking unit to calculate the virtual current rotational phase of each inking unit, which is then stored in the memory M108.

In step P312, the previous setting rotational speed is read from the memory M103, and in step P313, the rotational speed correction value at deceleration is read from the memory M142. Subsequently, in step P314, the rotational speed correction value at deceleration is subtracted from the previous setting rotational speed to calculate the corrected current setting rotational speed, which is then stored in the memory M113.

Next, in step P315, it is judged whether the corrected current setting rotational speed is less than 0. If yes in step P315, in step P316, the corrected current setting rotational speed in the memory M113 is updated with 0, and in step P317, the corrected current setting rotational speed is stored in the memory M100 for storing the current setting rotational speed. If no in step P315, the process directly proceeds to step P317.

Next, in step P318, the current setting rotational speed and the virtual current rotational phase of each inking unit are sent to a corresponding one of the drive controllers 90*a*' to 90*d*' of the inking units. In step P319, the memory M109 for storing the instruction rotational speed is overwritten with the current setting rotational speed.

Next, in step P320, the instruction rotational speed is outputted to the drive motor driver 116, and in step P321, the current setting rotational speed is stored in the memory M103 for storing the previous setting rotational speed, and the process then returns to step P304.

On the other hand, if no in step P307, in step P322, outputs of the F/V converters 121 and 127*a* to 127*d*, which are connected to the rotary encoders for the drive motors of the printing press and of the respective inking units, are read, and are stored in the memory M144. In step P323, from the outputs of the F/V converters 121 and 127*a* to 127*d*, which are connected to the rotary encoders for the drive motors of the printing press and of the respective inking units, the current rotational speeds of the printing press and the inking units are calculated and stored in the memory M145.

Next, in step P324, it is judged whether the current rotational speeds of the printing press and all of the inking units are equal to 0. If yes in step P324, in step P325, the teaching finish signal is sent to the drive controllers 90*a*' to 90*d*' of the inking units, and the process returns to step P1. If no in step P324, the process proceeds to step P326.

Next, in step P326, it is judged whether clock pulse is outputted from the rotary encoder 18 for detecting rotational phase of the printing press. If yes in step P326, in step P327, the standard rotational speed of the load motor is read from the load motor standard rotational speed (torque value) setting unit 122, and is then stored in the memory M114 for storing the rotational speed of the first load motor. If no in step P326, the process returns to step P305.

Next, in step P328, the count value is read from the counter 117 for detecting the current rotational phase of the printing press, and is stored in the memory M105. In step P329, from the count value of the counter 117 for detecting the current rotational phase of the printing press, the current rotational phase of the printing press is calculated and stored in the memory M106.

Next, in step P330, the first plate-cylinder notch move-up start rotational phase is read from the memory M115, and in step P331, the first plate-cylinder notch move-up finish rotational phase is read from the memory M116. Subsequently, in step P332, it is judged whether the current rotational phase of the printing press is equal to or more than the first plate-cylinder notch move-up start rotational phase, and is equal to or less than the first plate-cylinder notch move-up finish rotational phase.

If yes in step P332, in step P333, the rotational speed of the first load motor 17*a* is read from the memory M114, and if no, the process proceeds to later-described step P336. Next, the load motor rotational speed compensation value related to move-up of the notch of the plate cylinder is read from the memory M117 in step P334. In step P335, the load motor rotational speed compensation value related to move-up of the notch of the plate cylinder is subtracted from the rotational speed of the first load motor 17*a*, and the memory M114 for storing the first load motor rotational speed is overwritten with the result.

Next, in step P336, the standard rotational speed of the load motor is read from the load motor standard rotational speed (torque value) setting unit 122, and is then stored in the memory M118 for storing the rotational speed of the second load motor. In step P337, the current rotational phase of the printing press is read from the memory M106.

Next, in step P338, the second plate-cylinder notch move-up start rotational phase is read from the memory M119, and in step P339, the second plate-cylinder notch move-up finish rotational phase is read from the memory M120. Subsequently, in step P340, it is judged whether the current rotational phase of the printing press is equal to or more than the second plate-cylinder notch move-up start rotational phase, and is equal to or less than the second plate-cylinder notch move-up finish rotational phase.

If yes in step P340, in step P341, the rotational speed of the second load motor 17*b* is read from the memory M118, and if no, the process proceeds to later-described step P344. Next, the load motor rotational speed compensation value related to move-up of the notch of the plate cylinder is read from the memory M117 in step P342. In step P343, the load motor rotational speed compensation value related to move-up of the notch of the plate cylinder is subtracted from the rotational speed of the second load motor, and the memory M118 for storing the rotational speed of the second load motor is overwritten with the result.

Next, in step P344, the standard rotational speed of the load motor is read from the load motor standard rotational speed (torque value) setting unit 122, and is then stored in the memory M121 for storing the rotational speed of the third load motor. In step P345, the current rotational phase of the printing press is read from the memory M106.

Next, in step P346, the third plate-cylinder notch move-up start rotational phase is read from the memory M122, and in step P347, the third plate-cylinder notch move-up finish rotational phase is read from the memory M123.

Next, in step P348, it is judged whether the current rotational phase of the printing press is equal to or more than the third plate-cylinder notch move-up start rotational phase, and is equal to or less than the third plate-cylinder notch move-up finish rotational phase. If yes in step P348, in step P349, the rotational speed of the third load motor 17*c* is read from the memory M121, and if no, the process proceeds to later-described step P352.

Next, the load motor rotational speed compensation value related to move-up of the notch of the plate cylinder is read from the memory M117 in step P350. In step P351, the load motor rotational speed compensation value related to move-up of the notch of the plate cylinder is subtracted from the rotational speed of the third load motor, and the memory M121 for storing the rotational speed of the third load motor is overwritten with the result.

Next, in step P352, the standard rotational speed of the load motor is read from the load motor standard rotational speed (torque value) setting unit 122, and is then stored in the memory M124 for storing the rotational speed of the fourth load motor. In step P353, the current rotational phase of the printing press is read from the memory M106.

Next, in step P354, the fourth plate-cylinder notch move-up start rotational phase is read from the memory M125, and in step P355, the fourth plate-cylinder notch move-up finish rotational phase is read from the memory M126. Subsequently, in step P356, it is judged whether the current rotational phase of the printing press is equal to or more than the fourth plate-cylinder notch move-up start rotational phase, and is equal to or less than the fourth plate-cylinder notch move-up finish rotational phase.

If yes in step P356, in step P357, the rotational speed of the fourth load motor 17*d* is read from the memory M124, and if no, the process proceeds to later-described step P360. Next, the load motor rotational speed compensation value related to move-up of the notch of the plate cylinder is read from the memory M117 in step P358. In step P359, the load motor rotational speed compensation value related to move-up of the notch of the plate cylinder is subtracted from the rotational speed of the fourth load motor, and the memory M124 for storing the rotational speed of the fourth load motor is overwritten with the result.

Next, in step P360, the rotational speed of the first load motor 17*a* is read from the memory M114. In step P361, the rotational speed of the first load motor 17*a* is outputted to the first load motor driver 124*a*.

Next, in step P362, the rotational speed of the second load motor 17*b* is read from the memory M118. In step P363, the rotational speed of the second load motor 17*b* is outputted to the second load motor driver 124*b*.

Next, in step P364, the rotational speed of the third load motor 17*c* is read from the memory M121. In step P365, the rotational speed of the third load motor 17*c* is outputted to the third load motor driver 124*c*.

Next, in step P366, the rotational speed of the fourth load motor 17*d* is read from the memory M124. In step P367, the rotational speed of the fourth load motor 17*d* is outputted to the fourth load motor driver 124*d*.

Next, in step P368, the count value is read from the acceleration/deceleration counter 119, and is stored in the memory M127. In step P369, the electric current value is read from the drive motor driver 116, and is stored in the memory M128. Subsequently, in step P370, the standard electric current value is read from the memory M129.

Next, in step P371, the standard electric current value is subtracted from the electric current value to calculate the electric current value difference, which is then stored in the memory M130. In step P372, the electric current value difference-load motor rotational speed compensation value conversion table is read from the memory M131. In step P373, by using the electric current value difference-load motor rotational speed compensation value conversion table, the load motor rotational speed compensation value is obtained from the electric current value difference, and is stored in the memory M132.

Next, in step P374, the rotational speed of the first load motor 17*a* is read from the memory M114. In step P375, the load motor rotational speed compensation value is subtracted from the rotational speed of the first load motor 17*a* to calculate the compensated rotational speed of the first load motor, which is then stored in the memory M133. In step P376, the setting rotational speed at teaching is read from the memory M101.

Next, in step P377, the count value of the acceleration/deceleration counter 119 is read from the memory M127. In step P378, the compensated rotational speed of the first load motor 17*a* is stored at an address position of the memory M143 for storing the rotational speed of the load motor at deceleration, the address position corresponding to the count value of the acceleration/deceleration counter 119 for the setting rotational speed at teaching for the first load motor.

Next, in step P379, the rotational speed of the second load motor 17*b* is read from the memory M118. In step P380, the load motor rotational speed compensation value is subtracted from the rotational speed of the second load motor 17*b* to calculate the compensated rotational speed of the second load motor, which is then stored in the memory M134. In step P381, the setting rotational speed at teaching is read from the memory M101.

Next, in step P382, the count value of the acceleration/deceleration counter 119 is read from the memory M127. In step P383, the compensated rotational speed of the second load motor 17*b* is stored at an address position of the memory M143 for storing the rotational speed of the load motor at deceleration, the address position corresponding to the count value of the acceleration/deceleration counter 119 for the setting rotational speed at teaching for the second load motor.

Next, in step P384, the rotational speed of the third load motor 17*c* is read from the memory M121. In step P385, the load motor rotational speed compensation value is subtracted from the rotational speed of the third load motor 17*c* to calculate the compensated rotational speed of the third load motor, which is then stored in the memory M135. In step P386, the setting rotational speed at teaching is read from the memory M101.

Next, in step P387, the count value of the acceleration/deceleration counter 119 is read from the memory M127. In step P388, the compensated rotational speed of the third load motor 17*c* is stored at an address position of the memory M143 for storing the rotational speed of the load motor at deceleration, the address position corresponding to the count value of the acceleration/deceleration counter 119 for the setting rotational speed at teaching for the third load motor.

Next, in step P389, the rotational speed of the fourth load motor 17*d* is read from the memory M124. In step P390, the load motor rotational speed compensation value is subtracted from the rotational speed of the fourth load motor 17*d* to calculate the compensated rotational speed of the fourth load motor, which is then stored in the memory M136. In step P391, the setting rotational speed at teaching is read from the memory M101.

Next, in step P392, the count value of the acceleration/deceleration counter 119 is read from the memory M127. In step P393, the compensated rotational speed of the fourth load motor 17*d* is stored at an address position of the memory M143 for storing the rotational speed of the load motor at deceleration, the address position corresponding to the count value of the acceleration/deceleration counter for the setting rotational speed at teaching for the fourth load motor. Then, the process returns to step P305.

Next, in step P394 to which the process proceeds from step P5, it is judged whether the printing press drive switch 108 is turned on. If yes in step P394, in step P395, the instruction to start home position alignment is sent to the drive controllers 90*a*' to 90*d*' of the inking units. If no in step P394, the process proceeds to step P396.

Next, in step P396, it is judged whether the synchronizing operation switch 107 is turned off. If yes in step P396, in step P397, the instruction to stop synchronizing operation is sent to the drive controllers 90*a*' to 90*d*' of the inking units, and the process then proceeds to later-described step P629. If no in step P396, the process returns to step P394.

Next, in step P398, the setting rotational speed is read from the rotational speed setting unit 114, and is stored in the memory M146 for storing the setting rotational speed at synchronizing operation. In step P399, the slower rotational speed is read from the memory M102. Subsequently, in step P400, the slower rotational speed is written in the memory M100 for storing the current setting rotational speed and the memory M103 for storing the previous setting rotational speed.

In step P401, the internal clock counter 105 (for counting elapsed time) starts to count. In step P402, the current setting rotational speed/virtual current rotational phase of each inking unit transmission interval is read from the memory M104.

Next, in step P403, the count value of the internal clock counter 105 is read, and in step P404, it is judged whether the count value of the internal clock counter is equal to or more than the current setting rotational speed/virtual current rotational phase of each inking unit transmission interval.

If yes in step P404, in step P405, the count value is read from the counter 117 for detecting the current rotational phase of the printing press, and is stored in the memory M105. In step P406, from the count value of the counter 117 for detecting the current rotational phase of the printing press, the current rotational phase of the printing press is calculated and stored in the memory M106.

Next, in step P407, the rotational phase compensation value of each inking unit is read from the memory M107. In step P408, the current rotational phase of the printing press is added to the rotational phase compensation value of each inking unit to calculate the virtual current rotational phase of each inking unit, which is then stored in the memory M108.

Next, in step P409, the current setting rotational speed (slower) is read from the memory M100, and in step P410, the current setting rotational speed (slower) and the virtual current rotational phase of each inking unit are sent to a corresponding one of the drive controllers 90*a*' to 90*d*' of the inking units.

Next, in step P411, the memory M109 for storing the instruction rotational speed is overwritten with the current setting rotational speed (slower). Thereafter, in step P412, the instruction rotational speed is outputted to the drive motor driver 116. Subsequently, in step P413, the current setting rotational speed (slower) is stored in the memory M103 for storing the previous setting rotational speed, and the process returns to step P401.

On the other hand, if no in step P404, in step P414, it is judged whether the home position alignment completion signal is sent from any of the drive controllers 90*a*' to 90*d*' of the inking units. If yes in step P414, in step P415, the number of the inking unit which has sent the home position alignment completion signal is received, and is stored in the memory M110 for storing the number of the inking unit which has finished home position alignment, and if no, the process returns to step P402.

Next, in step P416, the content of the memory M110 for storing the number of the inking unit which has finished home position alignment is read, and in step P417, it is judged whether home position alignment is finished for all of the inking units.

If yes in step P417, in step P418 the current setting rotational speed/virtual current rotational phase of each inking unit transmission interval is read from the memory M104. If no in step P417, the process returns to step P402.

Next, in step P419, the count value of the internal clock counter 105 is read, and in step P420, it is judged whether the count value of the internal clock counter is equal to or more than the current setting rotational speed/virtual current rotational phase of each inking unit transmission interval.

If yes in step P420, in step P421, the count value is read from the counter 117 for detecting the current rotational phase of the printing press, and is stored in the memory M105. If no in step P420, the process returns to step P418.

Next, in step P422, from the count value of the counter 117 for detecting the current rotational phase of the printing press, the current rotational phase of the printing press is calculated and stored in the memory M106. In step P423, the rotational phase compensation value of each inking unit is read from the memory M107.

Next, in step P424, the current rotational phase of the printing press is added to the rotational phase compensation value of each inking unit to calculate the virtual current rotational phase of each inking unit, which is then stored in the memory M108. In step P425, the current setting rotational speed (slower) is read from the memory M100.

Next, in step P426, the current setting rotational speed (slower) and the virtual current rotational phase of each inking unit are sent to a corresponding one of the drive controllers 90*a*' to 90*d*' of the inking units. In step P427, the memory M109 for storing the instruction rotational speed is overwritten with the current setting rotational speed (slower).

Next, in step P428, the instruction rotational speed is outputted to the drive motor driver 116. In step P429, the current setting rotational speed (slower) is stored in the memory M103 for storing the previous setting rotational speed.

Next, in step P430, the internal clock counter 105 (for counting elapsed time) starts to count. In step P431, the current setting rotational speed/virtual current rotational phase of each inking unit transmission interval is read from the memory M104.

Next, in step P432, the count value of the internal clock counter 105 is read. In step P433, it is judged whether the count value of the internal clock counter is equal to or more than the current setting rotational speed/virtual current rotational phase of each inking unit transmission interval.

If yes in step P433, in step P434, the count value is read from the counter 117 for detecting the current rotational phase of the printing press, and is stored in the memory M105. In step P435, from the count value of the counter 117 for detecting the current rotational phase of the printing press, the current rotational phase of the printing press is calculated and stored in the memory M106.

Next, in step P436, the rotational phase compensation value of each inking unit is read from the memory M107. In step P437, the current rotational phase of the printing press is added to the rotational phase compensation value of each inking unit to calculate the virtual current rotational phase of each inking unit, which is then stored in the memory M108.

Next, in step P438, the current setting rotational speed (slower) is read from the memory M100. In step P439, the current setting rotational speed (slower) and the virtual current rotational phase of each inking unit are sent to a corresponding one of the drive controllers 90*a*' to 90*d*' of the inking units.

Next, in step P440, the memory M109 for storing the instruction rotational speed is overwritten with the current setting rotational speed (slower), and in step P441, the instruction rotational speed is outputted to the drive motor driver 116. Subsequently, in step P442, the current setting rotational speed (slower) is stored in the memory M103 for storing the previous setting rotational speed, and the process returns to step P430.

On the other hand, if no in step P433, in step P443, the count value is read from the counter 117 for detecting the current rotational phase of the printing press, and is stored in the memory M105. In step P444, from the count value of the counter 117 for detecting the current rotational phase of the printing press, the current rotational phase of the printing press is calculated and stored in the memory M106.

Next, in step P445, the acceleration start rotational phase of the printing press is read from the memory M111. In step P446, it is then judged whether the current rotational phase of the printing press is equal to the acceleration start rotational phase of the printing press. If yes in step P446, in step P447, the instruction to start printing is sent to the printing press controller 28', and if no, the process returns to step P431.

Next, in step P448, the acceleration start rotational phase of the printing press is read from the memory M111, and in step P449, the rotational phase compensation value of each inking unit is read from the memory M107. Subsequently, in step P450, the acceleration start rotational phase of the printing press is added to the rotational phase compensation value of each inking unit to calculate the virtual current rotational phase of each inking unit, which is then stored in the memory M108.

Next, in step P451, the current setting rotational speed (slower) is read from the memory M100, and in step P452, the current setting rotational speed (slower) and the virtual current rotational phase of each inking unit are sent to a corresponding one of the drive controllers 90*a*' to 90*d*' of the inking units.

Next, in step P453, the memory M109 for storing the instruction rotational speed is overwritten with the current setting rotational speed (slower), and in step P454, the instruction rotational speed is outputted to the drive motor driver 116. Subsequently, in step P455, the current setting rotational speed (slower) is stored in the memory M103 for storing the previous setting rotational speed.

Next, in step P456, the reset and enable signals are outputted to the acceleration/deceleration counter 119, and in step P457, the output of the reset signal to the acceleration/deceleration counter 119 is stopped.

In step P458, the internal clock counter 105 (for counting elapsed time) starts to count. In step P459, the current setting rotational speed/virtual current rotational phase of each inking unit transmission interval is read from the memory M104.

Next, in step P460, the count value of the internal clock counter 105 is read, and in step P461, it is judged whether the count value of the internal clock counter is equal to or more than the current setting rotational speed/virtual current rotational phase of each inking unit transmission interval.

If yes in step P461, in step P462, the previous setting rotational speed is read from the memory M103. If no in step P461, the process returns to step P459. Subsequently, in step P463, the rotational speed correction value at acceleration is read from the memory M112.

Next, in step P464, the previous setting rotational speed is added to the rotational speed correction value at acceleration to calculate the corrected current setting rotational speed, which is then stored in the memory M113. In step P465, the setting rotational speed is read from the rotational speed setting unit 114, and is stored in the memory M100 for storing the current setting rotational speed.

Next, in step P466, it is judged whether the corrected current rotational speed is less than the current setting rotational speed. If yes in step P466, in step P467, the setting rotational speed at synchronizing operation is read from the memory M146. In step P468, the count value is read from the acceleration/deceleration counter 119, and is then stored in the memory M127.

Next, in step P496, the rotational speed of the first load motor 17*a* is read from an address position of the memory M137 for storing the rotational speed of the load motor at acceleration, the address position corresponding to the count value of the acceleration/deceleration counter for the setting rotational speed at synchronizing operation for the first load motor. In step P470, the rotational speed of the first load motor 17*a* is outputted to the first load motor driver 124*a*. Note that, the address position of the memory M137 for storing the rotational speed of the load motor at acceleration, the address position corresponding to the count value of the acceleration/deceleration counter for the setting rotational speed at synchronizing operation for the first load motor, corresponds to the address position of the memory M137, the address position corresponding to the count value of the acceleration/deceleration counter for the setting rotational speed at teaching for the first load motor, the memory M137 storing the compensated rotational speed of the first load motor in step P143 when the setting rotational speed at teaching is equal to the setting rotational speed at synchronizing operation, and when the count value of the acceleration/deceleration counter has a same count value.

Next, in step P471, the rotational speed of the second load motor 17*b* is read from an address position of the memory M137 for storing the rotational speed of the load motor at acceleration, the address position corresponding to the count value of the acceleration/deceleration counter for the setting rotational speed at synchronizing operation for the second load motor. In step P472, the rotational speed of the second load motor 17*b* is outputted to the second load motor driver 124*b*.

Next, in step P473, the rotational speed of the third load motor 17*c* is read from an address position of the memory M137 for storing the rotational speed of the load motor at acceleration, the address position corresponding to the count value of the acceleration/deceleration counter for the setting rotational speed at synchronizing operation for the third load motor. In step P474, the rotational speed of the third load motor 17*c* is outputted to the third load motor driver 124*c*.

Next, in step P475, the rotational speed of the fourth load motor 17*d* is read from an address position of the memory M137 for storing the rotational speed of the load motor at acceleration, the address position corresponding to the count value of the acceleration/deceleration counter for the setting rotational speed at synchronizing operation for the fourth load motor. In step P476, the rotational speed of the fourth load motor 17*d* is outputted to the fourth load motor driver 124*d*.

Next, in step P477, the count value is read from the counter 117 for detecting the current rotational phase of the printing press, and is stored in the memory M105. In step P478, from the count value of the counter 117 for detecting the current rotational phase of the printing press, the current rotational phase of the printing press is calculated and stored in the memory M106.

Next, in step P479, the rotational phase compensation value of each inking unit is read from the memory M107. In step P480, the current rotational phase of the printing press is added to the rotational phase compensation value of each inking unit to calculate the virtual current rotational phase of each inking unit, which is stored in the memory M108.

Next, in step P481, the corrected current setting rotational speed is stored in the memory M100 for storing the current setting rotational speed. In step P482, the current rotational speed and the virtual current rotational phase of each inking unit are sent to a corresponding one of the drive controllers 90*a*' to 90*d*' of the inking units.

Next, in step P483, the memory M109 for storing the instruction rotational speed is overwritten with the current setting rotational speed, and in step P484, the instruction rotational speed is outputted to the drive motor driver 116. Subsequently, in step P485, the current setting rotational speed is stored in the memory M103 for storing the previous setting rotational speed, and the process returns to step P458.

If no in step P466, in step P468, the setting rotational speed at synchronizing operation is read from the memory M146. In step P487, the count value is read from the counter 117 for detecting the current rotational phase of the printing press, and is stored in the memory M105. Subsequently, in step P488, from the count value of the counter 117 for detecting the current rotational phase of the printing press, the current rotational phase of the printing press is calculated and stored in the memory M106.

Next, in step P489, the rotational speed of the first load motor 17*a* is read from an address position of the memory M139 for storing the rotational speed of the load motor at constant-speed operation, the address position corresponding to the current rotational phase of the printing press for the setting rotational speed at synchronizing operation for the first load motor. In step P490, the rotational speed of the first load motor 17*a* is outputted to the first load motor driver 124*a*. Note that, the address position of the memory M139 for storing the rotational speed of the load motor at constant-speed operation, the address position corresponding to the current rotational phase of the printing press for the setting rotational speed at synchronizing operation for the first load motor, corresponds to the address position of the memory M139, the address position corresponding to the current rotational phase for the setting rotational speed at teaching for the first load motor, the memory M139 storing the compensated rotational speed of the first load motor in step P260 when the setting rotational speed at teaching is equal to the setting rotational speed at synchronizing operation, and when the current rotational phase of the printing press is the same.

Next, in step P491, the rotational speed of the second load motor 17*b* is read from an address position of the memory M139 for storing the rotational speed of the load motor at constant-speed operation, the address position corresponding to the current rotational phase of the printing press for the setting rotational speed at synchronizing operation for the second load motor. In step P492, the rotational speed of the second load motor 17*b* is outputted to the second load motor driver 124*b*.

Next, in step P493, the rotational speed of the third load motor 17*c* is read from an address position of the memory M139 for storing the rotational speed of the load motor at constant-speed operation, the address position corresponding to the current rotational phase of the printing press for the setting rotational speed at synchronizing operation for the third load motor. In step P494, the rotational speed of the third load motor 17*c* is outputted to the third load motor driver 124*c*.

Next, in step P495, the rotational speed of the fourth load motor 17*d* is read from an address position of the memory M139 for storing the rotational speed of the load motor at constant-speed operation, the address position corresponding to the current rotational phase of the printing press for the setting rotational speed at synchronizing operation for the fourth load motor. In step P496, the rotational speed of the fourth load motor 17*d* is outputted to the fourth load motor driver 124*d*.

Next, in step P497, the current rotational phase of the printing press is read from the memory M106, and in step P498, the rotational phase compensation value of each inking unit is read from the memory M107. Subsequently, in step P499, the current rotational phase of the printing press is added to the rotational phase compensation value of each inking unit to calculate the virtual current rotational phase of each inking unit, which is then stored in the memory M108.

Next, in step P500, the setting rotational speed is read from the rotational speed setting unit 114, and is stored in the memory M100 for storing the current setting rotational speed. In step P501, the current setting rotational speed and the virtual current rotational phase of each inking unit are sent to a corresponding one of the drive controllers 90*a*' to 90*d*' of the inking units.

Next, in step P502, the memory M109 for storing the instruction rotational speed is overwritten with the current setting rotational speed, and in step P503, the instruction rotational speed is outputted to the drive motor driver 116. Subsequently, in step P504, the current setting rotational speed is stored in the memory M103 for storing the previous setting rotational speed.

In step P505, the internal clock counter 105 (for counting elapsed time) starts to count. In step P506, the current setting rotational speed/virtual current rotational phase of each inking unit transmission interval is read from the memory M104.

Next, in step P507, the count value of the internal clock counter 105 is read, and in step P508, it is judged whether the count value of the internal clock counter is equal to or more than the current setting rotational speed/virtual current rotational phase of each inking unit transmission interval.

If yes in step P508, in step P509, the setting rotational speed at synchronizing operation is read from the memory M146. In step P510, the count value is read from the counter 117 for detecting the current rotational phase of the printing press, and is then stored in the memory M105. Subsequently, in step P511, from the count value of the counter 117 for detecting the current rotational phase of the printing press, the current rotational phase of the printing press is calculated and stored in the memory M106.

Next, in step P512, the rotational speed of the first load motor 17*a* is read from the address position of the memory M139 for storing the rotational speed of the load motor at constant-speed operation, the address position corresponding to the current rotational phase of the printing press for the setting rotational speed at synchronizing operation for the first load motor. In step P513, the rotational speed of the first load motor 17*a* is outputted to the first load motor driver 124*a*.

Next, in step P514, the rotational speed of the second load motor 17*b* is read from the address position of the memory M139 for storing the rotational speed of the load motor at constant-speed operation, the address position corresponding to the current rotational phase of the printing press for the setting rotational speed at synchronizing operation for the second load motor. In step P515, the rotational speed of the second load motor 17*b* is outputted to the second load motor driver 124*b*.

Next, in step P516, the rotational speed of the third load motor 17*c* is read from the address position of the memory M139 for storing the rotational speed of the load motor at constant-speed operation, the address position corresponding to the current rotational phase of the printing press for the setting rotational speed at synchronizing operation for the third load motor. In step P517, the rotational speed of the third load motor 17*c* is outputted to the third load motor driver 124*c*.

Next, in step P518, the rotational speed of the fourth load motor 17*d* is read from the address position of the memory M139 for storing the rotational speed of the load motor at constant-speed operation, the address position corresponding to the current rotational phase of the printing press for the setting rotational speed at synchronizing operation for the fourth load motor. In step P519, the rotational speed of the fourth load motor 17*d* is outputted to the fourth load motor driver 124*d*.

Next, in step P520, the current rotational phase of the printing press is read from the memory M106, and in step P521, the rotational phase compensation value of each inking unit is read from the memory M107. Subsequently, in step P522, the current rotational phase of the printing press is added to the rotational phase compensation value of each inking unit to calculate the virtual current rotational phase of each inking unit, which is then stored in the memory M108.

Next, in step P523, the setting rotational speed is read from the rotational speed setting unit 114, and is stored in the memory M100 for storing the current setting rotational speed. In step P524, the current setting rotational speed and the virtual current rotational phase of each inking unit are sent to a corresponding one of the drive controllers 90*a*' to 90*d*' of the inking units.

Next, in step P525, the memory M109 for storing the instruction rotational speed is overwritten with the current setting rotational speed, and in step P526, the instruction rotational speed is outputted to the drive motor driver 116. Subsequently, in step P527, the current setting rotational speed is stored in the memory M103 for storing the previous setting rotational speed. Then, the process returns to step P505.

On the other hand, if no in step P508, in step P528, it is judged whether the printing press drive stop switch 109 is turned on. If yes in step P528, the process proceeds to later-described step P529. If no, the process returns to step P506.

Next, in step P529, the setting rotational speed at synchronizing operation is read from the memory M146. In step P530, the count value is read from the counter 117 for detecting the current rotational phase of the printing press, and is stored in the memory M105. Subsequently, in step P531, from the count value of the counter 117 for detecting the current rotational phase of the printing press, the current rotational phase of the printing press is calculated and stored in the memory M106.

Next, in step P532, the rotational speed of the first load motor 17*a* is read from the address position of the memory M139 for storing the rotational speed of the load motor at constant-speed operation, the address position corresponding to the current rotational phase of the printing press for the setting rotational speed at synchronizing operation for the first load motor. In step P533, the rotational speed of the first load motor 17*a* is outputted to the first load motor driver 124*a*.

Next, in step P534, the rotational speed of the second load motor 17*b* is read from the address position of the memory M139 for storing the rotational speed of the load motor at constant-speed operation, the address position corresponding to the current rotational phase of the printing press for the setting rotational speed at synchronizing operation for the second load motor. In step P535, the rotational speed of the second load motor 17*b* is outputted to the second load motor driver 124*b*.

Next, in step P536, the rotational speed of the third load motor 17*c* is read from the address position of the memory M139 for storing the rotational speed of the load motor at constant-speed operation, the address position corresponding to the current rotational phase of the printing press for the setting rotational speed at synchronizing operation for the third load motor. In step P537, the rotational speed of the third load motor 17*c* is outputted to the third load motor driver 124*c*.

Next, in step P538, the rotational speed of the fourth load motor 17*d* is read from the address position of the memory M139 for storing the rotational speed of the load motor at constant-speed operation, the address position corresponding to the current rotational phase of the printing press for the setting rotational speed at synchronizing operation for the fourth load motor. In step P539, the rotational speed of the fourth load motor 17*d* is outputted to the fourth load motor driver 124*d*.

Next, in step P540, the current rotational phase of the printing press is read from the memory M106, and in step P541, the rotational phase compensation value of each inking unit is read from the memory M107. Subsequently, in step P542, the current rotational phase of the printing press is added to the rotational phase compensation value of each inking unit to calculate the virtual current rotational phase of each inking unit which is then stored in the memory M108.

Next, in step P543, the setting rotational speed is read from the rotational speed setting unit 114, and is stored in the memory M100 for storing the current setting rotational speed. In step P544, the current setting rotational speed and the virtual current rotational phase of each inking unit are sent to a corresponding one of the drive controllers 90*a*' to 90*d*' of the inking units.

Next, in step P545, the memory M109 for storing the instruction rotational speed is overwritten with the current setting rotational speed, and in step P546, the instruction rotational speed is outputted to the drive motor driver 116.

Subsequently, in step P547, the current setting rotational speed is stored in the memory M103 for storing the previous setting rotational speed.

In step P548, the internal clock counter 105 (for counting elapsed time) starts to count. In step P549, the current setting rotational speed/virtual current rotational phase of each inking unit transmission interval is read from the memory M104.

Next, in step P550, the count value of the internal clock counter 105 is read, and in step P551, it is judged whether the count value of the internal clock counter is equal to or more than the current setting rotational speed/virtual current rotational phase of each inking unit transmission interval.

If yes in step P551, in step P552, the setting rotational speed at synchronizing operation is read from the memory M146. In step P553, the count value is read from the counter 117 for detecting the current rotational phase of the printing press, and is then stored in the memory M105. Subsequently, in step P554, from the count value of the counter 117 for detecting the current rotational phase of the printing press, the current rotational phase of the printing press is calculated and stored in the memory M106.

Next, in step P555, the rotational speed of the first load motor 17*a* is read from the address position of the memory M139 for storing the rotational speed of the load motor at constant-speed operation, the address position corresponding to the current rotational phase of the printing press for the setting rotational speed at synchronizing operation for the first load motor. In step P556, the rotational speed of the first load motor 17*a* is outputted to the first load motor driver 124*a*.

Next, in step P557, the rotational speed of the second load motor 17*b* is read from the address position of the memory M139 for storing the rotational speed of the load motor at constant-speed operation, the address position corresponding to the current rotational phase of the printing press for the setting rotational speed at synchronizing operation for the second load motor. In step P558, the rotational speed of the second load motor 17*b* is outputted to the second load motor driver 124*b*.

Next, in step P559, the rotational speed of the third load motor 17*c* is read from the address position of the memory M139 for storing the rotational speed of the load motor at constant-speed operation, the address position corresponding to the current rotational phase of the printing press for the setting rotational speed at synchronizing operation for the third load motor. In step P560, the rotational speed of the third load motor 17*c* is outputted to the third load motor driver 124*c*.

Next, in step P561, the rotational speed of the fourth load motor 17*d* is read from the address position of the memory M139 for storing the rotational speed of the load motor at constant-speed operation, the address position corresponding to the current rotational phase of the printing press for the setting rotational speed at synchronizing operation for the fourth load motor. In step P562, the rotational speed of the fourth load motor 17*d* is outputted to the fourth load motor driver 124*d*.

Next, in step P563, the current rotational phase of the printing press is read from the memory M106, and in step P564, the rotational phase compensation value of each inking unit is read from the memory M107. Subsequently, in step P565, the current rotational phase of the printing press is added to the rotational phase compensation value of each inking unit to calculate the virtual current rotational phase of each inking unit, which is then stored in the memory M108.

Next, in step P566, the setting rotational speed is read from the rotational speed setting unit 114, and is stored in the memory M100 for storing the current setting rotational speed.

In step P567, the current setting rotational speed and the virtual current rotational phase of each inking unit are sent to a corresponding one of the drive controllers 90*a*' to 90*d*' of the inking units.

Next, in step P568, the memory M109 for storing the instruction rotational speed is overwritten with the current setting rotational speed, and in step P569, the instruction rotational speed is outputted to the drive motor driver 116. Subsequently, in step P570, the current setting rotational speed is stored in the memory M103 for storing the previous setting rotational speed. Then, the process returns to step P548.

On the other hand, if no in step P551, in step P571, the count value is read from the counter 117 for detecting the current rotational phase of the printing press, and is stored in the memory M105. Subsequently, in step P572, from the count value of the counter 117 for detecting the current rotational phase of the printing press, the current rotational phase of the printing press is calculated and stored in the memory M106.

Next, in step P573, the deceleration start rotational phase of the printing press is read from the memory M141. In step P574, it is then judged whether the current rotational phase of the printing press is equal to the deceleration start rotational phase of the printing press. If yes in step P574, the process proceeds to later described step P575. If no in step P574, the process returns to step P548.

Next, the instruction to stop printing is sent to the printing press controller 28' in step P575, and the setting rotational speed at synchronizing operation is read from the memory M146 in step P576. Subsequently, in step P577, the count value is read from the counter 117 for detecting the current rotational phase of the printing press, and is stored in the memory M105. In step P578, from the count value of the counter 117 for detecting the current rotational phase of the printing press, the current rotational phase of the printing press is calculated and stored in the memory M106.

Next, in step P579, the rotational speed of the first load motor 17*a* is read from the address position of the memory M139 for storing the rotational speed of the load motor at constant-speed operation, the address position corresponding to the current rotational phase of the printing press for the setting rotational speed at synchronizing operation for the first load motor. In step P580, the rotational speed of the first load motor 17*a* is outputted to the first load motor driver 124*a*.

Next, in step P581, the rotational speed of the second load motor 17*b* is read from the address position of the memory M139 for storing the rotational speed of the load motor at constant-speed operation, the address position corresponding to the current rotational phase of the printing press for the setting rotational speed at synchronizing operation for the second load motor. In step P582, the rotational speed of the second load motor 17*b* is outputted to the second load motor driver 124*b*.

Next, in step P583, the rotational speed of the third load motor 17*c* is read from the address position of the memory M139 for storing the rotational speed of the load motor at constant-speed operation, the address position corresponding to the current rotational phase of the printing press for the setting rotational speed at synchronizing operation for the third load motor. In step P584, the rotational speed of the third load motor 17*c* is outputted to the third load motor driver 124*c*.

Next, in step P585, the rotational speed of the fourth load motor 17*d* is read from the address position of the memory M139 for storing the rotational speed of the load motor at constant-speed operation, the address position corresponding to the current rotational phase of the printing press for the setting rotational speed at synchronizing operation for the fourth load motor. In step P586, the rotational speed of the fourth load motor 17*d* is outputted to the fourth load motor driver 124*d*.

Next, in step P587, the deceleration start rotational phase of the printing press is read from the memory M141. In step P588, the rotational phase compensation value of each inking unit is read from the memory M107. In step P589, the deceleration start rotational phase of the printing press is added to the rotational phase compensation value of each inking unit to calculate the virtual current rotational phase of each inking unit, which is then stored in the memory M108.

Next, in step P590, the setting rotational speed is read from the rotational speed setting unit 114, and is stored in the memory M100 for storing the current setting rotational speed. In step P591, the current setting rotational speed and the virtual current rotational phase of each inking unit are sent to a corresponding one of the drive controllers 90*a*' to 90*d*' of the inking units.

Next, in step P592, the memory M109 for storing the instruction rotational speed is overwritten with the current setting rotational speed, and in step P593, the instruction rotational speed is outputted to the drive motor driver 116. Subsequently, in step P594, the current setting rotational speed is stored in the memory M103 for storing the previous setting rotational speed.

Next, the reset and enable signals are outputted to the acceleration/deceleration counter 119 in step P595, and in step P596, the output of the reset signal to the acceleration/deceleration counter 119 is stopped.

In step P597, the internal clock counter 105 (for counting elapsed time) starts to count. In step P598, the current setting rotational speed/virtual current rotational phase of each inking unit transmission interval is read from the memory M104.

Next, in step P599, the count value of the internal clock counter 105 is read, and in step P600, it is judged whether the count value of the internal clock counter is equal to or more than the current setting rotational speed/virtual current rotational phase of each inking unit transmission interval.

If yes in step P600, the setting rotational speed at synchronizing operation is read from the memory M146 in step P601, and in step P602, the count value is read from the acceleration/deceleration counter 119, and is stored in the memory M127.

Next, in step P603, the rotational speed of the first load motor 17*a* is read from an address position of the memory M143 for storing the rotational speed of the load motor at deceleration, the address position corresponding to the count value of the acceleration/deceleration counter for the setting rotational speed at synchronizing operation for the first load motor. In step P604, the rotational speed of the first load motor 17*a* is outputted to the first load motor driver 124*a*. Note that, the address position of the memory M143 for storing the rotational speed of the load motor at deceleration, the address position corresponding to the count value of the acceleration/deceleration counter for the setting rotational speed at synchronizing operation for the first load motor, corresponds to the address position of the memory M143, the address position corresponding to the count value of the acceleration/deceleration counter for the setting rotational speed at teaching for the first load motor, the memory M143 storing the compensated rotational speed of the first load motor in step P378 when the setting rotational speed at teaching is equal to the setting rotational speed at synchronizing operation, and when the count value of the acceleration/deceleration counter has a same count value.

Next, in step P605, the rotational speed of the second load motor 17*b* is read from an address position of the memory M143 for storing the rotational speed of the load motor at deceleration, the address position corresponding to the count value of the acceleration/deceleration counter for the setting rotational speed at synchronizing operation for the second load motor. In step P606, the rotational speed of the second load motor 17*b* is outputted to the second load motor driver 124*b*.

Next, in step P607, the rotational speed of the third load motor 17*c* is read from an address position of the memory M143 for staring the rotational speed of the load motor at deceleration, the address position corresponding to the count value of the acceleration/deceleration counter for the setting rotational speed at synchronizing operation for the third load motor. In step P608, the rotational speed of the third load motor 17*c* is outputted to the third load motor driver 124*c*.

Next, in step P609, the rotational speed of the fourth load motor 17*d* is read from an address position of the memory M143 for storing the rotational speed of the load motor at deceleration, the address position corresponding to the count value of the acceleration/deceleration counter for the setting rotational speed at synchronizing operation for the fourth load motor. In step P610, the rotational speed of the fourth load motor 17*d* is outputted to the fourth load motor driver 124*d*.

Next, in step P611, the count value is read from the counter 117 for detecting the current rotational phase of the printing press, and is stored in the memory M105. In step P612, from the count value of the counter 117 for detecting the current rotational phase of the printing press, the current rotational phase of the printing press is calculated and stored in the memory M106.

Next, in step P613, the rotational phase compensation value of each inking unit is read from the memory M107. In step P614, the current rotational phase of the printing press is added to the rotational phase compensation value of each inking unit to calculate the virtual current rotational phase of each inking unit, which is stored in the memory M108.

Next, in step P615, the previous setting rotational speed is read from the memory M103, and in step P616, the rotational speed correction value at deceleration is read from the memory M142. Subsequently, in step P617, the rotational speed correction value at deceleration is subtracted from the previous setting rotational speed to calculate the corrected current setting rotational speed, which is then stored in the memory M113.

Next, in step P618, it is judged whether the corrected current setting rotational speed is less than 0. If yes in step P618, the corrected current setting rotational speed in memory M113 is updated with 0 in step P619. In step P620, the corrected current setting rotational speed is stored in the memory M100 for storing the current setting rotational speed. If no in step P618, the process directly proceeds to step P620.

Next, in step P621, the current setting rotational speed and the virtual current rotational phase of each inking unit are sent to a corresponding one of the drive controllers 90*a*' to 90*d*' of the inking units.

Next, in step P622, the memory M109 for storing the instruction rotational speed is overwritten with the current setting rotational speed. Thereafter, in step P623, the instruction rotational speed is outputted to the drive motor driver 116. Subsequently, in step P624, the current setting rotational speed is stored in the memory M103 for storing the previous setting rotational speed, and the process returns to step P597.

On the other hand, if no in step P600, in step P625, outputs of the F/V converters 121 and 127*a* to 127*d*, which are connected to the rotary encoders 118 and 128*a* to 128*d* for the drive motors of the printing press and of the respective inking units are read, and are stored in the memory M144. In step P626, from the outputs of the F/V converters 121 and 127*a* to 127*d*, which are connected to the rotary encoders 118 and 128*a* to 128*d* for the drive motors of the printing press and of the respective inking units, the current rotational speeds of the printing press and the inking units are calculated and stored in the memory M145.

Next, in step P627, it is judged whether the current rotational speeds of the printing press and all of the inking units are equal to 0. If yes in step P627, in step P628, the instruction to stop synchronizing operation is sent to the drive controllers 90*a*' to 90*d*' of the inking units, and the process returns to step P394. If no in step P627, the process proceeds to step P394. If no in step P627, the process returns to the P598.

Next, in step P629 to which the process proceeds from any of steps P6, P7 and P397, it is judged whether the setting rotational speed is inputted to the single drive rotational speed setting unit 129 for the printing press. If yes, in step P630, the setting rotational speed is read from the single drive rotational speed setting unit 129 for the printing press, and is then stored in the memory M100 for storing the current setting rotational speed. The process then proceeds to step P631. If no in step P629, the process directly proceeds to step P631.

Next, in step P631, it is judged whether the single drive switch 110 for the printing press is turned on. If yes, the current setting rotational speed is read from the memory M100 in step P632. If no, the process returns to step P1.

Next, in step P633, the current setting rotational speed is written in the memory M109 for storing the instruction rotational speed. In step P634, the instruction rotational speed is outputted to the drive motor driver 116.

Next, when the printing press drive stop switch 109 is turned on in step P635, the stop instruction is then outputted to the drive motor driver 116 in step P636. The process then returns to step P1. Hereinafter, the aforementioned process is repeated.

According to the above-described operational flows, the teaching processing and synchronizing operation processing of the drive motor 10 of the printing press are performed, and the breaking force control is carried out by the first to fourth load motors 17*a* to 17*d* at the synchronizing operation.

The drive controllers 90*a* to 90*d* of the first to fourth inking units operate according to the operational flows shown in FIGS. 46A and 46B, 47A and 47B, and 48.

Specifically, in step P1, it is judged whether the teaching instruction is sent from the drive controller 80' of the printing press. If yes, in step P2, it is judged whether an instruction to start home position alignment is sent from the drive controller 80' of the printing press. If no in step P1, in step P3, it is judged whether an instruction to start synchronizing operation is sent from the drive controller 80' of the printing press. If yes in step P3, the process returns to step P2. If no in step P3, the process proceeds to later-described step P42.

If yes in step P2, the process proceeds to step P4. If no in step P2, in step P5, it is judged whether the instruction to stop synchronizing operation is sent from the drive controller 80' of the printing press. If yes in step P5, the process proceeds to later-described step P42. If no, the process returns to step P2.

Next, when the current setting rotational speed (slower) and the corrected virtual current rotational phase of the inking unit are sent from the drive controller 80' of the printing press in step P4, in step P6, the current setting rotational speed (slower) and the corrected virtual current rotational phase of the inking unit are received from the drive controller 80' of the printing press, and are stored in the memory M147 for storing the current setting rotational speed and the memory M148 for storing the virtual current rotational phase of the inking unit, respectively.

Next, in step P7, the count value is read from the counter 137 for detecting current rotational phase of the inking unit, and is stored in the memory M149. In step P8, the current rotational phase of the inking unit is calculated from the count value of the counter 137 for detecting current rotational phase of the inking unit, and is stored in the memory M150. In step P9, the current rotational phase of the inking unit is subtracted from the virtual current rotational phase of the inking unit to calculate the current rotational phase difference of the inking unit, which is then stored in the memory M151.

Next, in step P10, the absolute value of the current rotational phase difference of the inking unit is calculated from the current rotational phase difference of the inking unit, and is stored in the memory M152. In step P11, the tolerance of the current rotational phase difference of the inking unit is read from the memory M153.

Next, in step P12, it is judged whether the absolute value of the current rotational phase difference of the inking unit is equal to or less than the tolerance of the current rotational phase difference of the inking unit. If yes in step P12, in step P13, the current setting rotational speed (slower) is read from the memory M147, and if no, the process proceeds to later-described step P17.

Next, in step P14, the memory M154 for storing the instruction rotational speed is overwritten with the current setting rotational speed (slower). In step P15, the instruction rotational speed is outputted to the drive motor driver 136 of the inking unit. In step P16, the home position alignment completion signal is sent to the drive controller 80' of the printing press, and the process proceeds to later-described step P23.

Next, in step P17, the current rotational phase difference of the inking unit-setting rotational speed compensation value conversion table is read from the memory M155, and in step P18, the current rotational phase difference of the inking unit is read from the memory M151.

Next, in step P19, by using the current rotational phase difference of the inking unit-setting rotational speed compensation value conversion table, the setting rotational speed compensation value is obtained from the current rotational phase difference of the inking unit, and is stored in the memory M156. In step P20, the current setting rotational speed (slower) is read from the memory M147.

Next, in step P21, the current setting rotational speed (slower) is added to the setting rotational speed compensation value to calculate the instruction rotational speed, which is then stored in the memory M154. In step P22, the instruction rotational speed is outputted to the drive motor driver 136 of the inking unit, and the process returns to step P4.

Next, in step P23 to which the process proceeds from step P16, it is judged whether the current setting rotational speed and the corrected virtual current rotational phase of the inking unit are sent from the drive controller 80' of the printing press. If yes in step P23, the process proceeds to step P24. If no in step P23, in step P25, it is judged whether the teaching finish signal is sent from the drive controller 80' of the printing press.

If yes in step P25, the process returns to step P1. If no in step P25, in step P26, it is judged whether the instruction to stop drive of synchronizing operation is sent from the drive controller 80' of the printing press. If yes in step P26, the process returns to step P2. If no, the process returns to step P23.

Next, in step P24, the current setting rotational speed and the corrected virtual current rotational phase of the inking unit are received from the drive controller 80' of the printing press, and are stored in the memory M147 for storing the current setting rotational speed and the memory M148 for storing the virtual current rotational phase of the inking unit, respectively. In step P27, the count value is read from the counter 137 for detecting current rotational phase of the inking unit, and is stored in the memory M149.

Next, in step P28, from the count value of the counter 137 for detecting current rotational phase of the inking unit, the current rotational phase of the inking unit is calculated and stored in the memory M150. In step P29, the current rotational phase of the inking unit is subtracted from the virtual current rotational phase of the inking unit to calculate the current rotational phase difference of the inking unit, which is then stored in the memory M151.

Next, in step P30, the absolute value of the current rotational phase difference of the inking unit is calculated from the current rotational phase difference of the inking unit, and is stored in the memory M152. In step P31, the tolerance of the current rotational phase difference of the inking unit is read from the memory M153.

Next, in step P32, it is judged whether the absolute value of the current rotational phase difference of the inking unit is equal to or less than the tolerance of the current rotational phase difference of the inking unit. If yes in step P32, in step P33, the current setting rotational speed is read from the memory M147, and if no, the process proceeds to later-described step P36.

Next, in step P34, the memory M154 for storing the instruction rotational speed is overwritten with the current setting rotational speed. In step P35, the instruction rotational speed is outputted to the drive motor driver 136 of the inking unit, and the process then returns to step P23. Next, in step P36, the current rotational phase difference of the inking unit-setting rotational speed compensation value conversion table is read from the memory M155.

Next, in step P37, the current rotational phase difference of the inking unit is read from the memory M151. In step P38, by using the current rotational phase difference of the inking unit-setting rotational speed compensation value conversion table, the setting rotational speed compensation value is obtained from the current rotational phase difference of the inking unit and stored in the memory M156.

Next, in step P39, the current setting rotational speed is read from the memory M147. In step P40, the current setting rotational speed is added to the setting rotational speed compensation value to calculate the instruction rotational speed, which is then stored in the memory M154. In step P41, the instruction rotational speed is outputted to the drive motor driver 136 of the inking unit, and the process returns to step P23.

Next, in step P42 to which the process proceeds from step P3 or step P5, it is judged whether the setting rotational speed is inputted to the single drive rotational speed setting unit 138 for the inking unit. If yes in step P42, in step P43, the setting rotational speed is read from the single drive rotational speed setting unit 138 for the inking unit, and is stored in the memory M147 for storing the current setting rotational speed. The process then proceeds to step P44. If no in step P42, the process directly proceeds to step P44.

Next, in step P44, it is judged whether the inking unit single drive switch 130 is turned on. If yes in step P44, in step P45, the current setting rotational speed is read from the memory M147, and if no, the process returns to step P1.

Next, in step P46, the current setting rotational speed is written in the memory M154 for storing the instruction rotational speed, and in step P47, the instruction rotational speed is outputted to the drive motor driver 136 of the inking unit.

Next, when the inking unit drive stop switch 131 is turned on in step P48, the stop instruction is then outputted to the drive motor driver 136 of the inking unit in step P49, and the process returns to step P1. Hereinafter, the aforementioned process is repeated.

According to the above-described operational flows, upon the instructions from the drive controller 80' of the printing press, the drive controllers 90*a* to 90*d* of the first to fourth inking units performs the teaching processing and synchronizing operation processing of the drive motors 15 (15*a* to 15*d*) of the inking units.

As described above, in this embodiment, the drive motor 10 and the drive motors 15 (15*a* to 15*d*) separately provide driving forces in such a way that the main body of the printing press is driven by the drive motor 10, and the inking units are driven by the drive motors 15 (15*a* to 15*d*). Accordingly, the drive motor 10 and the drive motors 15 (15*a* to 15*d*) can be reduced in size and capacity, and the printing press of the present invention can achieve lower cost and higher speed operation. Furthermore, the load motors 17*a* to 17*d* as the braking means are provided to eliminate non-uniform rotation of the plate cylinder 3, and this makes it possible to prevent occurrence of printing faults such as mackle.

Moreover, the braking means is composed of the load motors (torque motors) 17*a* to 17*d*. This eliminates the need to replace the components, unlike the case of brakes, and the braking means can be made maintenance-free. Moreover, the electric power generated by the load motors (torque motors) 17*a* to 17*d* is recovered as electric power for driving the drive motor 10, thus achieving energy savings.

Figure 51:
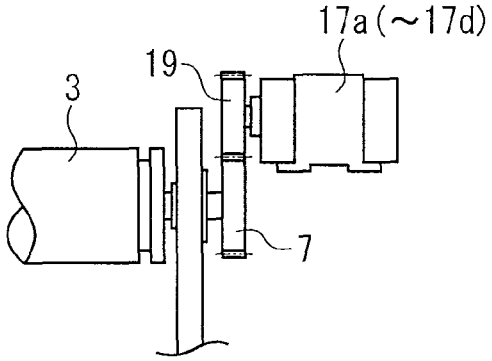

Note that, the present invention is not limited to the aforementioned embodiments. In an offset printing press, in a case where the installation space of the load motors 17*a* (to 17*d*) is limited, the load motors 17*a* (to 17*d*) may be installed at a position offset in a lateral direction, and coupled to the plate cylinder gear 7 via an intermediate gear (third driven means) 19 engaged with the plate cylinder gear 7 as shown in FIG. 51.

In addition, the present invention can be applied not only to an offset printing press, but also to an intaglio printing press as shown in FIG. 52. Specifically, an intaglio cylinder 20, an intaglio impression cylinder (first rotating body) 21, and a transfer cylinder (second rotating body) 22 on the printing press main body side in an intaglio printing press are driven by a not-shown drive motor (electric motor; first driving means) of the printing press via a gear train including a drive pinion 23, an intaglio cylinder gear 24, an intaglio impression cylinder gear (first driven means) 25 and a transfer cylinder gear (second driven means) 26.

On the other hand, the first to fourth inking units (inking devices) in an intaglio printing press are configured in the same manner as that of the offset printing press of Embodiment 1, and driven by drive motors (single drive motor; second driving means) of the inking units via a gear train including multiple roller gears including a not-shown oscillating roller gear.

Then, the load motors (torque motor; braking means) 17*a* (to 17*d*) are attached to the shaft of the transfer cylinder gear 26 for the transfer cylinder 22 on the printing press main body side with a coupling 16 interposed therebetween.

REFERENCE SIGNS LIST

1 IMPRESSION CYLINDER
2 BLANKET CYLINDER

3 PLATE CYLINDER
4 DRIVE PINION
5 IMPRESSION CYLINDER GEAR
6 BLANKET CYLINDER GEAR
7 PLATE CYLINDER GEAR
8 GEAR TRAIN
9 LARGE PULLEY
10 DRIVE MOTOR OF PRINTING PRESS
11 SMALL PULLEY
12 BELT
13*a*, 13*b* OSCILLATING ROLLER GEAR
14 GEAR TRAIN
15 (15*a* to 15*d*) DRIVE MOTOR OF INKING UNIT
16 COUPLING
17*a* to 17*d* FIRST TO FOURTH LOAD MOTOR
18 ROTARY ENCODER FOR DETECTING ROTATIONAL PHASE OF PRINTING PRESS
19 INTERMEDIATE GEAR
20 INTAGLIO PLATE CYLINDER
21 INTAGLIO IMPRESSION CYLINDER
22 TRANSFER CYLINDER
23 DRIVE PINION
24 INTAGLIO PLATE CYLINDER GEAR
25 INTAGLIO IMPRESSION CYLINDER GEAR
26 TRANSFER CYLINDER GEAR
28, 28' PRINTING PRESS CONTROLLER
30 CENTRAL CONTROLLER
36 INTERNAL CLOCK COUNTER
44 ROTATIONAL SPEED SETTING UNIT
48 ROTARY ENCODER FOR DRIVE MOTOR OF PRINTING PRESS
51*a* to 51*d* ROTARY ENCODERS FOR DRIVE MOTORS OF FIRST TO FOURTH INKING UNITS
60 VIRTUAL MASTER GENERATOR
63 ACCELERATION/DECELERATION COUNTER
64 LOAD MOTOR STANDARD ROTATIONAL SPEED SETTING UNIT
68 SINGLE DRIVE ROTATIONAL SPEED SETTING UNIT FOR PRINTING PRESS
69 SINGLE DRIVE SWITCH FOR PRINTING PRESS
70 PRINTING PRESS STOP SWITCH
73 COUNTER FOR DETECTING CURRENT ROTATIONAL PHASE OF INKING UNIT
75 SINGLE DRIVE ROTATIONAL SPEED SETTING UNIT FOR INKING UNIT
76 INKING UNIT SINGLE DRIVE SWITCH
77 INKING UNIT DRIVE STOP SWITCH
80, 80' DRIVE CONTROLLER OF PRINTING PRESS
90*a* to 90*d*, 90*a'* to 90*d'* DRIVE CONTROLLERS OF FIRST TO FOURTH INKING UNITS

The invention claimed is:

1. A method for driving a printing press, the printing press including:
first driven means driven by first driving means;
a first rotating body including a notch, the first rotating body being rotationally driven by the first driven means;
second driven means rotationally driven by the first driving means through the first driven means; and
a second rotating body provided with a notch at a position corresponding to the notch of the first rotating body, the second rotating body being rotationally driven by the second driven means, the method comprising the steps of:
providing braking means to any one of the second rotating body, the second driven means, and third driven means rotationally driven by the second driven means; and
obtaining a correction value according to load applied to the first driving means and correcting a braking force of the braking means according to the obtained correction value.

2. The method according to claim 1, wherein the braking force of the braking means to be applied when the notch of the first rotating body and the notch of the second rotating body face each other is larger than that applied when a circumferential surface of the first rotating body and a circumferential surface of the second rotating body face each other.

3. The method according to claim 1, wherein the braking means is a load motor.

4. The method according to claim 3, wherein
the first driving means is an electric motor, and
electric power generated by the load motor is used to drive the electric motor.

5. The method according to claim 1, wherein
the first rotating body is a blanket cylinder of an offset printing press,
the second rotating body is a plate cylinder of the offset printing press,
the offset printing press includes:
an inking device supplying ink to a printing plate supported by the plate cylinder of the offset printing press; and
second driving means for driving the inking device, and rotational speeds of the first driving means and the second driving means are synchronously controlled when printing is performed.

6. The method according to claim 1, wherein
the first rotating body is an intaglio impression cylinder of an intaglio printing press,
the second rotating body is a transfer cylinder of the intaglio printing press,
the intaglio printing press includes:
an inking device supplying ink to an intaglio printing plate supported by an intaglio cylinder of the intaglio printing press; and
second driving means for driving the inking device, and rotational speeds of the first driving means and the second driving means are synchronously controlled when printing is performed.

7. A driving apparatus for a printing press, the printing press including:
first driven means driven by first driving means;
a first rotating body including a notch, the first rotating body being rotationally driven by the first driven means;
second driven means rotationally driven by the first driving means through the first driven means; and
a second rotating body provided with a notch at a position corresponding to the notch of the first rotating body, the second rotating body being rotationally driven by the second driven means, the driving apparatus comprising:
braking means provided to any one of the second rotating body, the second driven means, and third driven means rotationally driven by the second driven means; and
control means for obtaining a correction value according to load applied to the first driving means and correcting a braking force of the braking means according to the obtained correction value.

8. The driving apparatus according to claim 7, wherein the braking force of the braking means to be applied when the notch of the first rotating body and the notch of the second rotating body face each other is larger than that applied when a circumferential surface of the first rotating body and a circumferential surface of the second rotating body face each other.

9. The driving apparatus according to claim 7, wherein the braking means is a load motor.

10. The driving apparatus according to claim 9, wherein the first driving means is an electric motor, and electric power generated by the load motor is recovered to be used as electric power to drive the electric motor.

11. The driving apparatus according to claim 7, wherein the first rotating body is a blanket cylinder of an offset printing press, the second rotating body is a plate cylinder of the offset printing press, the offset printing press includes;

an inking device supplying ink to a printing plate supported by the plate cylinder of the offset printing press; and second driving means for driving the inking device, and rotational speeds of the first driving means and the second driving means are synchronously controlled when printing is performed.

12. The driving apparatus according to claim 7, wherein the first rotating body is an intaglio impression cylinder of an intaglio printing press, the second rotating body is a transfer cylinder of the intaglio printing press, the intaglio printing press includes:

an inking device supplying ink to an intaglio printing plate supported by an intaglio cylinder of the intaglio printing press; and second driving means for driving the inking device, and rotational speeds of the first driving means and the second driving means are synchronously controlled when printing is performed.

* * * * *